US008747251B2

(12) United States Patent
Hayase et al.

(10) Patent No.: US 8,747,251 B2
(45) Date of Patent: Jun. 10, 2014

(54) GOLF CLUB HEAD

(75) Inventors: Seiji Hayase, Kobe (JP); Masahide Onuki, Kobe (JP)

(73) Assignee: SRI Sports Limited, Kobe (JP)

( * ) Notice: Subject to any disclaimer, the term of this patent is extended or adjusted under 35 U.S.C. 154(b) by 371 days.

(21) Appl. No.: 12/974,358

(22) Filed: Dec. 21, 2010

(65) Prior Publication Data

US 2011/0177881 A1 Jul. 21, 2011

(30) Foreign Application Priority Data

Dec. 29, 2009 (JP) ..... 2009-299181

(51) Int. Cl.
*A63B 53/04* (2006.01)

(52) U.S. Cl.
USPC ..... 473/332; 473/345; 473/346

(58) Field of Classification Search
USPC ..... 473/324–350
See application file for complete search history.

(56) References Cited

U.S. PATENT DOCUMENTS

| | | | | |
|---|---|---|---|---|
| 7,051,416 | B2 * | 5/2006 | Yabu | 29/527.6 |
| 7,056,228 | B2 | 6/2006 | Beach et al. | |
| 7,241,230 | B2 * | 7/2007 | Tsunoda | 473/324 |
| 7,273,423 | B2 * | 9/2007 | Imamoto | 473/332 |
| 7,448,962 | B2 * | 11/2008 | Kusumoto | 473/334 |
| 7,758,453 | B2 * | 7/2010 | Horacek et al. | 473/345 |
| 7,803,067 | B2 * | 9/2010 | Horacek et al. | 473/345 |
| 7,828,676 | B2 * | 11/2010 | Wada et al. | 473/346 |
| 7,850,545 | B2 * | 12/2010 | Wada et al. | 473/332 |
| 8,029,385 | B2 * | 10/2011 | Horacek et al. | 473/345 |
| 8,126,687 | B2 * | 2/2012 | Matsunaga et al. | 703/6 |
| 8,226,500 | B2 * | 7/2012 | Yamamoto et al. | 473/346 |
| 8,246,489 | B2 * | 8/2012 | Yamamoto | 473/346 |
| 8,323,121 | B2 * | 12/2012 | Wada et al. | 473/346 |
| 2006/0172818 | A1 | 8/2006 | Yamamoto | |

FOREIGN PATENT DOCUMENTS

| | | | | |
|---|---|---|---|---|
| JP | 2000176056 | A * | 6/2000 | A63B 53/04 |
| JP | 2001353240 | A * | 12/2001 | A63B 53/04 |
| JP | 2002-186691 | A | 7/2002 | |
| JP | 2003-102877 | A | 4/2003 | |
| JP | 2003102877 | A * | 4/2003 | A63B 53/04 |
| JP | 2003159354 | A * | 6/2003 | A63B 53/04 |
| JP | 2005-143589 | A | 6/2005 | |
| JP | 2005160947 | A * | 6/2005 | A63B 53/04 |
| JP | 2006-204604 | A | 8/2006 | |
| JP | 2011136110 | A * | 7/2011 | |
| JP | 2012120646 | A * | 6/2012 | |

* cited by examiner

*Primary Examiner* — Alvin Hunter
(74) *Attorney, Agent, or Firm* — Birch, Stewart, Kolasch & Birch, LLP

(57) ABSTRACT

A golf club head is provided with a crown, a sole, and a continuously extending rib (X). The rib (X) is provided on an inner surface of the head. Preferably, the rib (X) is substantially parallel to a toe-heel direction. When a maximum amplitude of vibration in a first-order mode in a state where the rib (X) is removed is defined as Ma1 and an amplitude ratio with respect to the maximum amplitude Ma1 is defined as Rh (%), disposal of the rib (X) satisfies the following items (a), (b), and (c):

(a) the rib (X) crosses at least one of high Rh regions having the amplitude ratio Rh of equal to or greater than 80%;
(b) no region having the amplitude ratio Rh of equal to or greater than 60% exists on a toe side than the rib (X); and
(c) no region having the amplitude ratio Rh of equal to or greater than 60% exists on a heel side than the rib (X).

18 Claims, 121 Drawing Sheets

THIRD-ORDER 3432Hz

FOURTH-ORDER 3641Hz

FIRST-ORDER 3422Hz

SECOND-ORDER 3633Hz

THIRD-ORDER 3907Hz

FOURTH-ORDER 4055Hz

FIRST-ORDER 3422Hz

SECOND-ORDER 3629Hz

THIRD-ORDER 3895Hz

FOURTH-ORDER 4010Hz

THIRD-ORDER 3871Hz

FOURTH-ORDER 3962Hz

SOLE-3

CROWN-3

THIRD-ORDER 3711Hz

SOLE-4

CROWN-4

FOURTH-ORDER 3823Hz

THIRD-ORDER 3630Hz

FOURTH-ORDER 3788Hz

FIRST-ORDER 3387Hz

SECOND-ORDER 3427Hz

THIRD-ORDER 3618Hz

FOURTH-ORDER 3782Hz

THIRD-ORDER 3605Hz

FOURTH-ORDER 3733Hz

FIRST-ORDER 3126Hz

SECOND-ORDER 3419Hz

THIRD-ORDER 3553Hz

FOURTH-ORDER 3677Hz

THIRD-ORDER 3778Hz

FOURTH-ORDER 3899Hz

FIRST-ORDER 3408Hz

SECOND-ORDER 3464Hz

THIRD-ORDER 3651Hz

FOURTH-ORDER 3901Hz

FIRST-ORDER 3421Hz

SECOND-ORDER 3630Hz

FIRST-ORDER 3421Hz

SECOND-ORDER 3628Hz

THIRD-ORDER 3889Hz

FOURTH-ORDER 3994Hz

THIRD-ORDER 3889Hz

FOURTH-ORDER 3972Hz

THIRD-ORDER 3868Hz

FOURTH-ORDER 3905Hz

FIRST-ORDER 3419Hz

SECOND-ORDER 3618Hz

THIRD-ORDER 3868Hz

FOURTH-ORDER 3905Hz

THIRD-ORDER 3868Hz

FOURTH-ORDER 3905Hz

FIRST-ORDER 3421Hz

SECOND-ORDER 3620Hz

SOLE-3

CROWN-3

THIRD-ORDER 3751Hz

SOLE-4

CROWN-4

FOURTH-ORDER 3930Hz

SOLE-3

CROWN-3

THIRD-ORDER 3708Hz

SOLE-4

CROWN-4

FOURTH-ORDER 3928Hz

THIRD-ORDER 3710Hz

FOURTH-ORDER 3913Hz

THIRD-ORDER 3723Hz

FOURTH-ORDER 3827Hz

FIRST-ORDER 3411Hz

SECOND-ORDER 3557Hz

THIRD-ORDER 3716Hz

FOURTH-ORDER 3739Hz

THIRD-ORDER 3648Hz

FOURTH-ORDER 3751Hz

THIRD-ORDER 3618Hz

FOURTH-ORDER 3756Hz

GOLF CLUB HEAD

This application claims priority on Patent Application No. 2009-299181 filed in JAPAN on Dec. 29, 2009, the entire contents of which are hereby incorporated by reference.

BACKGROUND OF THE INVENTION

1. Field of the Invention

The present invention relates to a golf club head.

2. Description of the Related Art

An enlarged hollow golf club head emits a low hitting sound. There is disclosed a golf club head having a rib in order to obtain a good hitting sound. U.S. Pat. No. 7,056,228 discloses a head having a stiffening member provided therein. Japanese Patent Application Laid-Open No. 2003-102877 discloses a rib provided in an antinode part of out-of-plane second-order bending vibration in a sole portion.

SUMMARY OF THE INVENTION

When the head is further enlarged, the wall thickness of the head is made thinner to excessively reduce the hitting sound. On the other hand, a mass distributed to a rib is unavoidably suppressed with the enlargement of the head. When the rib has a small mass, the effect of the rib is degraded to complicate obtention of a high hitting sound.

It is an object of the present invention to provide a golf club head having a high improving effect of a hitting sound caused by a rib.

A golf club head according to the present invention is provided with a crown, a sole, and a continuously extending rib (X). The rib (X) is provided on an inner surface of the head. Preferably, the rib (X) is substantially parallel to a toe-heel direction. When a maximum amplitude of vibration in a first-order mode in a state where the rib (X) is removed is defined as Ma1 and an amplitude ratio with respect to the maximum amplitude Ma1 is defined as Rh (%), disposal of the rib (X) satisfies the following items (a), (b), and (c). The head is hollow.

(a) The rib (X) crosses at least one of high Rh regions having the amplitude ratio Rh of equal to or greater than 80%.

(b) No region having the amplitude ratio Rh of equal to or greater than 60% exists on a toe side than the rib (X).

(c) No region having the amplitude ratio Rh of equal to or greater than 60% exists on a heel side than the rib (X).

Preferably, the plurality of high Rh regions exist, and the rib (X) crosses all of the high Rh regions.

Preferably, a maximum amplitude point Pe1 in the first-order mode in the state where the rib (X) is removed is located at a position other than the crown. Preferably, a maximum amplitude point Pm1 in the first-order mode (in a state where the rib (X) is disposed) is located on the crown. The maximum amplitude point Pm1 is a maximum amplitude point in the first-order mode of the head. In other words, the maximum amplitude point Pm1 is a maximum amplitude point in the first-order mode in the state where the rib (X) is disposed.

Another aspect of a head of the present invention is a golf club head provided with a crown, a sole, and a rib (X), wherein a volume of a head is equal to or greater than 400 cc; the rib (X) is provided on an inner surface of the head; and a maximum amplitude point Pm1 in a first-order mode is located on the crown.

Preferably, a maximum amplitude point Pe1 in the first-order mode in a state where the rib (X) is removed is located at a position other than the crown. Preferably, a maximum amplitude point Pe1 in the first-order mode in a state where the rib (X) is removed is located on the sole. Preferably, the rib (X) is provided on an inner surface of the sole. The head is further provided with a side. The rib (X) may be provided on an inner surface of the sole and an inner surface of the side.

Preferably, a height HR of the rib (X) is 2 mm or greater and 15 mm or less. Preferably, a mean value of a width BR of the rib (X) is 0.5 mm or greater and 3 mm or less.

Preferably, a weight of the head is equal to or less than 200 g. Preferably, a lateral moment of inertia of the head is equal to or greater than 4000 g·cm$^2$. Preferably, a thickness of the sole is equal to or less than 1 mm. Preferably, a curvature radius of the sole is equal to or greater than 100 mm.

DESCRIPTION OF THE PREFERRED EMBODIMENTS

Figure 1:
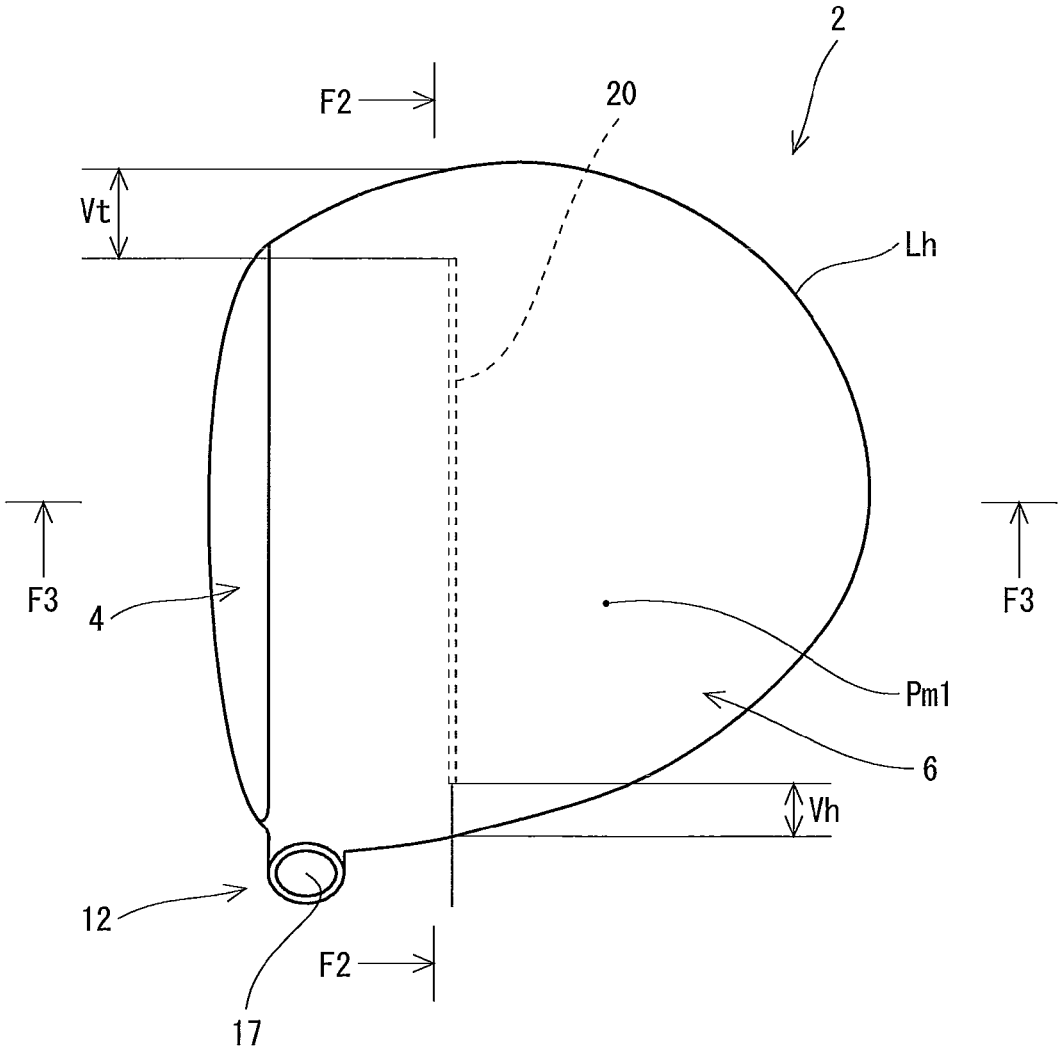
FIG. 1 is a view of a head according to one embodiment of the present invention, as viewed from a crown side.

The present invention will be described below in detail based on preferred embodiments with reference to the drawings.

In the present invention, a natural mode of a head and a natural frequency of the head are considered.

First, terms in the present application will be defined as follows.

[Natural Mode]

All objects have a natural form when the objects vibrate. The natural form is a natural mode. The natural mode of the head (whole head) is considered in the present application.

"The natural mode" of the present application is a natural mode of the head. When "the natural mode" is merely described in the present application, "the natural mode" means the natural mode of the whole head. When "the natural mode of the head" is described in the present application, "the natural mode of the head" means the natural mode of the whole head.

A method for obtaining the natural mode is not limited. A mode test (also referred to as experimental mode analysis) or mode analysis can be used. In the mode test, excitation experiment is conducted and the natural mode is obtained based on the result of the experiment. In the mode analysis, the natural mode is obtained by simulation. In the simulation, for example, a finite element method may be used. The methods of the mode test and the mode analysis are known.

The mode test or the mode analysis is conducted under a free support condition. That is, a constraint condition is made free. In the mode analysis, for example, commercially available natural value analyzing software is used. "ABAQUS" (trade name) (manufactured by ABAQUS INC.), MARC (manufactured by MSC SOFT) and "IDEAS" (manufactured by EDS PLM Solutions) are exemplified as the software.

In examples to be described later, the mode analysis using the natural value analyzing software is conducted. In the mode test by actual measurement, for example, a thread is fixed to a region of the head (for example, an end face of a neck). Each of parts of the head is struck by an impact hammer in a state where the head is hung with the thread. The mode is obtained for by measuring a transfer function with acceleration response of a center of a face.

[Natural Frequency]

"A natural frequency" of the present application is a natural frequency of the head. When "the natural frequency" is merely described in the present application, "the natural frequency" means the natural frequency of the whole head. When "the natural frequency of the head" is described in the present application, "the natural frequency of the head" means the natural frequency of the whole head.

[N-th Order Natural Frequency]

"An N-th order natural frequency" of the present application is "an N-th natural frequency counted from the smallest natural frequency among the natural frequencies in the whole head". N is an integer of equal to or greater than 1. A rigidity mode in which the head is not deformed is not counted as the order. For example, "a first-order natural frequency" is "a first-order natural frequency in the whole head". For example, "a second-order natural frequency" is "a second-order natural frequency in the whole head". When "the N-th order natural frequency" is merely described in the present application, "the N-th order natural frequency" means the N-th order natural frequency in the whole head. When "the N-th order natural frequency of the head" is described in the present application, "the N-th order natural frequency of the head" means the N-th order natural frequency in the whole head.

[N-th Order Mode]

"An N-th order mode" of the present application is "an N-th order natural mode in the whole head". N is an integer of equal to or greater than 1. For example, "a first-order mode" is "a first-order natural mode in the whole head". For example, "a second-order mode" is "a second-order natural mode in the whole head". When "the N-th order mode" is merely described in the present application, "the N-th order mode" means the N-th order natural mode in the whole head. When "the N-th order mode of the head" is described in the present application, "the N-th order mode of the head" means the N-th order natural mode in the whole head.

"The first-order natural frequency" is the smallest natural frequency among the natural frequencies of the head. "The second-order natural frequency" is a second smallest natural frequency. "The third-order natural frequency" is a third smallest natural frequency. "The N-th order natural frequency" is an N-th smallest natural frequency. Increase of "the first-order natural frequency" is considered to be most effective in enhancing a hitting sound.

[Maximum Amplitude Point]

In the N-th order natural mode, a point having the greatest amplitude is a maximum amplitude point. The maximum amplitude point is ordinarily set at one place per each order natural mode. For example, a maximum amplitude point Pm1 in the first-order mode is ordinarily set at one place. Similarly, a maximum amplitude point Pm2 in the second-order mode is ordinarily set at one place. Similarly, a maximum amplitude point Pm3 in the third-order mode is ordinarily set at one place. Similarly, a maximum amplitude point Pm4 in the fourth-order mode is ordinarily set at one place. Similarly, a maximum amplitude point Pm5 in the fifth-order mode is ordinarily set at one place.

The maximum amplitude point Pm1 is a point having the greatest amplitude in the first-order mode. The maximum amplitude point Pm2 is a point having the greatest amplitude in the second-order mode. The maximum amplitude point Pm3 is a point having the greatest amplitude in the third-order mode. The maximum amplitude point Pm4 is a point having the greatest amplitude in the fourth-order mode. The maximum amplitude point Pm5 is a point having the greatest amplitude in the fifth-order mode.

[Maximum Amplitude Ma1 of Vibration in First-Order Mode]

A maximum amplitude Ma1 of vibration in the first-order mode is amplitude in a maximum amplitude point Pe1 in the first-order mode in a state where the rib (X) is removed.

[Amplitude Ratio Rh]

An amplitude ratio to the maximum amplitude Ma1 of the vibration in the first-order mode is defined as an amplitude ratio Rh (%). The amplitude ratio Rh is determined in the state where the rib (X) is removed.

[High Rh Region]

"A high Rh region" means a region having the amplitude ratio Rh (%) of equal to or greater than 80%. Typically, the high Rh region is located on the sole. The number of the high Rh regions is a singular number or a plural number. In a typical large-sized head (number one wood), the number of the high Rh regions may be a plural number.

[First Antinode (Maximum Antinode)]

"A first antinode" of the present application means an antinode having the greatest amplitude in each of the natural modes. The maximum amplitude point Pm1 is located on the first antinode in the first-order mode. The maximum amplitude point Pm2 is located on the first antinode in the second-order mode. The maximum amplitude point Pm3 is located on the first antinode in the third-order mode. The maximum amplitude point Pm4 is located on the first antinode in the fourth-order mode. The maximum amplitude point Pm5 is located on the first antinode in the fifth-order mode. The first antinode is also referred to as "a maximum antinode".

[Second Antinode]

"A second antinode" of the present application means an antinode having a second greatest amplitude in each of the natural modes.

[Third Antinode]

"A third antinode" of the present application means an antinode having a third greatest amplitude in each of the natural modes.

[Forth Antinode]

"A forth antinode" of the present application means an antinode having a forth greatest amplitude in each of the natural modes.

[Fifth Antinode]

"A fifth antinode" of the present application means an antinode having a fifth greatest amplitude in each of the natural modes.

[Rib (X)]

"A rib (X)" of the present application is a rib according to the present invention. In a golf club head of the present invention, a rib which is not related to the present invention may be further provided. The term "rib (X)" is used in order to clearly distinguish the rib according to the present invention from the rib which is not related to the present invention.

The golf club head of the present invention has the rib (X). In the present invention, the state where the rib (X) is removed is considered in order to determine the disposal of the rib (X). A preferable disposal of the rib (X) can be achieved by considering the state where the rib (X) is removed. "The state where the rib (X) is removed" is "a state where only the rib (X) is removed and the others are the same".

The maximum amplitude point in the first-order mode in the state where the rib (X) is removed is the point Pe1. The maximum amplitude point in the second-order mode in the state where the rib (X) is removed is the point Pe2. The maximum amplitude point in the third-order mode in the state where the rib (X) is removed is the point Pe3. The maximum amplitude point in the fourth-order mode in the state where the rib (X) is removed is the point Pe4. The maximum amplitude point in the fifth-order mode in the state where the rib (X) is removed is the point Pe5.

In the present application, the first-order natural frequency of the head having the rib (X) is defined as H1 (Hz), and the first-order natural frequency of the head in the state where the rib (X) is removed is defined as V1 (Hz).

In the present application, the second-order natural frequency of the head having the rib (X) is defined as H2 (Hz), and the second-order natural frequency of the head in the state where the rib (X) is removed is defined as V2 (Hz).

In the present application, the third-order natural frequency of the head having the rib (X) is defined as H3 (Hz), and the third-order natural frequency of the head in the state where the rib (X) is removed is defined as V3 (Hz).

In the present application, the forth-order natural frequency of the head having the rib (X) is defined as H4 (Hz), and the forth-order natural frequency of the head in the state where the rib (X) is removed is defined as V4 (Hz).

In the present application, the fifth-order natural frequency of the head having the rib (X) is defined as H5 (Hz), and the fifth-order natural frequency of the head in the state where the rib (X) is removed is defined as V5 (Hz).

The natural frequency of the head having the rib (X) satisfies the following relationship.

$$H1<H2<H3<H4<H5$$

That is, the natural frequency of the head having the rib (X) is H1, H2, H3, H4, and H5 in order from the smallest natural frequency.

The natural frequency of the head in a state where the rib (X) is removed satisfies the following relationship.

$$V1<V2<V3<V4<V5$$

That is, the natural frequency of the head in the state where the rib (X) is removed is V1, V2, V3, V4, and V5 in order from the smallest natural frequency.

Next, one example of the structure of the golf club head according to the present invention will be described.

Figure 2:
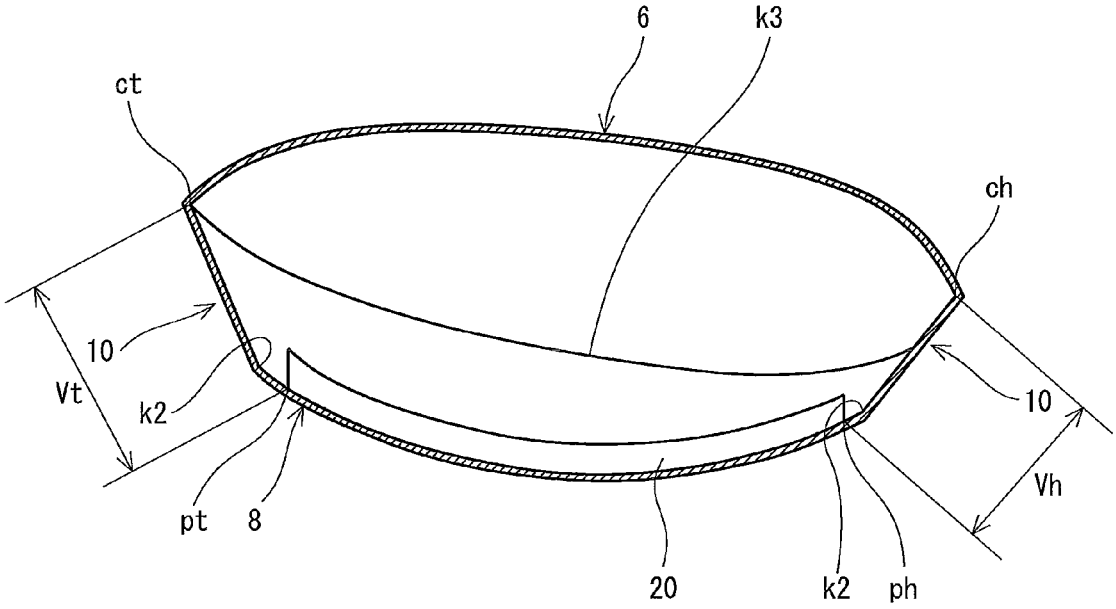
FIG. 2 is a sectional view taken in line F2-F2 of FIG. 1.
Figure 3:
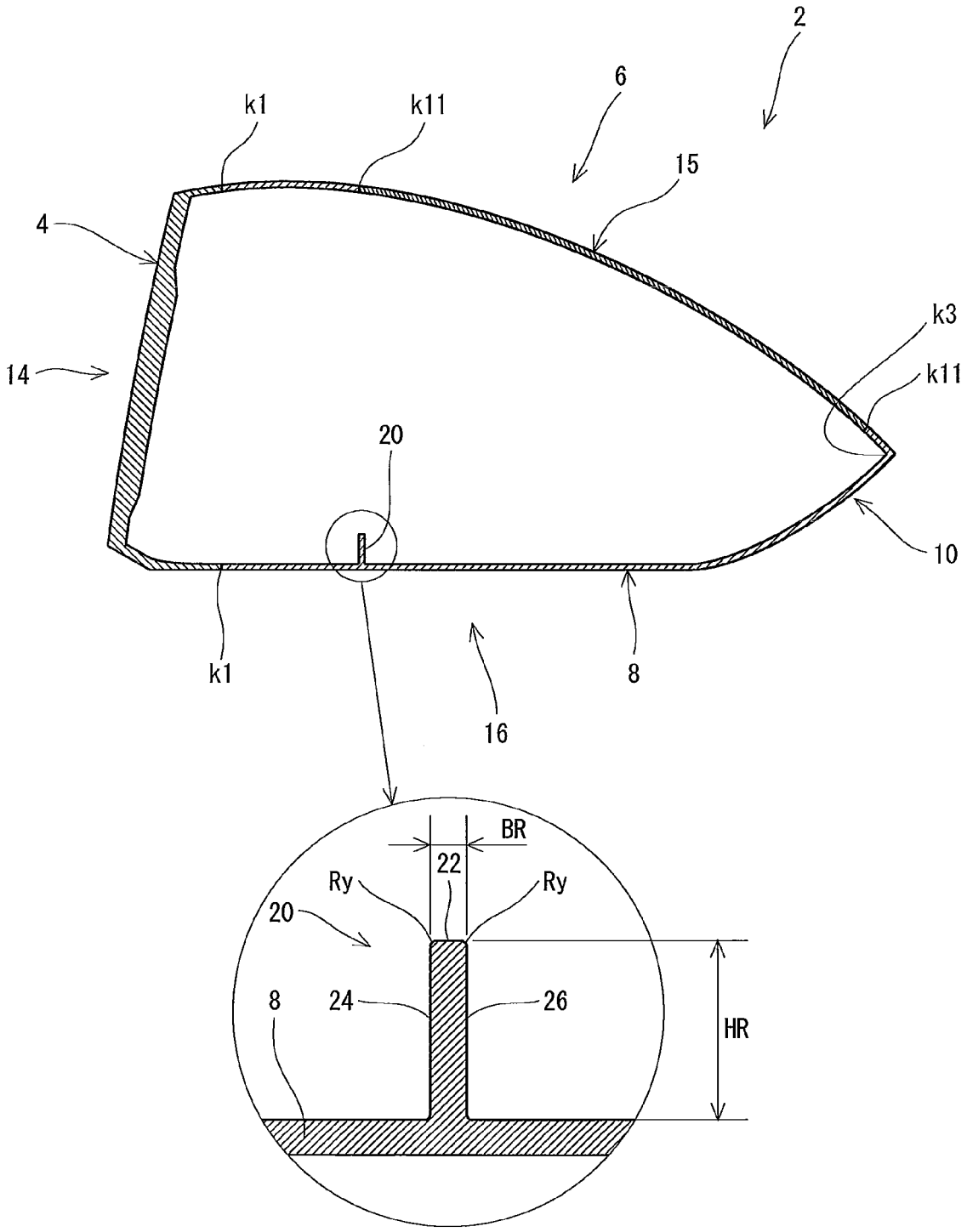
FIG. 3 is a sectional view taken in line F3-F3 of FIG. 1.
Figure 4:
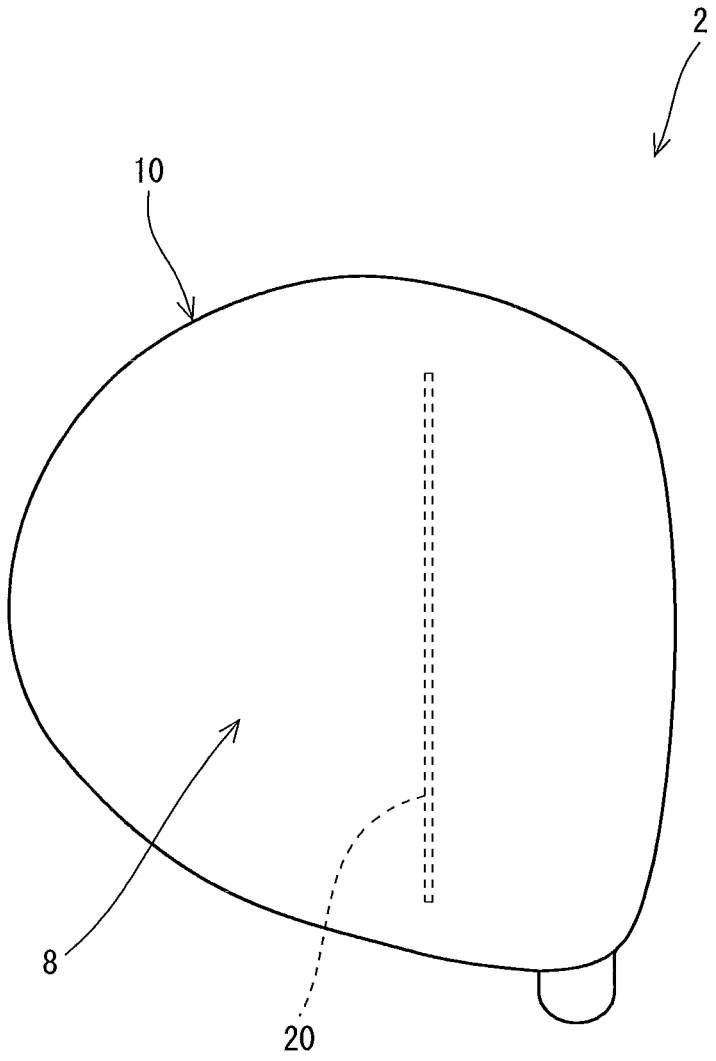
FIG. 4 is a view of the head of FIG. 1, as viewed from a sole side.
Figure 5:
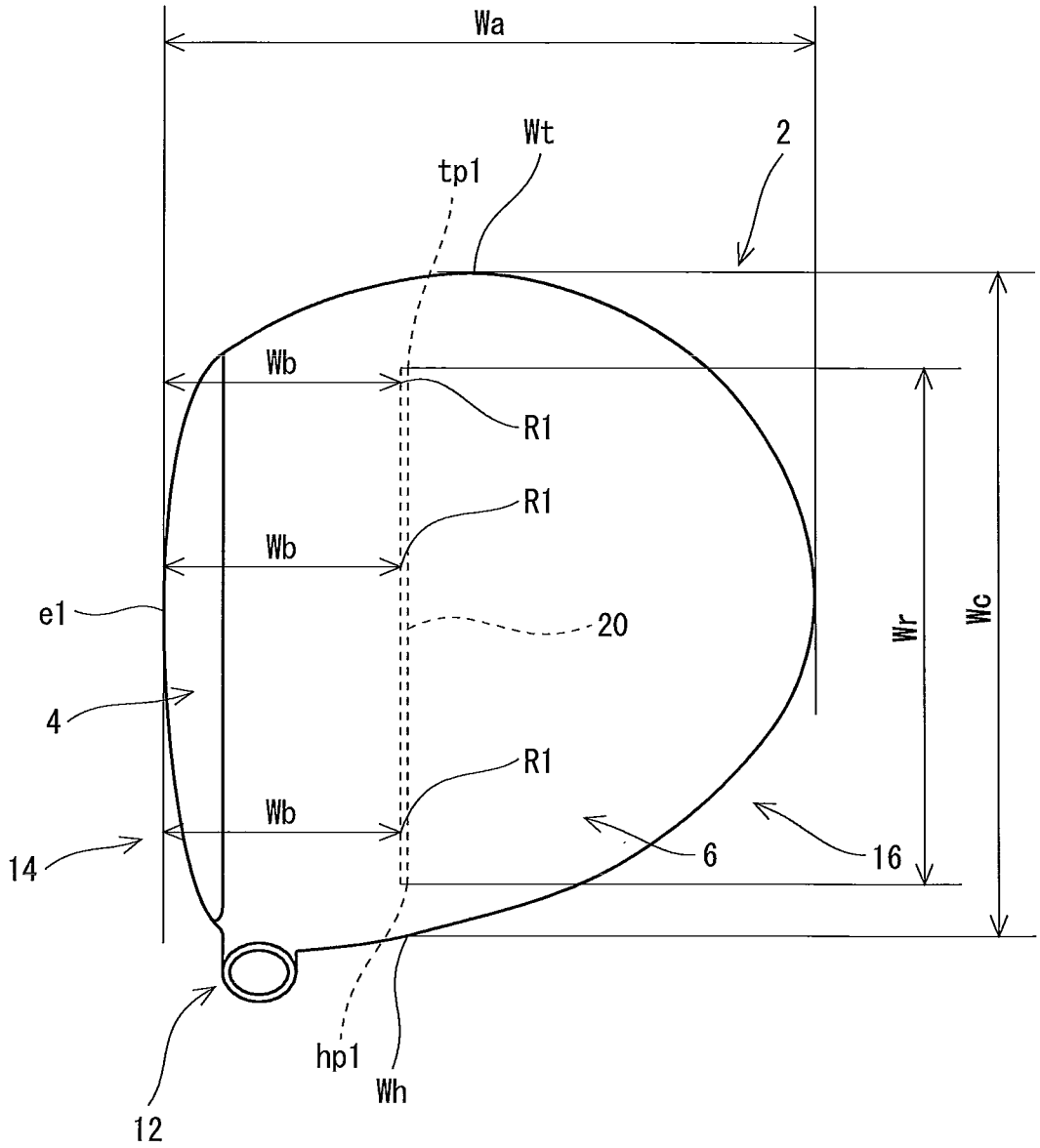
FIG. 5 is a view having dimension lines or the like applied to FIG. 1.

FIGS. 1 and 5 are views of a golf club head 2 according to one embodiment of the present invention, as viewed from a crown side. FIG. 2 is a cross sectional view taken along a line F2-F2 of FIG. 1. FIG. 3 is a cross sectional view taken along a line F3-F3 of FIG. 1. FIG. 4 is a view of the head 2, as viewed from a sole side.

The head 2 has a face 4, a crown 6, a sole 8, a side 10 and a hosel 12. The crown 6 extends toward the back of the head from the upper edge of the face 4. The sole 8 extends toward the back of the head from the lower edge of the face 4. The side 10 extends between the crown 6 and the sole 8. As shown in FIGS. 2 and 3, the inside of the head 2 is hollow. The head 2 is hollow. The head 2 is a so-called wood type golf club head.

As shown in FIGS. 2 and 3, a boundary k2 between the sole 8 and the side 10 exists on the inner surface of the head 2. Furthermore, a boundary k3 between the side 10 and the crown 6 exists on the inner surface of the head 2.

When the boundary between the sole 8 and the side 10 is unknown, a portion located on a sole side than a profile line Lh of the head is regarded as a sole. A portion located on a crown side than the profile line Lh of the head is regarded as a crown. The profile line Lh of the head is a profile line when the head is viewed from the crown side.

The head 2 is constituted by joining a face member 14, a crown member 15, and a head body 16 (see FIG. 3). A joining method is welding. All of the face member 14, the crown member 15, and the head body 16 are made of a titanium alloy. A boundary k1 between the face member 14 and the head body 16 is shown in FIG. 3. A boundary k11 between the crown member 15 and the head body 16 is shown in FIG. 3.

The face member 14 constitutes the whole face 4. Furthermore, the face member 14 constitutes apart of the crown 6, a part of the sole 8, and a part of the side 10. The face member 14 is approximately dish-formed (cup-formed). The face member 14 may be referred to as a cup face.

The crown member 15 constitutes a part of the crown 6. The crown member 15 constitutes the central part of the crown 6.

The body 16 constitutes a part of the crown 6, a part of the sole 8, a part of the side 10, and the whole hosel 12. The body 16 has a through hole (not shown) having a shape corresponding to the shape of the crown member 15. The crown member 15 blocks the through hole.

As shown in FIG. 1, the hosel 12 has a hole 17 to which a shaft is mounted. The shaft (not shown) is inserted into the hole 17. The hole 17 has a center axial line Z1 (not shown). The center axial line Z1 generally conforms to a shaft axial line of a golf club having the head 2.

The structure of the head and the manufacturing method of the head are not limited in the present invention.

In the present application, a standard vertical plane, a face-back direction, and a toe-heel direction are defined. A standard condition denotes a state where the center axial line Z1 is contained in a plane P1 perpendicular to a horizontal plane H and the head is placed on the horizontal plane H at a prescribed lie angle and real loft angle. The standard vertical plane denotes the plane P1.

In the present application, the toe-heel direction is a direction of an intersection line between the standard vertical plane and the horizontal plane H.

In the present application, the face-back direction is a direction perpendicular to the toe-heel direction and parallel to the horizontal plane H.

The head 2 has an inner surface on which a rib 20 is provided. As shown in FIG. 2, the rib 20 is provided on the inner surface of the sole 8. The rib 20 is substantially parallel to the toe-heel direction. The term "substantially parallel" means that an angle of the rib 20 to the toe-heel direction is within ±5 degrees.

The rib 20 is the rib (X) in the present application.

The number of the ribs 20 is one. The rib 20 extends in the shape of the line. As shown in FIG. 1, the rib 20 extends linearly. When the rib 20 is projected on the horizontal plane H in the head 2 of the standard condition, a projection image Tr of the rib 20 is almost straight. The width directional central line (not shown) of the upper surface 22 of the rib 20 is a straight line. The width of the upper surface 22 of the rib 20 is constant. The upper surface 22 of the rib 20 extends straightly. A side 24 located on the face side of the rib 20 is a plane. A side 26 located on the back side of the rib 20 is a plane.

The head 2 vibrates in hitting a ball. The vibration of the head 2 contributes to a hitting sound. The rib 20 enhances the rigidity of the sole 8. The position of the first antinode in the first-order mode of the head 2 is moved to the crown from the sole by disposing the rib 20. The first-order natural frequency V1 is changed to the first-order natural frequency H1 by the rib 20. The value of the first-order natural frequency H1 has a large influence on the pitch of the hitting sound. The hitting sound tends to be high-pitch sound by the first-order natural frequency H1. The rib 20 contributes to the improvement of the hitting sound.

A forefront point of the head is shown by numeral character e1 in FIG. 5. A forefront point e1 is a point located closest to the face side (front) in the head 2 of the standard condition. The forefront point e1 is included in a leading edge.

A width of the head is shown by numeral character Wa in FIG. 5. The width of the head is the maximum width of the head in the face-back direction. The width Wa of the head is measured based on a projection image obtained by projecting the head of the standard condition on the horizontal plane H. The projection direction of the projection is a direction perpendicular to the horizontal plane H.

Points belonging to the rib 20 are shown by numeral character R1 in FIG. 5. A large number of points R1 exist.

A face-back direction distance between the forefront point e1 and the point R1 is shown by sign Wb in FIG. 5. The distance Wb is determined for each of the points R1 belonging to the rib 20.

The length of the head is shown by sign Wc in FIG. 5. The length of the head is a toe-heel direction length between a point Wh on the heel side and a point Wt on the toe side. The point Wt is a point located closest to the toe side in the head of the standard condition. On the determination of the point Wh, in the head of the standard condition, a horizontal plane H1 separated by 22.23 mm above the horizontal plane H is considered. A point included in the horizontal plane H1, also included in the head and located closest to the heel side is the point Wh. The length Wc of the head is a distance in the toe-heel direction between the point Wt and the point Wh.

The length of the rib 20 is shown by numeral character Wr in FIG. 5. The length Wr of the rib is measured based on the projection image Tr obtained by projecting the rib 20 on the horizontal plane H in the head 2 of the standard condition. The projection direction of the projection is a direction perpendicular to the horizontal plane H. The length Wr of the rib is a length in the toe-heel direction.

A ratio (Wb/Wa) is designed in consideration of the form of the first-order mode in a head 28. The ratio (Wb/Wa) may not be constant. In view of the hitting sound, the ratio (Wb/Wa) is preferably substantially constant. In this view, the ratio (Wb/Wa) for all of the points R1 of the rib 20 is preferably within ±5%.

The rib 20 may extend in a curved condition. However, an angle of the rib 20 to the toe-heel direction is preferably within ±5 degrees. In view of improving the hitting sound while suppressing the mass of the rib 20, preferably, the rib 20 extends straightly.

Figure 6:
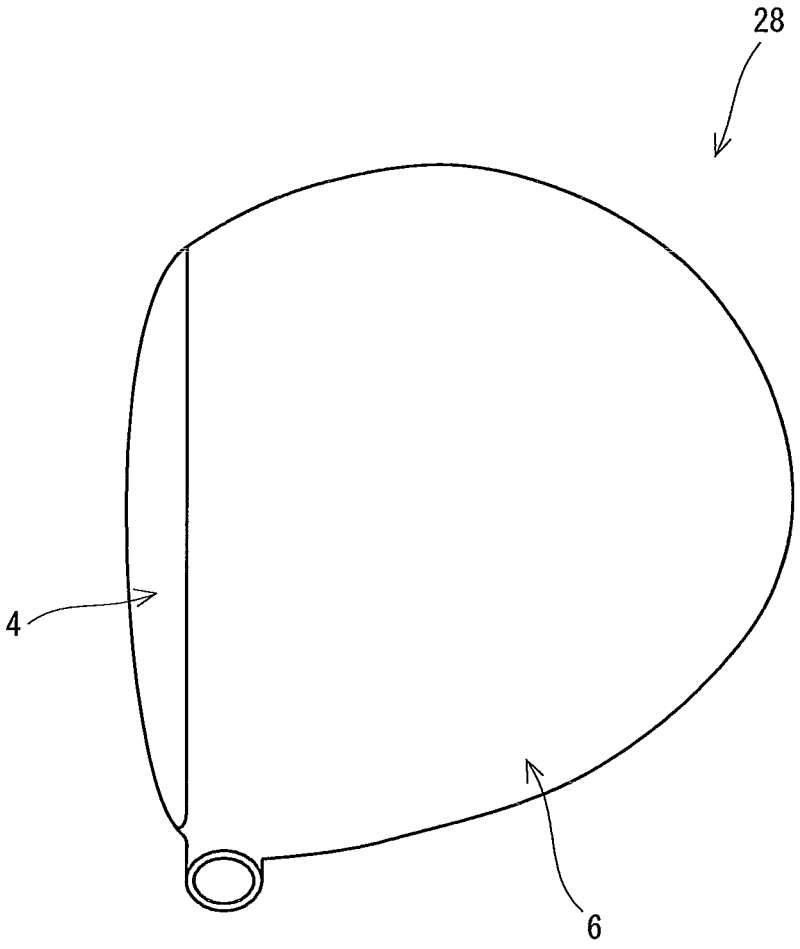
FIG. 6 is a view showing a state where a rib is removed from the head of FIG. 1.
Figure 7:
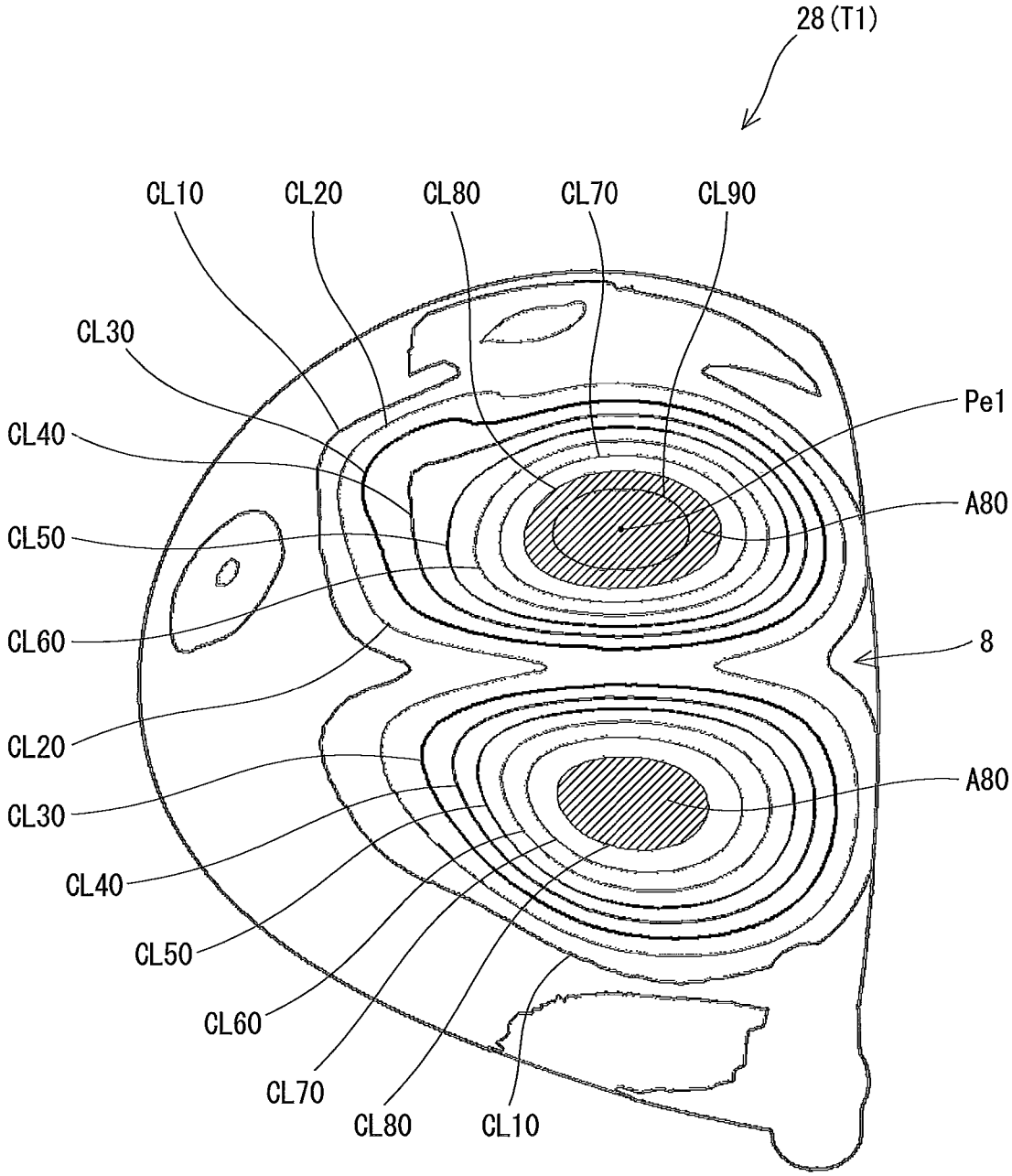
FIG. 7 is a view in which a vibration form in a first-order mode of the head of FIG. 6 is shown by contour lines.
Figure 8:
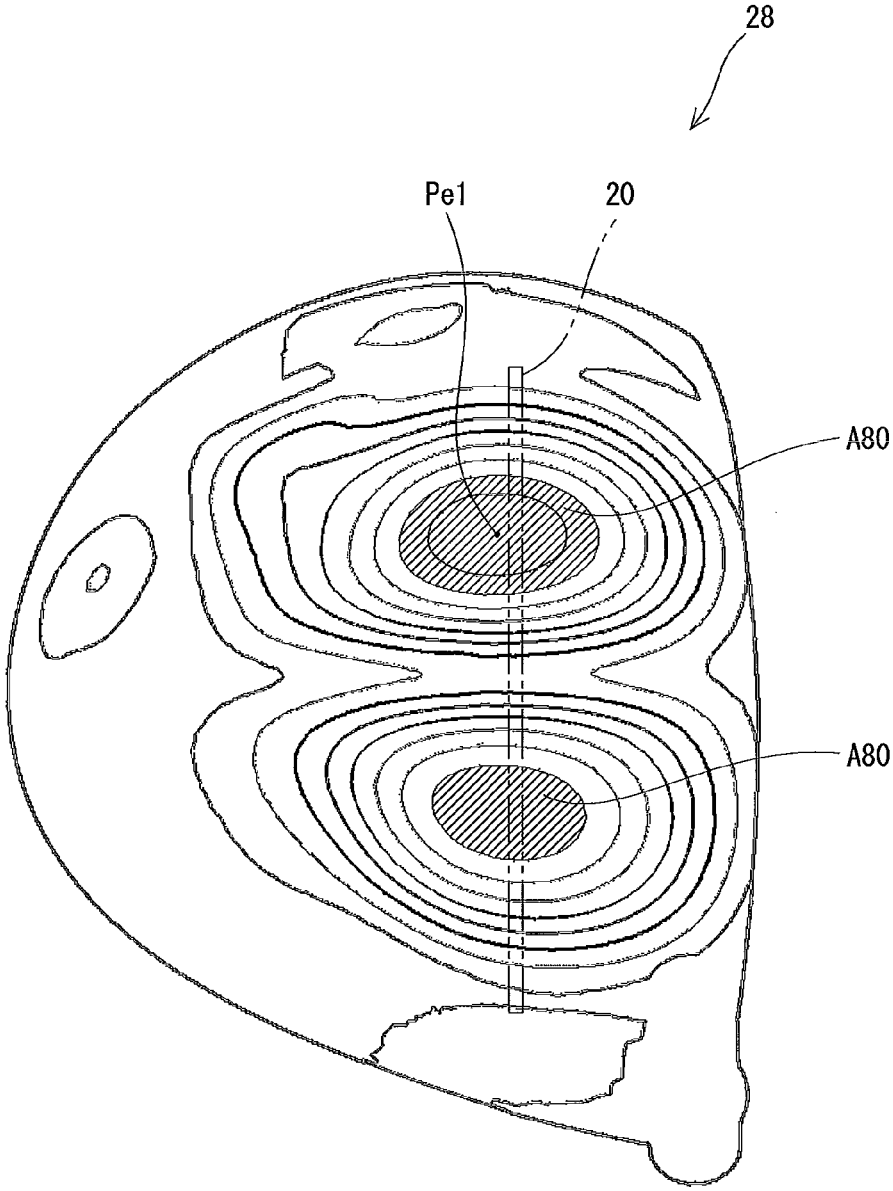
FIG. 8 is a view having disposal of a rib added to FIG. 7.

In the present invention, the head 28 having the state where the rib 20 is removed is considered. FIG. 6 is a view of the head 28, as viewed from the crown side. FIGS. 7 and 8 are views of the head 28, as viewed from the sole side. The head 2 and the head 28 are identical except for the existence or nonexistence of the rib 20. For example, the head 28 can be obtained by removing the rib 20 from the head 2. The head 28 can be obtained by manufacturing the head in the same manner as in the head 2 except that the rib 20 is not mounted. The rib 20 may be removed in the three-dimensional data of the head.

A vibration form in the first-order mode in the head 28 having the state where the rib 20 is removed is shown in FIGS. 7 and 8. The amplitude ratio Rh is shown as contour lines in FIGS. 7 and 8. A contour line CL10, a contour line CL20, a contour line CL30, a contour line CL40, a contour line CL50, a contour line CL60, a contour line CL70, a contour line CL80, and a contour line CL90 are shown in FIGS. 7 and 8. The contour line CL10 shows a position having the amplitude ratio Rh of 10%. The contour line CL20 shows a position having the amplitude ratio Rh of 20%. The contour line CL30 shows a position having the amplitude ratio Rh of 30%. The contour line CL40 shows a position having the amplitude ratio Rh of 40%. A contour line CL50 shows a position having the amplitude ratio Rh of 50%. A contour line CL60 shows a position having the amplitude ratio Rh of 60%. A contour line CL70 shows a position having the amplitude ratio Rh of 70%. A contour line CL80 shows a position having the amplitude ratio Rh of 80%. A contour line CL90 shows a position having the amplitude ratio Rh of 90%.

As shown in FIGS. 7 and 8, the head 28 has a high Rh region A80 having the amplitude ratio Rh of equal to or greater than 80%. The high Rh region A80 is a region inside the contour line CL80. In the head 28, the two high Rh regions A80 exist. Both the high Rh regions A80 are also located on the sole 8. The maximum amplitude point Pe1 is located in the toe side high Rh region A80. The high Rh regions A80 are shown by hatching in FIGS. 7 and 8.

As shown in FIG. 7, the maximum amplitude point Pe1 in the first-order mode in the state where the rib (X) is removed is located on the sole 8. By contrast, as shown in FIG. 1, the maximum amplitude point Pm1 of the head 2 (having the rib (X)) is located on the crown. The maximum amplitude point in the first-order mode is moved to the crown from the sole by setting the rib (X). The location of the maximum amplitude point Pm1 on the crown contributes to the increase of the first-order natural frequency H1. The increase of the first-order natural frequency H1 is effective in enhancing the hitting sound.

The shape of the sole is often almost flat. By contrast, curvature is ordinarily applied to the crown. The curvature radius of the crown is ordinarily smaller than that of the sole. By contrast, the thickness of the crown and the thickness of the sole tend to draw near to each other with enlargement of the head. The sole tends to be thinned with enlargement of the head. As a result, the thickness of the crown and the thickness of the sole tend to draw near to each other. In this case, the maximum amplitude point in the first-order mode tends to be located on the sole.

When the maximum amplitude point in the first-order mode is located on the sole, the first-order natural frequency H1 tends to be reduced. The comparatively flat shape of the sole contributes to the reduction. By contrast, when the maximum amplitude point in the first-order mode is located on the crown, the first-order natural frequency H1 tends to be increased. The comparatively small curvature radius of the crown contributes to the increase of the first-order natural frequency H1. The hitting sound tends to be high-pitch sound by the great first-order natural frequency H1. The disposal of the rib 20 is effective in increasing the first-order natural frequency H1.

As described above, in the head 2, the position of the maximum amplitude point in the first-order mode is moved to the crown from a position other than the crown by the setting of the rib 20. This shows that the rib 20 is effective in enhancing the hitting sound.

When the maximum amplitude point in the first-order mode is located on the sole, in view of moving the position of the maximum amplitude point to the crown from the sole, the rib (X) is preferably disposed on the inner surface of the sole.

In the case of the head having the side, the rib (X) may be disposed on only the inner surface of the sole, and may be disposed over the inner surface of the sole and the inner surface of the side. The position of the maximum amplitude point can be moved to the crown from the sole by disposing the rib (X) on the inner surface of the sole.

The position of the rib 20 is shown by a virtual line (two-dot chain line) in FIG. 8. The rib 20 passes through at least one high Rh region A80. The disposal of the rib 20 satisfies the following items (a), (b), and (c).

(a) The rib (X) crosses at least one of the high Rh regions having the amplitude ratio Rh of equal to or greater than 80%.

(b) No region having the amplitude ratio Rh of equal to or greater than 60% exists on the toe side than the rib (X).

(c) No region having the amplitude ratio Rh of equal to or greater than 60% exists on the heel side than the rib (X).

The items (a), (b), and (c) contribute to the restraint of the vibration. The rib (X) satisfying the items (a), (b), and (c) is effective in increasing the first-order natural frequency H1. The items (a), (b), and (c) contribute to the restraint of the vibration.

The disposal of the rib 20 satisfies the following item (a1).

(a1) The rib (X) crosses the high Rh region A80 in which the maximum amplitude point Pe1 exists among the high Rh regions having the amplitude ratio Rh of equal to or greater than 80%.

The rib (X) satisfying the item (a1) is effective in increasing the first-order natural frequency H1.

The plurality of high Rh regions A80 exist in the head 28. The rib 20 crosses the two high Rh regions A80. That is, the rib 20 crosses all of the high Rh regions A80. The constitution can further enhance the hitting sound.

In the case of the head having the side, the sole and the side may simultaneously vibrate. In the case of the head having the side, one antinode (antinode of the first-order mode) existing over the side and the sole may be generated. In the case of the head having the side, the rib (X) existing on the side and the sole may be provided. That is, the rib (X) may be provided on the inner surface of the sole and the inner surface of the side.

The single rib (X) may stiffen the sole 8, the side 10 located on the heel side, and the side 10 located on the toe side.

Figure 9:
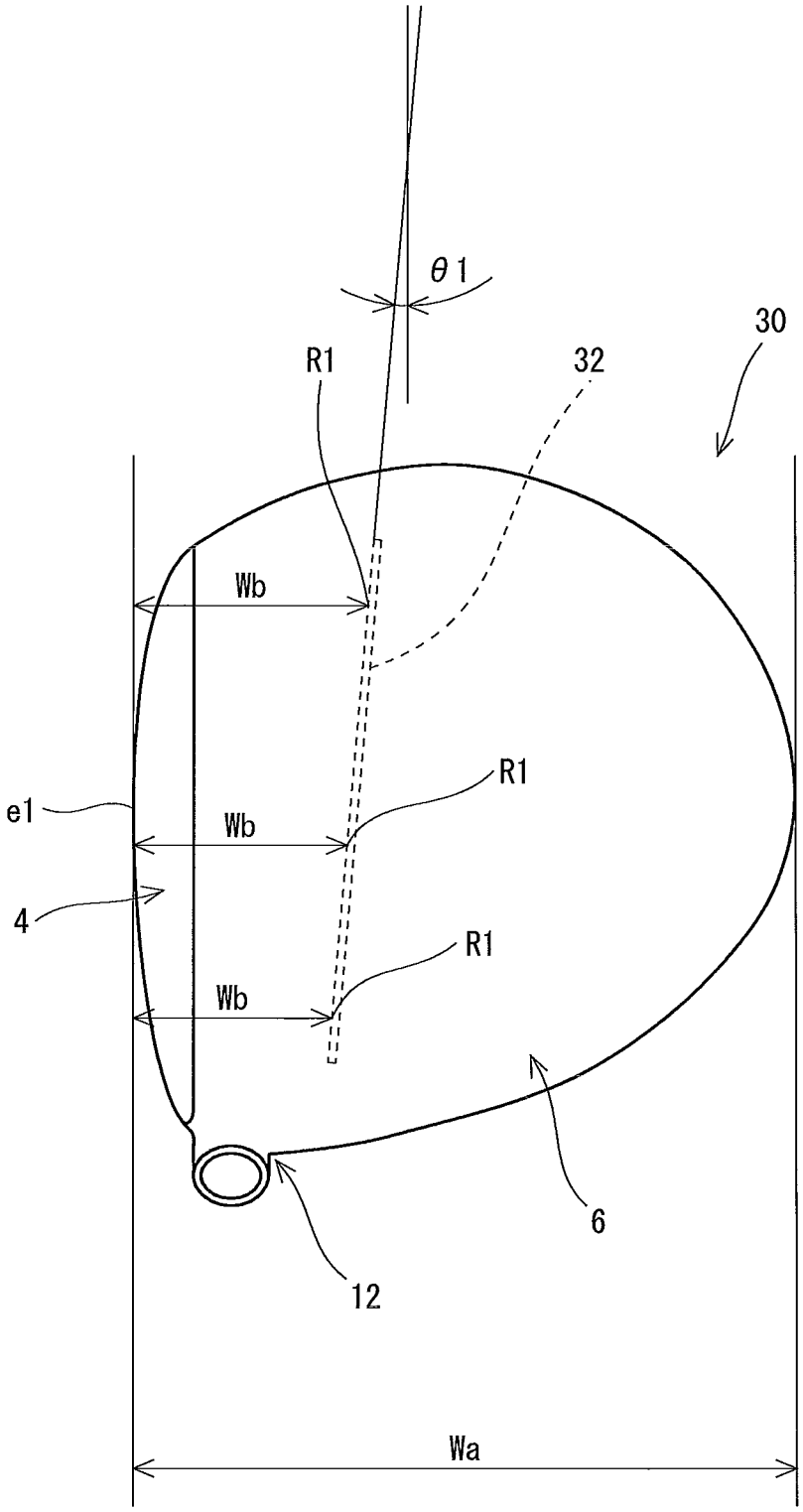
FIG. 9 is a view of a head according to another embodiment of the present invention, as viewed from a crown side.

FIG. 9 is a view of a head 30 according to a second embodiment, as viewed from a crown side.

A head 30 has a face 4, a crown 6, a sole (not shown), and a hosel 12. The head 30 is hollow. The head 30 is a so-called wood type golf club head.

The head 30 has an inner surface on which a rib 32 is provided. The rib 32 continuously extends to the side 10 of the heel side from the side 10 of the toe side via the sole 8. The rib 32 is the rib (X).

In the head 30, the extending direction of the rib 32 is inclined to a toe-heel direction. In the present invention, the constitution is also possible.

An angle (degree) between the extending direction of the projection image Tr of the rib and the toe-heel direction is shown by a double-pointed arrow θ1 in FIG. 9. When the projection image Tr of the rib is bent, the angle θ1 is an angle between each of tangents of the projection image Tr and the toe-heel direction. In view of increasing the first-order natural frequency H1, the absolute value of the angle θ1 is preferably equal to or less than 5 degrees, more preferably equal to or less than 4 degrees, and still more preferably equal to or less than 3 degrees.

Figure 10:
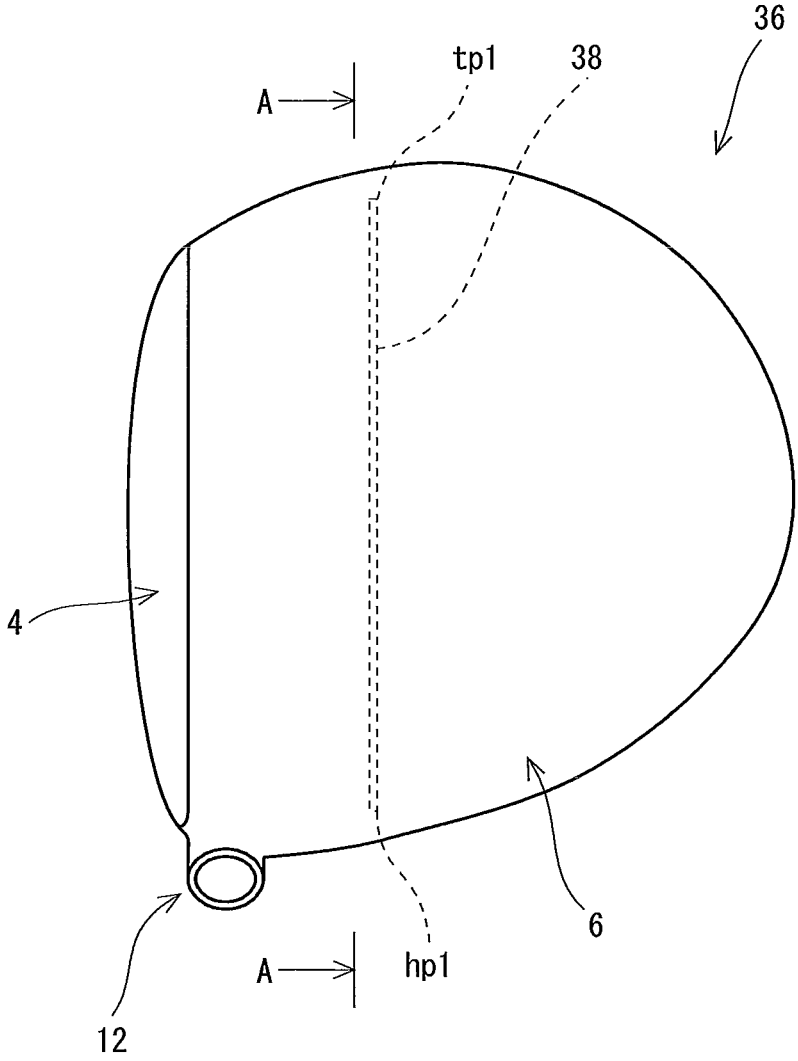
FIG. 10 is a view of a head according to another embodiment of the present invention, as viewed from a crown side.
Figure 11:
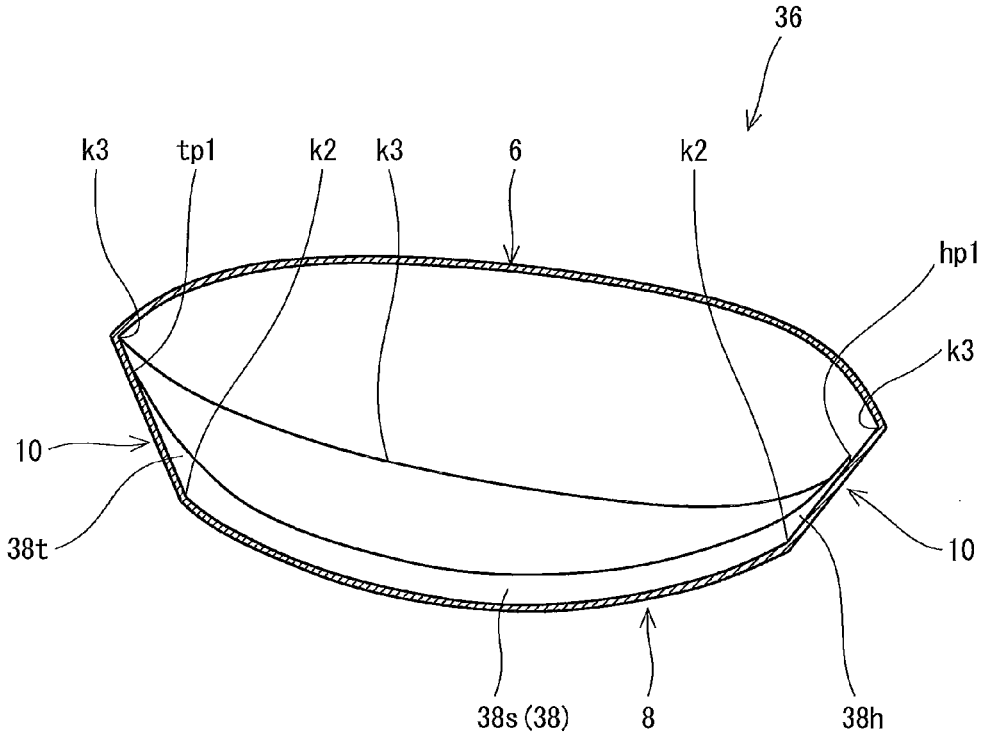
FIG. 11 is a cross sectional view taken along a line A-A of FIG. 10.

FIG. 10 is a view of a head 36 according to a third embodiment, as viewed from a crown side. FIG. 11 is a cross sectional view taken along a line A-A of FIG. 10. A rib 38 is provided on the inner surface of the head 36. The rib 38 is the rib (X).

The rib 38 continuously extends to the side 10 of the heel side from the side 10 of the toe side via the sole 8. That is, the rib 38 has a sole disposing part 38*s* located on the inner surface of the sole 8, a toe side part 38*t* located on the side 10 of the toe side, and a heel side part 38*h* located on the side 10 of the heel side. The first-order natural frequency H1 can be effectively increased by the rib 38.

Thus, the rib 38 has a heel side end extending to the crown 6. In the rib 38, the toe side part 38*t*, the sole disposing part 38*s*, and the heel side part 38*h* are continuously provided. In the present invention, the constitution is also possible. As described above, the rib 38 provided over the side and the sole can effectively increase the first-order natural frequency H1. The maximum amplitude point in the first-order mode tends to be located on the crown by the rib 38 provided over the side and the sole.

Figure 12:
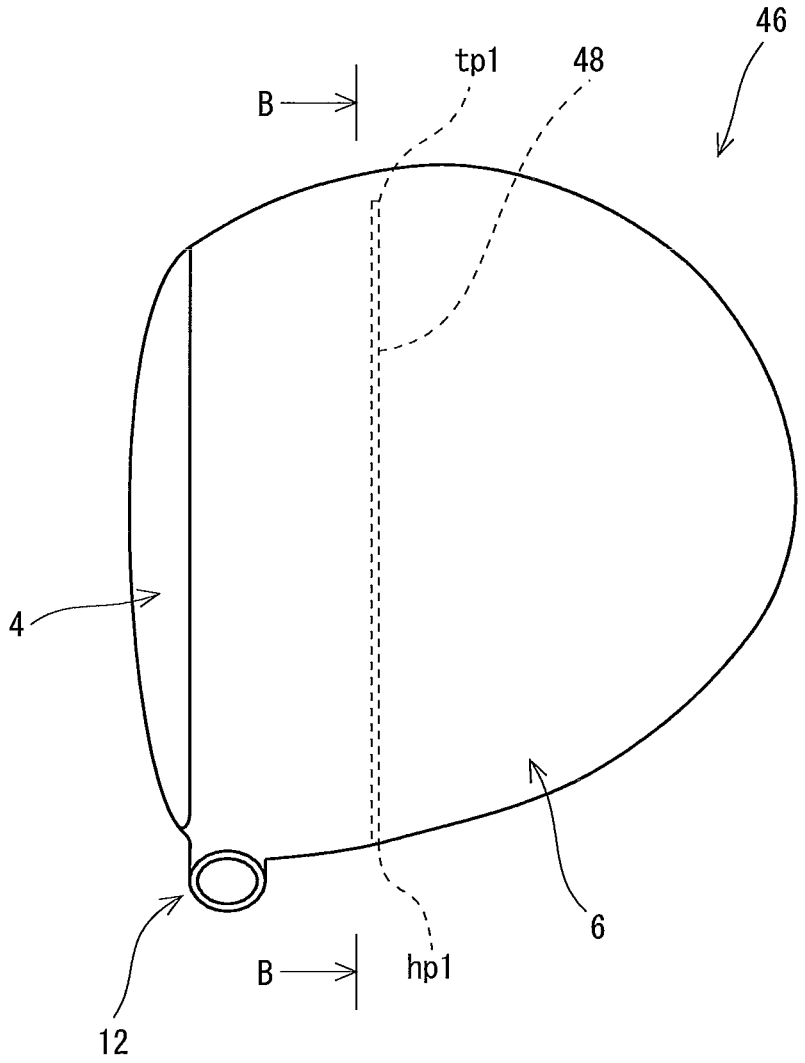
FIG. 12 is a view of a head according to another embodiment of the present invention, as viewed from a crown side.
Figure 13:
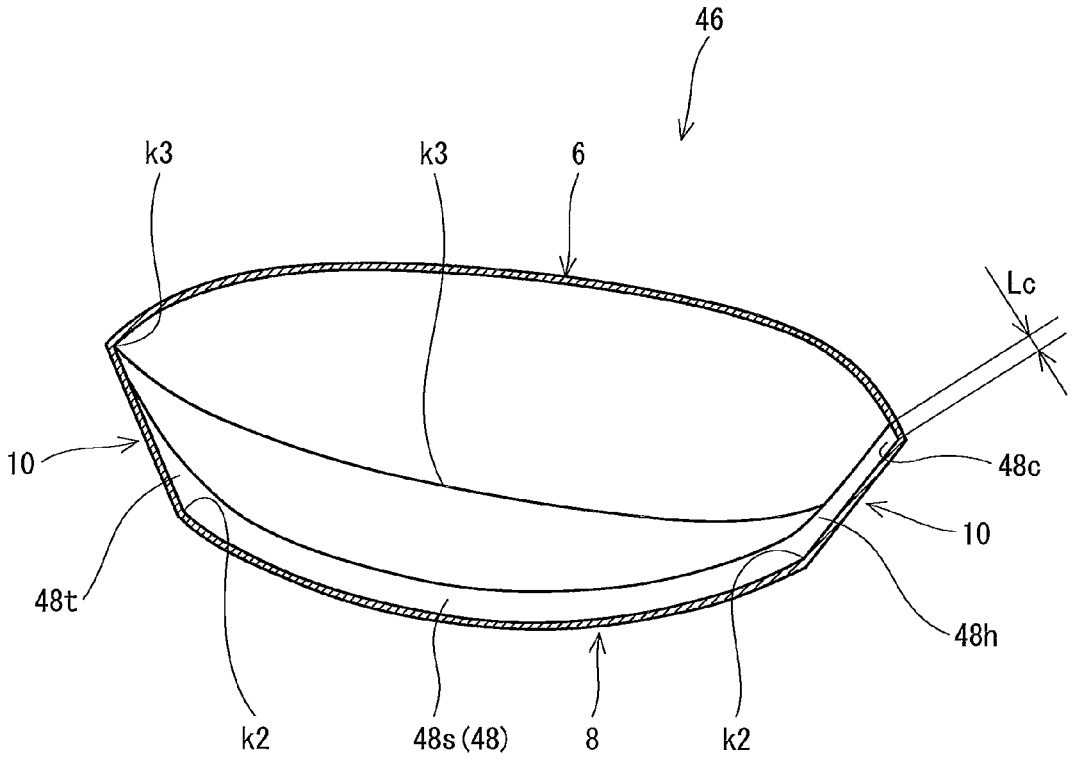
FIG. 13 is a cross sectional view taken along a line B-B of FIG. 12.

FIG. 12 is a view of a head 46 according to a fourth embodiment, as viewed from a crown side. FIG. 13 is a cross sectional view taken along a line B-B of FIG. 12. A rib 48 is provided on the inner surface of the head 46. The rib 48 is the rib (X).

The rib 48 continuously extends to the crown 6 from the side 10 of the toe side via the sole 8 and the side 10 of the heel side. That is, the rib 48 has a sole disposing part 48*s* located on the inner surface of the sole 8, a toe side part 48*t* located on the side 10 of the toe side, a heel side part 48*h* located on the side 10 of the heel side, and a crown disposing part 48*c* located on the inner surface of the crown 6.

Thus, the rib 48 may be disposed on the inner surface of the crown. The first-order natural frequency H1 can be increased by the rib 48 provided over the sole and the crown.

A rib other than the rib (X) may be provided in the head of the present invention.

A distance (three-dimensional distance) between a toe side end point pt of the rib 20 (rib (X)) and a crown boundary point ct is shown by a double-pointed arrow Vt in FIGS. 1 and 2. A distance (three-dimensional distance) between a heel side end point ph of the rib 20 (rib (X)) and a crown boundary point ch is shown by a double-pointed arrow Vh in FIGS. 1 and 2. The end point pt is a point located closest to the toe side in the rib (X). The end point ph is a point located closest to the heel side in the rib (X). In order to determine the crown boundary point ct and the crown boundary point ch, a plane Px (not shown) is defined. The plane Px includes the endpoint pt and the end point ph, and is perpendicular to the face-back direction. The crown boundary point ct is located closest to the toe side in the intersection line of the plane Px and the inner surface of the crown 6. The crown boundary point ch is located closest to the heel side in the intersection line of the plane Px and the inner surface of the crown 6.

The distance Vt and the distance Vh can be appropriately set based on the form of natural vibration in the first-order mode, or the like. In view of increasing the natural frequency, the distance Vt and the distance Vh are preferably small. In this view, the distance Vt can be preferably set to be, for example, equal to or less than 50 mm, and further equal to or less than 45 mm. Similarly, the distance Vh can be preferably set to be, for example, equal to or less than 50 mm, and further equal to or less than 45 mm.

An excessively short rib cannot enhance the hitting sound. On the other hand, the excessively short rib may lower the hitting sound. While the excessively short rib provided at the position of the antinode of the vibration increases the mass of the position of the antinode of the vibration, the rib hardly restrains the vibration. Therefore, the excessively short rib lowers the hitting sound. The short rib which cannot cross at least one high Rh region lowers the hitting sound.

The width Wa of the head (see FIG. 5) is not limited. In views of deepening a depth of center of gravity and of increasing a moment of inertia, the width Wa of the head is preferably equal to or greater than 100 mm, more preferably equal to or greater than 107 mm, and still more preferably equal to or greater than 115 mm. In view of conforming the rules for the golf club, the width Wa of the head is preferably equal to or less than 127 mm, and particularly preferably 125 mm when the error of measurement of 2 mm is considered.

The length Wc of the head is not limited. In views of widening the face and of increasing the moment of inertia, the length Wc of the head is preferably equal to or greater than 100 mm, more preferably equal to or greater than 107 mm, and still more preferably equal to or greater than 115 mm. In view of conforming the rules for the golf club, the length Wc of the head is preferably equal to or less than 127 mm, and particularly preferably 125 mm when the error of measurement of 2 mm is considered.

The volume of the head is not limited. In views of the increase of the moment of inertia and of the enlargement of a sweet area, the volume of the head is preferably equal to or greater than 400 cc, more preferably equal to or greater than 420 cc, and still more preferably equal to or greater than 440 cc. In view of conforming the rules for the golf club, the volume of the head is preferably equal to or less than 470 cc, and particularly preferably 460 cc when the error of measurement of 10 cc is considered.

The weight Mh of the head is not limited. In view of swing balance, the weight Mh of the head is preferably equal to or greater than 175 g, more preferably equal to or greater than 180 g, and still more preferably equal to or greater than 185 g. In view of the swing balance, the weight Mh of the head is preferably equal to or less than 200 g, and more preferably equal to or less than 195 g.

The weight Mr of the rib (X) is not limited. In view of increasing the first-order natural frequency H1, the weight Mr of the rib (X) is preferably equal to or greater than 1.0 g, more preferably equal to or greater than 1.2 g, and still more preferably equal to or greater than 1.5 g. When the weight of the rib (X) is excessive, the weight capable of being distributed to the head body decreases, and the moment of inertia is reduced. In this view, the weight Mr of the rib (X) is preferably equal to or less than 5.0 g, more preferably equal to or less than 4.0 g, and still more preferably equal to or less than 3.0 g.

A ratio (Mr/Mh) of the weight Mr of the rib to the weight Mh of the head is not limited. In view of obtaining the high-pitch hitting sound, the ratio (Mr/Mh) is preferably equal to or greater than 0.005, more preferably equal to or greater than 0.007, and still more preferably equal to or greater than 0.009. When the weight of the rib (X) is excessive, the weight capable of being distributed to the head body decreases, and the moment of inertia is reduced. In this view, the ratio (Mr/Mh) is preferably equal to or less than 0.028, more preferably equal to or less than 0.021, and still more preferably equal to or less than 0.015.

The height of the rib (X) is shown by a double-pointed arrow HR in an enlarged view of FIG. 3. In view of enhancing the hitting sound, the height HR of the rib is preferably equal to or greater than 2 mm, more preferably equal to or greater than 2.5 mm, and still more preferably equal to or greater than 3 mm. In view of suppressing the weight of the rib, the height HR of the rib is preferably equal to or less than 15 mm, and more preferably equal to or less than 10 mm.

In view of suppressing the weight of the rib while suppressing the vibration of the side on the heel side, the height HR of the rib in the heel side end part of the rib may be gradually or stepwisely reduced as going to the heel side. In view of suppressing the weight of the rib while suppressing the vibration of the side on the toe side, the height HR of the rib in the toe side end part of the rib may be gradually or stepwisely reduced as going to the toe side.

In view of suppressing the weight of the rib (X) while suppressing the vibration of the side, the mean value of the height HR of the rib on the side may be smaller than the mean value of the height HR of the rib on the sole.

The width of the rib (X) is shown by a double-pointed arrow BR in the enlarged view of FIG. 3. In view of enhancing the hitting sound, the mean value of the width BR of the rib is preferably equal to or greater than 0.5 mm, more preferably equal to or greater than 0.7 mm, and still more preferably equal to or greater than 0.9 mm. In view of suppressing the weight of the rib, the mean value of the width BR of the rib is preferably equal to or less than 3 mm, and more preferably equal to or less than 2 mm.

The ratio (Wr/Wc) of the length Wr of the rib to the length We of the head is not limited. In view of enhancing the effect caused by the rib (X), the ratio (Wr/Wc) is preferably equal to or greater than 0.80, more preferably equal to or greater than 0.85, and still more preferably equal to or greater than 0.90. In view of the productivity of the head, the ratio (Wr/Wc) is preferably equal to or less than 1, more preferably less than 1, still more preferably equal to or less than 0.98, and yet still more preferably equal to or less than 0.95.

When the first-order natural frequency H1 is high, the hitting sound in actual hitting also tends to be enhanced. In this view, the first-order natural frequency H1 is preferably equal to or greater than 2000 Hz, more preferably equal to or greater than 2500 Hz, and still more preferably equal to or greater than 3400 HZ. When the first-order natural frequency H1 is excessively high, rebound performance may be reduced, and there is limit on the design of the head. In these respects, the first-order natural frequency H1 can be also set to be equal to or less than 5000 Hz, and further equal to or less than 4000 Hz.

Although the degree of influence of the second-order natural frequency H2 on the hitting sound is lowered below the first-order natural frequency H1, the second-order natural frequency H2 may have an influence on the hitting sound. In this view, the second-order natural frequency H2 is preferably equal to or greater than 3000 Hz, more preferably equal to or greater than 3200 Hz, and still more preferably equal to or greater than 3400 Hz. The second-order natural frequency H2 is considered to be ordinarily equal to or less than 5000 Hz and further equal to or less than 4000 Hz from the limit on the design of the head.

Although the degree of influence of the third-order natural frequency H3 on the hitting sound is lowered significantly below the second-order natural frequency H2, the third-order natural frequency H3 may have an influence on the hitting sound. In this view, the third-order natural frequency H3 is preferably equal to or greater than 3000 Hz, more preferably equal to or greater than 3200 Hz, and still more preferably equal to or greater than 3400 Hz. The third-order natural frequency H3 is considered to be ordinarily equal to or less than 5000 Hz and further equal to or less than 4500 Hz from the limit on the design of the head.

Although the degree of influence of the forth-order natural frequency H4 on the hitting sound is lowered significantly below the third-order natural frequency H3, the forth-order natural frequency H4 may have an influence on the hitting sound. In this view, the forth-order natural frequency H4 is preferably equal to or greater than 3000 Hz, more preferably equal to or greater than 3200 Hz, and still more preferably equal to or greater than 3400 Hz. The forth-order natural frequency H4 is considered to be ordinarily equal to or less than 5000 Hz and further equal to or less than 4500 Hz from the limit on the design of the head.

Although the degree of influence of the fifth-order natural frequency H5 on the hitting sound is lowered significantly below the forth-order natural frequency H4, the fifth-order natural frequency H5 may have an influence on the hitting sound. In this view, the fifth-order natural frequency H5 is preferably equal to or greater than 3000 Hz, more preferably equal to or greater than 3200 Hz, and still more preferably equal to or greater than 3400 Hz, and yet still more preferably equal to or greater than 4050 Hz. The fifth-order natural frequency H5 is considered to be ordinarily equal to or less than 5000 Hz and further equal to or less than 4500 Hz from the limit on the design of the head.

The number of the ribs (X) is not limited. In view of suppressing the weight of the rib, the number of the ribs (X) is preferably equal to or less than 2, and particularly preferably 1. In addition to the rib (X), the other rib may be provided. The ribs (X) may intersect with each other. The rib (X) may intersect with a rib other than the rib (X). In view of suppressing the weight of the rib, it is preferable that a rib other than the rib (X) does not exist.

As described above, when the sole is thin, the effect of the present invention can be enhanced. In this view, a mean thickness Ts of the sole is preferably equal to or less than 1 mm, more preferably equal to or less than 0.8 mm, and still more preferably equal to or less than 0.7 mm. In view of the strength of the head, the mean thickness Ts of the sole is preferably equal to or greater than 0.5 mm.

As described above, when a mean thickness Tc (mm) of the crown and the mean thickness Ts (mm) of the sole are close to each other, the effect of the present invention tend to be actualized. In this view, a ratio (Ts/Tc) is preferably equal to or less than 2.0, and more preferably equal to or less than 1.8. In view of a low center of gravity, the ratio (Ts/Tc) is preferably equal to or greater than 1.0, and more preferably equal to or greater than 1.2.

When the curvature radius of the sole is great and the sole is almost flat, the sole tends to vibrate. Therefore, in this case, the improving effect of the hitting sound caused by providing the rib (X) on the sole is great. In this view, the curvature radius of the sole is preferably equal to or greater than 100 mm, more preferably equal to or greater than 110 mm, and still more preferably equal to or greater than 120 mm. In view of suppressing ground resistance in the case of doubling, the curvature radius of the sole is preferably equal to or less than 150 mm.

The curvature radius of the sole can be measured as follows. All planes Hp including the axis Z are considered. Intersection lines of the planes Hp and the inner surface of the sole are determined. A large number of intersection lines are determined. The curvature of each of the intersection lines is the curvature radius of the sole. In the determination of the curvature radius of the sole, unevenness caused by characters or the like indicated on the sole is disregarded.

The material of the head is not limited. As the material of the head, a metal and Carbon Fiber Reinforced Plastic (CFRP) or the like are exemplified. As the metal used for the head, one or more kinds of metals selected from pure titanium, a titanium alloy, stainless steel, maraging steel, an aluminium alloy, a magnesium alloy, and a tungsten-nickel alloy are exemplified. SUS630 and SUS304 are exemplified as stainless steel. As the specific example of stainless steel, CUSTOM450 (manufactured by Carpenter Technology Corporation) is exemplified. As the titanium alloy, 6-4 titanium (Ti-6A1-4V) and Ti-15V-3Cr-3Sn-3A1 or the like are exemplified. When the volume of the head is great, the hitting sound tends to be increased. The present invention is particularly effective in a head having a great hitting sound. In this view, the material of the head is preferably the titanium alloy. In this view, the materials of the sole and side are preferably the titanium alloy.

A method for manufacturing the head is not limited. Ordinarily, a hollow head is manufactured by joining two or more members. A method for manufacturing the members constituting the head is not limited. As the method, casting, forging and press processing are exemplified.

Examples of the structures of the heads include a two-piece structure in which two members integrally formed are joined, a three-piece structure in which three members integrally formed are joined, and a four-piece structure in which four members integrally formed are joined.

EXAMPLES

Hereinafter, the effects of the present invention will be clarified by examples. However, the present invention should not be interpreted in a limited way based on the description of the examples.

[Simulation 1: Consideration Based on Heads T1 to T6

[Head T1]

Three-dimensional data of a head T1 having the same shape as that of the head 28 was prepared. The head T1 does not have a rib. A thickness Tc of a crown of the head was set to 0.55 (mm). A thickness Ts of a sole was set to 1.3 mm. A volume of the head was set to 460 cc. A titanium alloy was selected as a material of the head, and calculation was conducted using a coefficient based on the material. A weight of the head was set to 193 g.

The head T1 was mesh-divided into a finite element using a commercially available preprocessor (HyperMesh or the like) to obtain a calculation model. Next, natural value analysis was conducted using commercially available natural value analyzing software to calculate a natural frequency and a mode shape.

Figure 14:
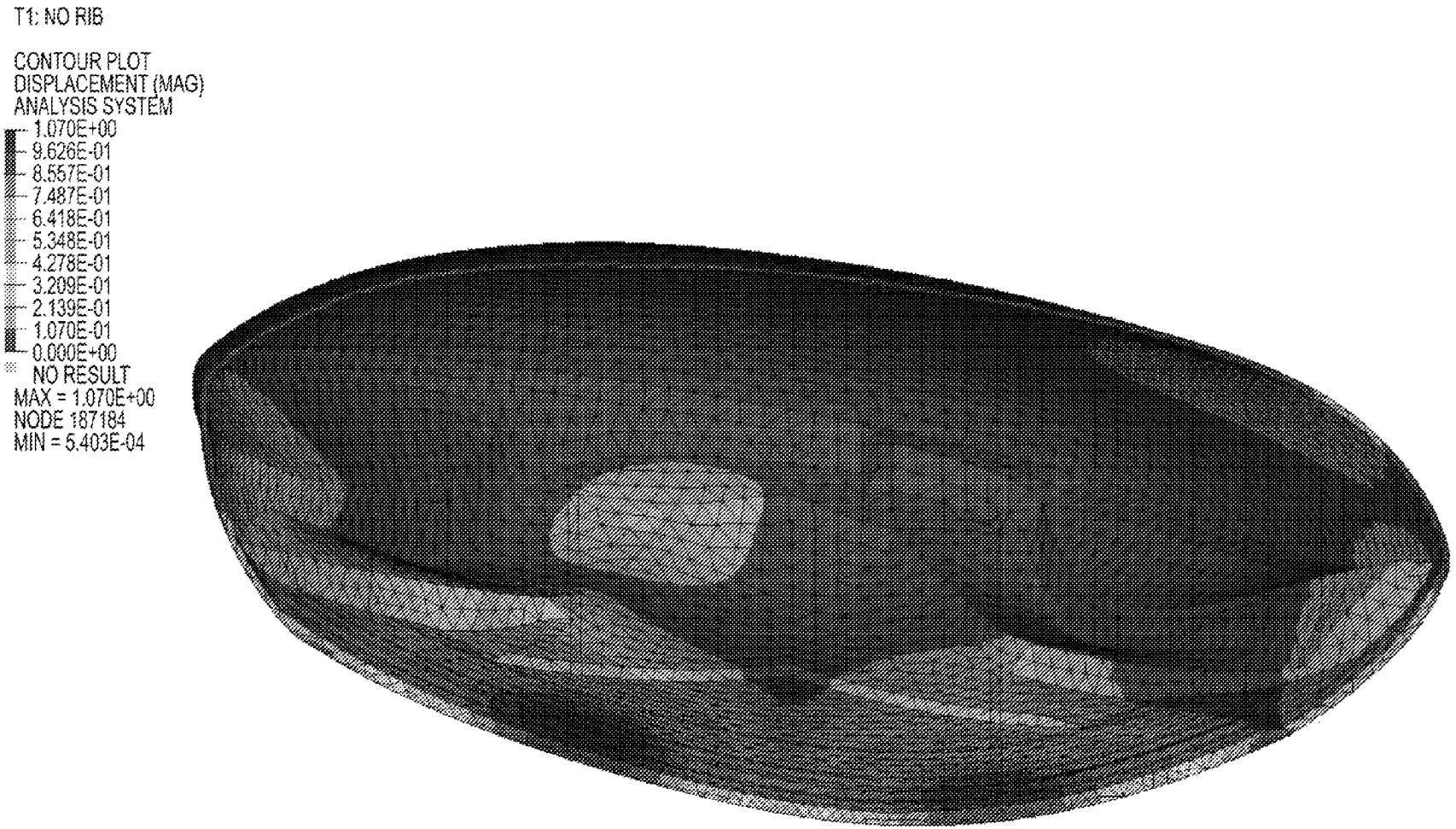
FIG. 14 is a simulation image of a head T1.
Figure 15A:
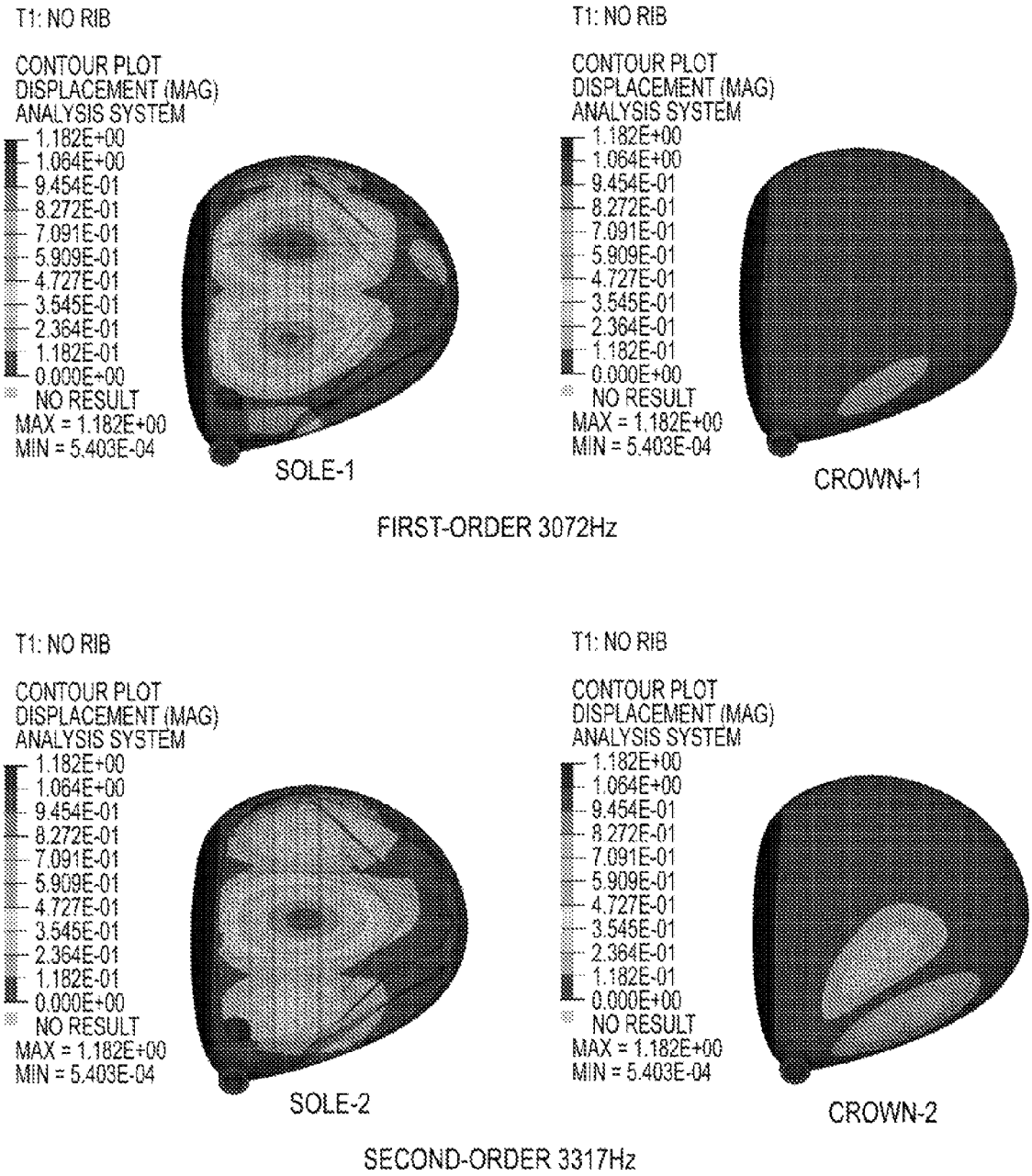
FIG. 15 is a simulation image of a head T1.
Figure 15B:
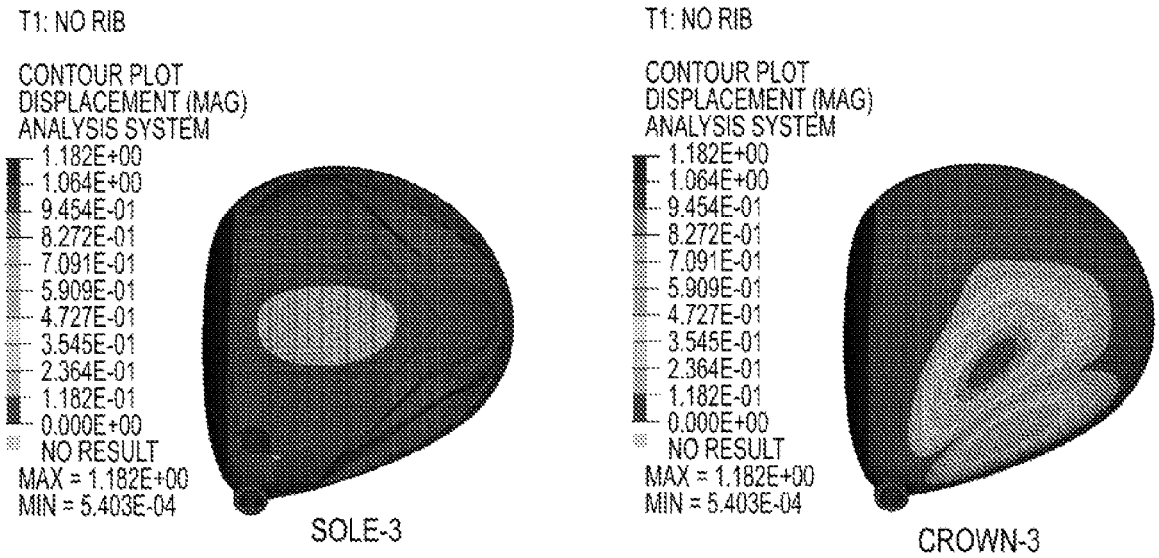
Figure 15B:
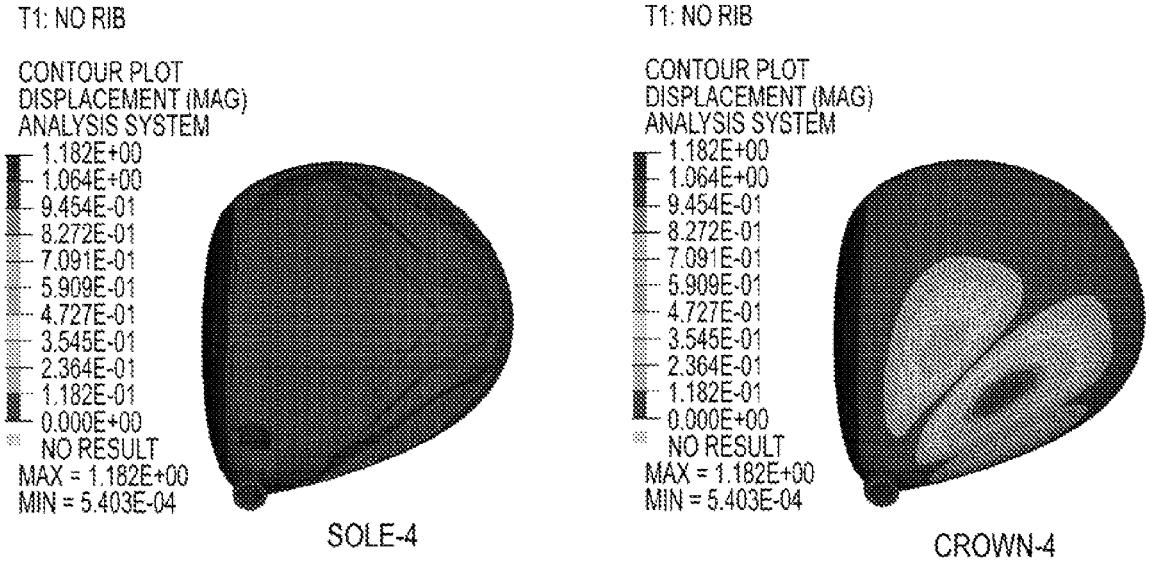

FIGS. 14 and 15 are simulation images showing the mesh-divided head T1. FIG. 14 shows a back side portion of the head cut at the same position as that of line F2-F2 in FIG. 1. A shade of FIG. 14 shows a form of natural vibration in a first-order mode. A deeper portion has a greater amplitude.

Four kinds of simulation images are shown in FIG. 15. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 15 are images viewed from a crown side. Therefore, the SOLE-1, the SOLE-2, the SOLE-3, and the SOLE-4 are perspective views in which a sole is viewed from the crown side.

A plurality of lines is drawn in the SOLE-1, the SOLE-2, the SOLE-3, and the SOLE-4. These are not ribs (X) but level differences of the inner surface of the sole or mesh lines of the calculation model.

The vibration form in the first-order mode of the head T1 was shown in FIG. 7. FIG. 7 is a view as viewed from the sole side.

As shown in the image SOLE-1 in FIG. 15, and FIG. 7, two high Rh regions are located on the sole in the head T1.

Natural frequency in each of the orders of the head T1 was as follows as the result of the calculation.

First-order natural frequency V1: 3072 Hz
Second-order natural frequency V2: 3317 Hz
Third-order natural frequency V3: 3432 Hz
Fourth-order natural frequency V4: 3641 Hz

[Head T2]

A calculation model of a head T2 was obtained in the same manner as in the head T1 except that a rib t2 to be described later was provided on the sole as the rib (X). Natural value analysis was conducted using commercially available natural value analyzing software to calculate a natural frequency and a mode shape.

Figure 16:
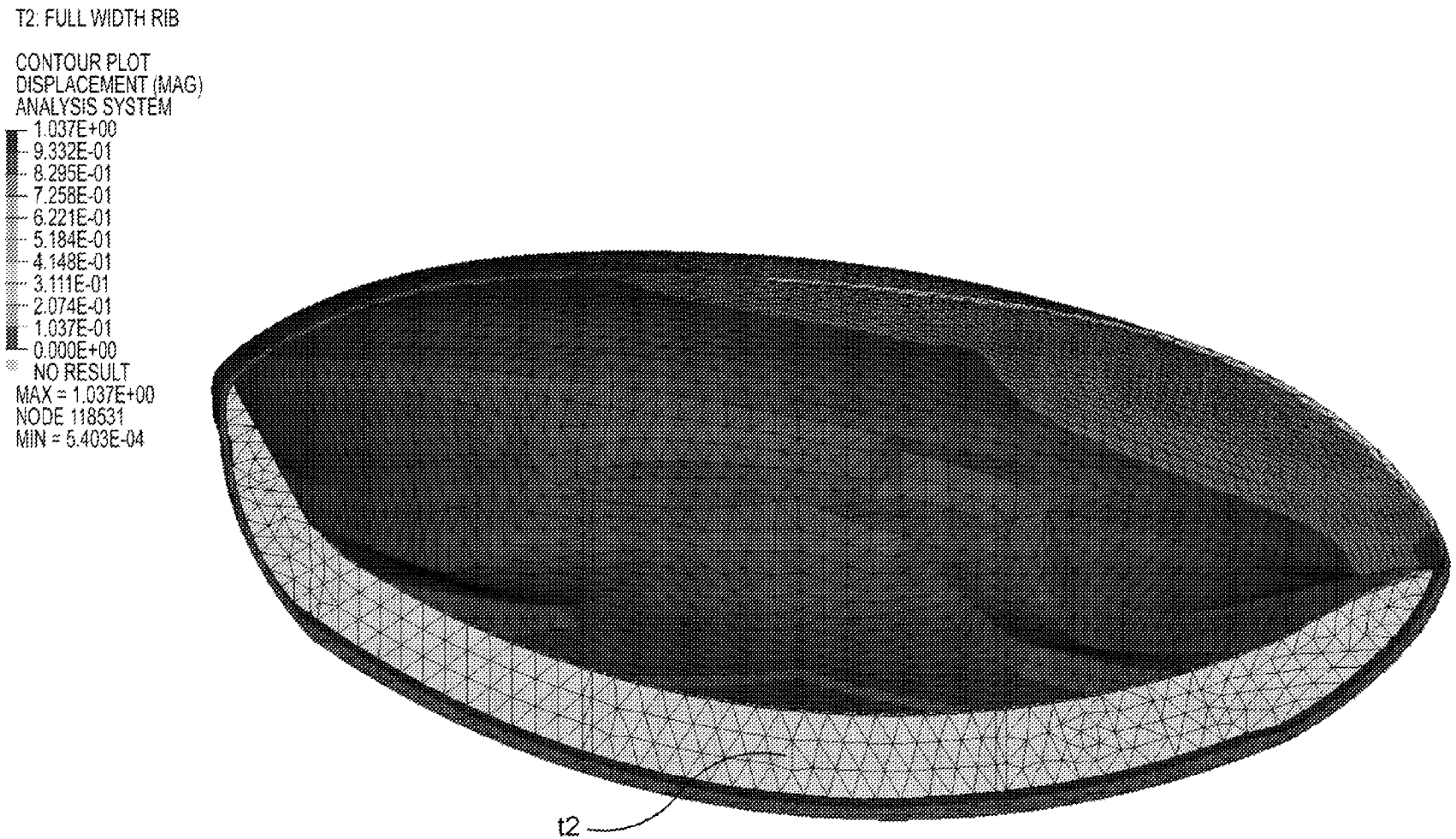
FIG. 16 is a simulation image of a head T2.
Figure 17A:
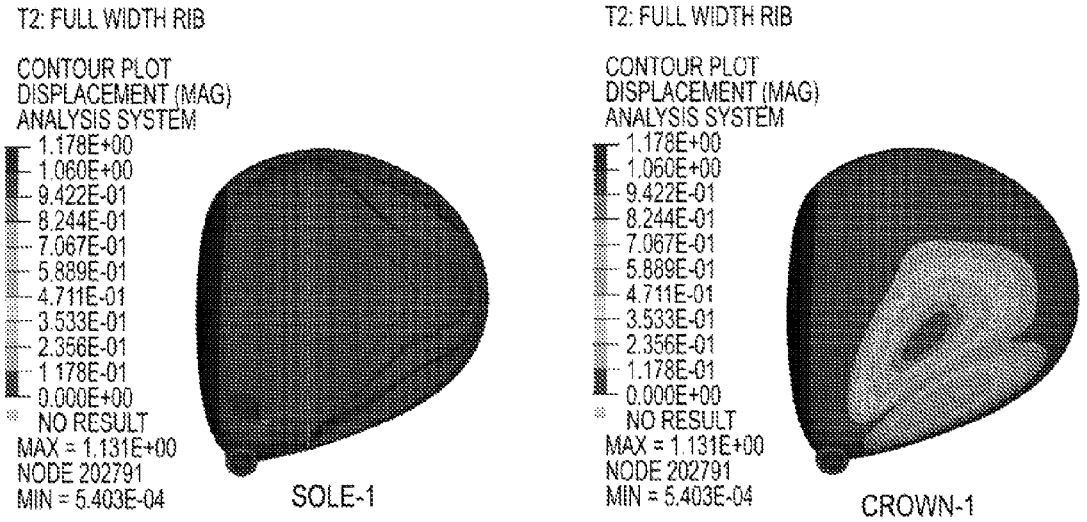
FIG. 17 is a simulation image of a head T2.
Figure 17A:
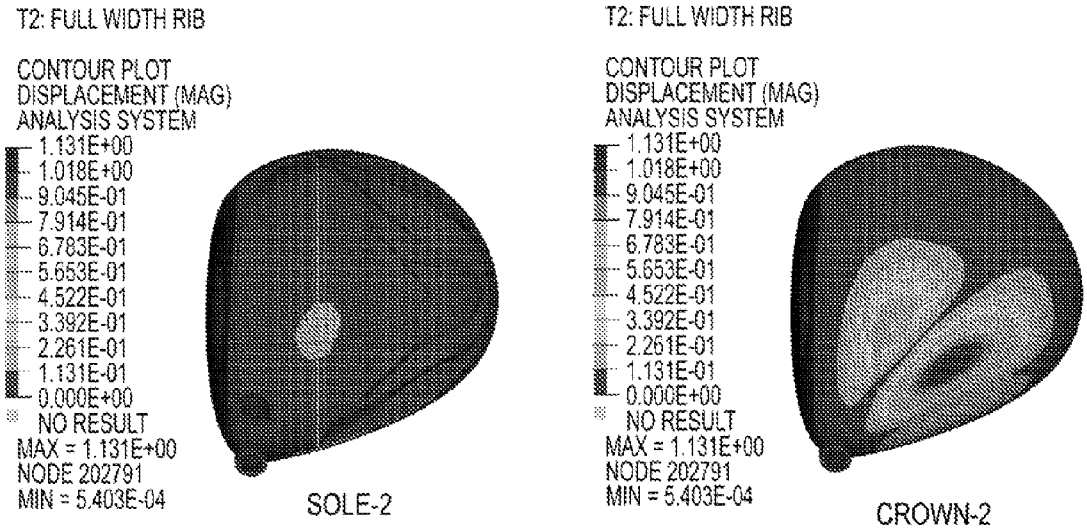
Figure 17B:
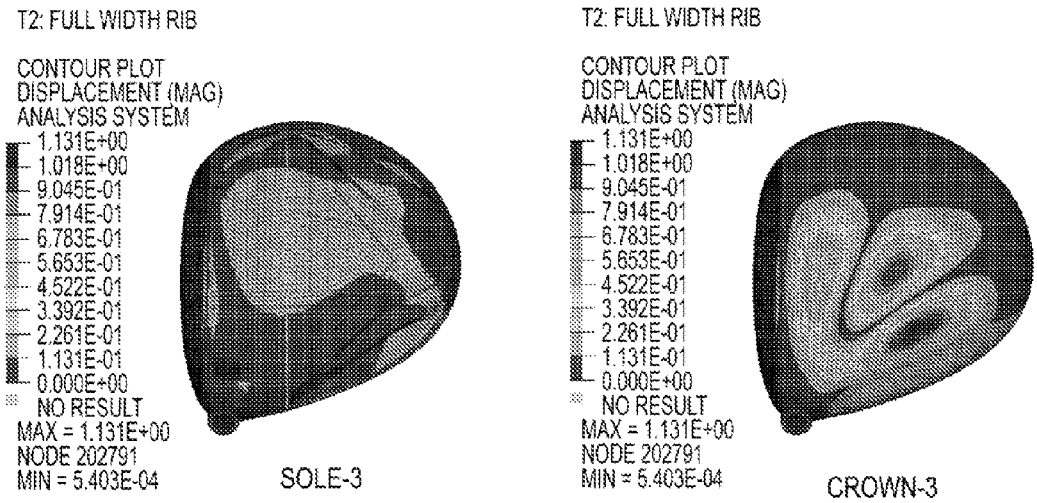
Figure 17B:
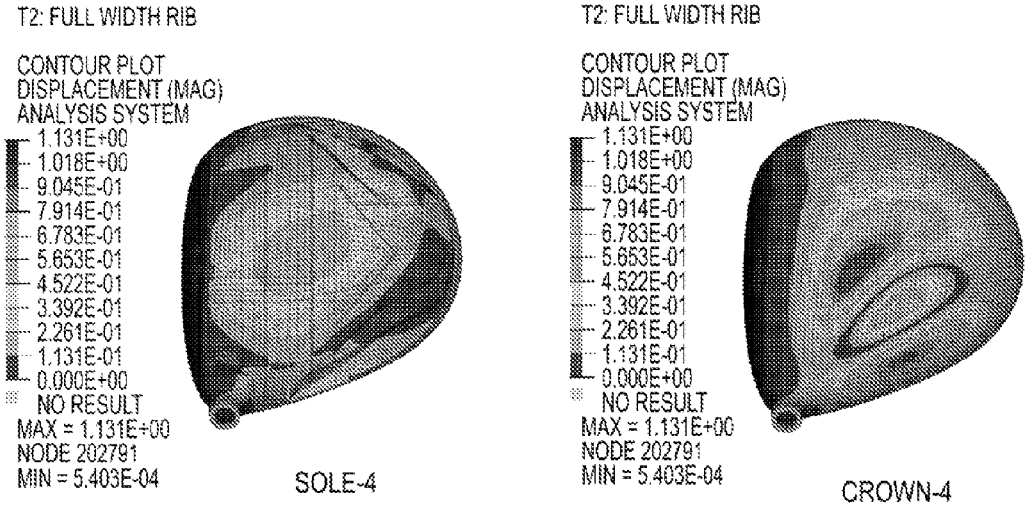

FIGS. 16 and 17 are simulation images showing the mesh-divided head T2. FIG. 16 shows a back side portion of the head cut at the same position as that of line F2-F2 in FIG. 1. A shade of FIG. 16 shows a form of natural vibration in a first-order mode. A deeper portion has a greater amplitude.

As the position of the rib t2, the distance Wb (see FIG. 5) was set to 36 mm; the distance Vt (see FIG. 2) was set to 0 mm; and the distance Vh (see FIG. 2) was set to 0 mm.

Four kinds of simulation images are shown in FIG. 17. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 17 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 17, in the head T2, a maximum amplitude point in the first-order mode does not exist on the sole. In the head T2, the maximum amplitude point in the first-order mode is located on the crown. The location of the maximum amplitude point in the first-order mode on the crown contributes to the increase of a first-order natural frequency.

Natural frequency in each of the orders of the head T2 was as follows as the result of the calculation.

First-order natural frequency H1: 3422 Hz
Second-order natural frequency H2: 3633 Hz
Third-order natural frequency H3: 3907 Hz
Fourth-order natural frequency H4: 4055 Hz

[Head T3]

[Head T3—10 mm]

A calculation model of a head T3—10 mm was obtained in the same manner as in the head T1 except that a rib t310 to be described later was provided on the sole as the rib (X). Natural value analysis was conducted using commercially available natural value analyzing software to calculate a natural frequency and a mode shape.

Figure 18:
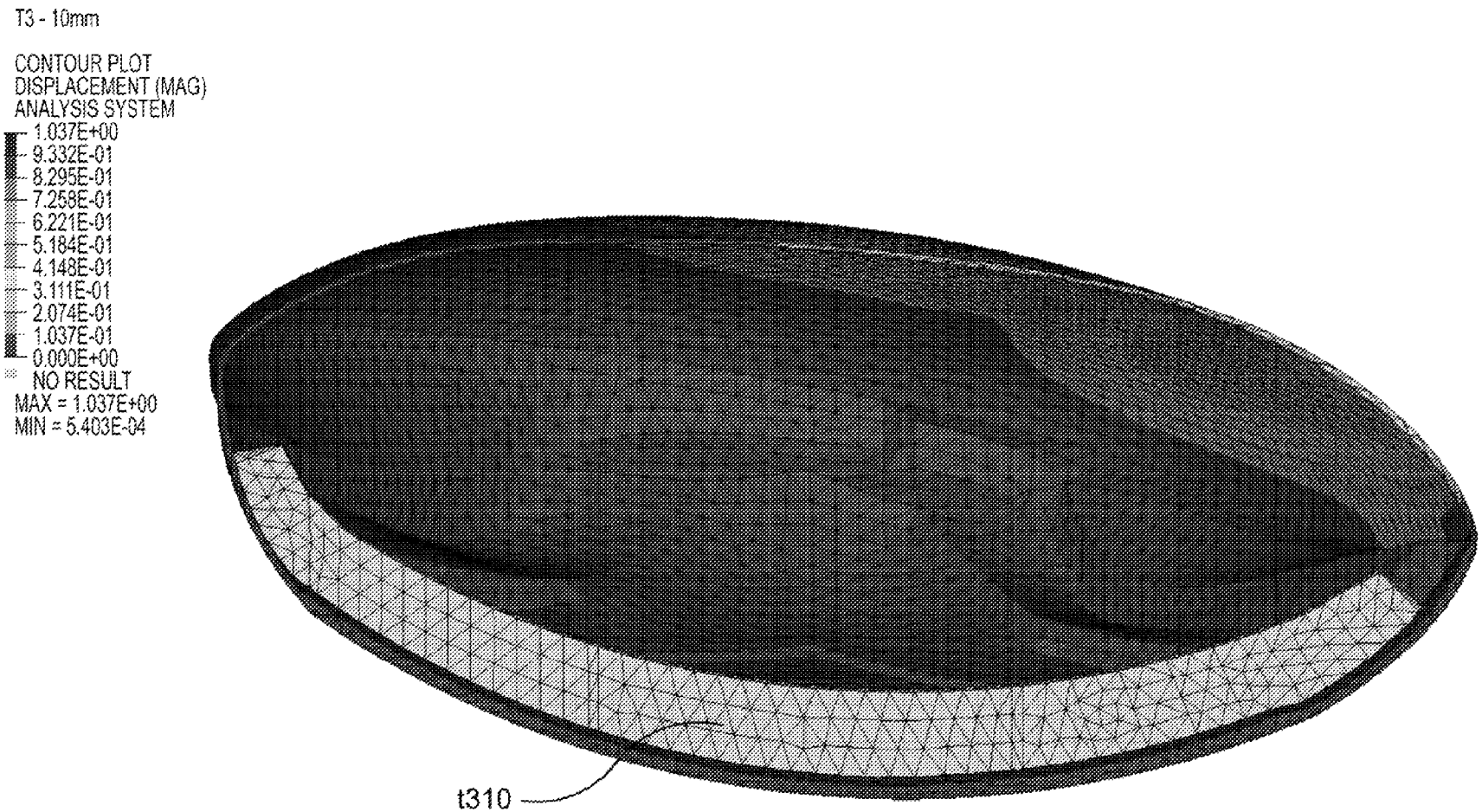
FIG. 18 is a simulation image of a head T3—10 mm.
Figure 19A:
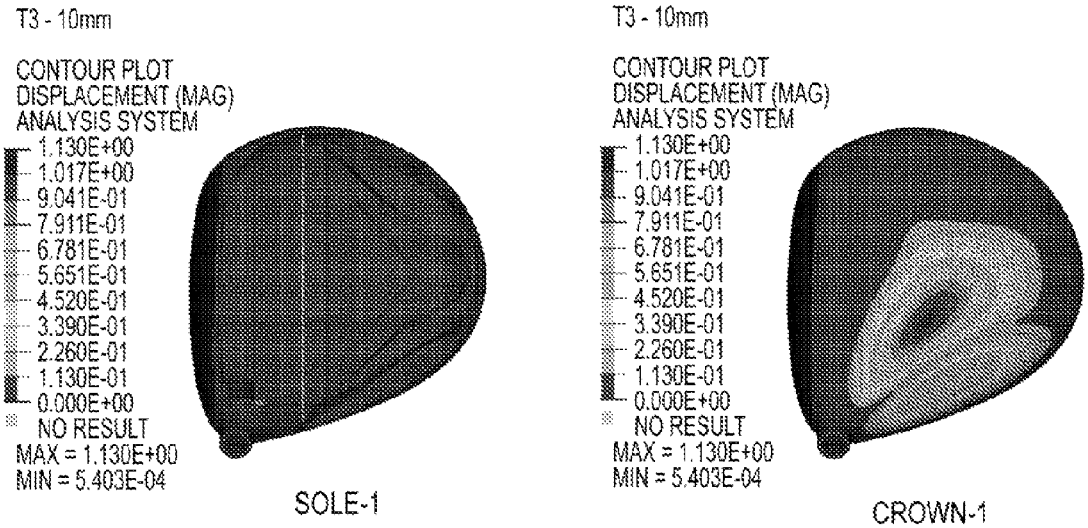
FIG. 19 is a simulation image of a head T3—10 mm.
Figure 19A:
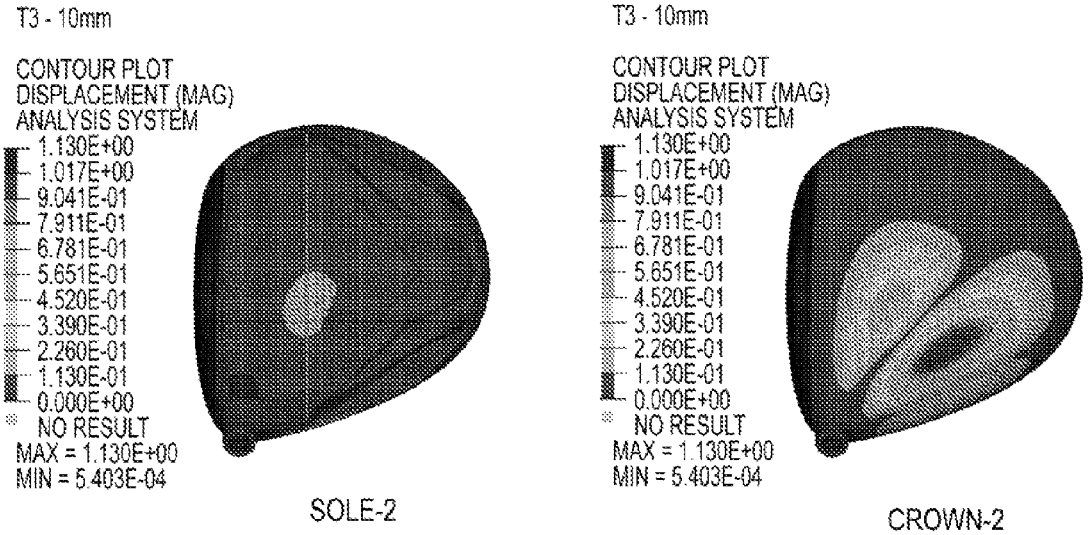
Figure 19B:
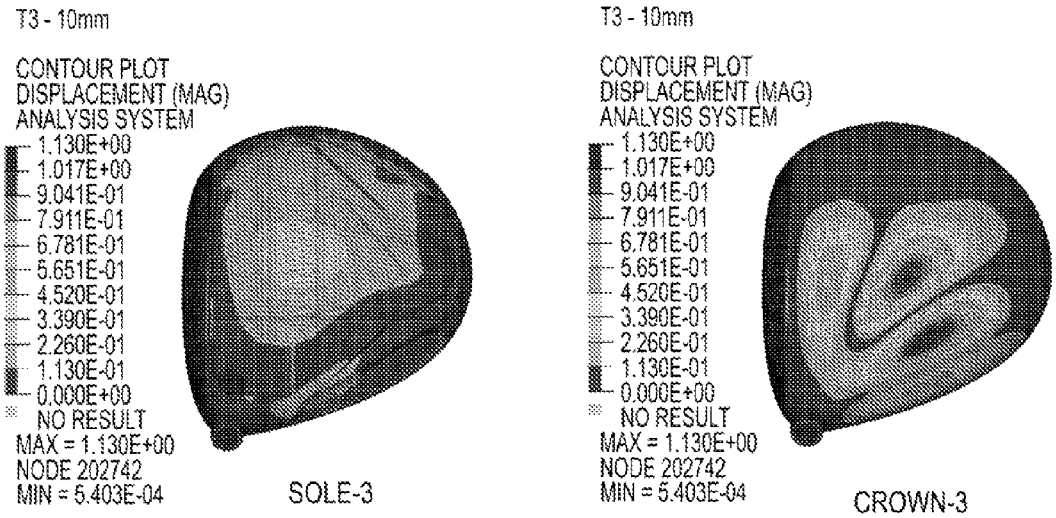
Figure 19B:
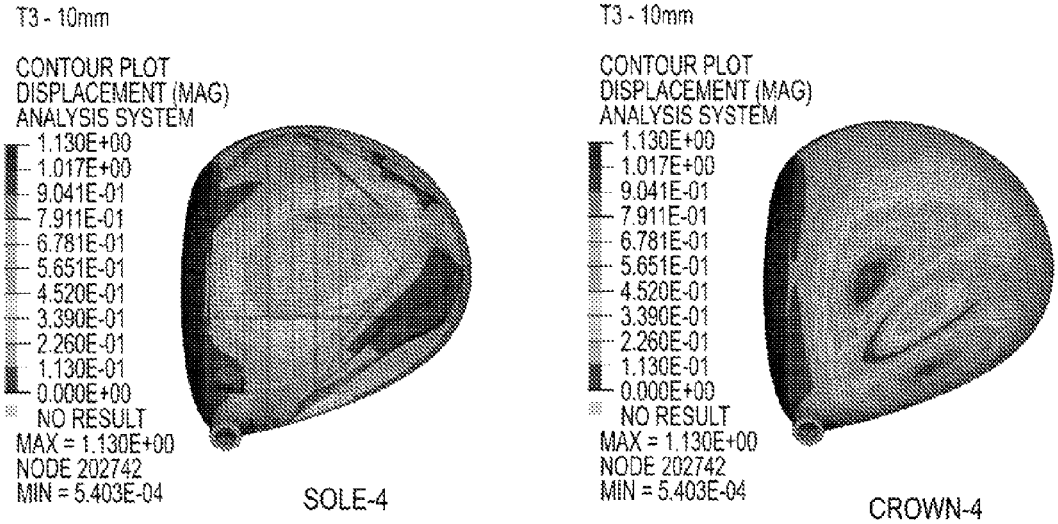

FIGS. 18 and 19 are simulation images showing the mesh-divided head T3—10 mm. FIG. 18 shows a back side portion of the head cut at the same position as that of line F2-F2 in FIG. 1. A shade of FIG. 18 shows a form of natural vibration in a first-order mode. A deeper portion has a greater amplitude.

As the position of the rib t310, the distance Wb (see FIG. 5) was set to 36 mm; the distance Vt (see FIG. 2) was set to 10 mm; and the distance Vh (see FIG. 2) was set to 10 mm.

Four kinds of simulation images are shown in FIG. 19. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 19 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 19, in the head T3—10 mm, a maximum amplitude point in the first-order mode does not exist on the sole. In the head T3—10 mm, the maximum amplitude point in the first-order mode is located on the crown. The location of the maximum amplitude point in the first-order mode on the crown contributes to the increase of a first-order natural frequency.

Natural frequency in each of the orders of the head T3—10 mm was as follows as the result of the calculation.

First-order natural frequency H1: 3422 Hz
Second-order natural frequency H2: 3629 Hz
Third-order natural frequency H3: 3895 Hz
Fourth-order natural frequency H4: 4010 Hz

[Head T3—15 mm]

A calculation model of a head T3—15 mm was obtained in the same manner as in the head T1 except that a rib t310 to be described later was provided on the sole as the rib (X). Natural value analysis was conducted using commercially available natural value analyzing software to calculate a natural frequency and a mode shape.

Figure 20:
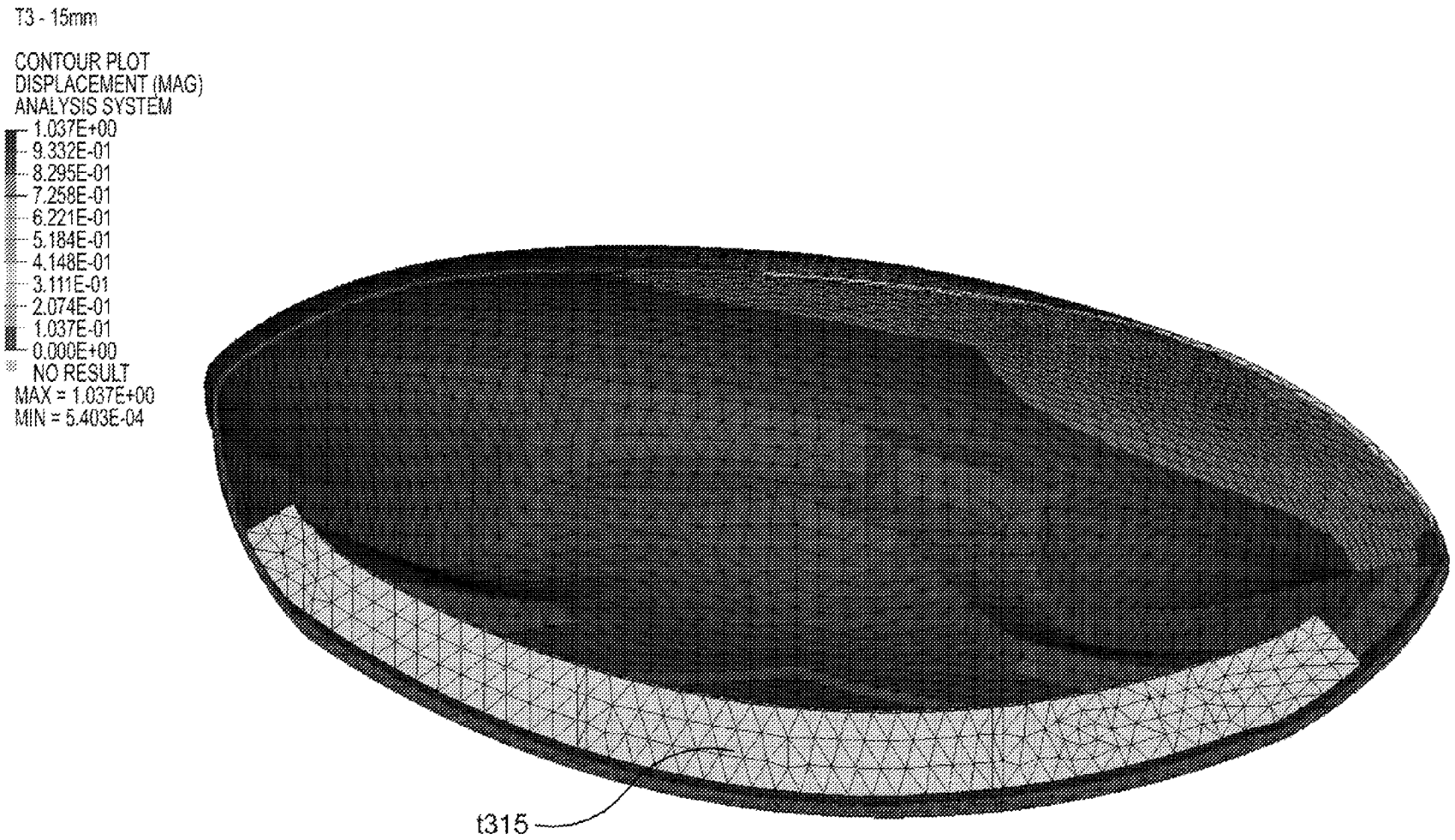
FIG. 20 is a simulation image of a head T3—15 mm.
Figure 21A:
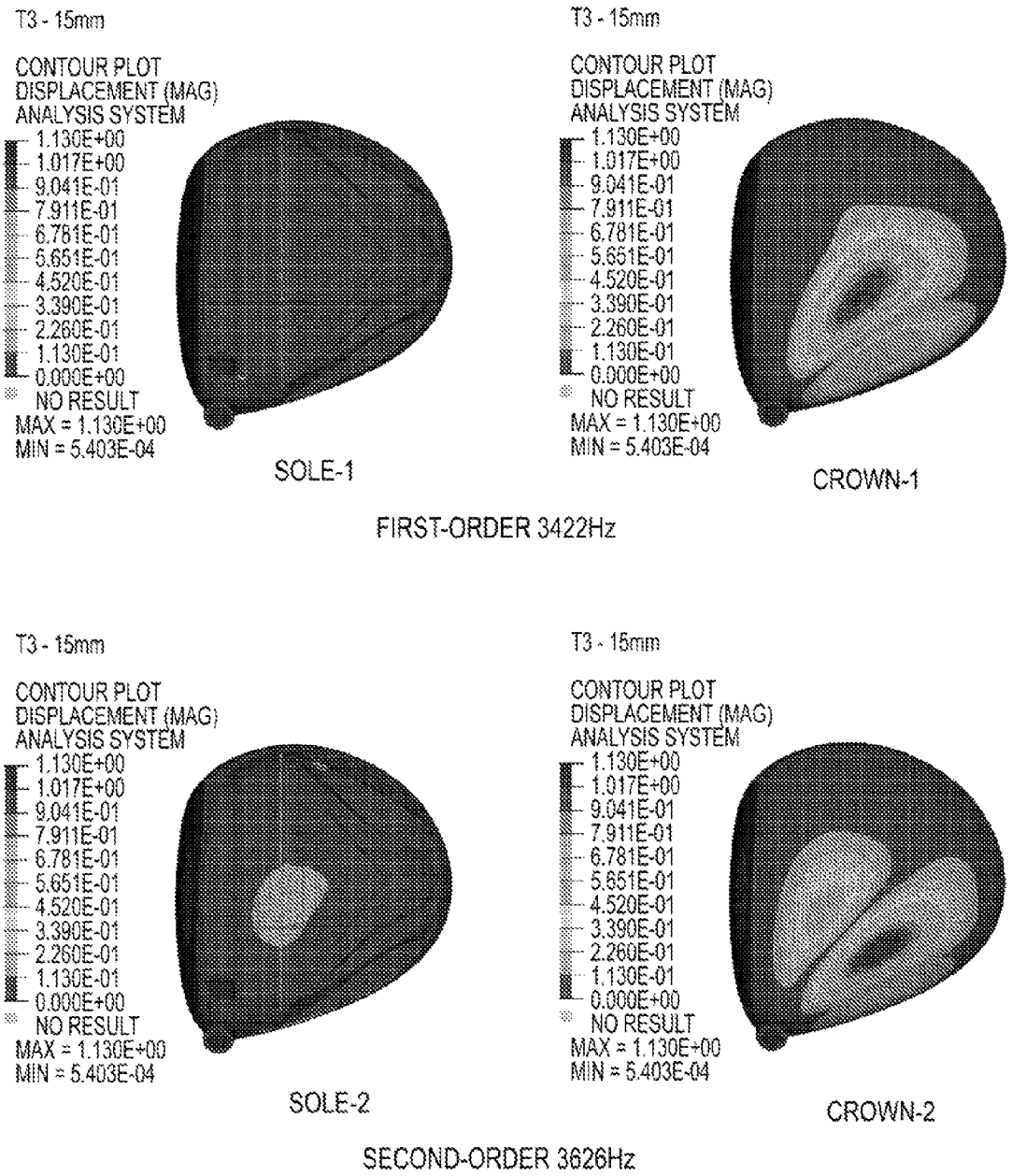
FIG. 21 is a simulation image of a head T3—15 mm.
Figure 21B:
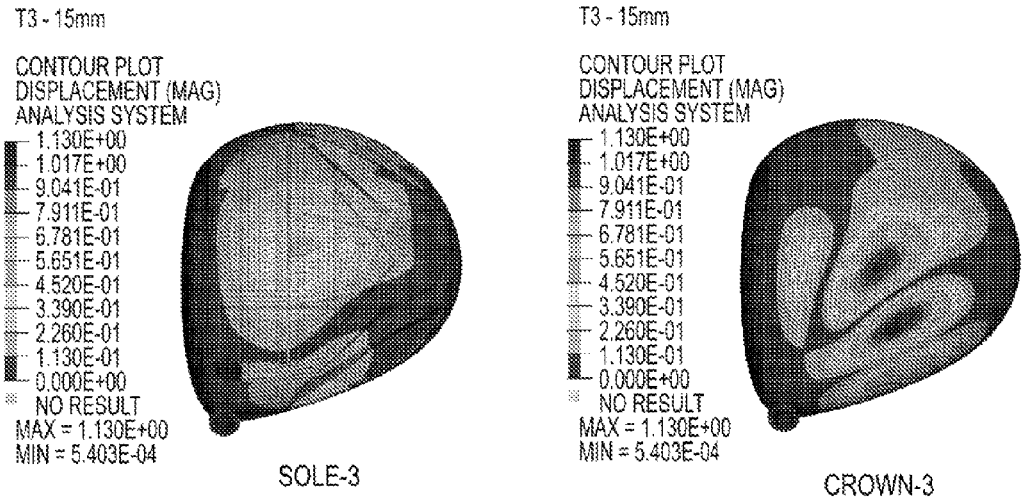
Figure 21B:
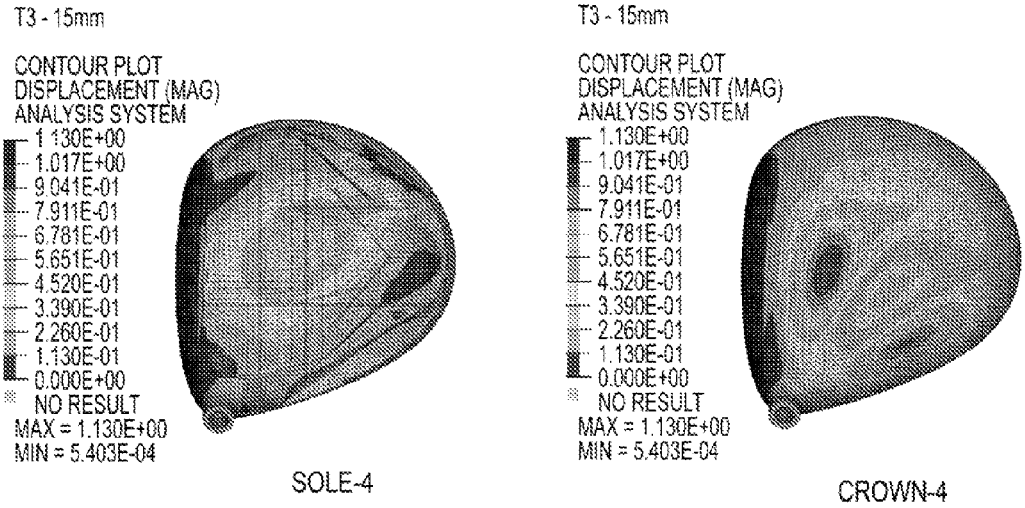

FIGS. 20 and 21 are simulation images showing the mesh-divided head T3—15 mm. FIG. 20 shows a back side portion of the head cut at the same position as that of line F2-F2 in FIG. 1. A shade of FIG. 20 shows a form of natural vibration in a first-order mode. A deeper portion has a greater amplitude.

As the position of the rib t315, the distance Wb (see FIG. 5) was set to 36 mm; the distance Vt (see FIG. 2) was set to 15 mm; and the distance Vh (see FIG. 2) was set to 15 mm.

Four kinds of simulation images are shown in FIG. 21. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 21 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 21, in the head T3—15 mm, a maximum amplitude point in the first-order mode does not exist on the sole. In the head T3—15 mm, the maximum amplitude point in the first-order mode is located on the crown. The location of the maximum amplitude point in the first-order mode on the crown contributes to the increase of a first-order natural frequency.

Natural frequency in each of the orders of the head T3—15 mm was as follows as the result of the calculation.

First-order natural frequency H1: 3422 Hz
Second-order natural frequency H2: 3626 Hz
Third-order natural frequency H3: 3871 Hz
Fourth-order natural frequency H4: 3962 Hz

[Head T3—30 mm]

A calculation model of a head T3—30 mm was obtained in the same manner as in the head T1 except that a rib t330 to be described later was provided on the sole as the rib (X). Natural value analysis was conducted using commercially available natural value analyzing software to calculate a natural frequency and a mode shape.

Figure 22:
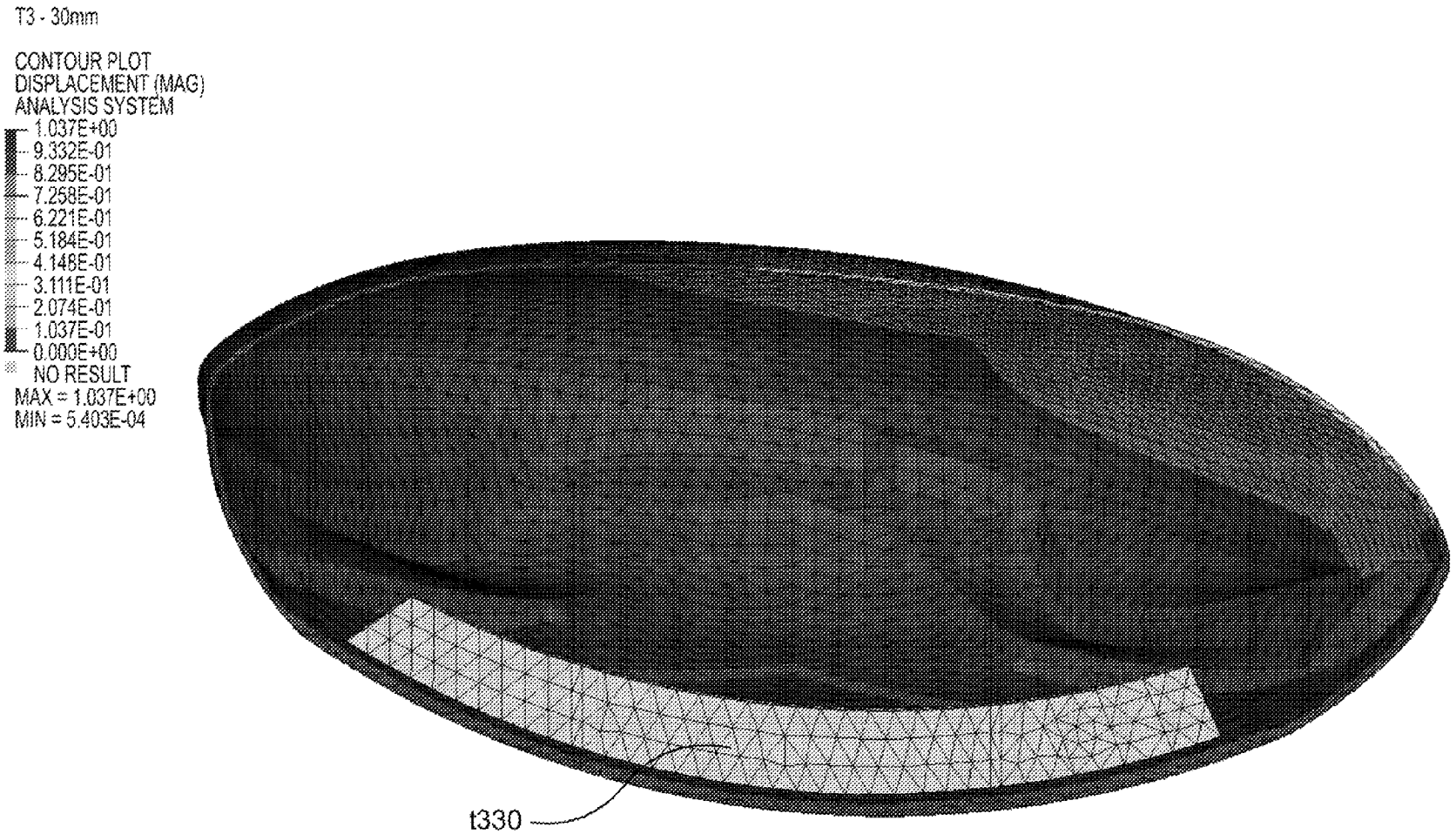
FIG. 22 is a simulation image of a head T3—30 mm.
Figure 23A:
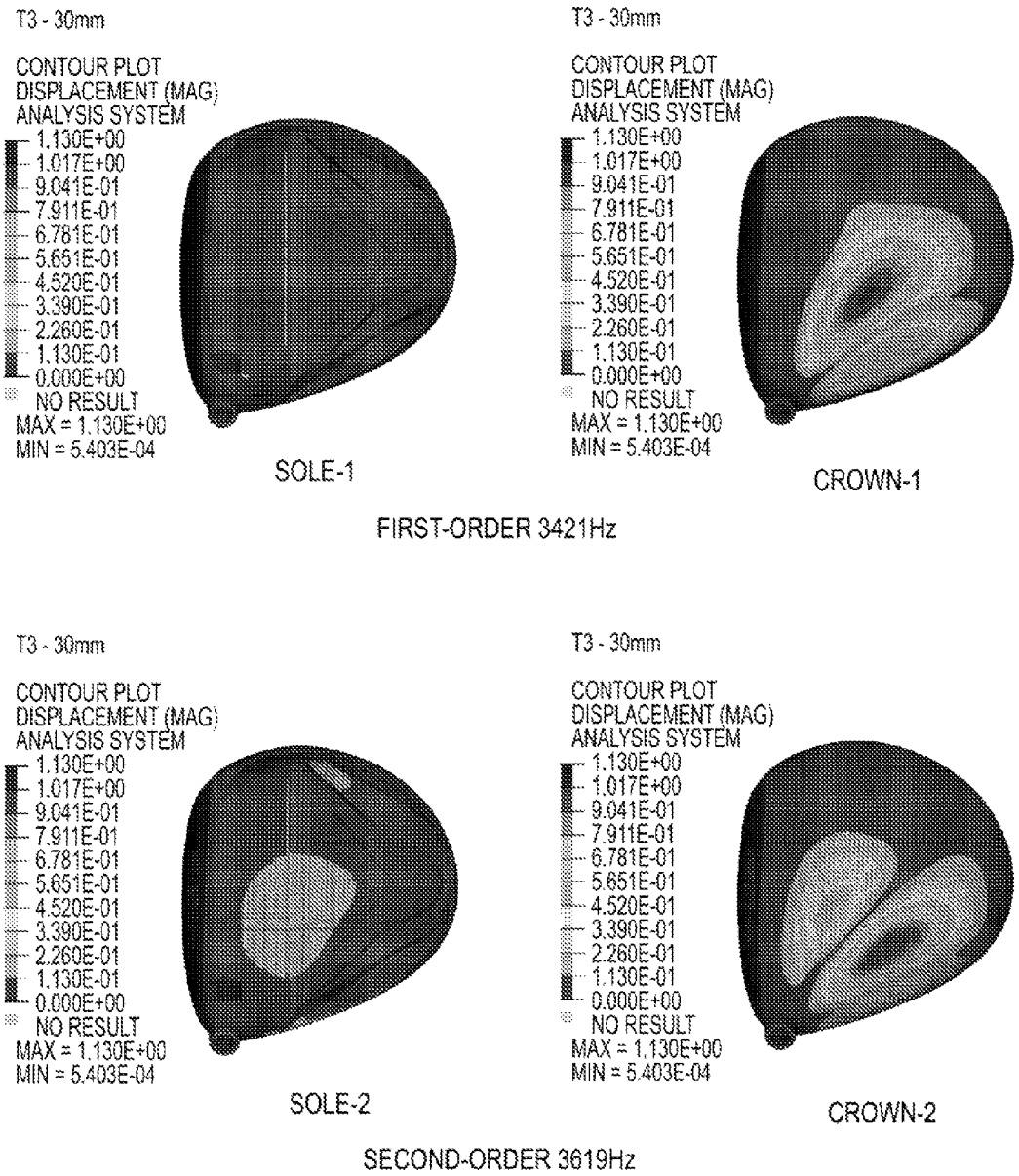
FIG. 23 is a simulation image of a head T3—30 mm.
Figure 23B:
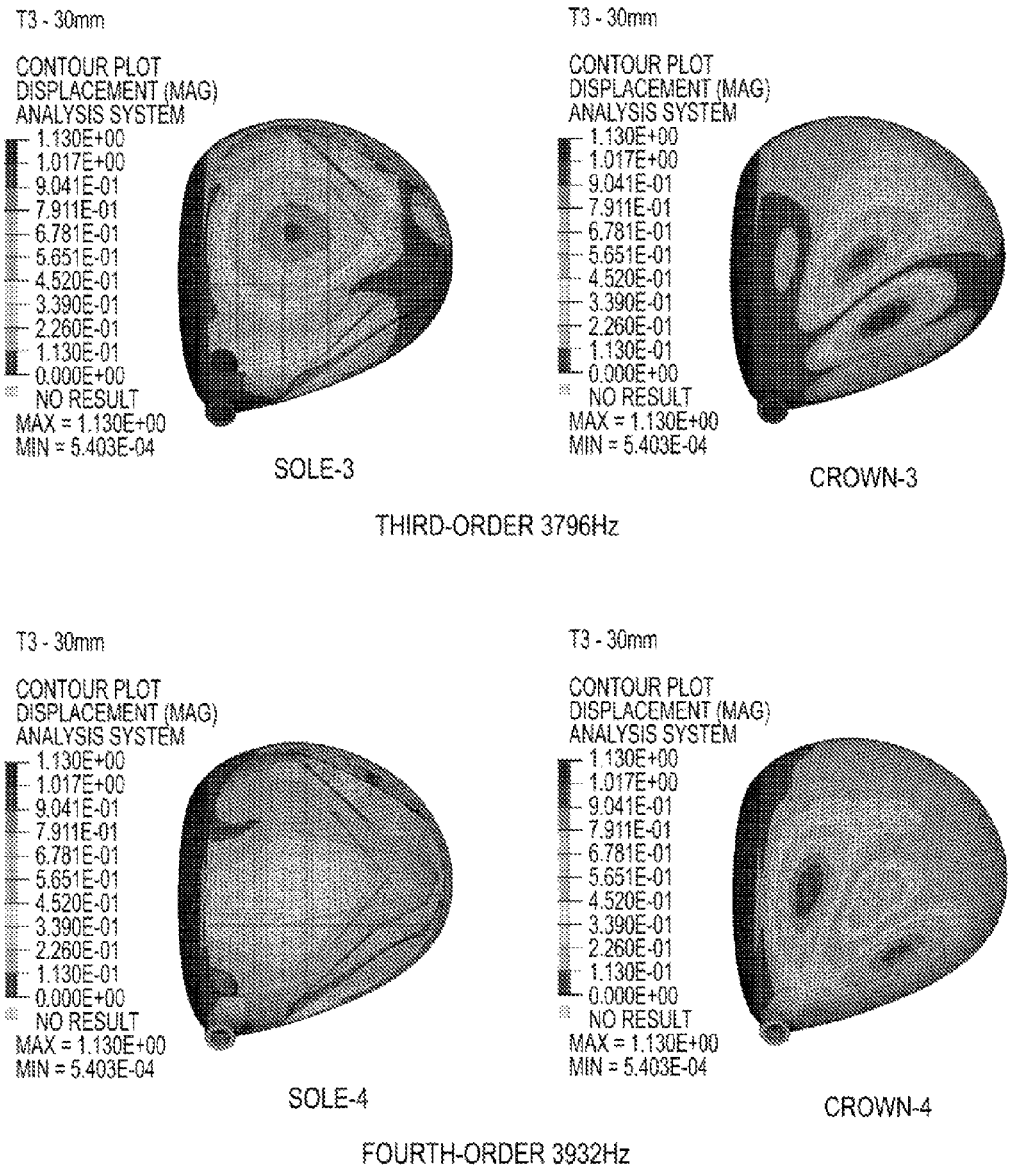

FIGS. 22 and 23 are simulation images showing the mesh-divided head T3—30 mm. FIG. 22 shows a back side portion of the head cut at the same position as that of line F2-F2 in FIG. 1. A shade of FIG. 22 shows a form of natural vibration in a first-order mode. A deeper portion has a greater amplitude.

As the position of the rib t330, the distance Wb (see FIG. 5) was set to 36 mm; the distance Vt (see FIG. 2) was set to 30 mm; and the distance Vh (see FIG. 2) was set to 30 mm.

Four kinds of simulation images are shown in FIG. 23. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 23 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 23, in the head T3—30 mm, a maximum amplitude point in the first-order mode does not exist on the sole. In the head T3—30 mm, the maximum amplitude point in the first-order mode is located on the crown. The location of the maximum amplitude point in the first-order mode on the crown contributes to the increase of a first-order natural frequency.

Natural frequency in each of the orders of the head T3—30 mm was as follows as the result of the calculation.

First-order natural frequency H1: 3421 Hz
Second-order natural frequency H2: 3619 Hz
Third-order natural frequency H3: 3796 Hz
Fourth-order natural frequency H4: 3932 Hz

[Head T3—35 mm]

A calculation model of a head T3—35 mm was obtained in the same manner as in the head T1 except that a rib t335 to be described later was provided on the sole as the rib (X). Natural value analysis was conducted using commercially available natural value analyzing software to calculate a natural frequency and a mode shape.

Figure 24:
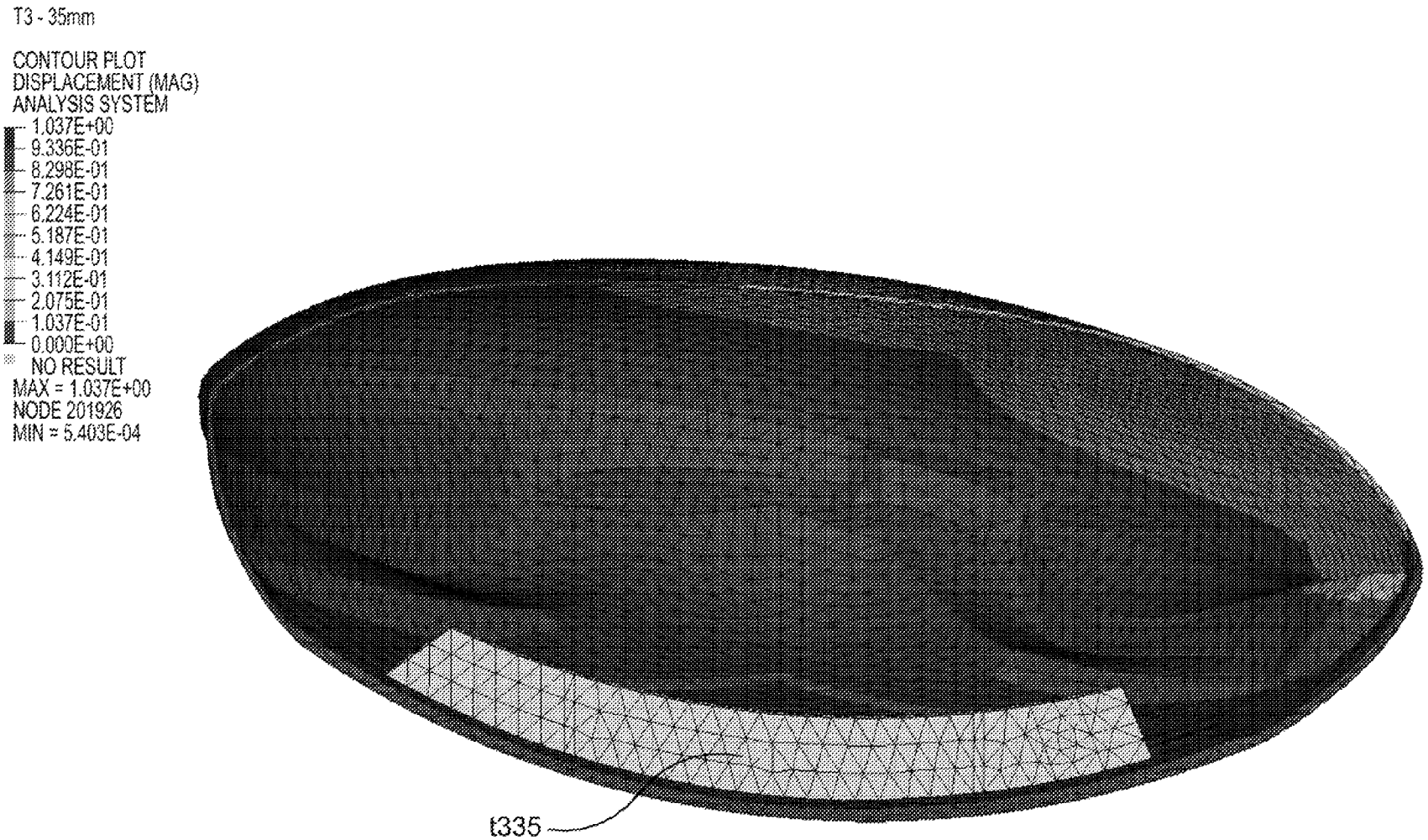
FIG. 24 is a simulation image of a head T3—35 mm.
Figure 25A:
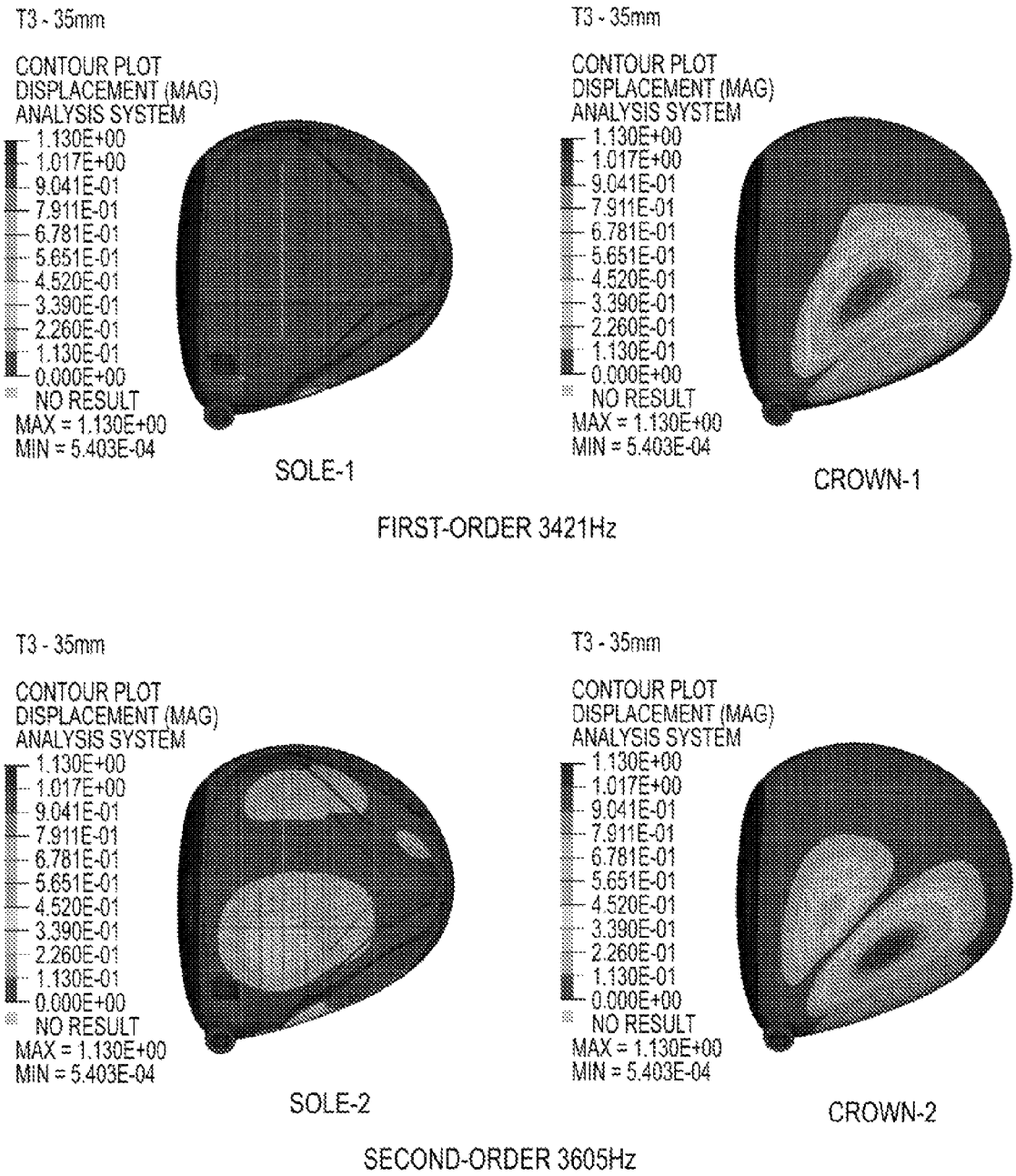
FIG. 25 is a simulation image of a head T3—35 mm.
Figure 25B:
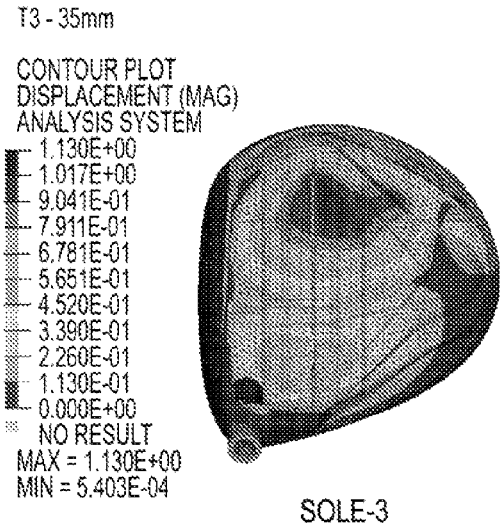
Figure 25B:
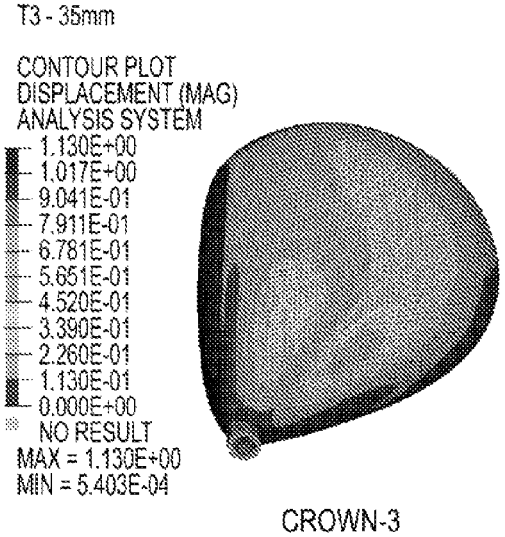
Figure 25B:
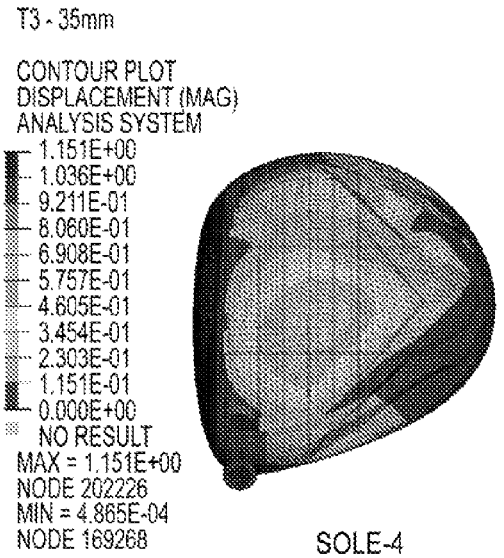
Figure 25B:
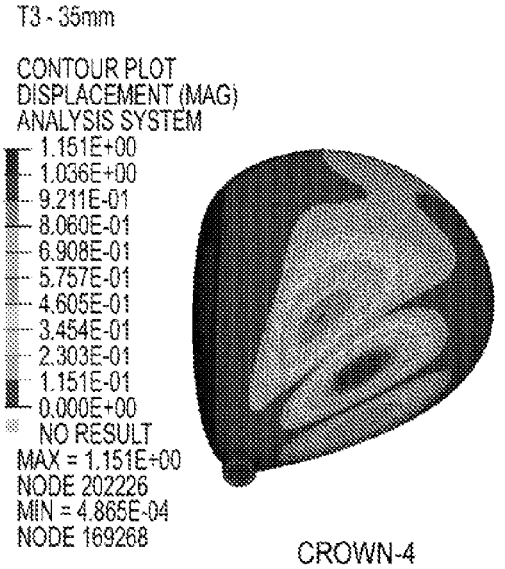

FIGS. 24 and 25 are simulation images showing the mesh-divided head T3—35 mm. FIG. 24 shows a back side portion of the head cut at the same position as that of line F2-F2 in FIG. 1. A shade of FIG. 24 shows a form of natural vibration in a first-order mode. A deeper portion has a greater amplitude.

As the position of the rib t335, the distance Wb (see FIG. 5) was set to 36 mm; the distance Vt (see FIG. 2) was set to 35 mm; and the distance Vh (see FIG. 2) was set to 35 mm.

Four kinds of simulation images are shown in FIG. 25. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 25 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 25, in the head T3—35 mm, a maximum amplitude point in the first-order mode does not exist on the sole. In the head T3—35 mm, the maximum amplitude point in the first-order mode is located on the crown. The location of the maximum amplitude point in the first-order mode on the crown contributes to the increase of a first-order natural frequency.

Natural frequency in each of the orders of the head T3—35 mm was as follows as the result of the calculation.

First-order natural frequency H1: 3421 Hz
Second-order natural frequency H2: 3605 Hz
Third-order natural frequency H3: 3711 Hz
Fourth-order natural frequency H4: 3823 Hz

[Head T3—40 mm]

A calculation model of a head T3—40 mm was obtained in the same manner as in the head T1 except that a rib t340 to be described later was provided on the sole as the rib (X). Natural value analysis was conducted using commercially available natural value analyzing software to calculate a natural frequency and a mode shape.

Figure 26:
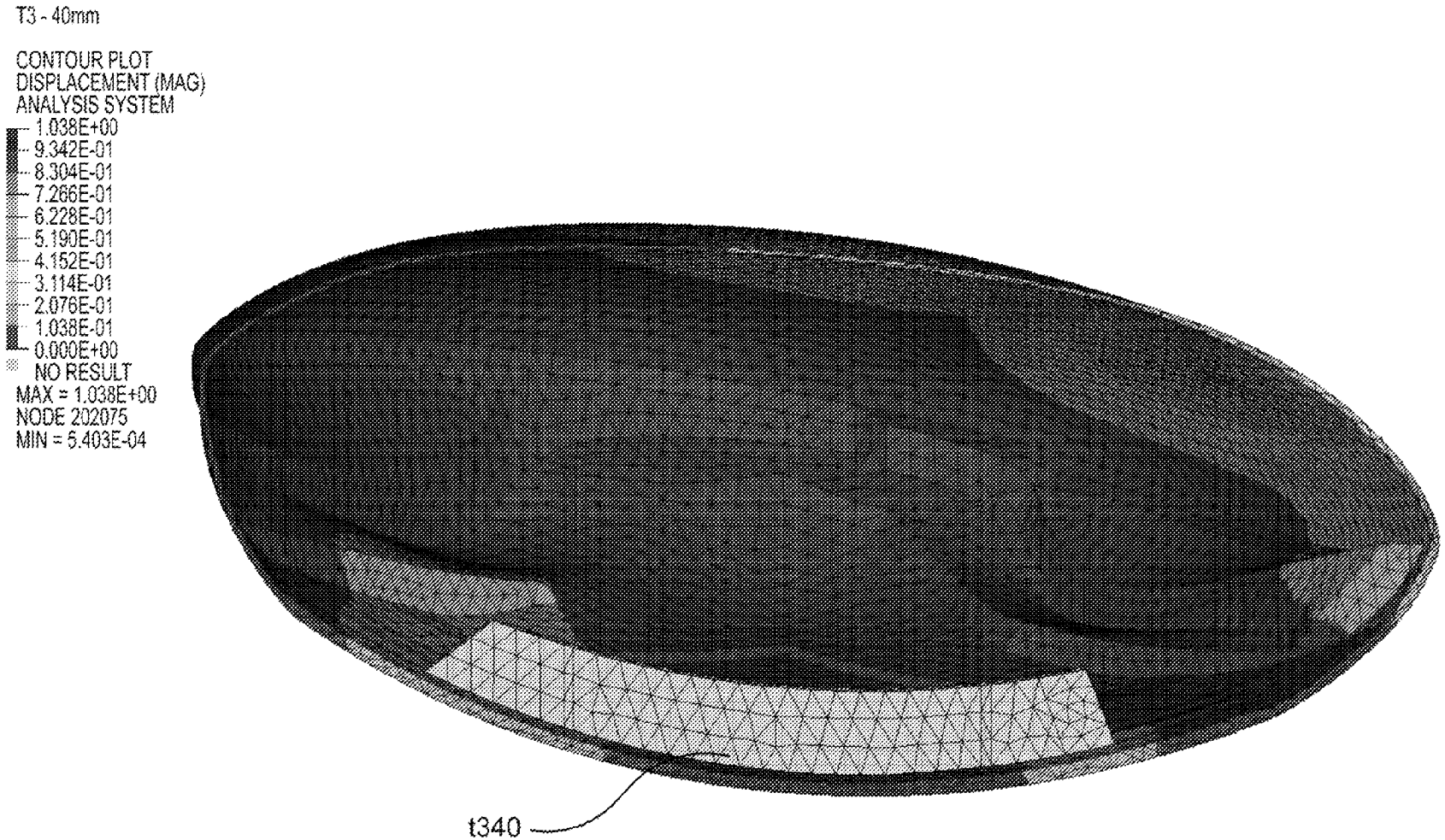
FIG. 26 is a simulation image of a head T3—40 mm.
Figure 27A:
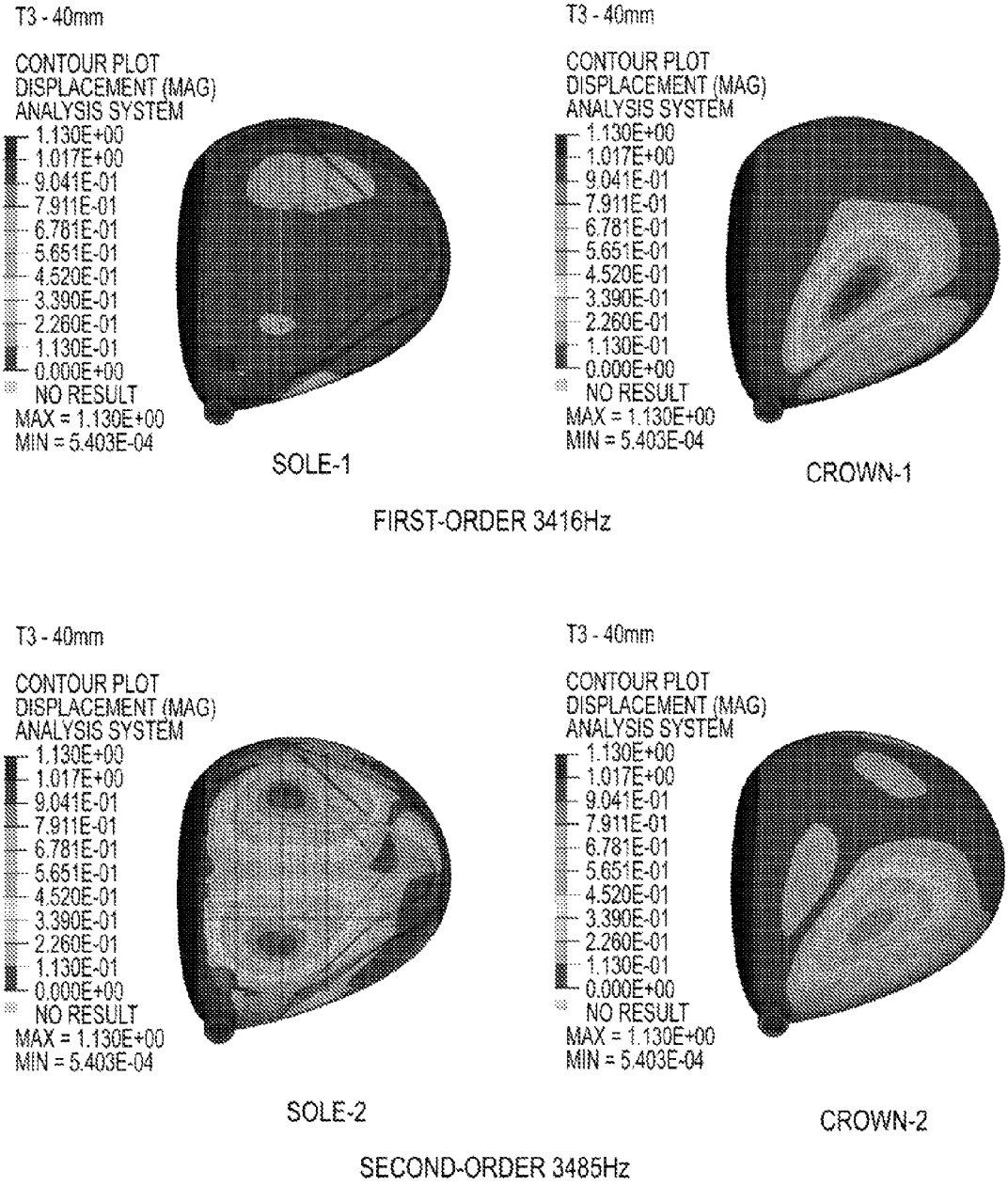
FIG. 27 is a simulation image of a head T3—40 mm.
Figure 27B:
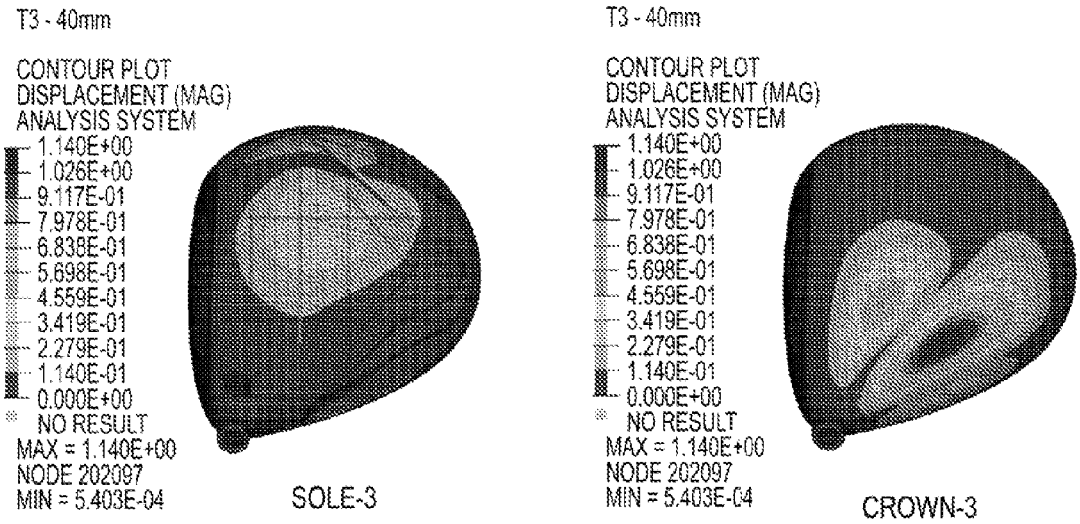
Figure 27B:
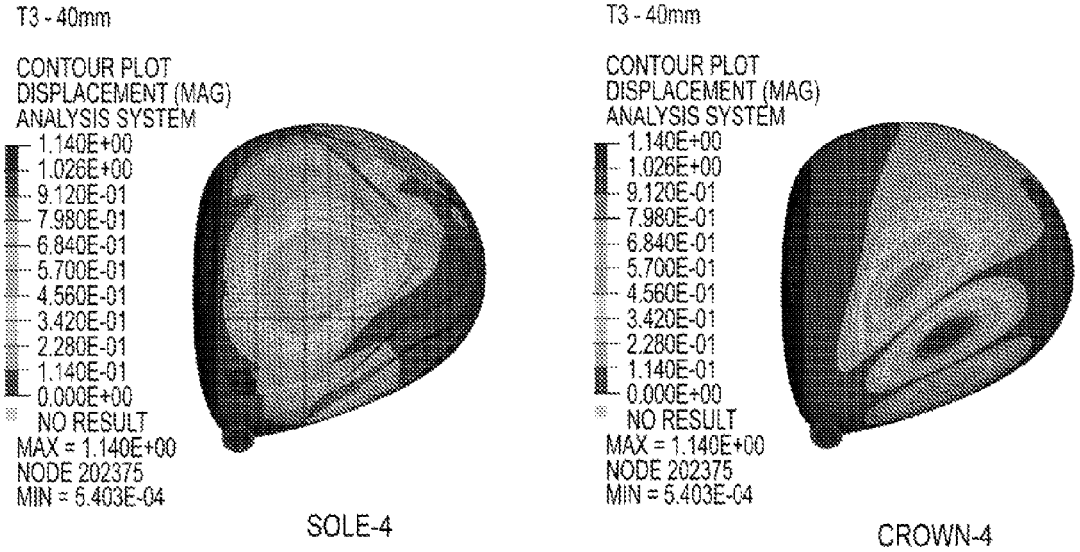

FIGS. 26 and 27 are simulation images showing the mesh-divided head T3—40 mm. FIG. 26 shows a back side portion of the head cut at the same position as that of line F2-F2 in FIG. 1. A shade of FIG. 26 shows a form of natural vibration in a first-order mode. A deeper portion has a greater amplitude.

As the position of the rib t340, the distance Wb (see FIG. 5) was set to 36 mm; the distance Vt (see FIG. 2) was set to 40 mm; and the distance Vh (see FIG. 2) was set to 40 mm.

Four kinds of simulation images are shown in FIG. 27. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 27 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 27, in the head T3—40 mm, a maximum amplitude point in the first-order mode does not exist on the sole. In the head T3—40 mm, the maximum amplitude point in the first-order mode is located on the crown. The location of the maximum amplitude point in the first-order mode on the crown contributes to the increase of a first-order natural frequency.

Natural frequency in each of the orders of the head T3—40 mm was as follows as the result of the calculation.

First-order natural frequency H1: 3416 Hz
Second-order natural frequency H2: 3485 Hz
Third-order natural frequency H3: 3630 Hz
Fourth-order natural frequency H4: 3788 Hz

[Head T3—45 mm]

A calculation model of a head T3—45 mm was obtained in the same manner as in the head T1 except that a rib t345 to be described later was provided on the sole as the rib (X). Natural value analysis was conducted using commercially available natural value analyzing software to calculate a natural frequency and a mode shape.

Figure 28:
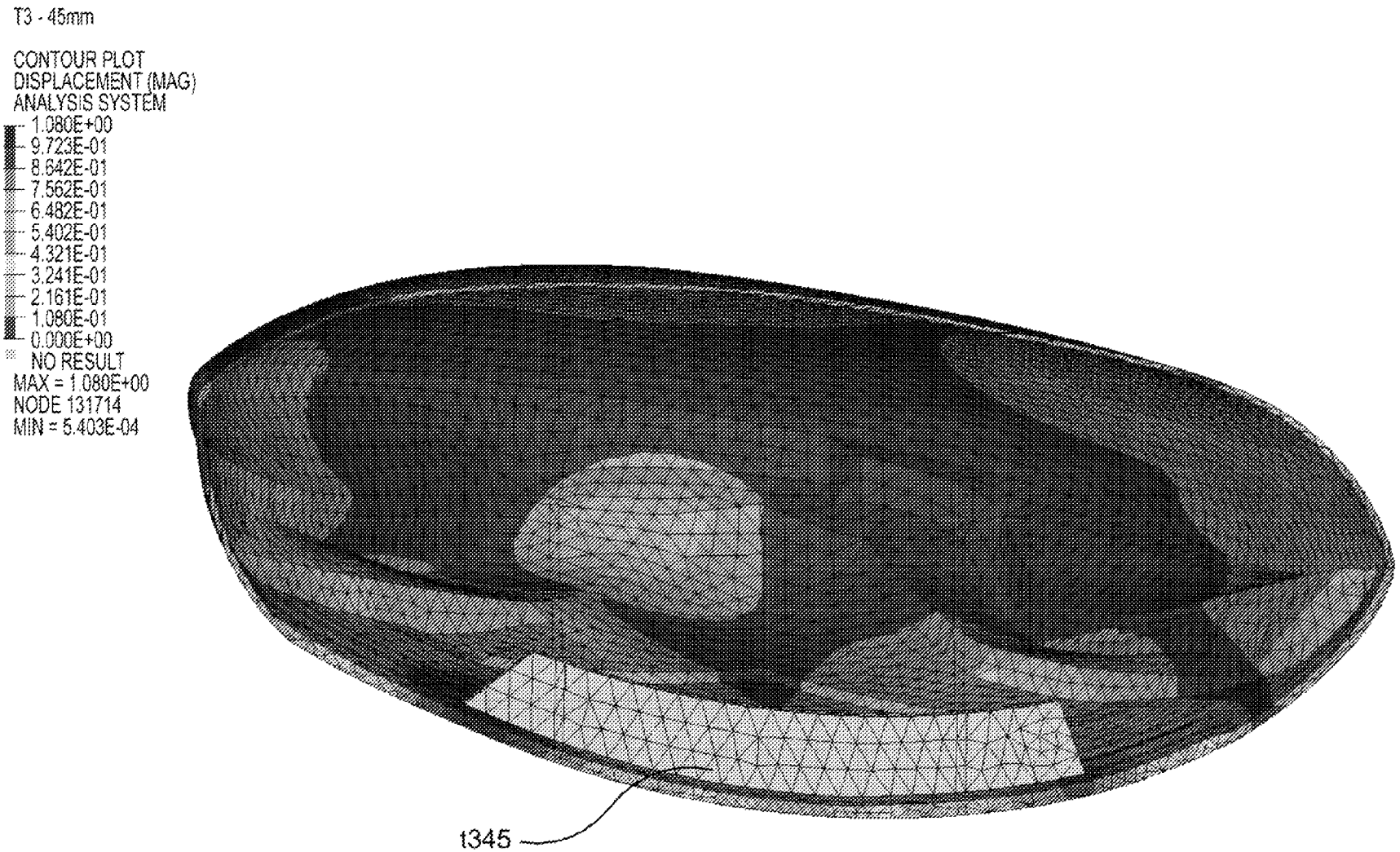
FIG. 28 is a simulation image of a head T3—45 mm.
Figure 29A:
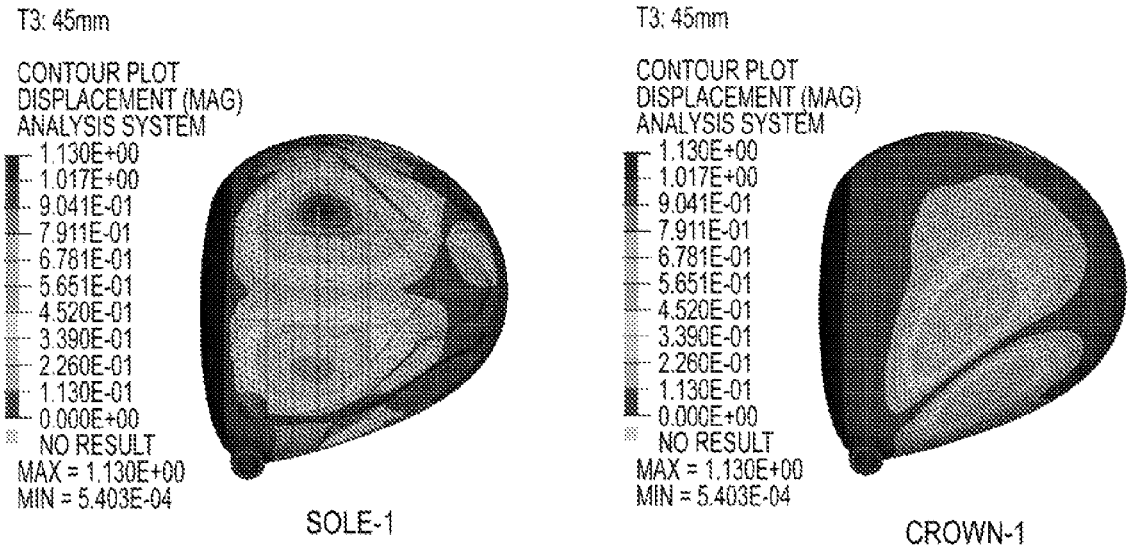
FIG. 29 is a simulation image of a head T3—45 mm.
Figure 29A:
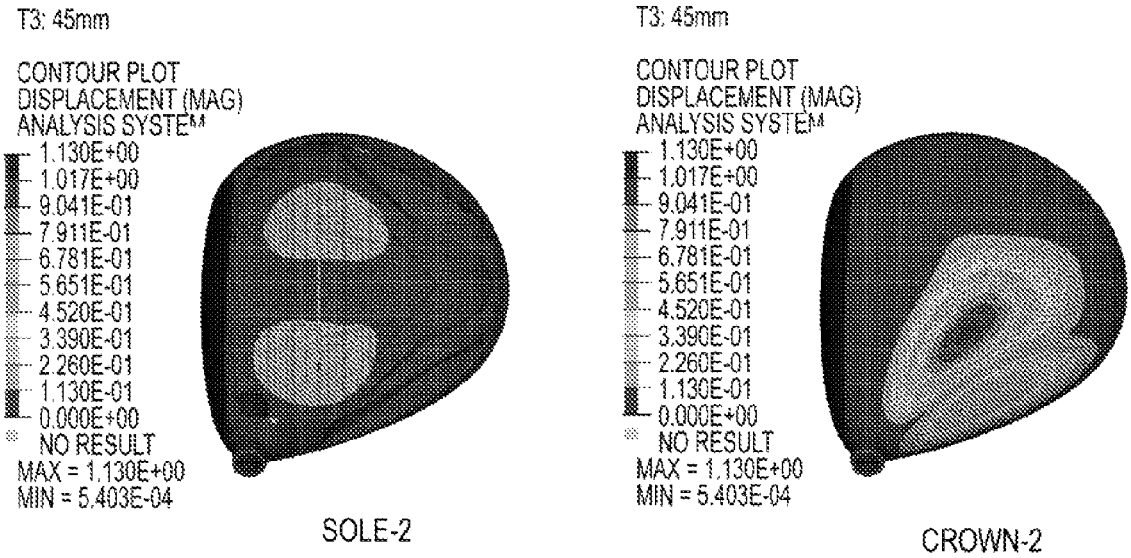
Figure 29B:
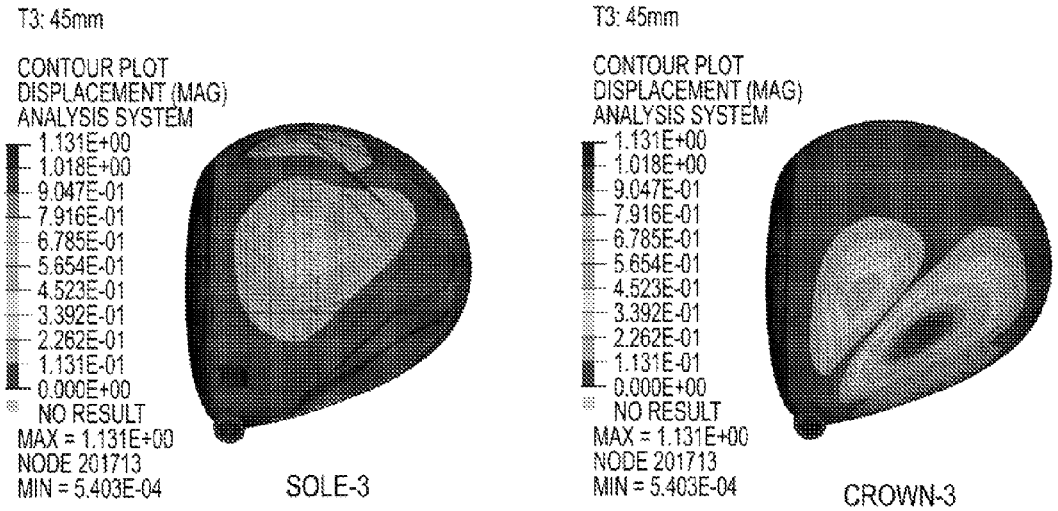
Figure 29B:
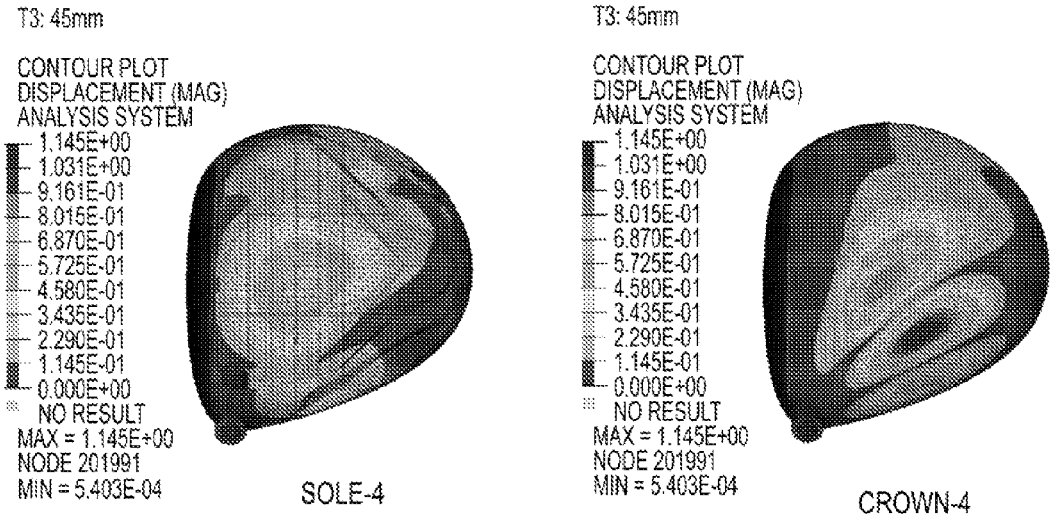

FIGS. 28 and 29 are simulation images showing the mesh-divided head T3—45 mm. FIG. 28 shows a back side portion of the head cut at the same position as that of line F2-F2 in FIG. 1. A shade of FIG. 28 shows a form of natural vibration in a first-order mode. A deeper portion has a greater amplitude.

As the position of the rib t345, the distance Wb (see FIG. 5) was set to 36 mm; the distance Vt (see FIG. 2) was set to 45 mm; and the distance Vh (see FIG. 2) was set to 45 mm.

Four kinds of simulation images are shown in FIG. 29. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 29 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 29, in the head T3—45 mm, a maximum amplitude point in the first-order mode is located on the sole. In the head T3—45 mm, a rib t345 does not cross both two existing high Rh regions (see FIG. 7).

Natural frequency in each of the orders of the head T3—45 mm was as follows as the result of the calculation.

First-order natural frequency H1: 3387 Hz
Second-order natural frequency H2: 3427 Hz
Third-order natural frequency H3: 3618 Hz
Fourth-order natural frequency H4: 3782 Hz The first-order natural frequency H1 of the head T3—45 mm is lower than that of the head T3—40 mm described above. In the rib t340 described above, the maximum amplitude point in the first-order mode is moved to the crown from the sole. On the other hand, in the rib t345, the maximum amplitude point in the first-order mode cannot be moved to the crown from the sole. A remarkable difference exists between the head T3—40 mm and the head T3—45 mm.

[Head T3—50 mm]

A calculation model of a head T3—50 mm was obtained in the same manner as in the head T1 except that a rib t350 to be described later was provided on the sole as the rib (X). Natural value analysis was conducted using commercially available natural value analyzing software to calculate a natural frequency and a mode shape.

Figure 30:
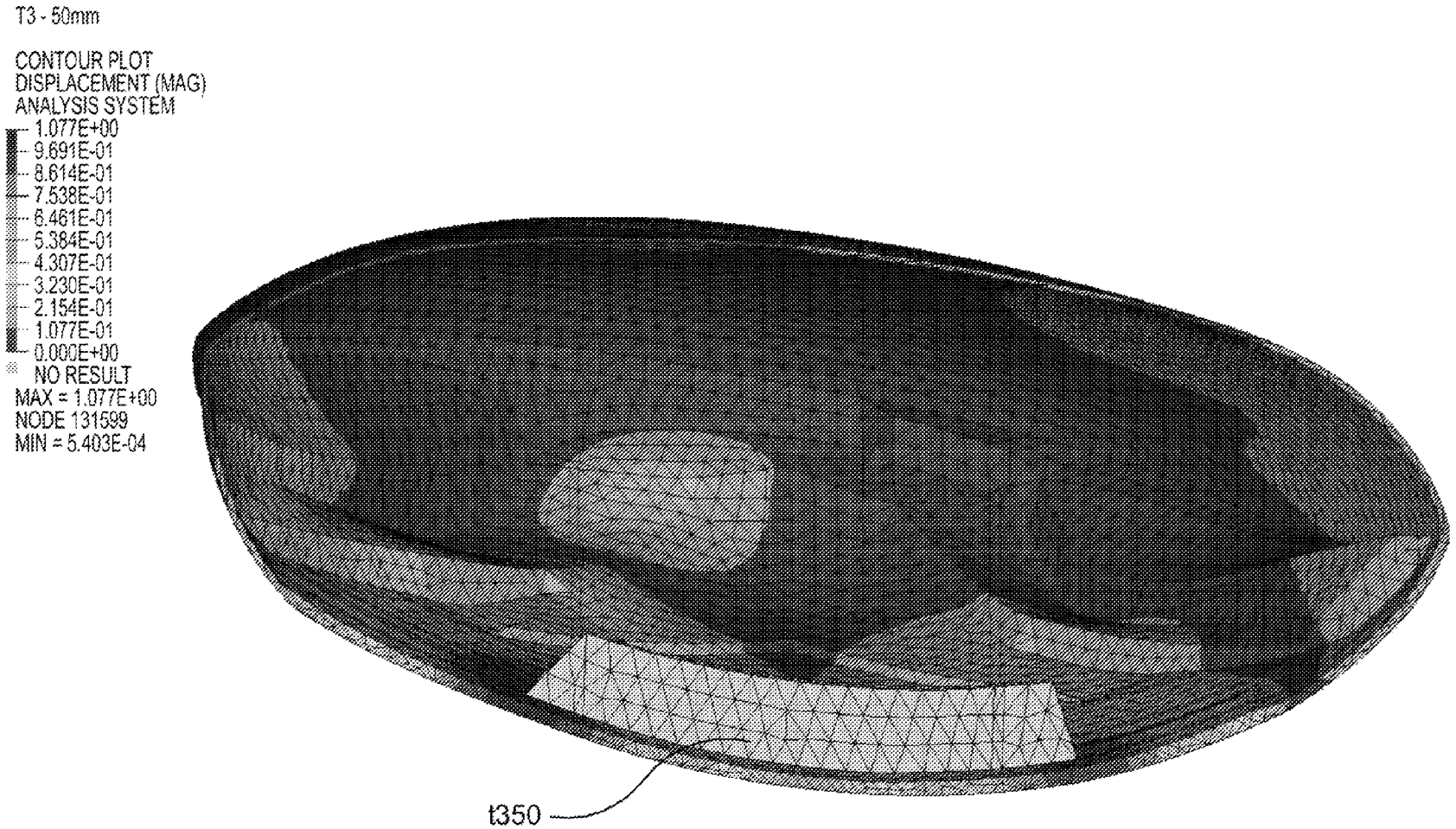
FIG. 30 is a simulation image of a head T3—50 mm.
Figure 31A:
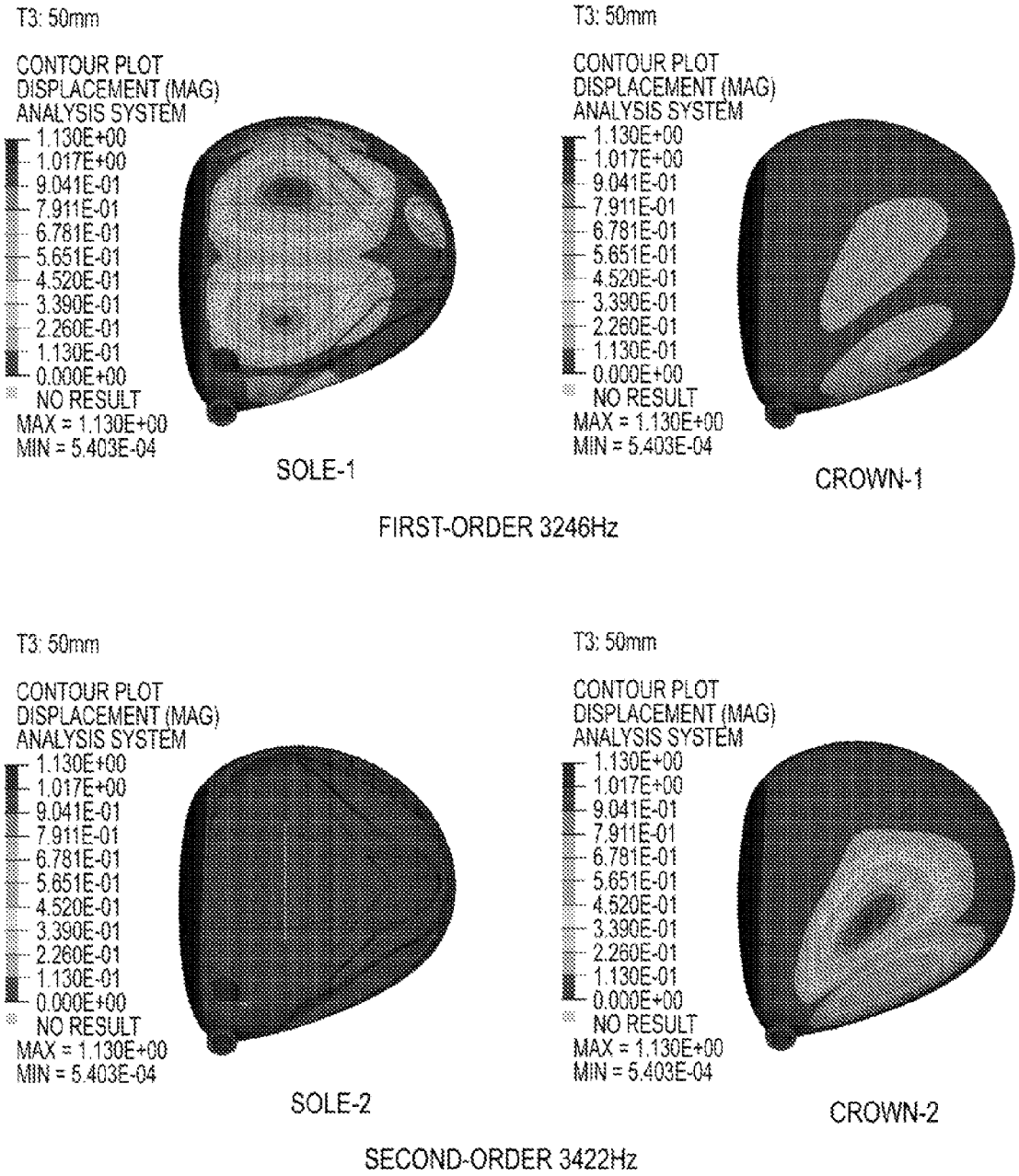
FIG. 31 is a simulation image of a head T3—50 mm.
Figure 31B:
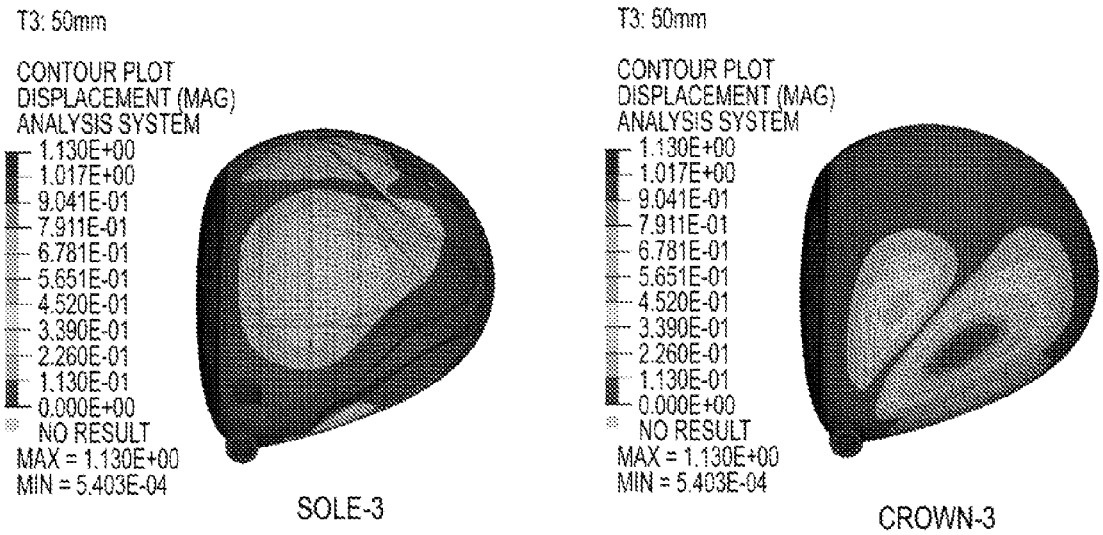
Figure 31B:
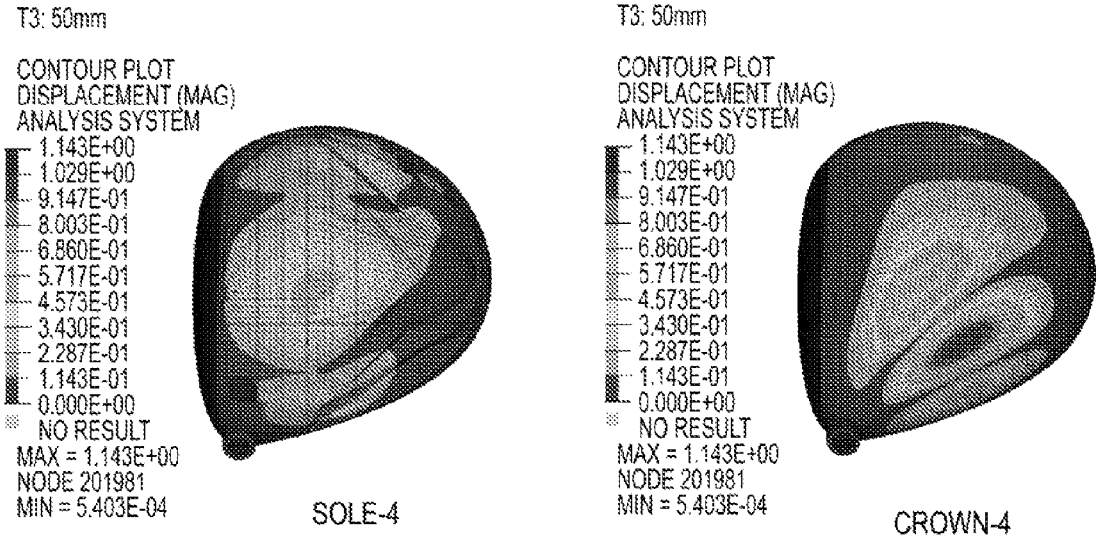

FIGS. 30 and 31 are simulation images showing the mesh-divided head T3—50 mm. FIG. 30 shows a back side portion of the head cut at the same position as that of line F2-F2 in FIG. 1. A shade of FIG. 30 shows a form of natural vibration in a first-order mode. A deeper portion has a greater amplitude.

As the position of the rib t350, the distance Wb (see FIG. 5) was set to 36 mm; the distance Vt (see FIG. 2) was set to 50 mm; and the distance Vh (see FIG. 2) was set to 50 mm.

Four kinds of simulation images are shown in FIG. 31. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 31 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 31, in the head T3—50 mm, a maximum amplitude point in the first-order mode is located on the sole. In the head T3—50 mm, a rib t350 does not cross both two existing high Rh regions (see FIG. 7).

Natural frequency in each of the orders of the head T3—50 mm was as follows as the result of the calculation.

First-order natural frequency H1: 3246 Hz
Second-order natural frequency H2: 3422 Hz
Third-order natural frequency H3: 3605 Hz
Fourth-order natural frequency H4: 3733 Hz

[Head T3—55 mm]

A calculation model of a head T3—55 mm was obtained in the same manner as in the head T1 except that a rib t355 to be described later was provided on the sole as the rib (X). Natural value analysis was conducted using commercially available natural value analyzing software to calculate a natural frequency and a mode shape.

Figure 32:
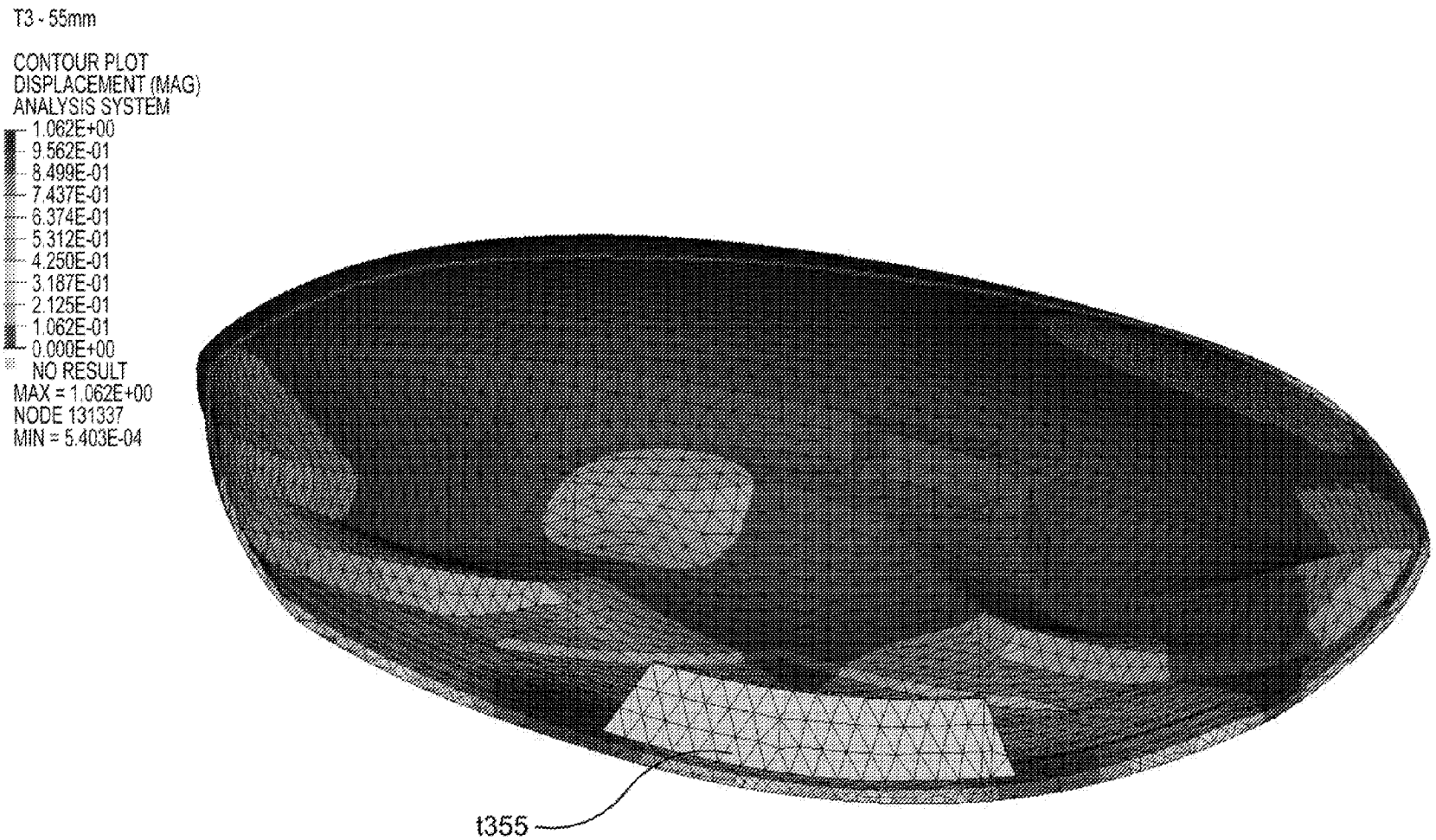
FIG. 32 is a simulation image of a head T3—55 mm.
Figure 33A:
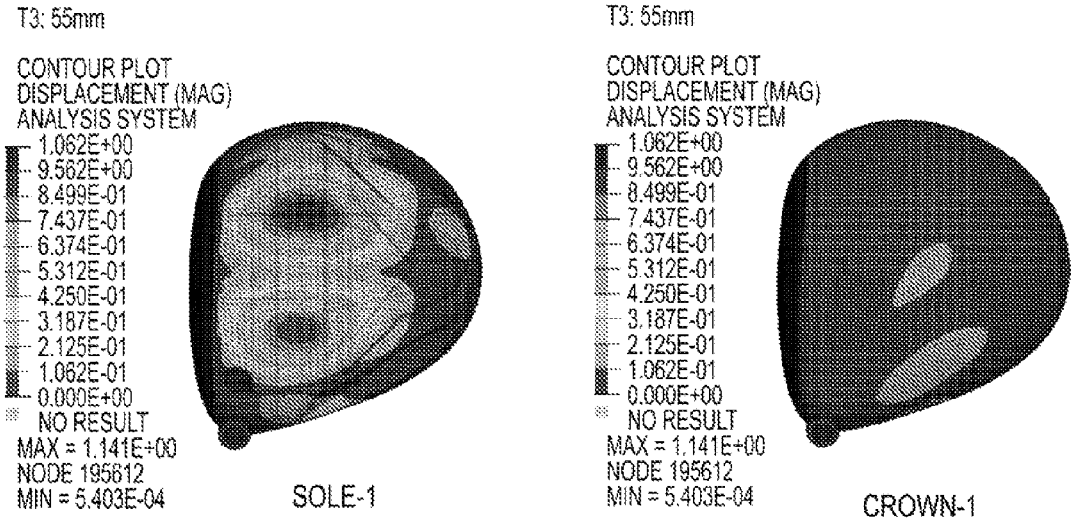
FIG. 33 is a simulation image of a head T3—55 mm.
Figure 33A:
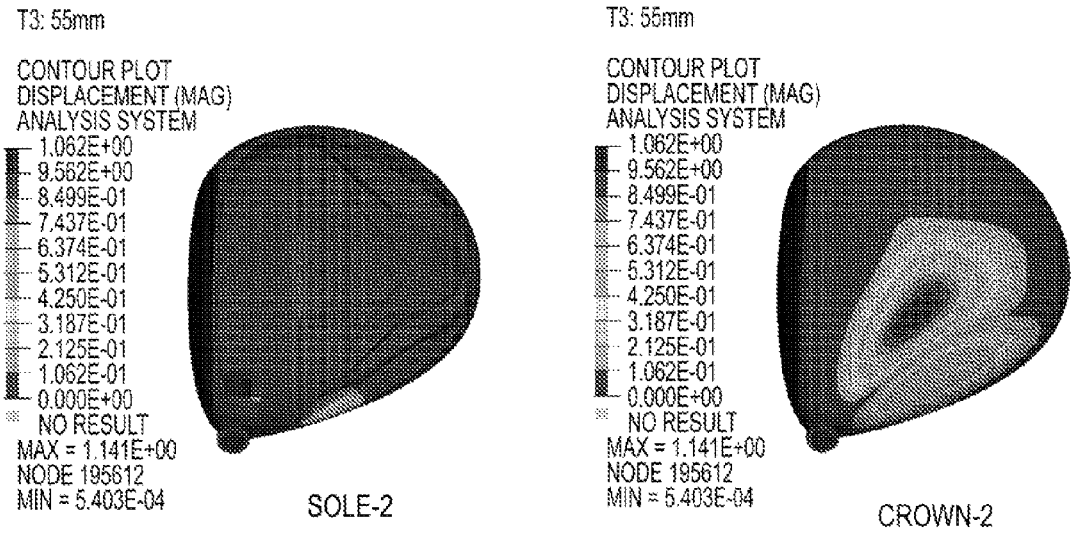
Figure 33B:
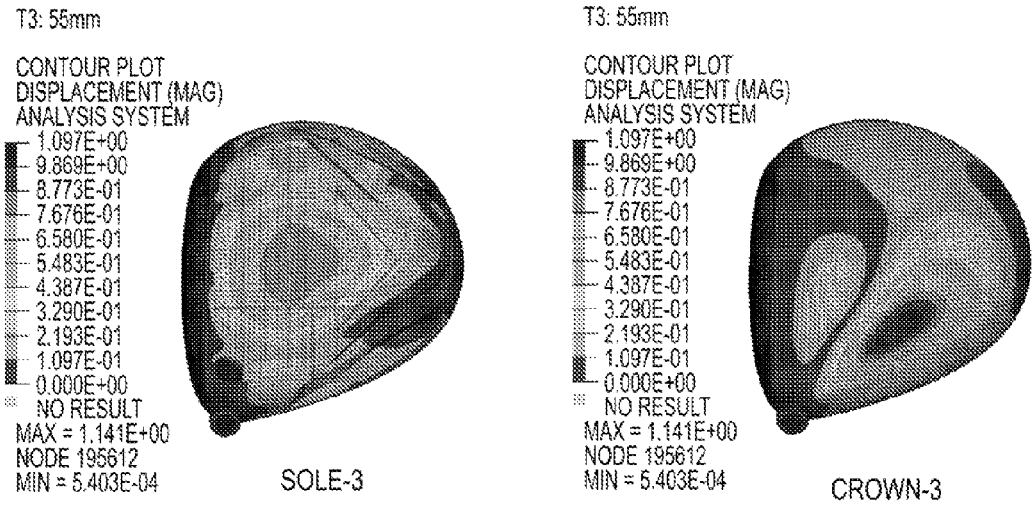
Figure 33B:
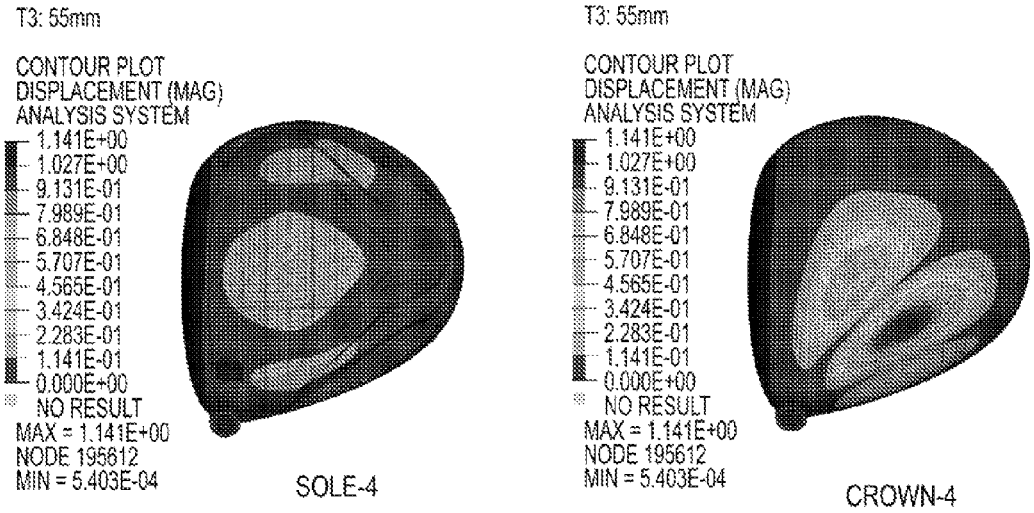

FIGS. 32 and 33 are simulation images showing the mesh-divided head T3—55 mm. FIG. 32 shows a back side portion of the head cut at the same position as that of line F2-F2 in FIG. 1. A shade of FIG. 32 shows a form of natural vibration in a first-order mode. A deeper portion has a greater amplitude.

As the position of the rib t355, the distance Wb (see FIG. 5) was set to 36 mm; the distance Vt (see FIG. 2) was set to 55 mm; and the distance Vh (see FIG. 2) was set to 55 mm.

Four kinds of simulation images are shown in FIG. 33. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 33 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 33, in the head T3—55 mm, a maximum amplitude point in the first-order mode is located on the sole. In the head T3—55 mm, a rib t355 does not cross both two existing high Rh regions (see FIG. 7).

Natural frequency in each of the orders of the head T3—55 mm was as follows as the result of the calculation.

First-order natural frequency H1: 3126 Hz
Second-order natural frequency H2: 3419 Hz
Third-order natural frequency H3: 3553 Hz
Fourth-order natural frequency H4: 3677 Hz

[Head 4]

[Head T4—5 mm]

A calculation model of a head T4—5 mm was obtained in the same manner as in the head T1 except that a rib t45 to be described later was provided on the sole as the rib (X). Natural value analysis was conducted using commercially available natural value analyzing software to calculate a natural frequency and a mode shape.

Figure 34:
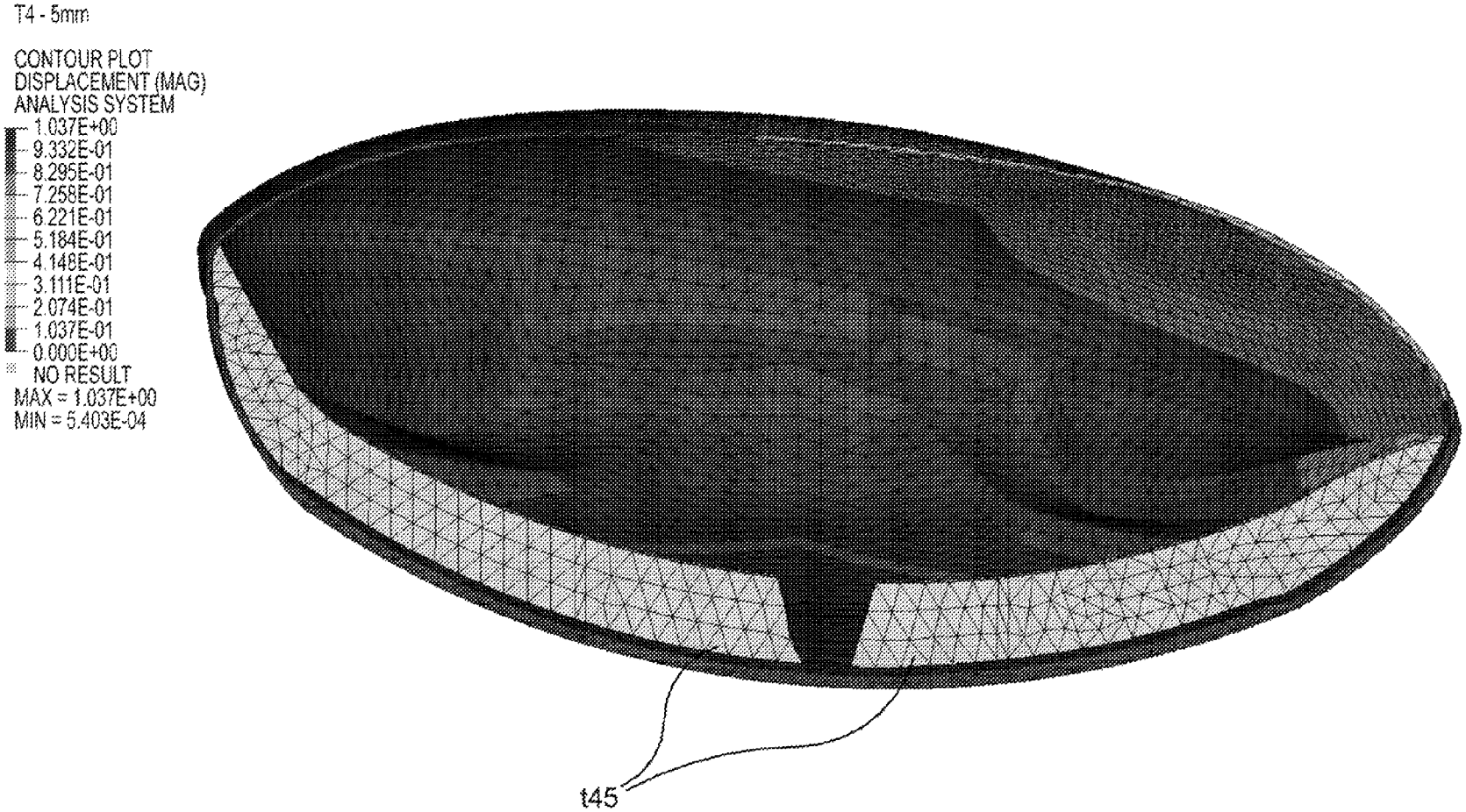
FIG. 34 is a simulation image of a head T4—5 mm.
Figure 35A:
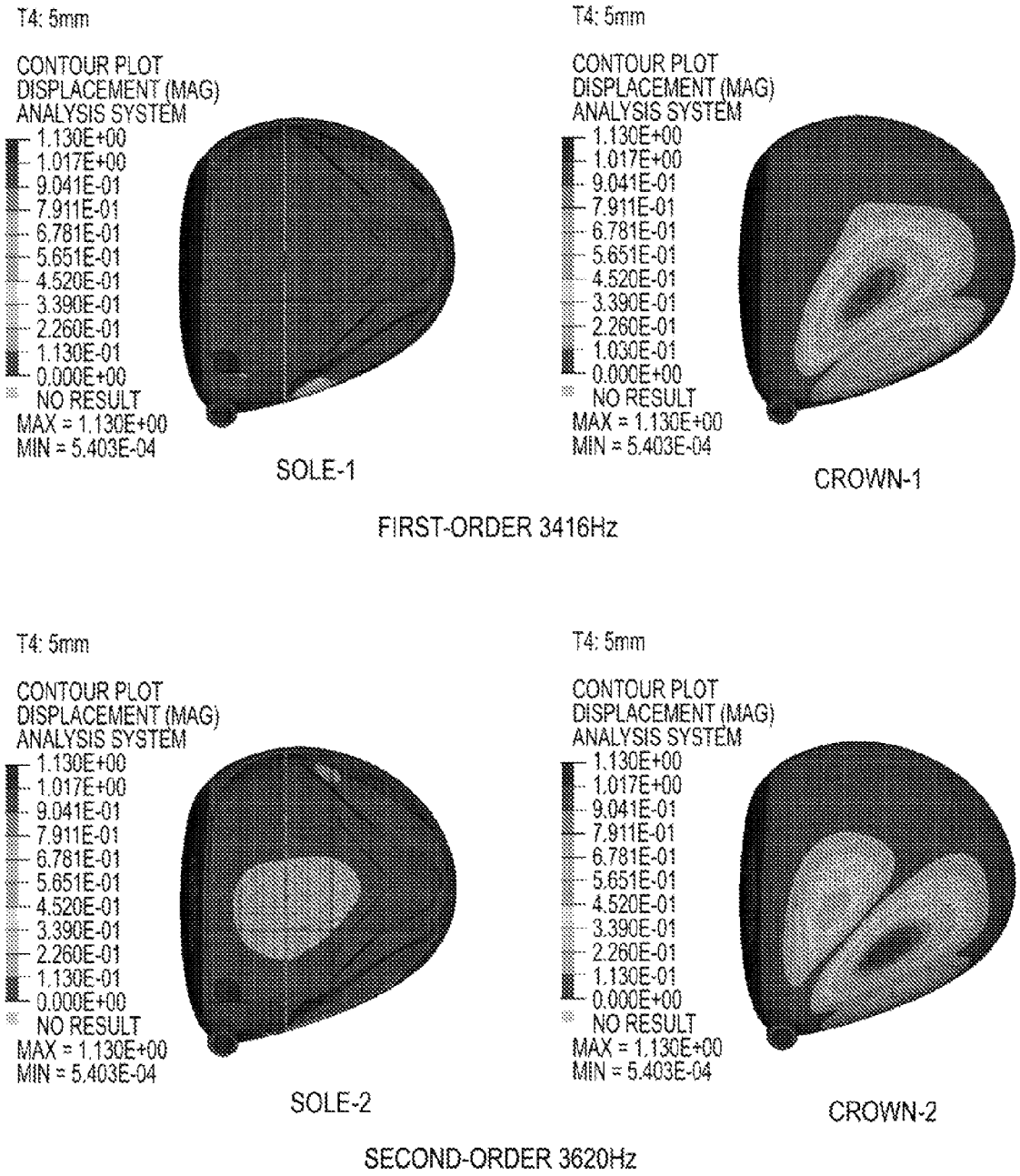
FIG. 35 is a simulation image of a head T4—5 mm.
Figure 35B:
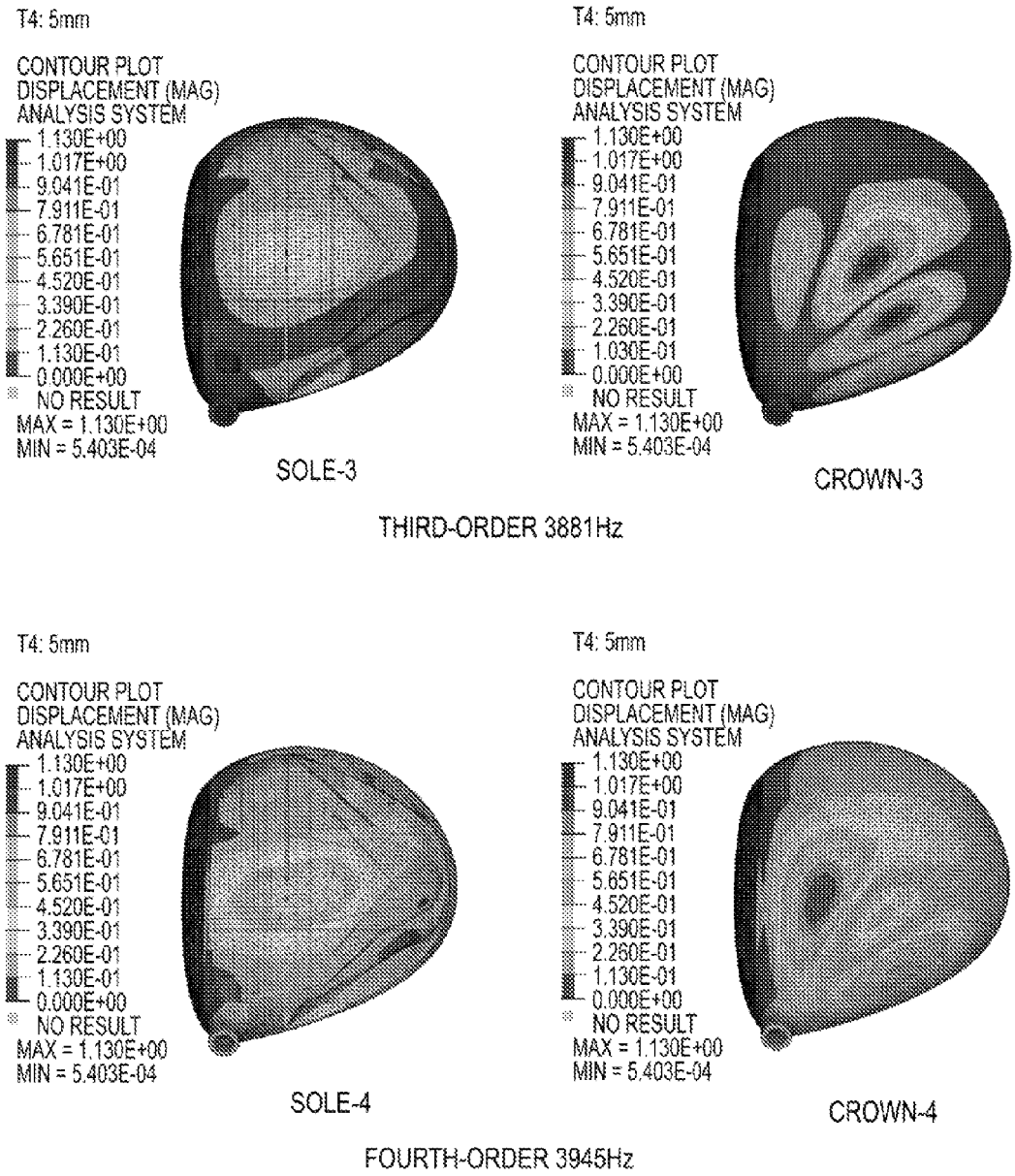

FIGS. 34 and 35 are simulation images showing the mesh-divided head T4—5 mm. FIG. 34 shows a back side portion of the head cut at the same position as that of line F2-F2 in FIG. 1. A shade of FIG. 34 shows a form of natural vibration in a first-order mode. A deeper portion has a greater amplitude.

As the position of the rib t45, the distance Wb (see FIG. 5) was set to 36 mm; the distance Vt (see FIG. 2) was set to 0 mm; and the distance Vh (see FIG. 2) was set to 0 mm.

In the head T4—5 mm, the rib t45 is not continuous but intermittent. The rib t45 is discontinued at a substantially center position in a toe-heel direction. A toe-heel direction width (may be referred to as a dividing width) of the discontinued portion (dividing part) is 5 mm.

Four kinds of simulation images are shown in FIG. 35. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 35 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 35, in the head T4—5 mm, a maximum amplitude point in the first-order mode is located on the crown.

Natural frequency in each of the orders of the head T4—5 mm was as follows as the result of the calculation.

First-order natural frequency H1: 3416 Hz
Second-order natural frequency H2: 3620 Hz
Third-order natural frequency H3: 3881 Hz
Fourth-order natural frequency H4: 3945 Hz

[Head T4—10 mm]

A calculation model of a head T4—10 mm was obtained in the same manner as in the head T1 except that a rib t410 to be described later was provided on the sole as the rib (X). Natural value analysis was conducted using commercially available natural value analyzing software to calculate a natural frequency and a mode shape.

Figure 36:
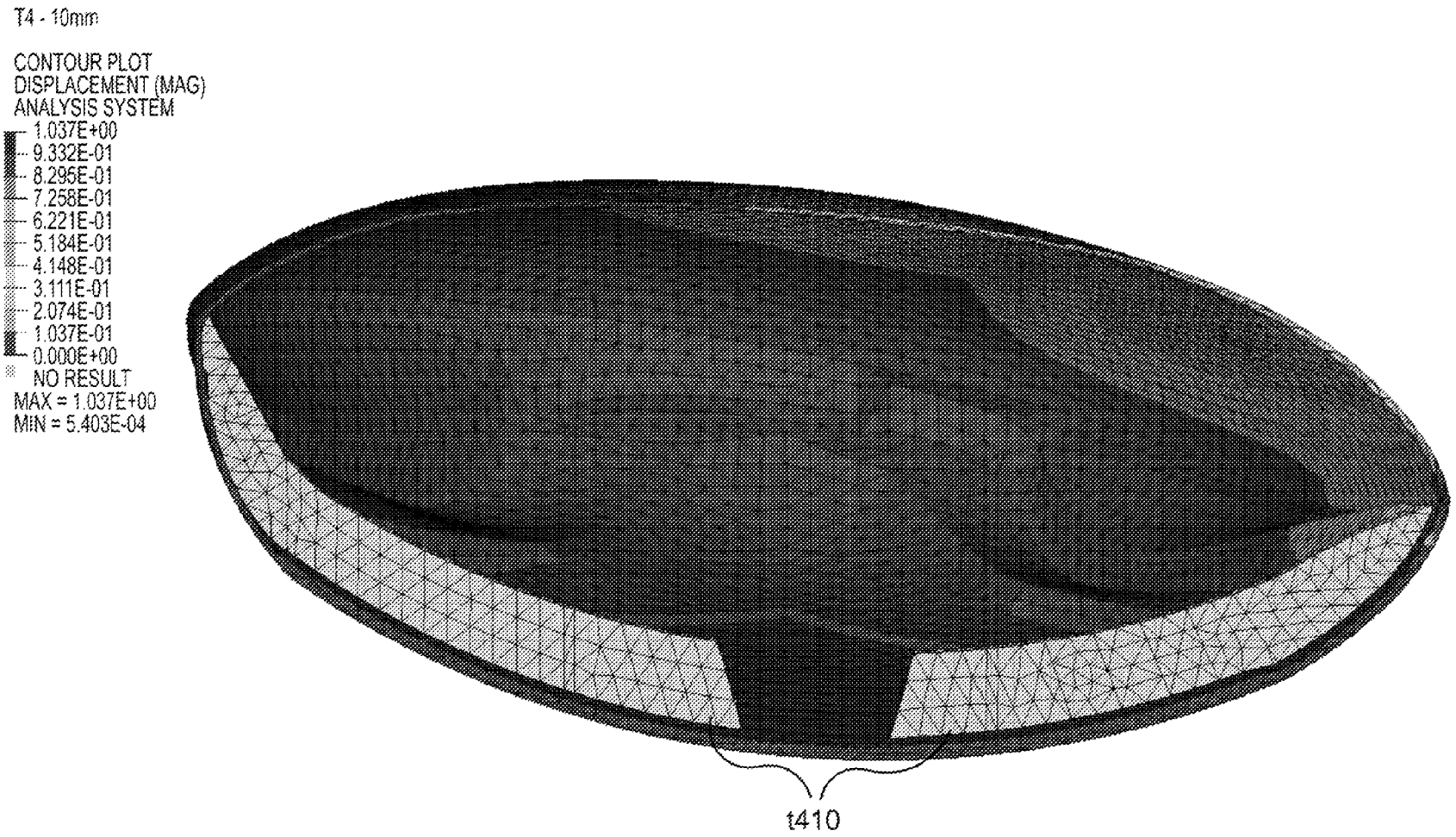
FIG. 36 is a simulation image of a head T4—10 mm.
Figure 37A:
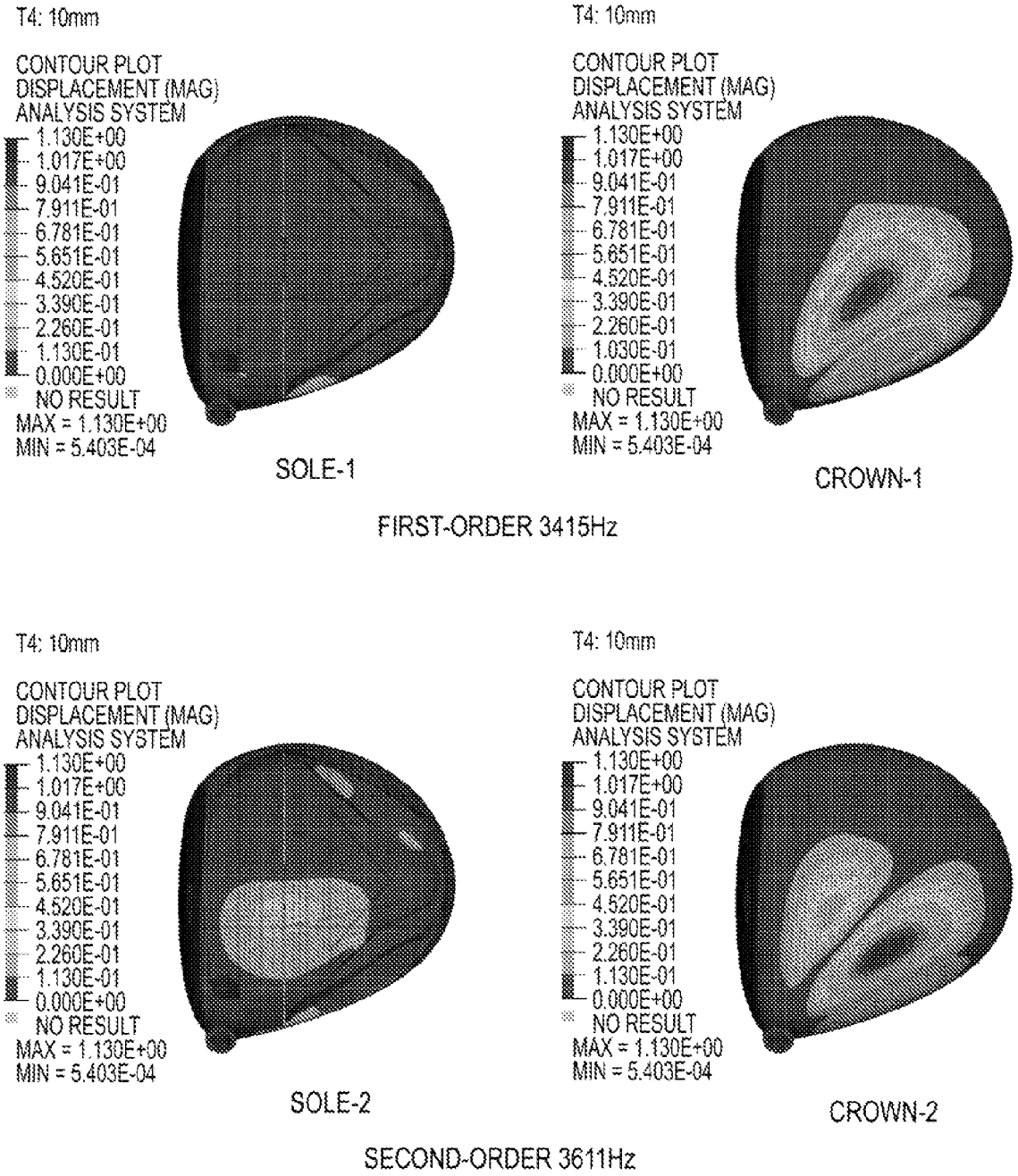
FIG. 37 is a simulation image of a head T4—10 mm.
Figure 37B:
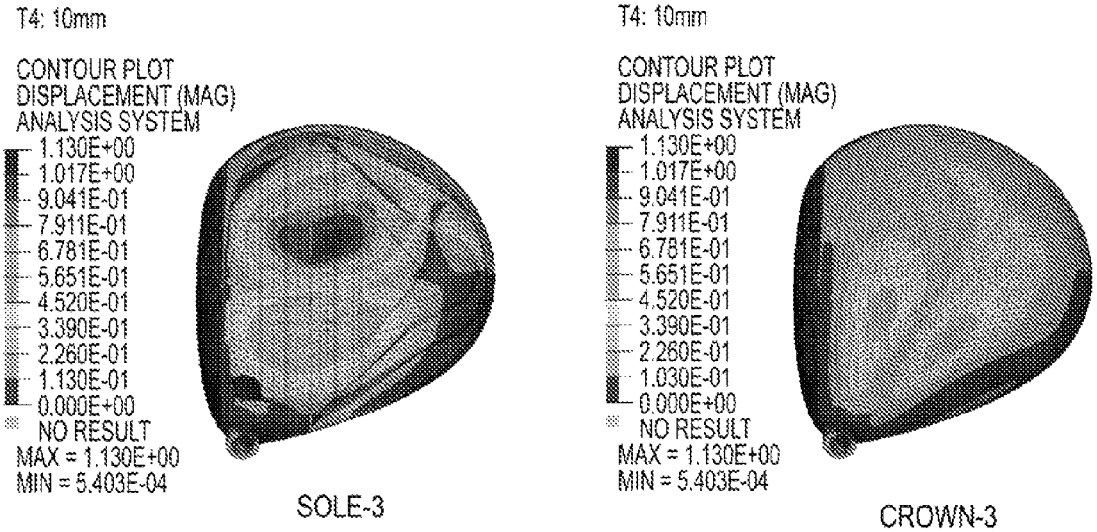
Figure 37B:
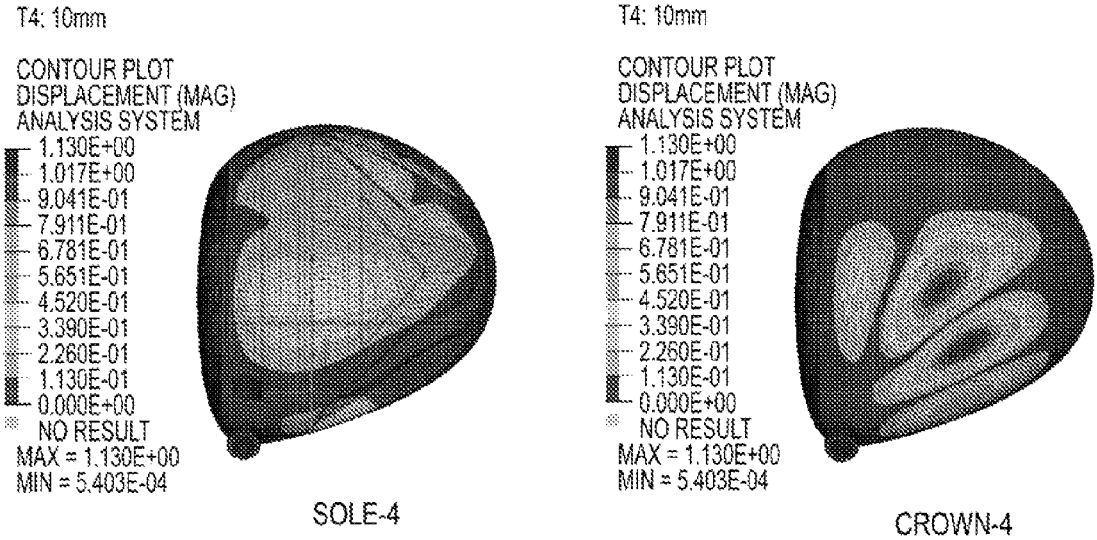

FIGS. 36 and 37 are simulation images showing the mesh-divided head T4—10 mm. FIG. 36 shows a back side portion of the head cut at the same position as that of line F2-F2 in FIG. 1. A shade of FIG. 36 shows a form of natural vibration in a first-order mode. A deeper portion has a greater amplitude.

As the position of the rib t410, the distance Wb (see FIG. 5) was set to 36 mm; the distance Vt (see FIG. 2) was set to 0 mm; and the distance Vh (see FIG. 2) was set to 0 mm.

In the head T4—10 mm, the rib t410 is not continuous but intermittent. The rib t410 is discontinued at a substantially center position in a toe-heel direction. A toe-heel direction width (may be referred to as a dividing width) of the discontinued portion is 10 mm.

Four kinds of simulation images are shown in FIG. 37. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 37 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 37, in the head T4—10 mm, a maximum amplitude point in the first-order mode is located on the crown.

Natural frequency in each of the orders of the head T4—10 mm was as follows as the result of the calculation.

First-order natural frequency H1: 3415 Hz
Second-order natural frequency H2: 3611 Hz
Third-order natural frequency H3: 3778 Hz
Fourth-order natural frequency H4: 3899 Hz

[Head T4—15 mm]

A calculation model of a head T4—15 mm was obtained in the same manner as in the head T1 except that a rib t415 to be described later was provided on the sole as the rib (X). Natural value analysis was conducted using commercially available natural value analyzing software to calculate a natural frequency and a mode shape.

Figure 38:
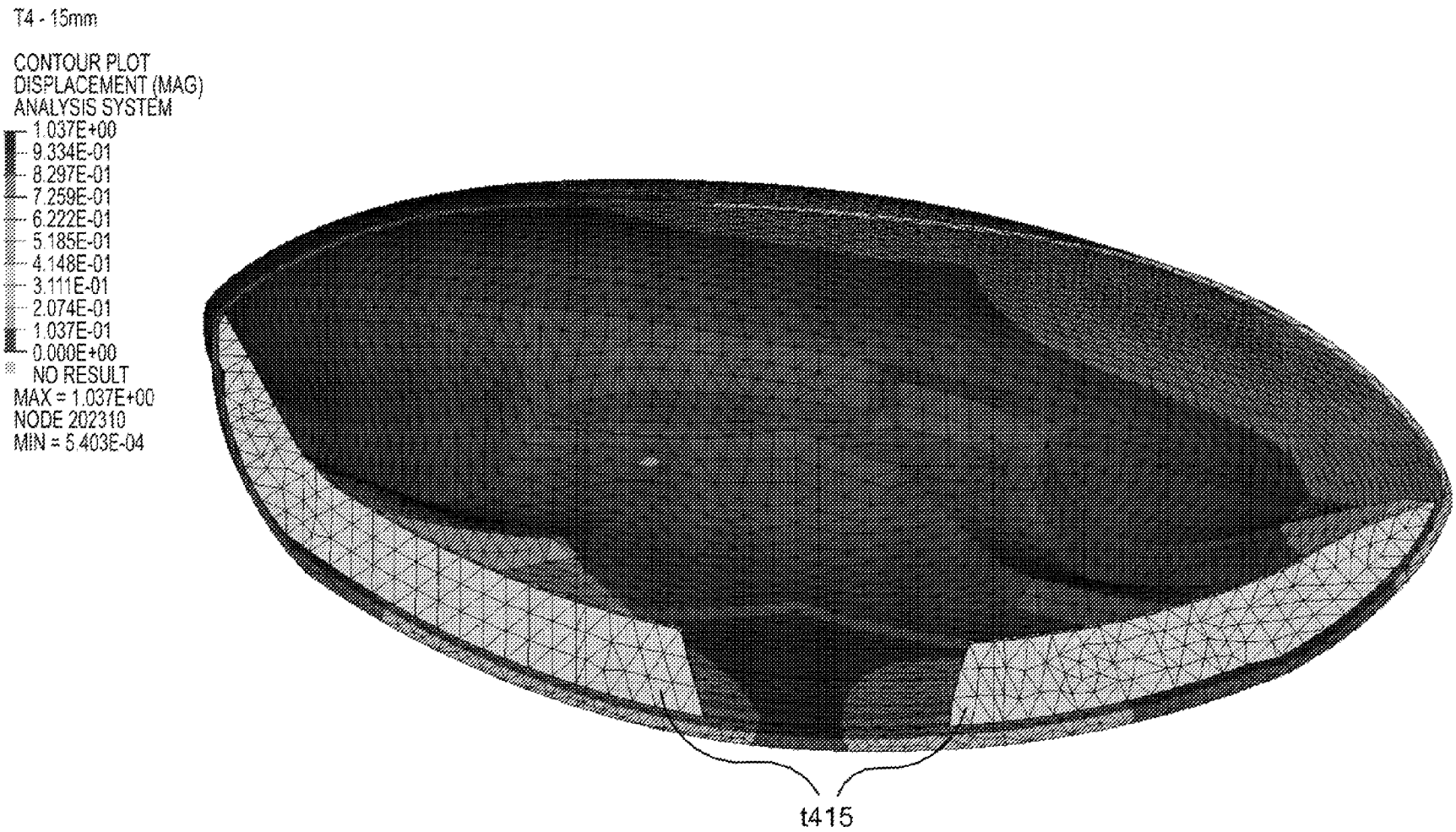
FIG. 38 is a simulation image of a head T4—15 mm.
Figure 39A:
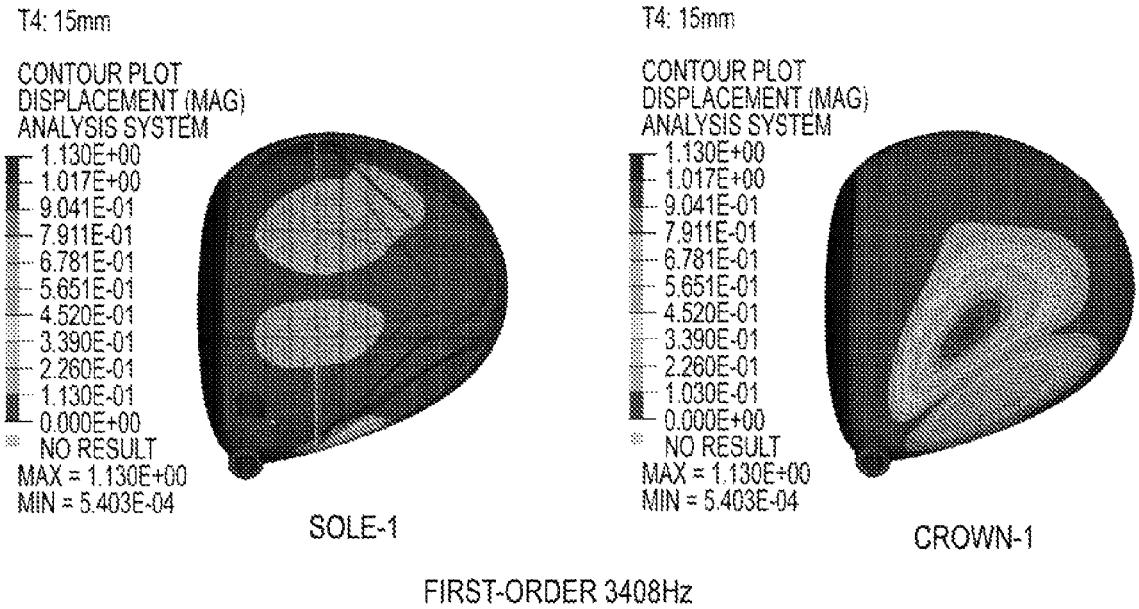
FIG. 39 is a simulation image of a head T4—15 mm.
Figure 39A:
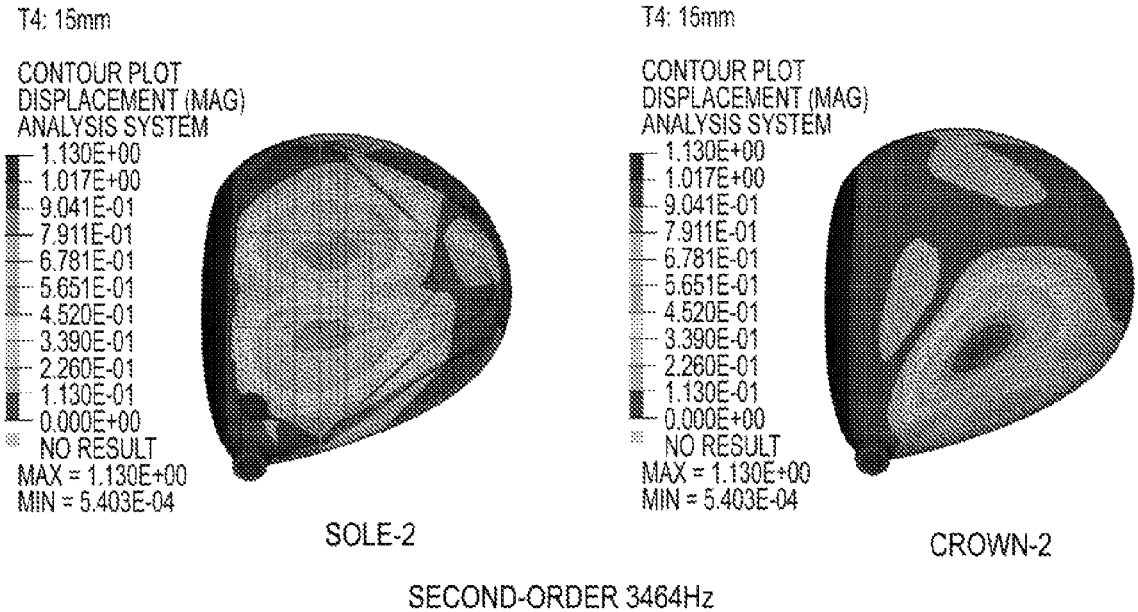
Figure 39B:
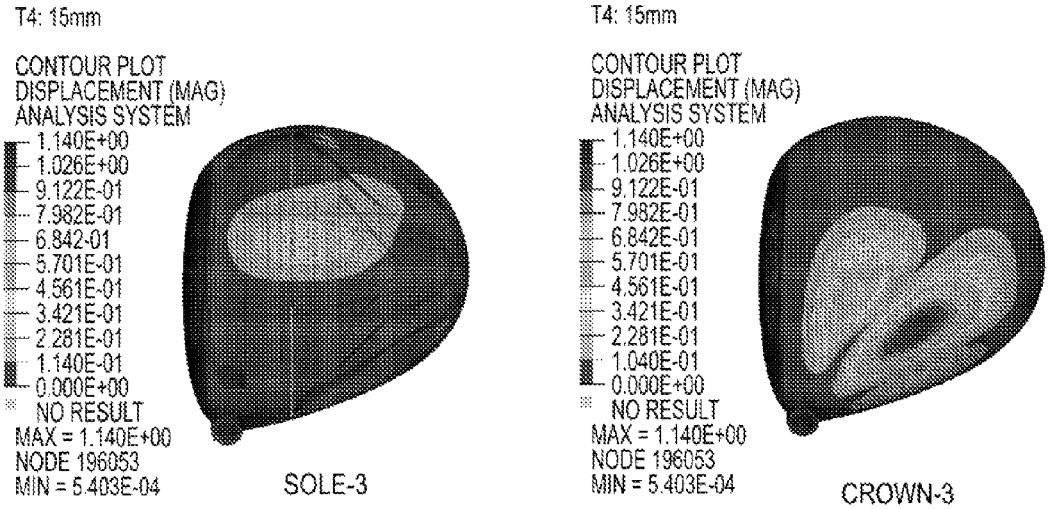
Figure 39B:
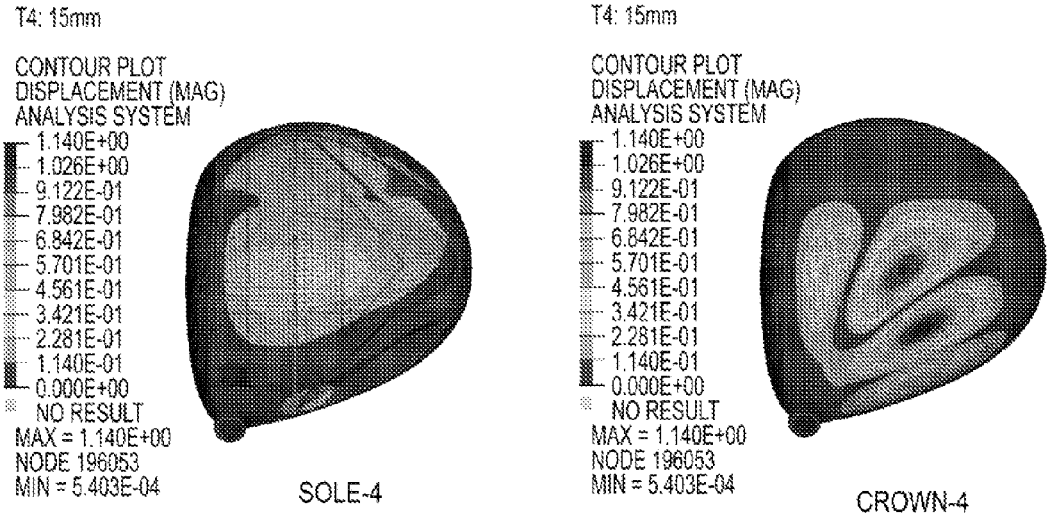

FIGS. 38 and 39 are simulation images showing the mesh-divided head T4—15 mm. FIG. 38 shows a back side portion of the head cut at the same position as that of line F2-F2 in FIG. 1. A shade of FIG. 38 shows a form of natural vibration in a first-order mode. A deeper portion has a greater amplitude.

As the position of the rib t415, the distance Wb (see FIG. 5) was set to 36 mm; the distance Vt (see FIG. 2) was set to 0 mm; and the distance Vh (see FIG. 2) was set to 0 mm.

In the head T4—15 mm, the rib t415 is not continuous but intermittent. The rib t415 is discontinued at a substantially center position in a toe-heel direction. A toe-heel direction width (may be referred to as a dividing width) of the discontinued portion (dividing part) is 15 mm.

Four kinds of simulation images are shown in FIG. 39. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 39 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 39, in the head T4—15 mm, a maximum amplitude point in the first-order mode is located on the crown.

Natural frequency in each of the orders of the head T4—15 mm was as follows as the result of the calculation.

First-order natural frequency H1: 3408 Hz
Second-order natural frequency H2: 3464 Hz
Third-order natural frequency H3: 3651 Hz
Fourth-order natural frequency H4: 3901 Hz

[Head T5]

[Head T5—20 mm]

A calculation model of a head T5—20 mm was obtained in the same manner as in the head T1 except that a rib t520 to be described later was provided on the sole as the rib (X). Natural value analysis was conducted using commercially available natural value analyzing software to calculate a natural frequency and a mode shape.

Figure 40:
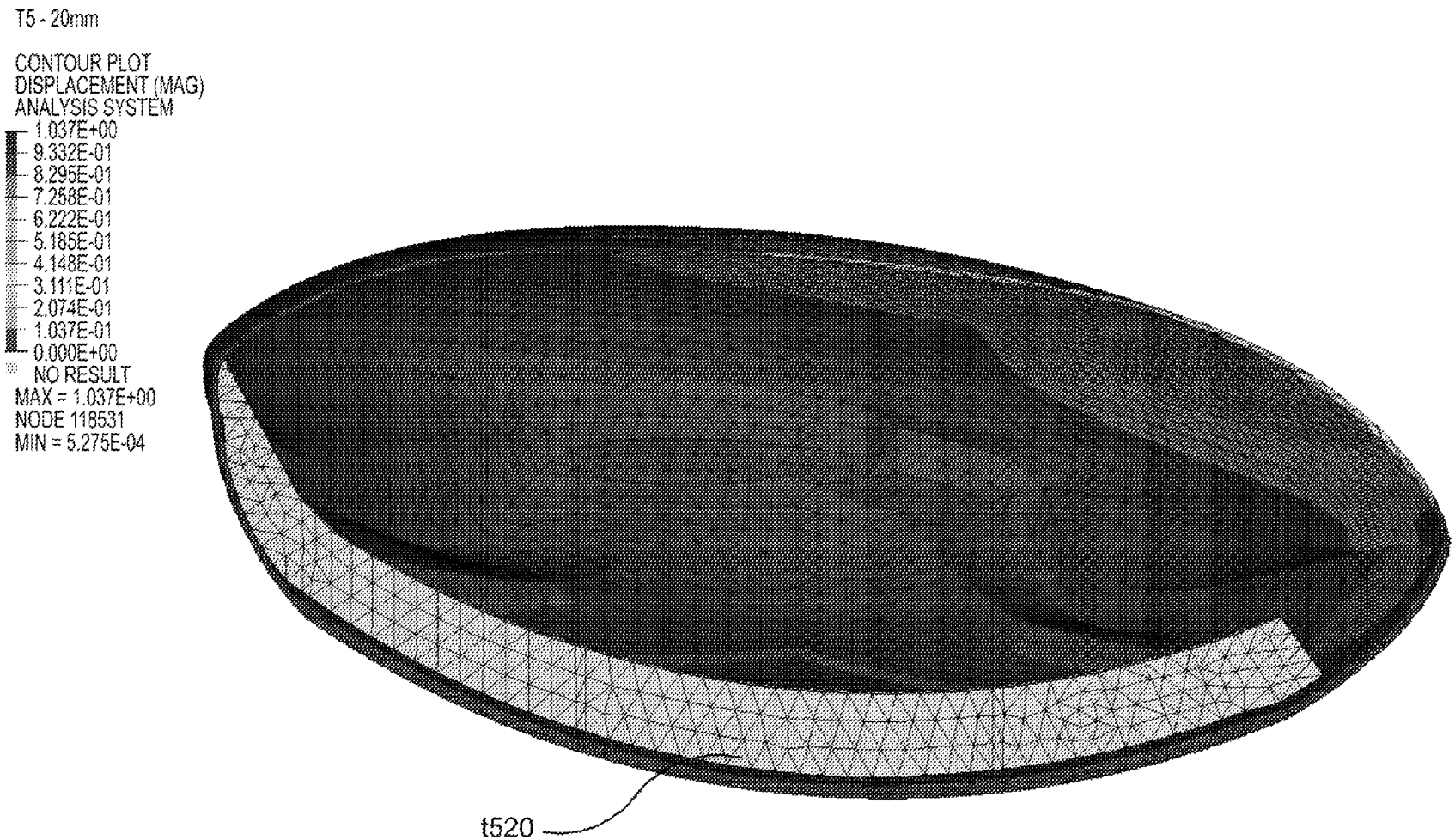
FIG. 40 is a simulation image of a head T5—20 mm.
Figure 41A:
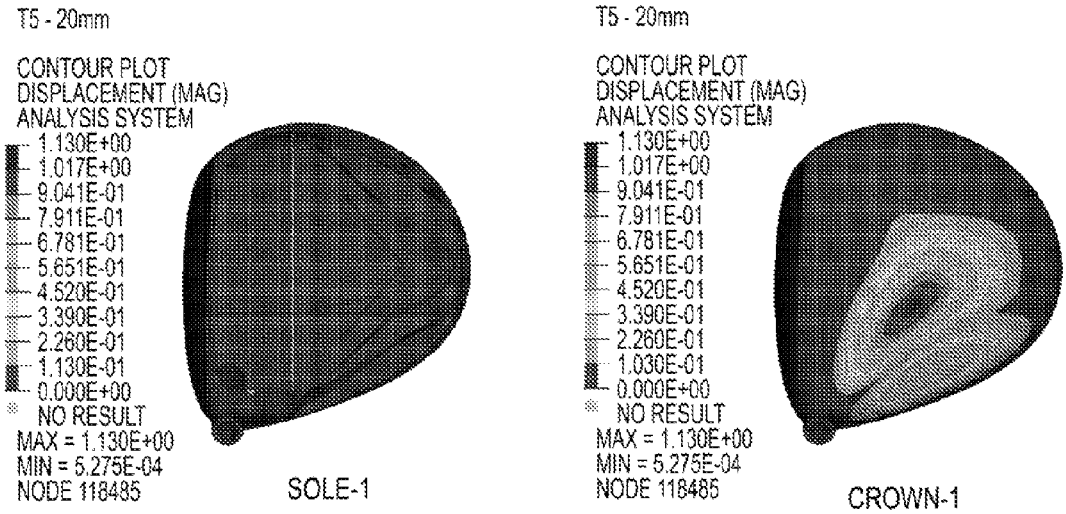
FIG. 41 is a simulation image of a head T5—20 mm.
Figure 41A:
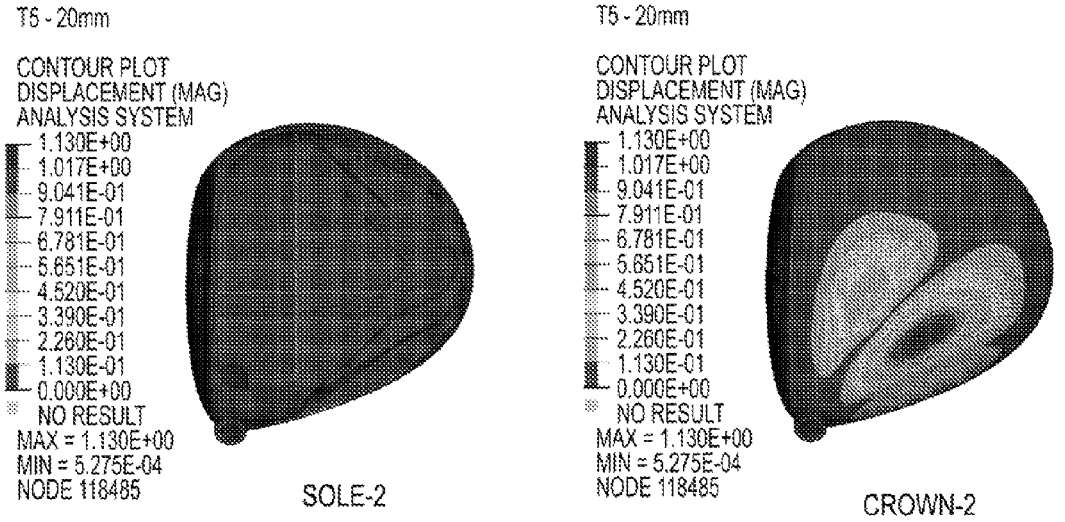
Figure 41B:
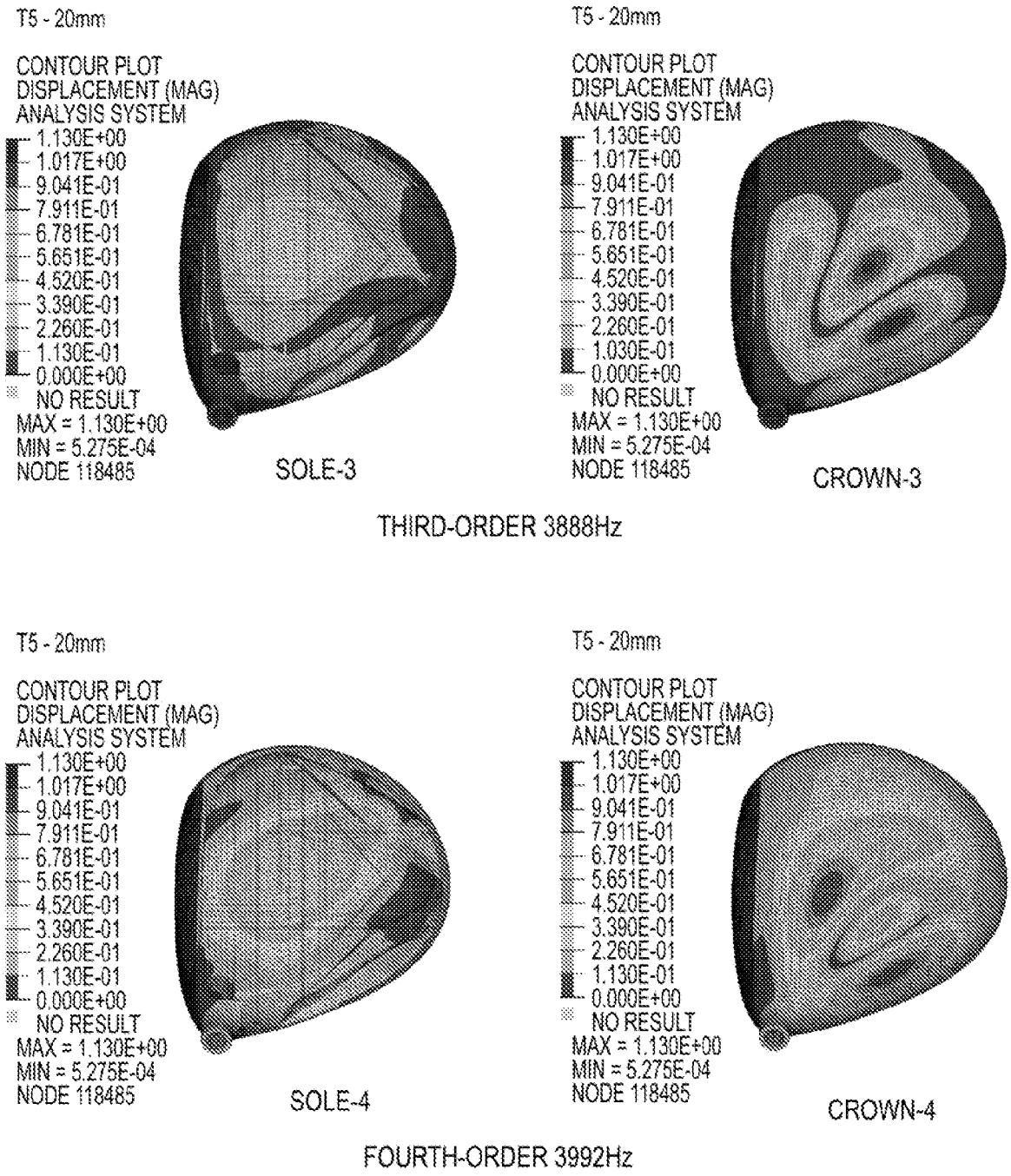

FIGS. 40 and 41 are simulation images showing the mesh-divided head T5—20 mm. FIG. 40 shows a back side portion of the head cut at the same position as that of line F2-F2 in FIG. 1. A shade of FIG. 40 shows a form of natural vibration in a first-order mode. A deeper portion has a greater amplitude.

As the position of the rib t520, the distance Wb (see FIG. 5) was set to 36 mm; the distance Vt (see FIG. 2) was set to 0 mm; and the distance Vh (see FIG. 2) was set to 20 mm.

Four kinds of simulation images are shown in FIG. 41. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 41 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 41, in the head T5—20 mm, a maximum amplitude point in the first-order mode is located on the crown.

Natural frequency in each of the orders of the head T5—20 mm was as follows as the result of the calculation.

First-order natural frequency H1: 3421 Hz
Second-order natural frequency H2: 3630 Hz
Third-order natural frequency H3: 3888 Hz
Fourth-order natural frequency H4: 3992 Hz

[Head T5—30 mm]

A calculation model of a head T5—30 mm was obtained in the same manner as in the head T1 except that a rib t530 to be described later was provided on the sole as the rib (X). Natural value analysis was conducted using commercially available natural value analyzing software to calculate a natural frequency and a mode shape.

Figure 42:
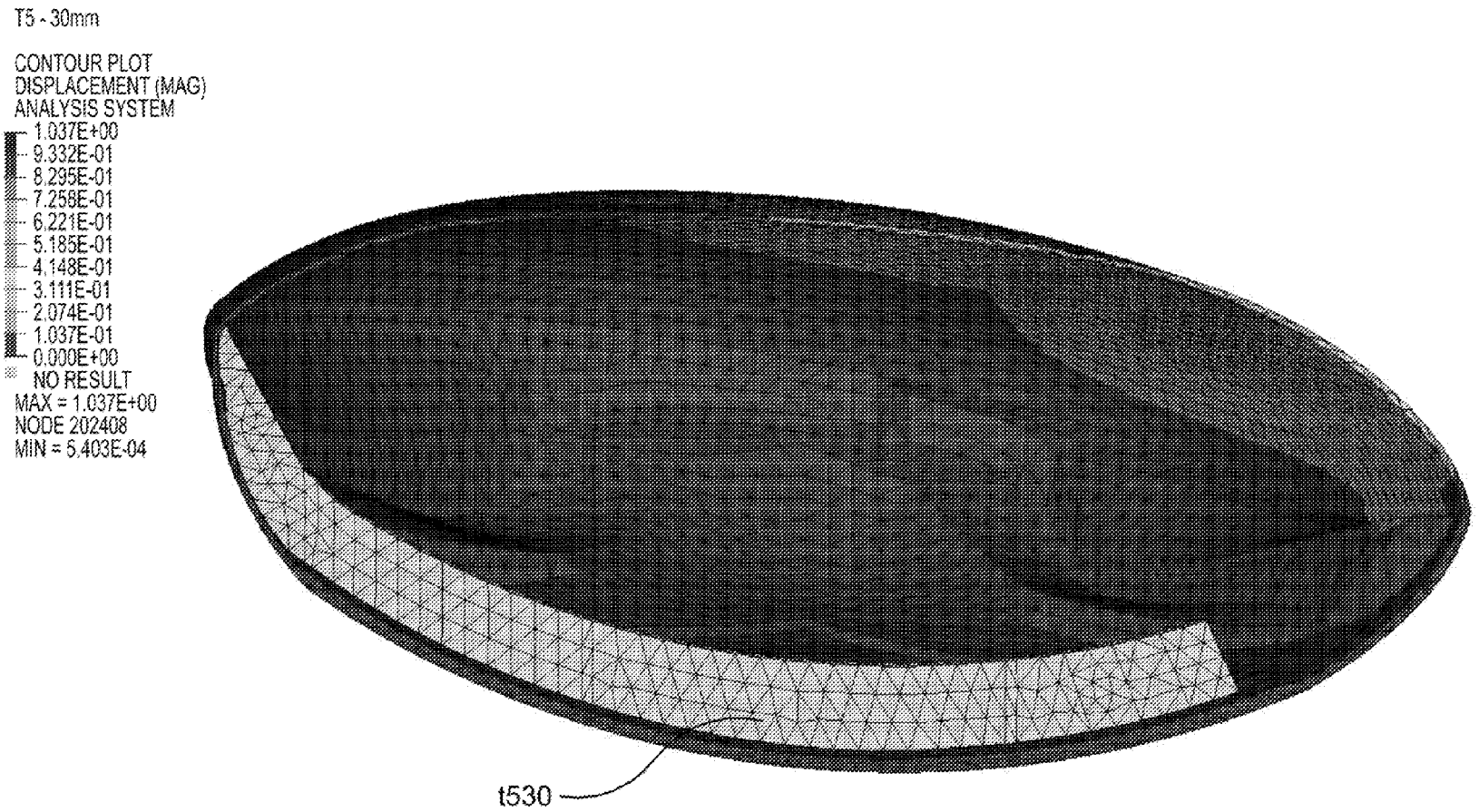
FIG. 42 is a simulation image of a head T5—30 mm.
Figure 43A:
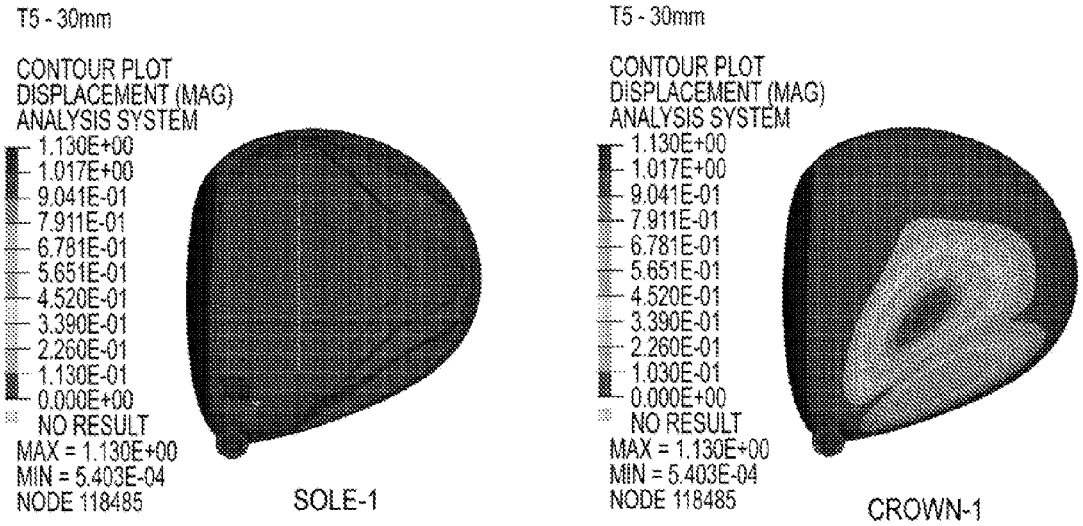
FIG. 43 is a simulation image of a head T5—30 mm.
Figure 43A:
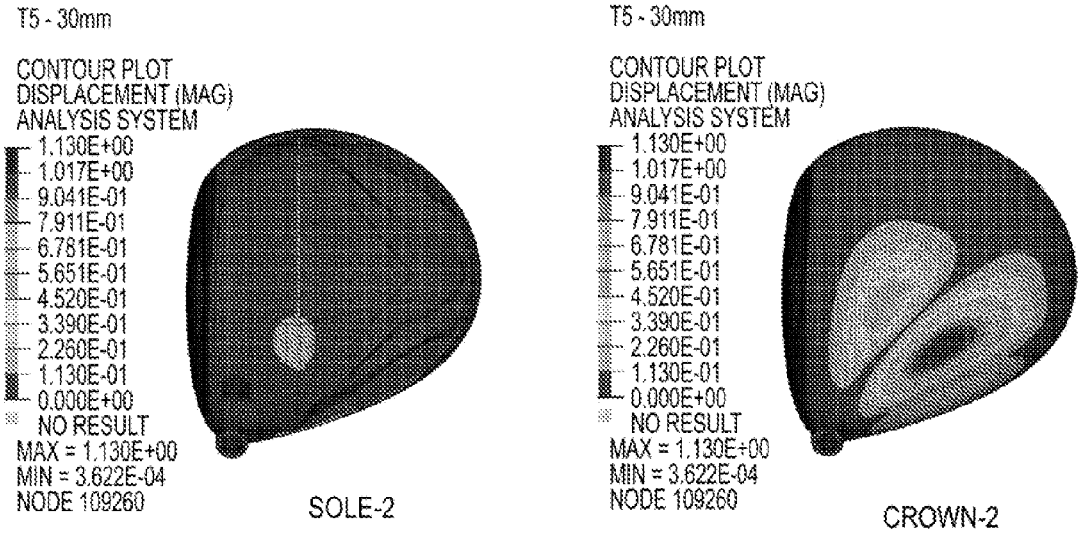
Figure 43B:
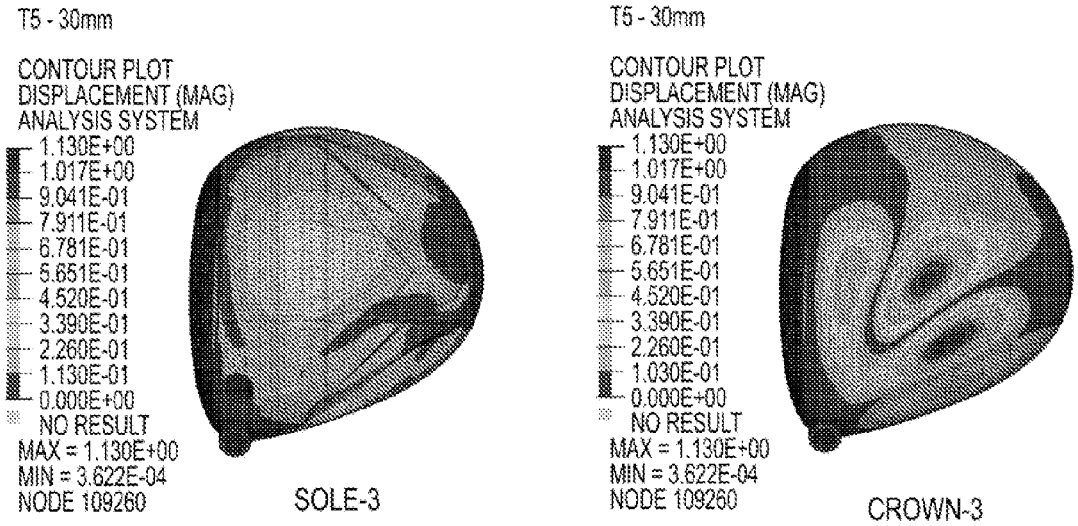
Figure 43B:
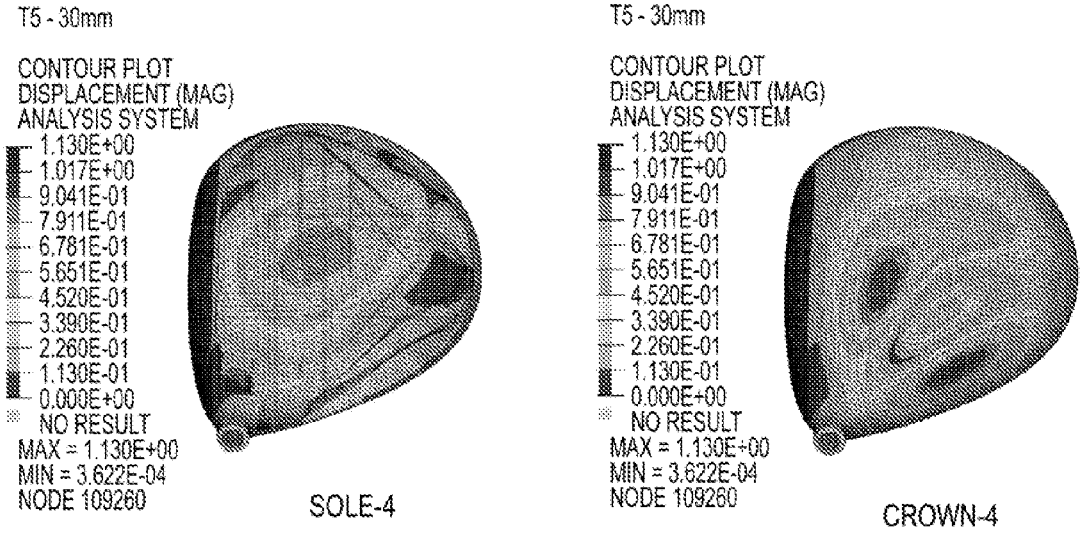

FIGS. 42 and 43 are simulation images showing the mesh-divided head T5—30 mm. FIG. 42 shows a back side portion of the head cut at the same position as that of line F2-F2 in FIG. 1. A shade of FIG. 42 shows a form of natural vibration in a first-order mode. A deeper portion has a greater amplitude.

As the position of the rib t530, the distance Wb (see FIG. 5) was set to 36 mm; the distance Vt (see FIG. 2) was set to 0 mm; and the distance Vh (see FIG. 2) was set to 30 mm.

Four kinds of simulation images are shown in FIG. 43. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 43 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 43, in the head T5—30 mm, a maximum amplitude point in the first-order mode is located on the crown.

Natural frequency in each of the orders of the head T5—30 mm was as follows as the result of the calculation.

First-order natural frequency H1: 3421 Hz
Second-order natural frequency H2: 3628 Hz
Third-order natural frequency H3: 3889 Hz
Fourth-order natural frequency H4: 3994 Hz

[Head T5—35 mm]

A calculation model of a head T5—35 mm was obtained in the same manner as in the head T1 except that a rib t535 to be described later was provided on the sole as the rib (X). Natural value analysis was conducted using commercially available natural value analyzing software to calculate a natural frequency and a mode shape.

Figure 44:
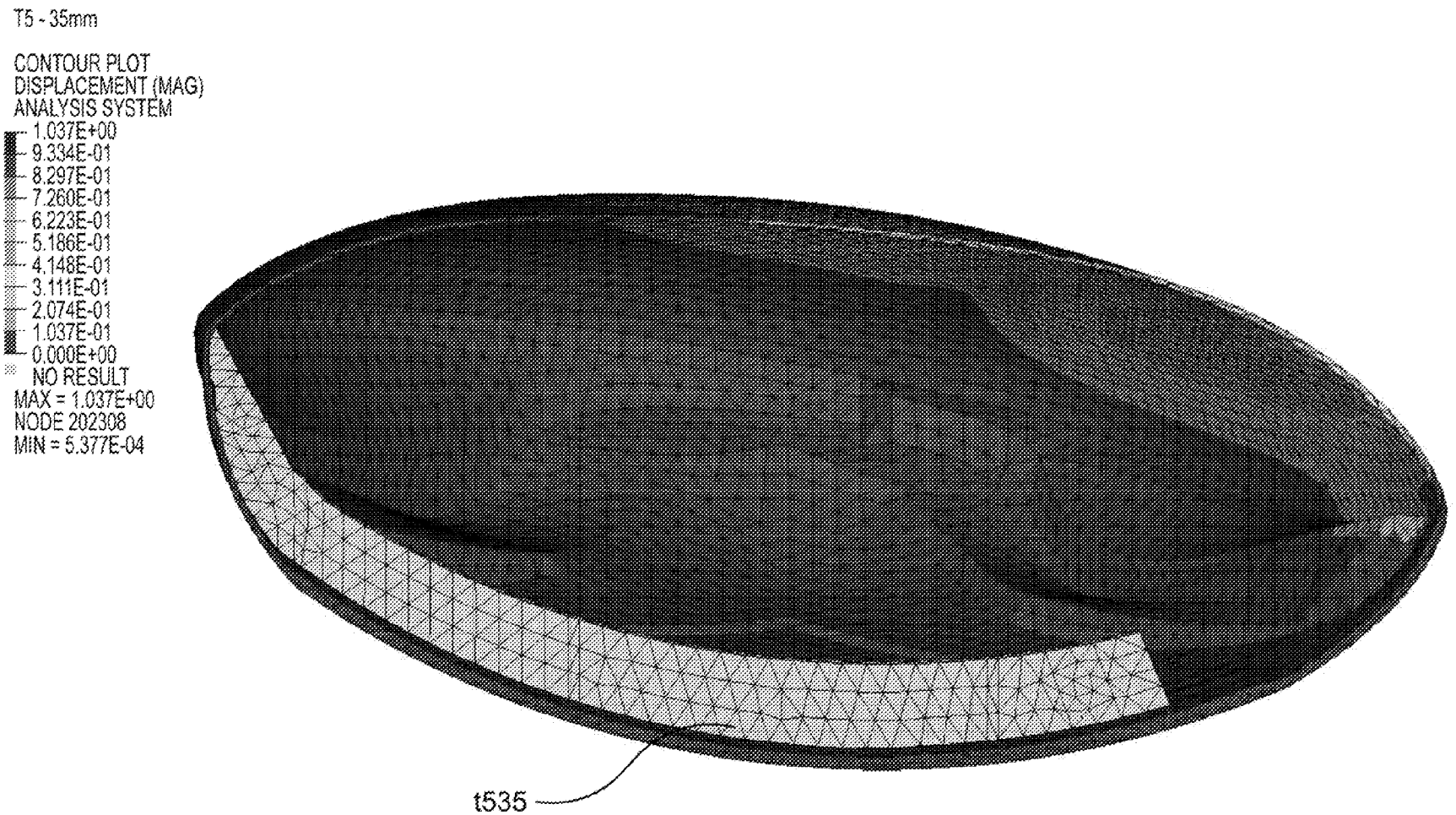
FIG. 44 is a simulation image of a head T5—35 mm.
Figure 45A:
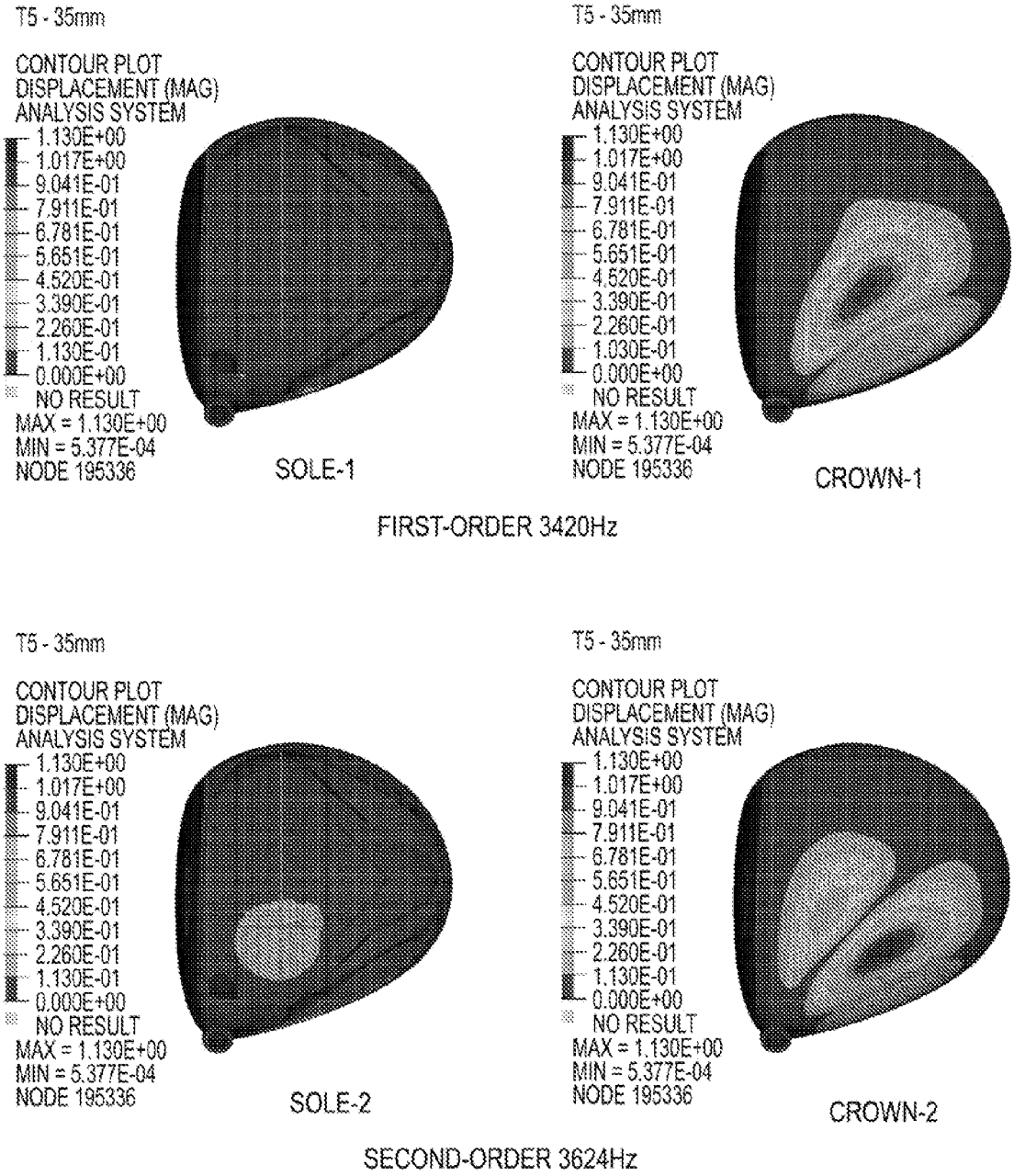
FIG. 45 is a simulation image of a head T5—35 mm.
Figure 45B:
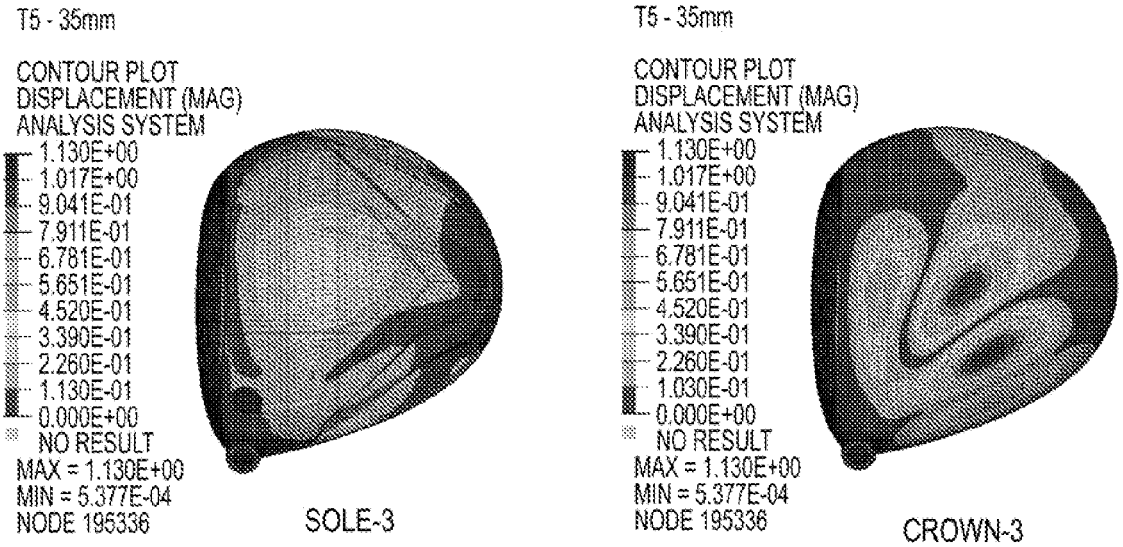
Figure 45B:
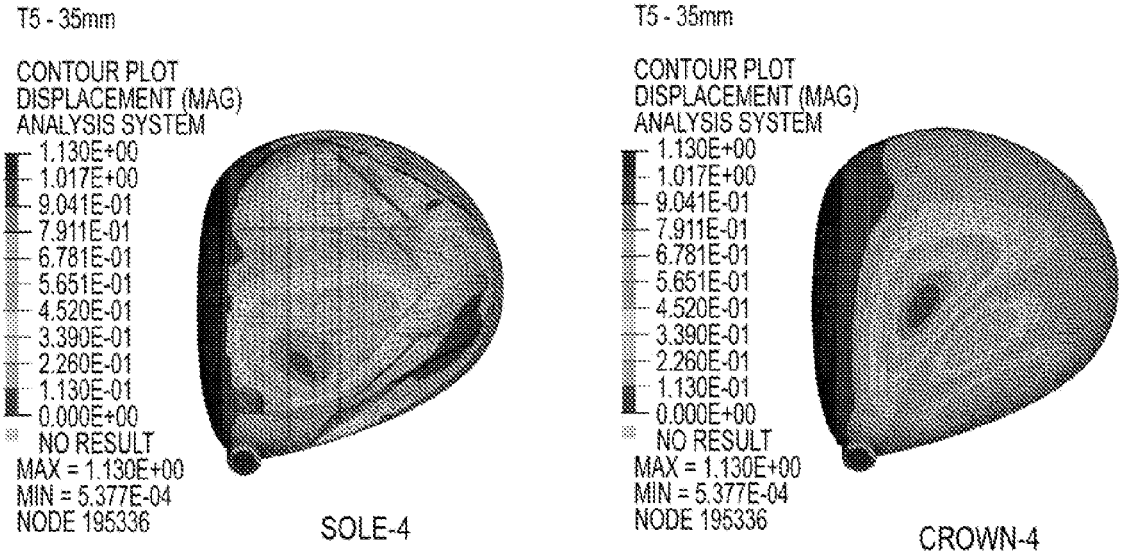

FIGS. 44 and 45 are simulation images showing the mesh-divided head T5—35 mm. FIG. 44 shows a back side portion of the head cut at the same position as that of line F2-F2 in FIG. 1. A shade of FIG. 44 shows a form of natural vibration in a first-order mode. A deeper portion has a greater amplitude.

As the position of the rib t535, the distance Wb (see FIG. 5) was set to 36 mm; the distance Vt (see FIG. 2) was set to 0 mm; and the distance Vh (see FIG. 2) was set to 35 mm.

Four kinds of simulation images are shown in FIG. 45. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 45 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 45, in the head T5—35 mm, a maximum amplitude point in the first-order mode is located on the crown.

Natural frequency in each of the orders of the head T5—35 mm was as follows as the result of the calculation.

First-order natural frequency H1: 3420 Hz
Second-order natural frequency H2: 3624 Hz
Third-order natural frequency H3: 3889 Hz
Fourth-order natural frequency H4: 3972 Hz

[Head T5—45 mm]

A calculation model of a head T5—45 mm was obtained in the same manner as in the head T1 except that a rib t545 to be described later was provided on the sole as the rib (X). Natural value analysis was conducted using commercially available natural value analyzing software to calculate a natural frequency and a mode shape.

Figure 46:
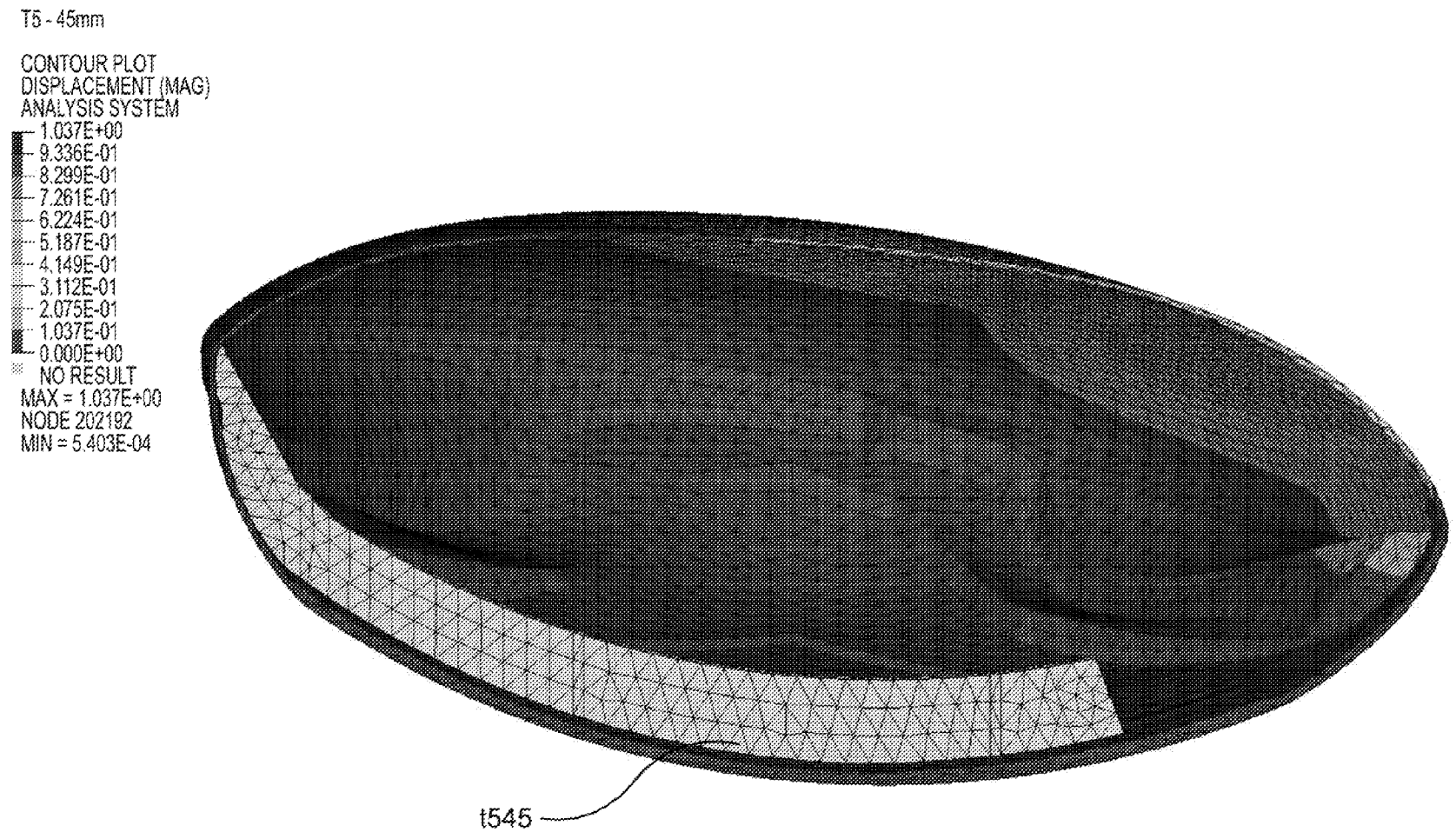
FIG. 46 is a simulation image of a head T5—45 mm.
Figure 47A:
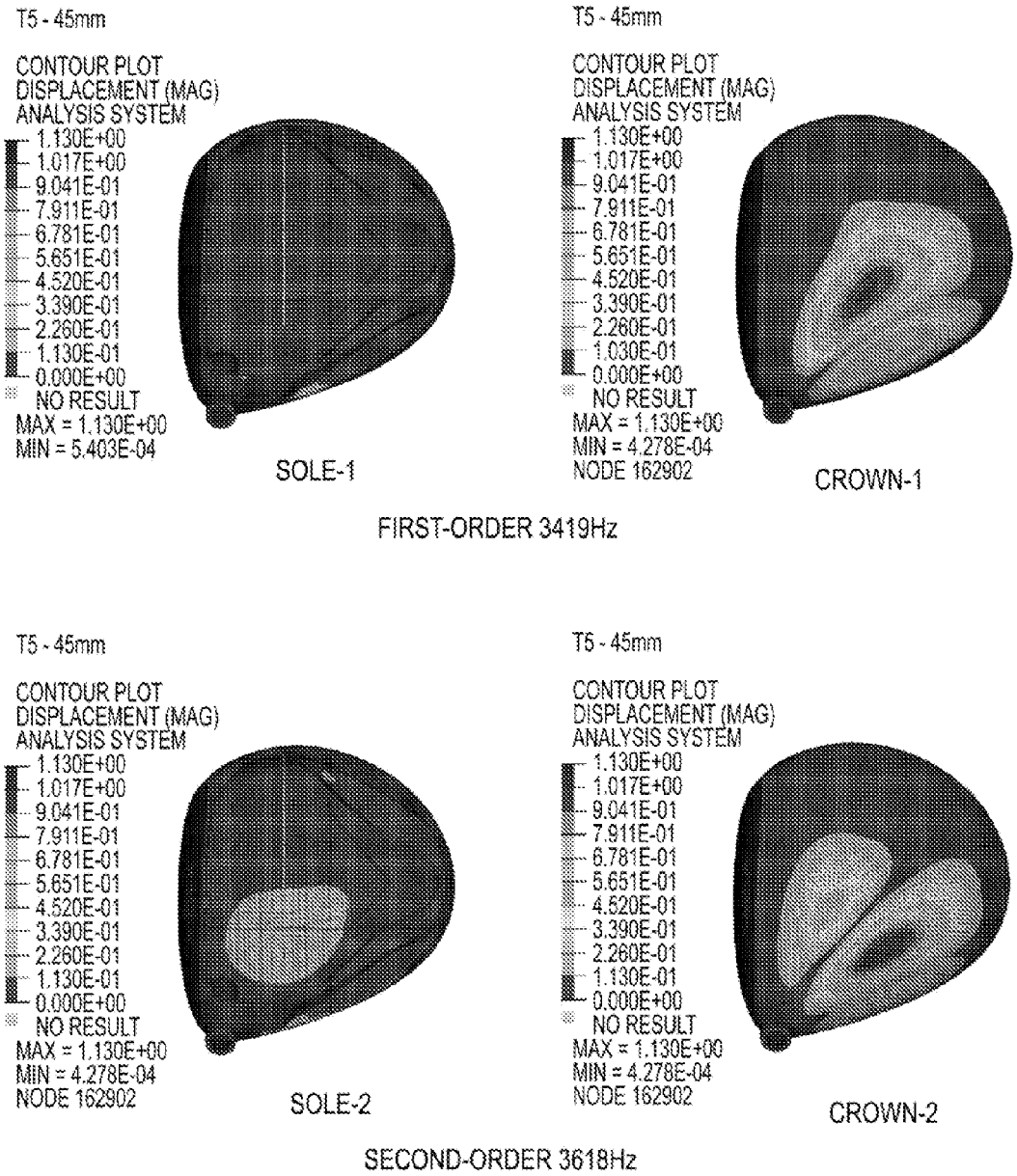
FIG. 47 is a simulation image of a head T5—45 mm.
Figure 47B:
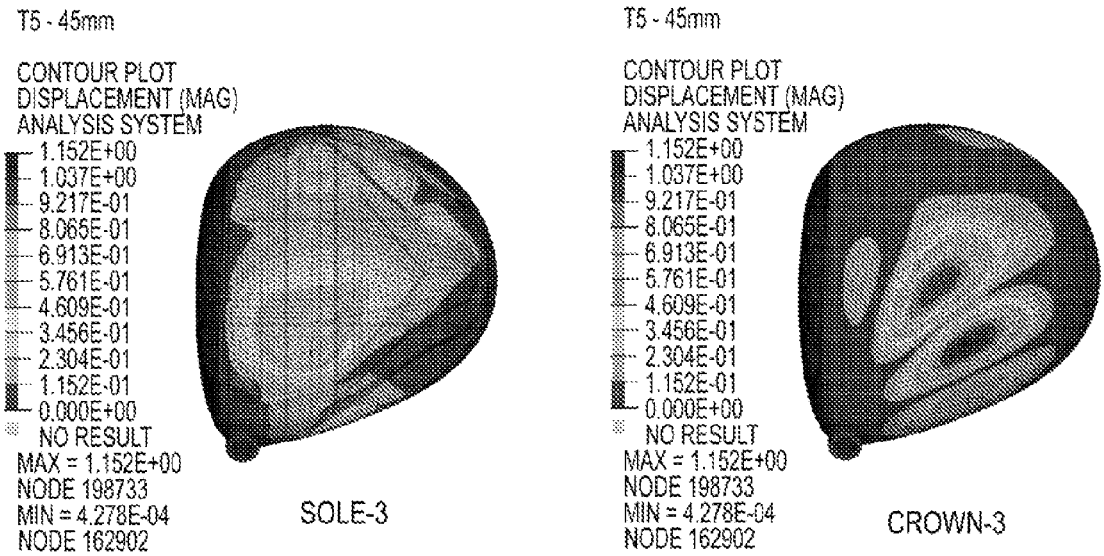
Figure 47B:
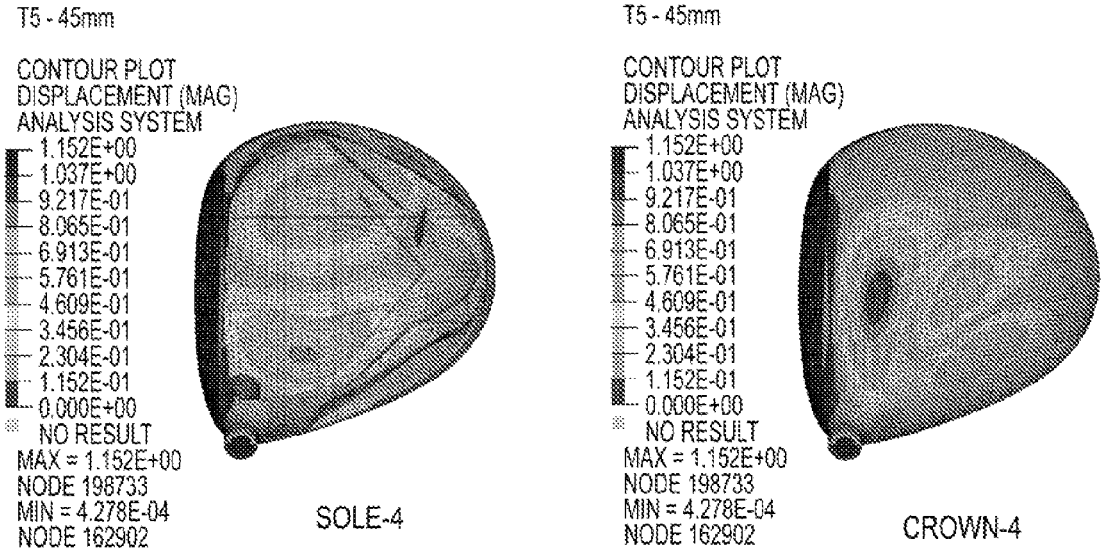

FIGS. 46 and 47 are simulation images showing the mesh-divided head T5—45 mm. FIG. 46 shows a back side portion of the head cut at the same position as that of line F2-F2 in FIG. 1. A shade of FIG. 46 shows a form of natural vibration in a first-order mode. A deeper portion has a greater amplitude.

As the position of the rib t545, the distance Wb (see FIG. 5) was set to 36 mm; the distance Vt (see FIG. 2) was set to 0 mm; and the distance Vh (see FIG. 2) was set to 45 mm.

Four kinds of simulation images are shown in FIG. 47. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 47 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 47, in the head T5—45 mm, a maximum amplitude point in the first-order mode is located on the crown.

Natural frequency in each of the orders of the head T5—45 mm was as follows as the result of the calculation.

First-order natural frequency H1: 3419 Hz
Second-order natural frequency H2: 3618 Hz
Third-order natural frequency H3: 3868 Hz
Fourth-order natural frequency H4: 3905 Hz

[Head T5—60 mm]

A calculation model of a head T5—60 mm was obtained in the same manner as in the head T1 except that a rib t560 to be described later was provided on the sole as the rib (X). Natural value analysis was conducted using commercially available natural value analyzing software to calculate a natural frequency and a mode shape.

Figure 48:
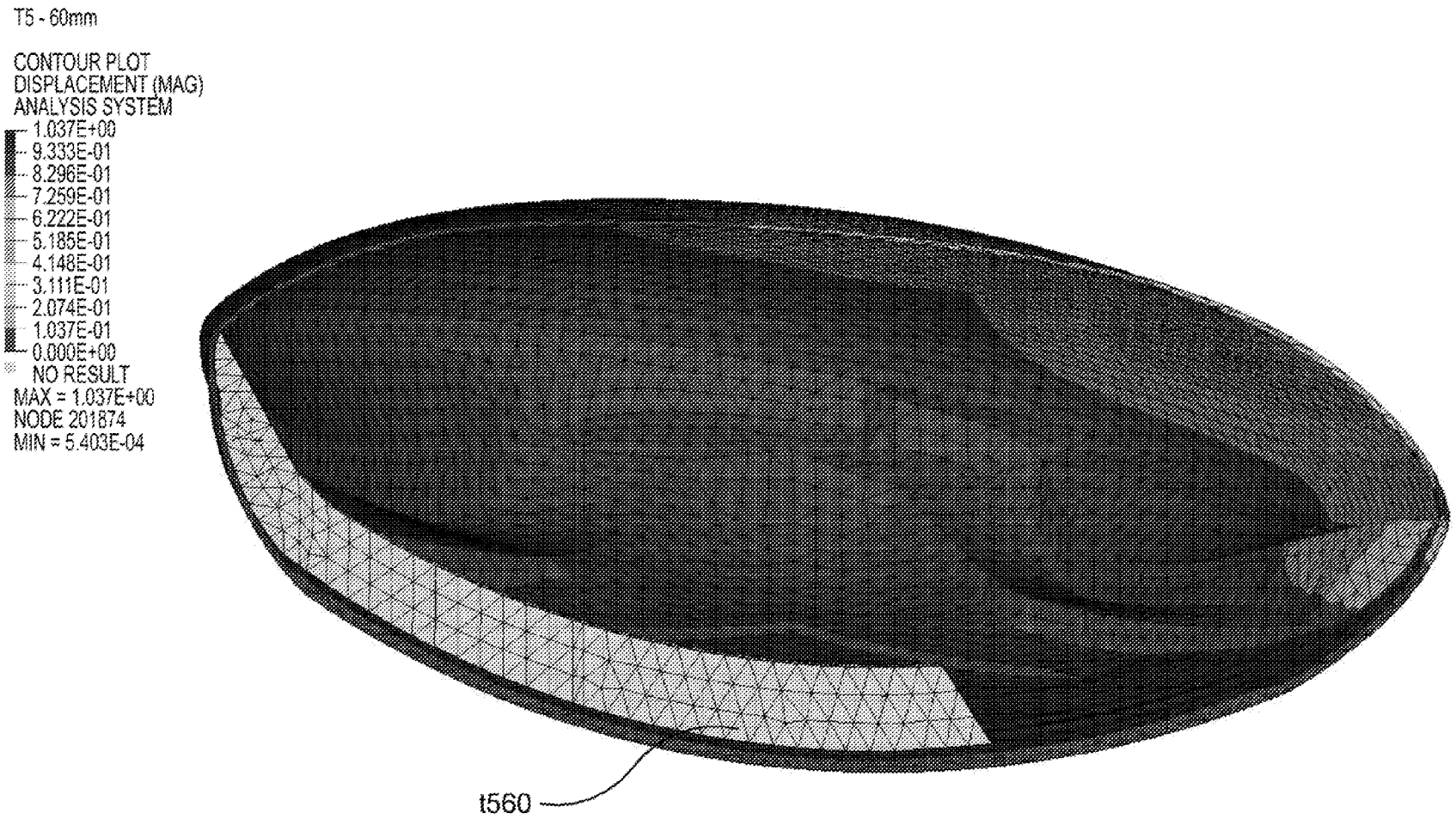
FIG. 48 is a simulation image of a head T5—60 mm.
Figure 49A:
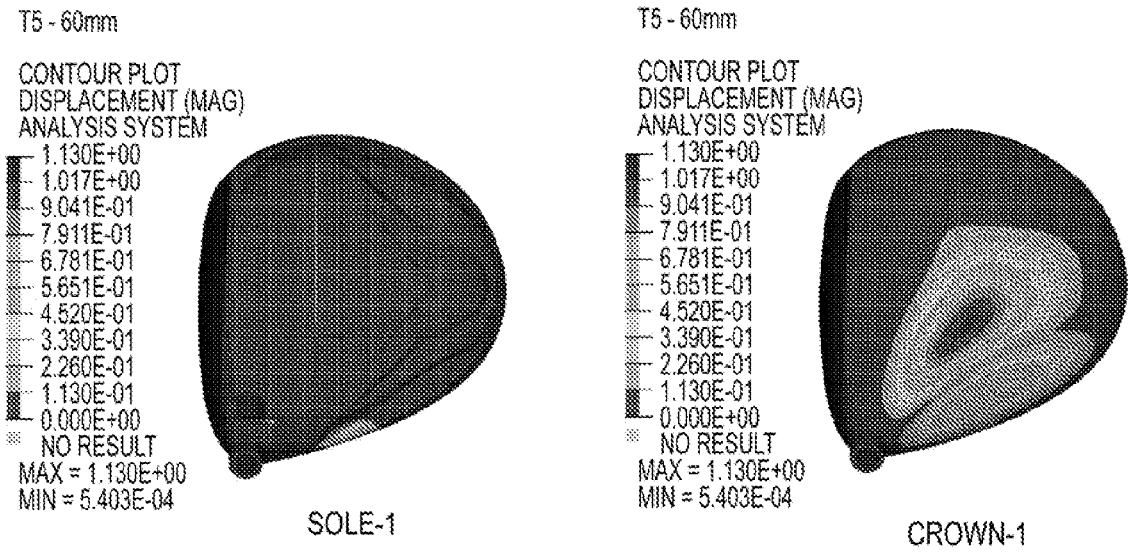
FIG. 49 is a simulation image of a head T5—60 mm.
Figure 49A:
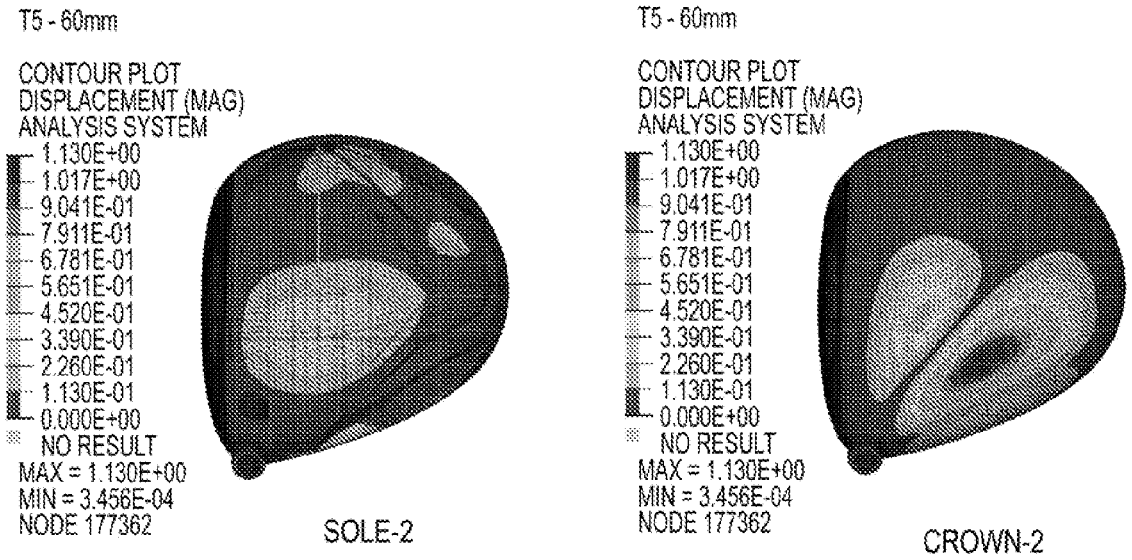
Figure 49B:
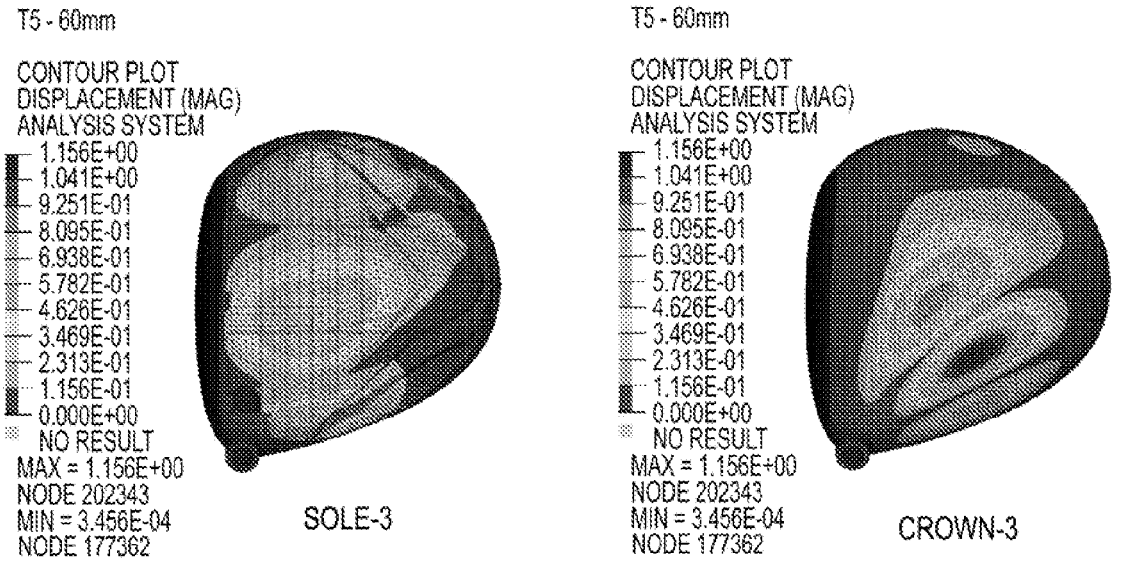
Figure 49B:
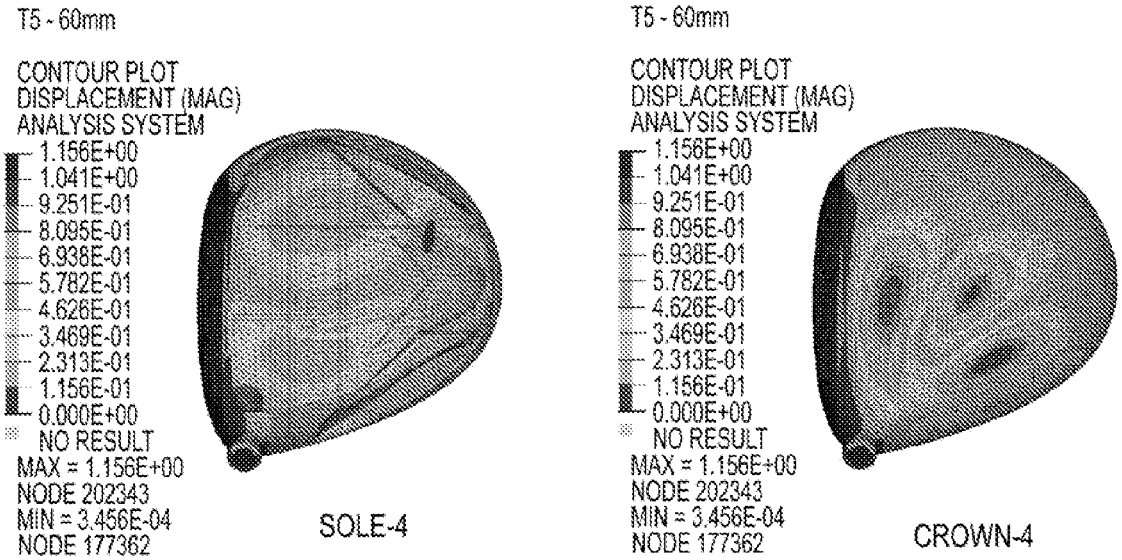

FIGS. 48 and 49 are simulation images showing the mesh-divided head T5—60 mm. FIG. 48 shows a back side portion of the head cut at the same position as that of line F2-F2 in FIG. 1. A shade of FIG. 48 shows a form of natural vibration in a first-order mode. A deeper portion has a greater amplitude.

As the position of the rib t560, the distance Wb (see FIG. 5) was set to 36 mm; the distance Vt (see FIG. 2) was set to 0 mm; and the distance Vh (see FIG. 2) was set to 60 mm.

Four kinds of simulation images are shown in FIG. 49. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 49 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 49, in the head T5—60 mm, a maximum amplitude point in the first-order mode is located on the crown.

Natural frequency in each of the orders of the head T5—60 mm was as follows as the result of the calculation.

First-order natural frequency H1: 3419 Hz
Second-order natural frequency H2: 3618 Hz
Third-order natural frequency H3: 3868 Hz
Fourth-order natural frequency H4: 3905 Hz

[Head T5—80 mm]

A calculation model of a head T5—80 mm was obtained in the same manner as in the head T1 except that a rib t580 to be described later was provided on the sole as the rib (X). Natural value analysis was conducted using commercially available natural value analyzing software to calculate a natural frequency and a mode shape.

Figure 50:
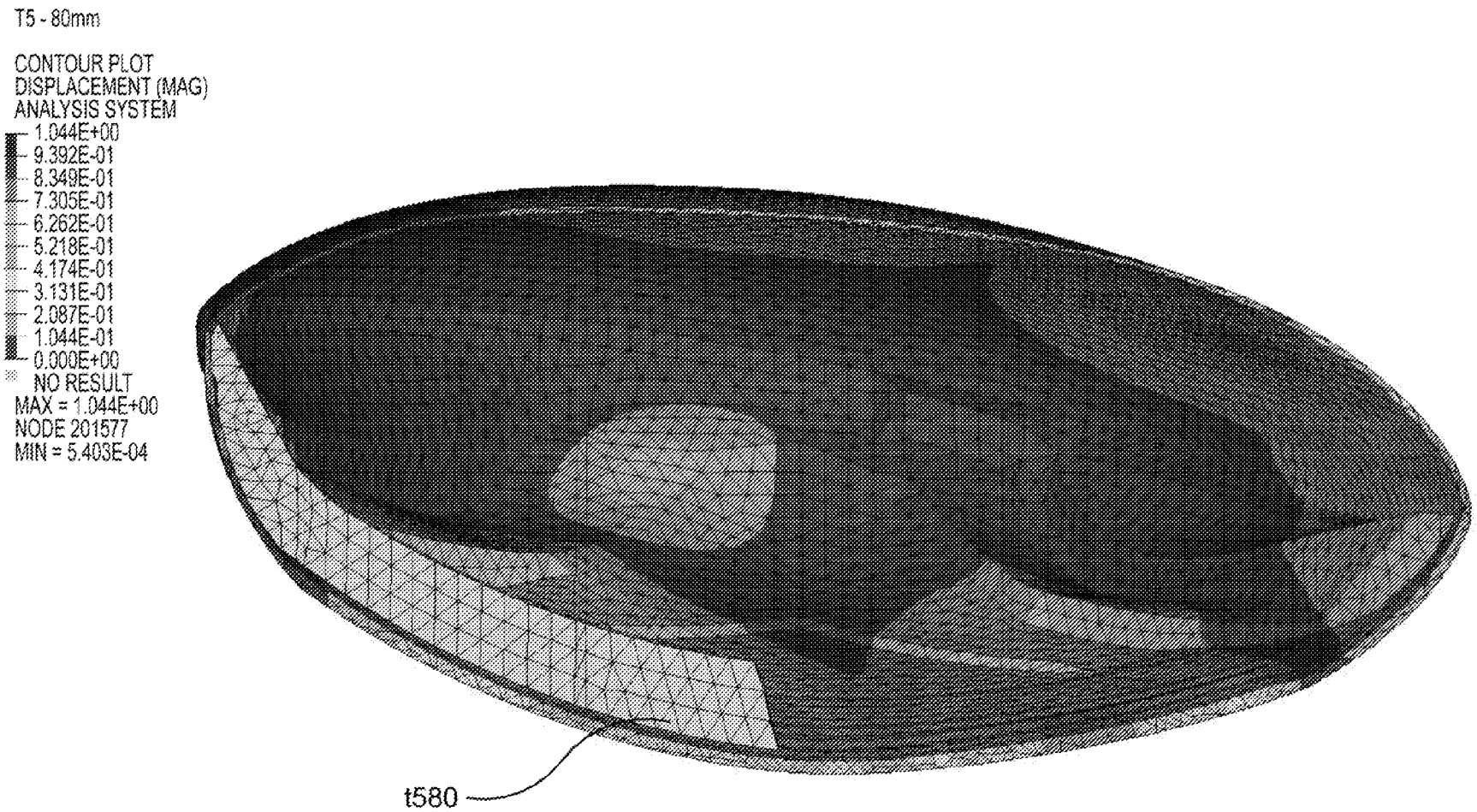
FIG. 50 is a simulation image of a head T5—80 mm.
Figure 51A:
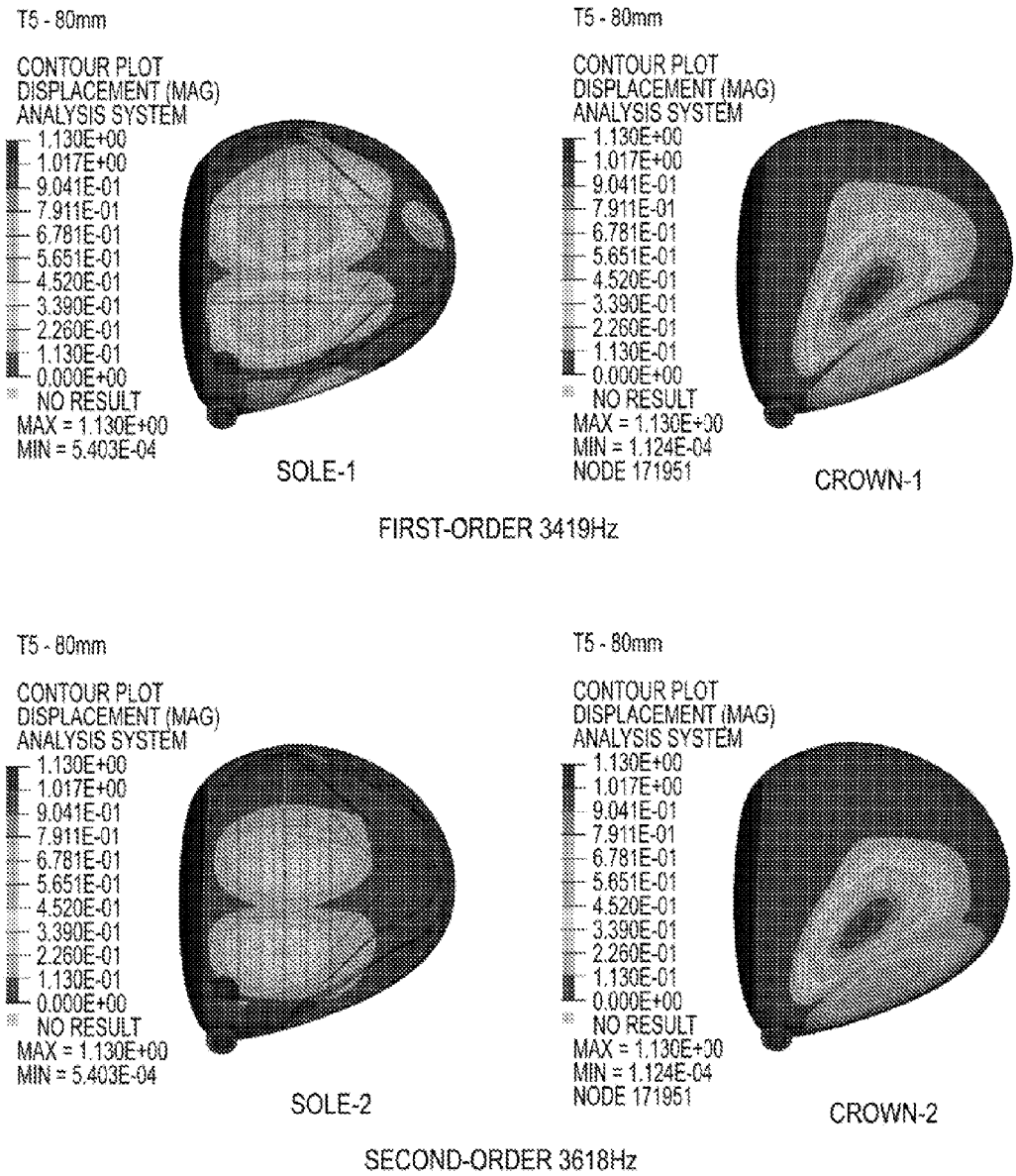
FIG. 51 is a simulation image of a head T5—80 mm.
Figure 51B:
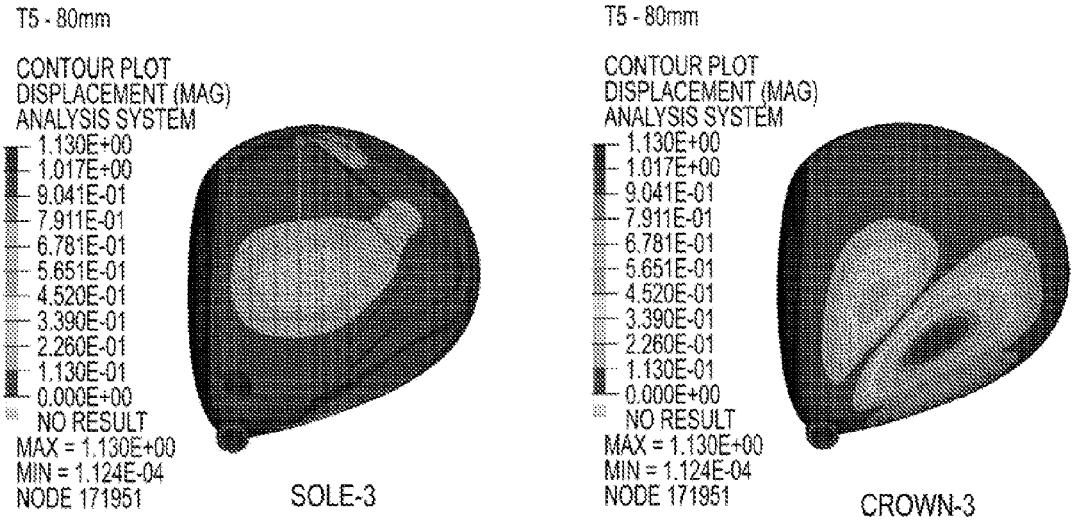
Figure 51B:
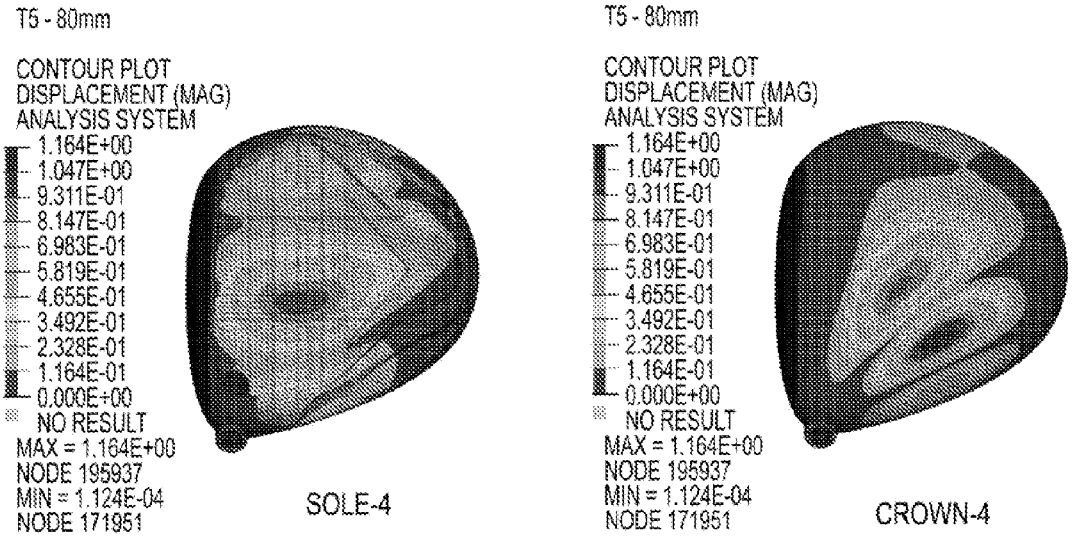

FIGS. 50 and 51 are simulation images showing the mesh-divided head T5—80 mm. FIG. 50 shows a back side portion of the head cut at the same position as that of line F2-F2 in FIG. 1. A shade of FIG. 50 shows a form of natural vibration in a first-order mode. A deeper portion has a greater amplitude.

As the position of the rib t580, the distance Wb (see FIG. 5) was set to 36 mm; the distance Vt (see FIG. 2) was set to 0 mm; and the distance Vh (see FIG. 2) was set to 80 mm.

Four kinds of simulation images are shown in FIG. 51. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 51 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 51, in the head T5—80 mm, a maximum amplitude point in the first-order mode is located on the crown.

Natural frequency in each of the orders of the head T5—80 mm was as follows as the result of the calculation.

First-order natural frequency H1: 3419 Hz
Second-order natural frequency H2: 3618 Hz
Third-order natural frequency H3: 3868 Hz
Fourth-order natural frequency H4: 3905 Hz

[Head T6]

[Head T6—45 mm]

A calculation model of a head T6—45 mm was obtained in the same manner as in the head T1 except that a rib t645 to be described later was provided on the sole as the rib (X). Natural value analysis was conducted using commercially available natural value analyzing software to calculate a natural frequency and a mode shape.

Figure 52:
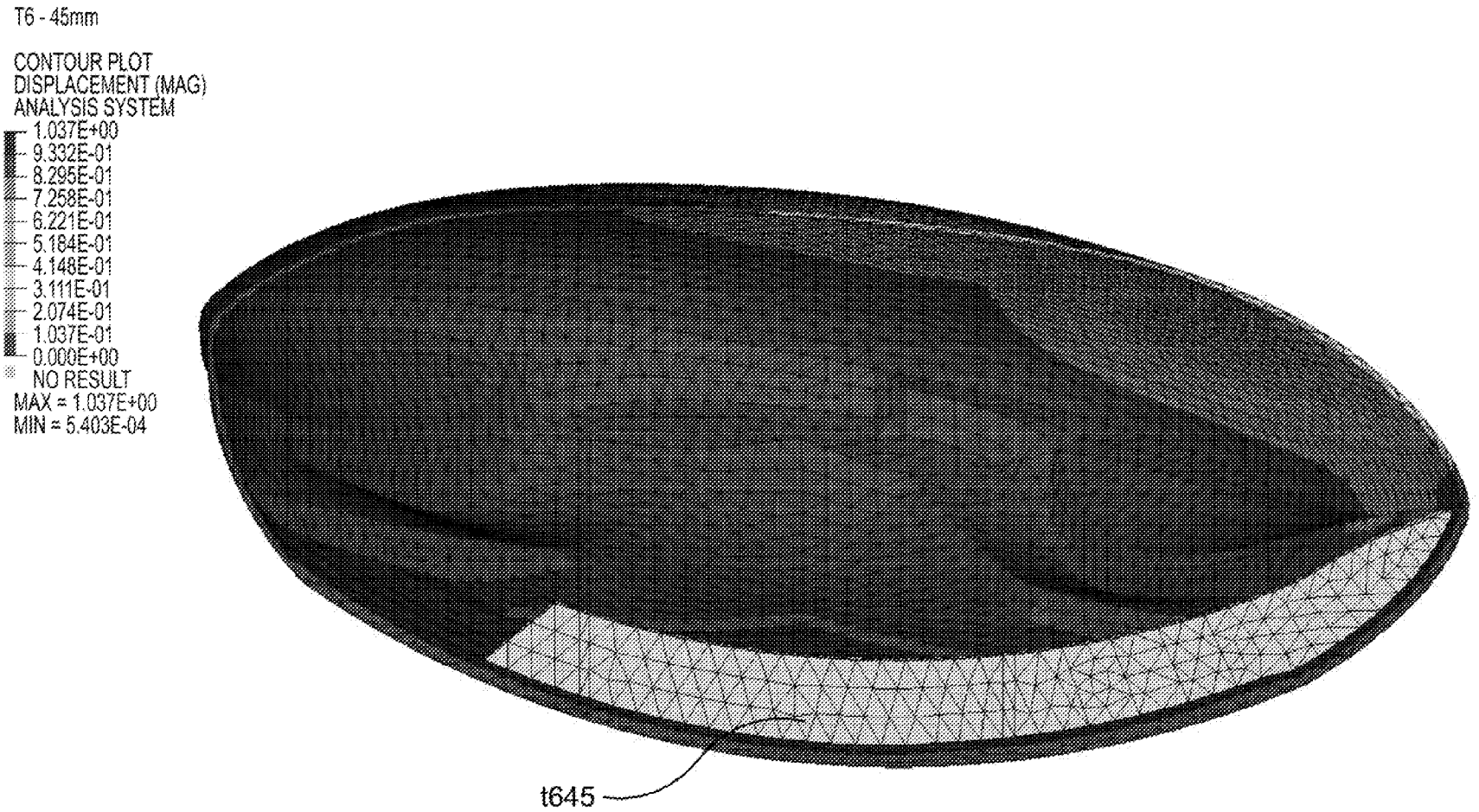
FIG. 52 is a simulation image of a head T6—45 mm.
Figure 53A:
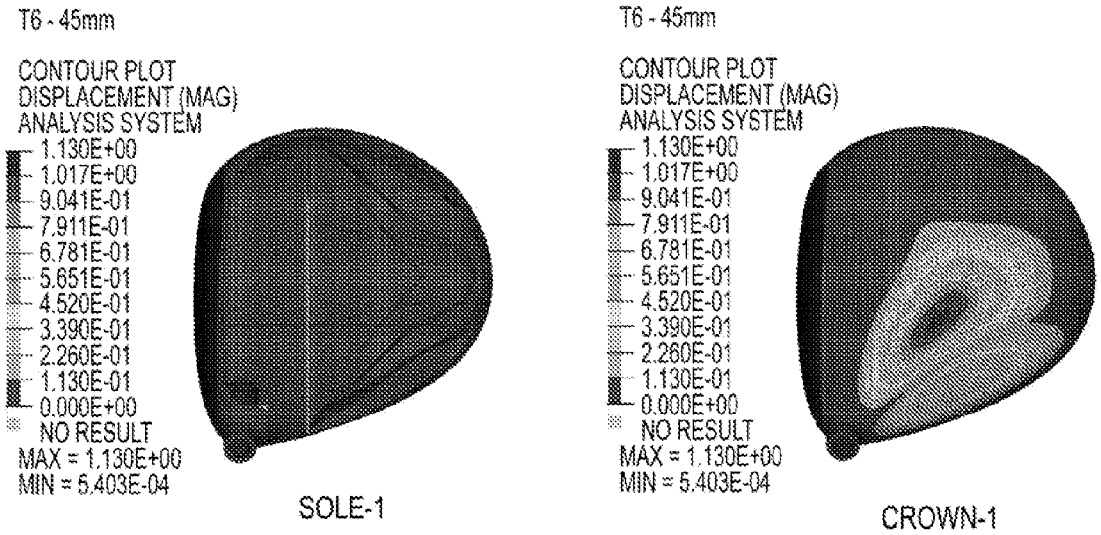
FIG. 53 is a simulation image of a head T6—45 mm.
Figure 53A:
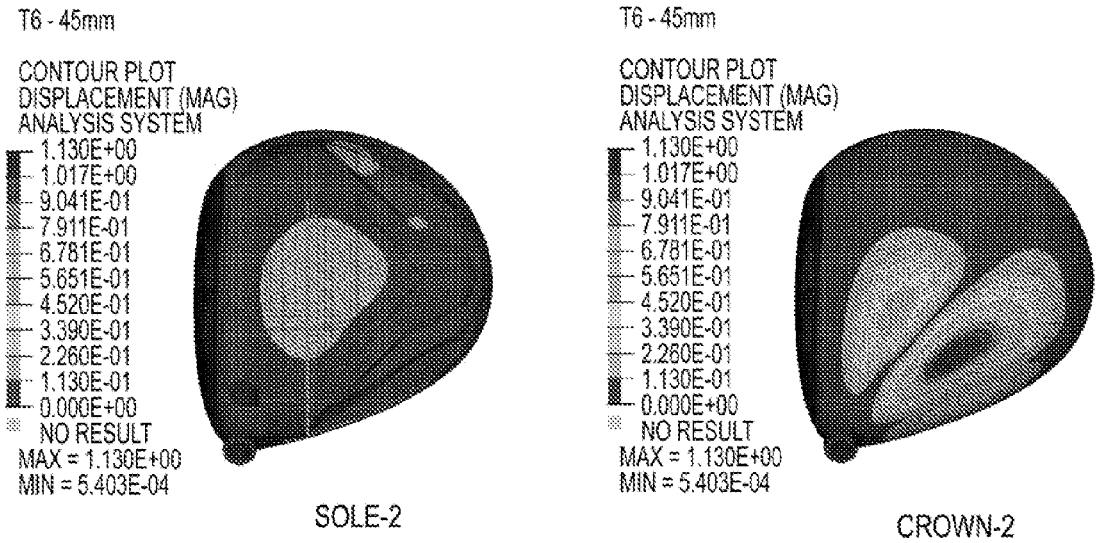
Figure 53B:
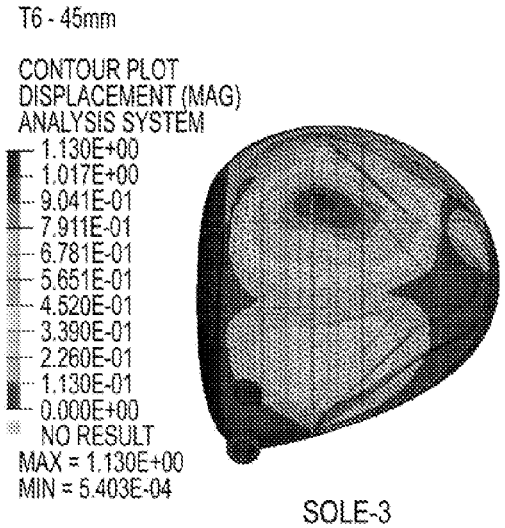
Figure 53B:
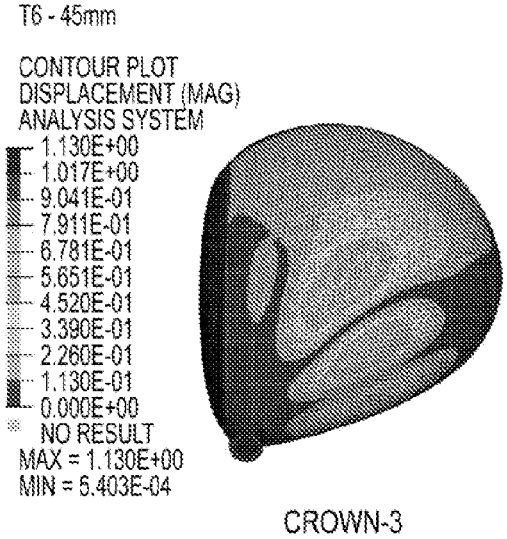
Figure 53B:
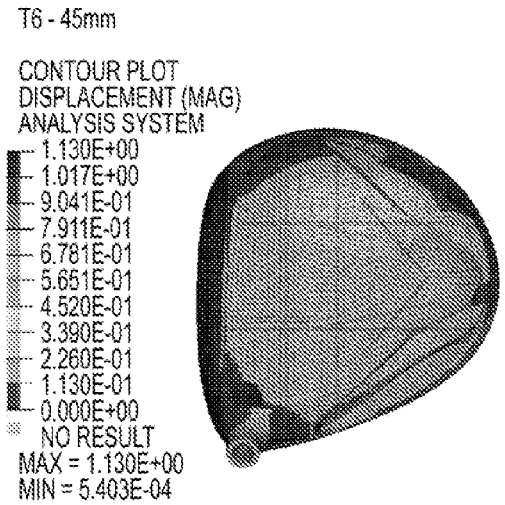
Figure 53B:
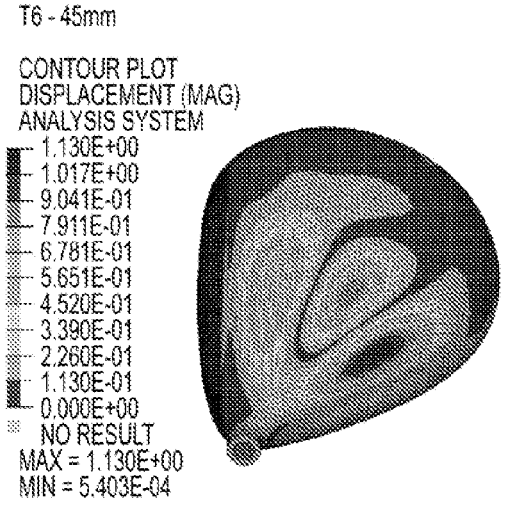

FIGS. 52 and 53 are simulation images showing the mesh-divided head T6—45 mm. FIG. 52 shows a back side portion of the head cut at the same position as that of line F2-F2 in FIG. 1. A shade of FIG. 52 shows a form of natural vibration in a first-order mode. A deeper portion has a greater amplitude.

As the position of the rib t645, the distance Wb (see FIG. 5) was set to 36 mm; the distance Vt (see FIG. 2) was set to 45 mm; and the distance Vh (see FIG. 2) was set to 0 mm.

Four kinds of simulation images are shown in FIG. 53. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 53 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 53, in the head T6—45 mm, a maximum amplitude point in the first-order mode is located on the crown.

Natural frequency in each of the orders of the head T6—45 mm was as follows as the result of the calculation.

First-order natural frequency H1: 3421 Hz
Second-order natural frequency H2: 3620 Hz
Third-order natural frequency H3: 3751 Hz
Fourth-order natural frequency H4: 3930 Hz

[Head T6—50 mm]

A calculation model of a head T6—50 mm was obtained in the same manner as in the head T1 except that a rib t650 to be described later was provided on the sole as the rib (X). Natural value analysis was conducted using commercially available natural value analyzing software to calculate a natural frequency and a mode shape.

Figure 54:
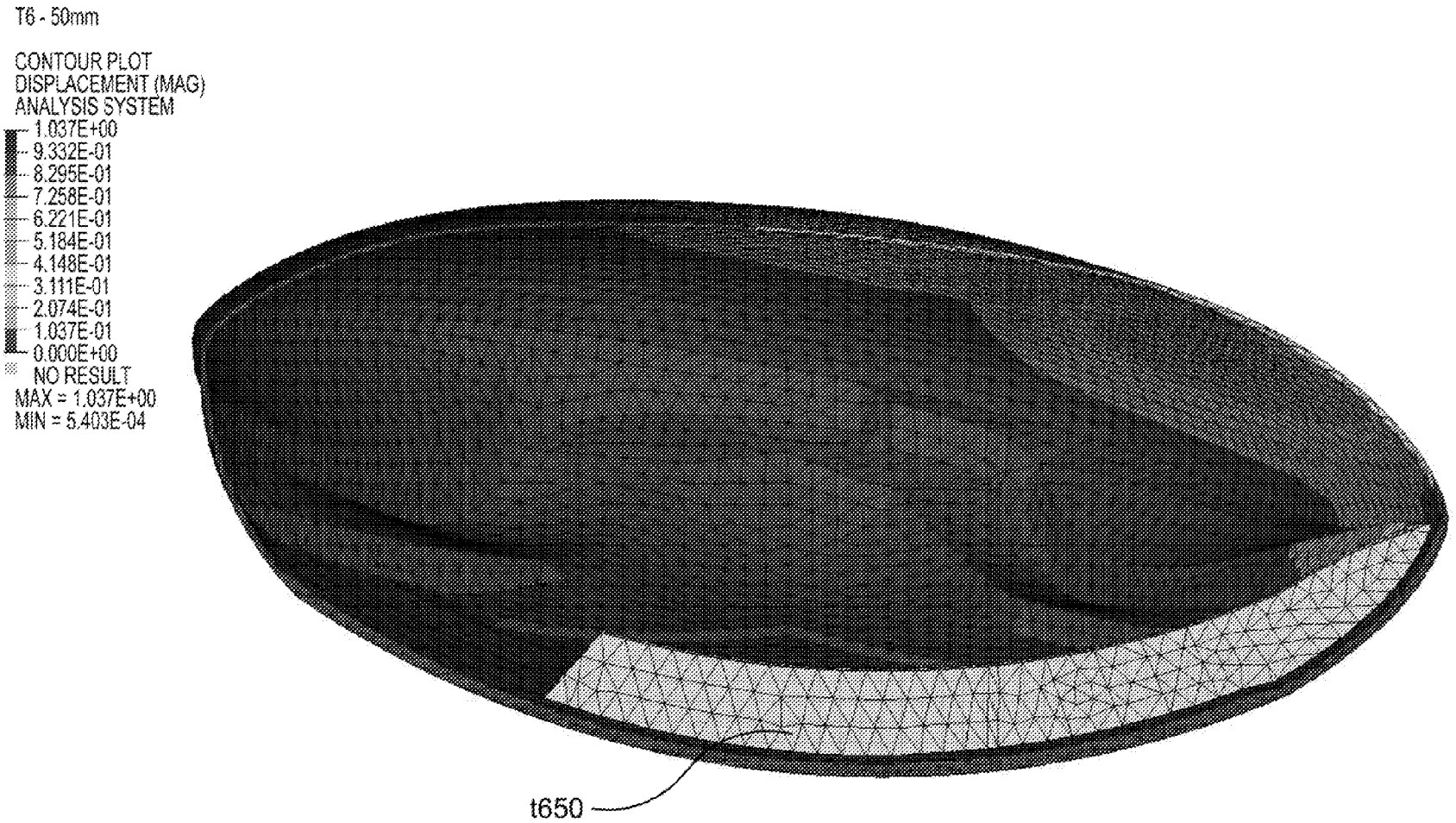
FIG. 54 is a simulation image of a head T6—50 mm.
Figure 55A:
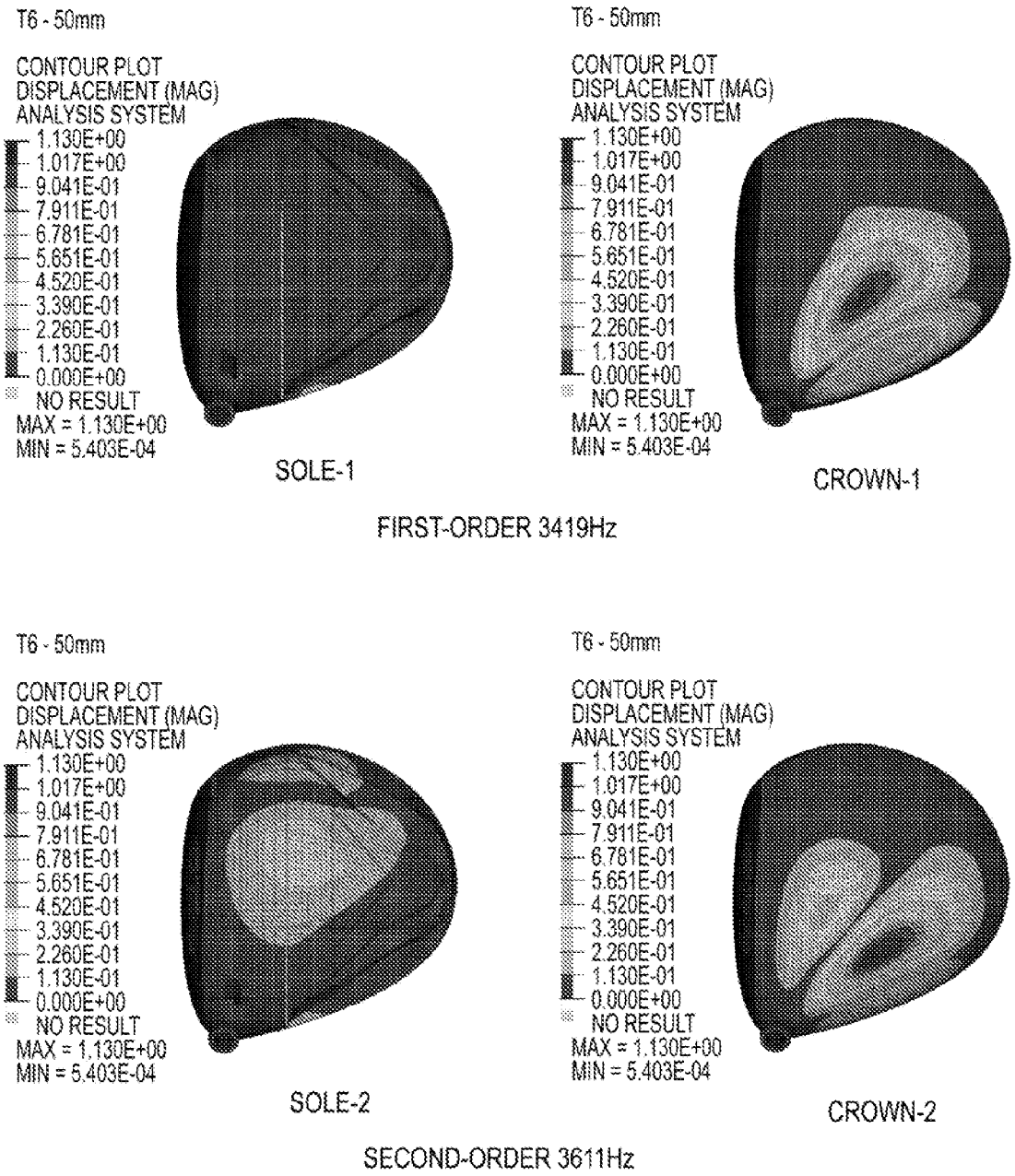
FIG. 55 is a simulation image of a head T6—50 mm.
Figure 55B:
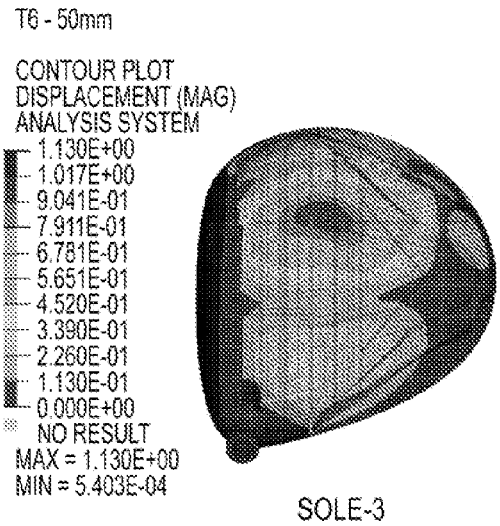
Figure 55B:
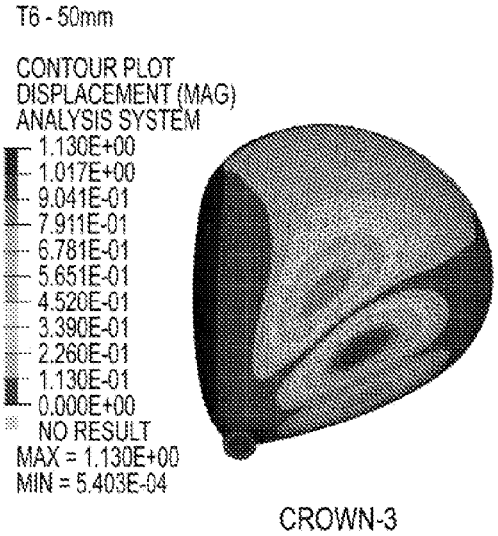
Figure 55B:
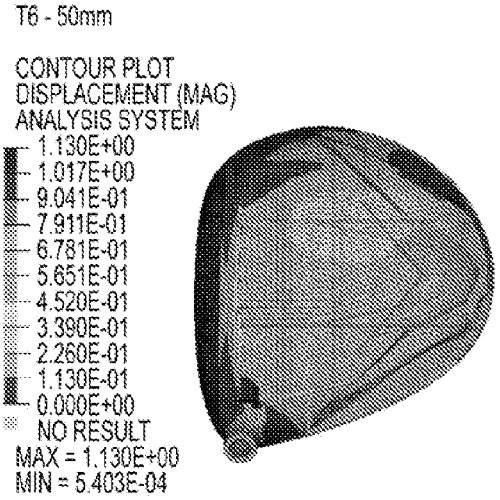
Figure 55B:
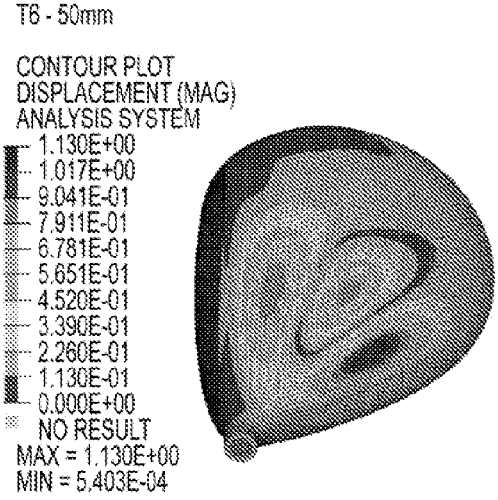

FIGS. 54 and 55 are simulation images showing the mesh-divided head T6—50 mm. FIG. 54 shows a back side portion of the head cut at the same position as that of line F2-F2 in FIG. 1. A shade of FIG. 54 shows a form of natural vibration in a first-order mode. A deeper portion has a greater amplitude.

As the position of the rib t650, the distance Wb (see FIG. 5) was set to 36 mm; the distance Vt (see FIG. 2) was set to 50 mm; and the distance Vh (see FIG. 2) was set to 0 mm.

Four kinds of simulation images are shown in FIG. 55. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 55 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 55, in the head T6—50 mm, a maximum amplitude point in the first-order mode is located on the crown.

Natural frequency in each of the orders of the head T6—50 mm was as follows as the result of the calculation.

First-order natural frequency H1: 3419 Hz
Second-order natural frequency H2: 3611 Hz
Third-order natural frequency H3: 3708 Hz
Fourth-order natural frequency H4: 3928 Hz

[Head T6—55 mm]

A calculation model of a head T6—55 mm was obtained in the same manner as in the head T1 except that a rib t655 to be described later was provided on the sole as the rib (X). Natural value analysis was conducted using commercially available natural value analyzing software to calculate a natural frequency and a mode shape.

Figure 56:
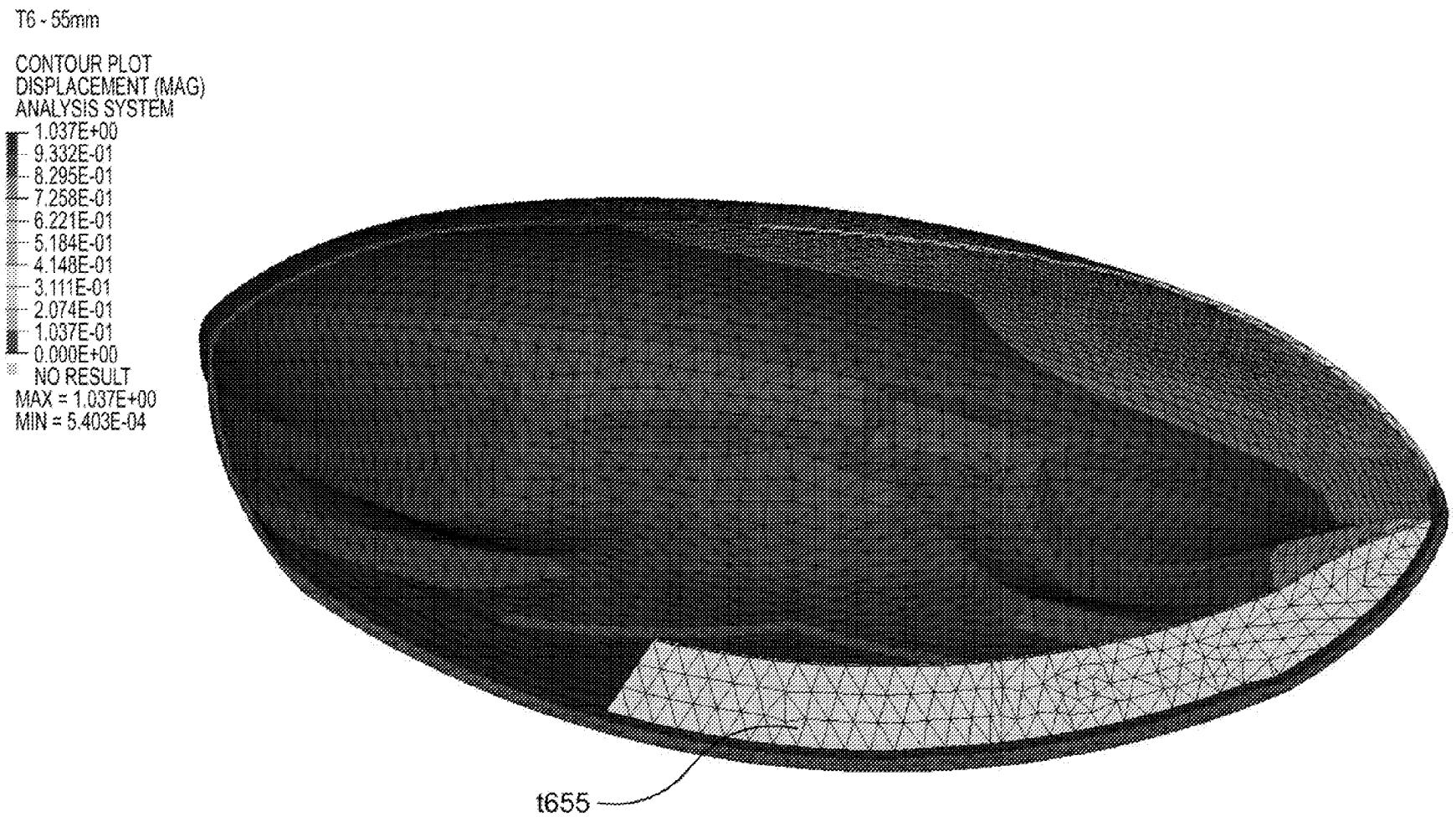
FIG. 56 is a simulation image of a head T6—55 mm.
Figure 57A:
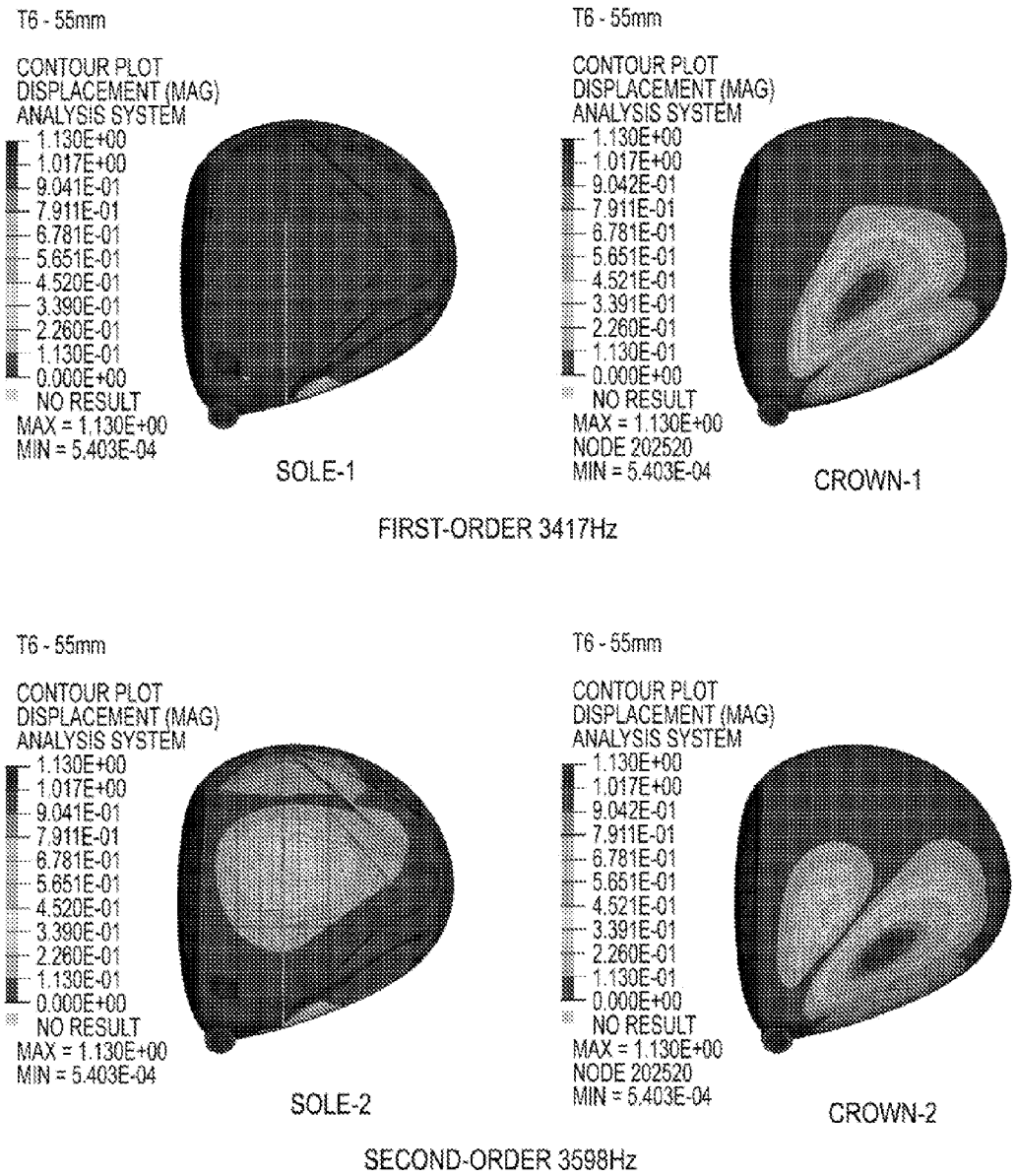
FIG. 57 is a simulation image of a head T6—55 mm.
Figure 57B:
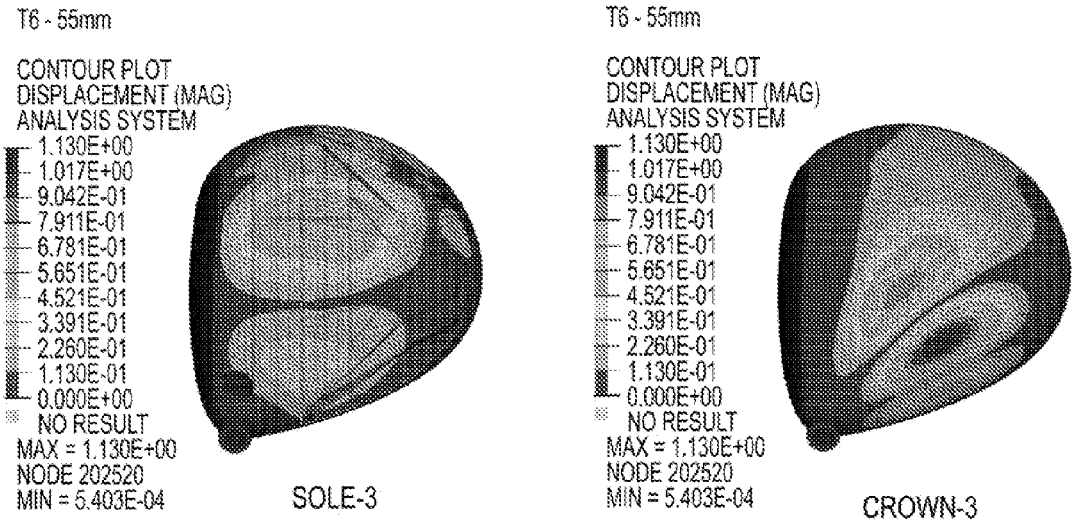
Figure 57B:
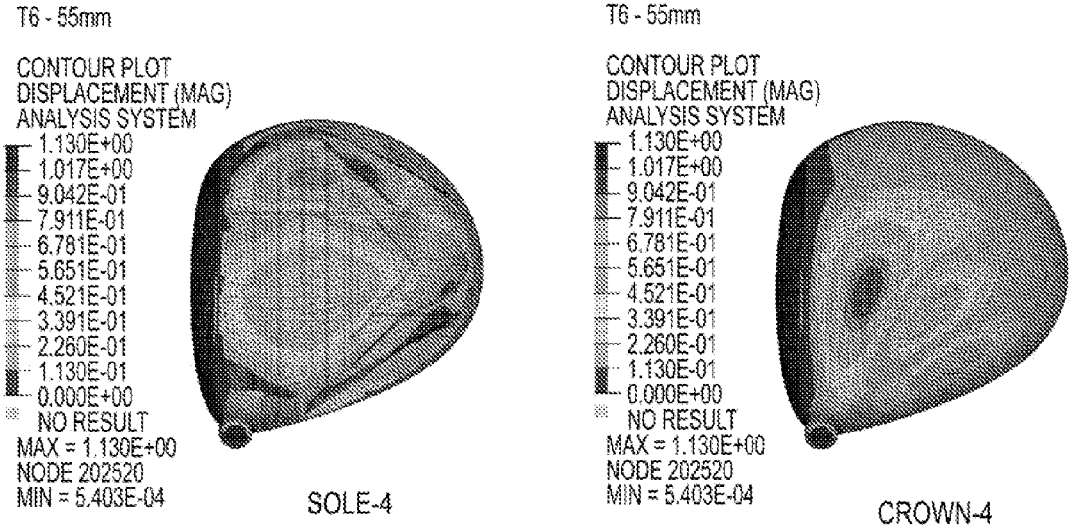

FIGS. 56 and 57 are simulation images showing the mesh-divided head T6—55 mm. FIG. 56 shows a back side portion of the head cut at the same position as that of line F2-F2 in FIG. 1. A shade of FIG. 56 shows a form of natural vibration in a first-order mode. A deeper portion has a greater amplitude.

As the position of the rib t655, the distance Wb (see FIG. 5) was set to 36 mm; the distance Vt (see FIG. 2) was set to 55 mm; and the distance Vh (see FIG. 2) was set to 0 mm.

Four kinds of simulation images are shown in FIG. 57. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 57 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 57, in the head T6—55 mm, a maximum amplitude point in the first-order mode is located on the crown.

Natural frequency in each of the orders of the head T6—55 mm was as follows as the result of the calculation.

First-order natural frequency H1: 3417 Hz
Second-order natural frequency H2: 3598 Hz
Third-order natural frequency H3: 3710 Hz
Fourth-order natural frequency H4: 3913 Hz

[Head T6—60 mm]

A calculation model of a head T6—60 mm was obtained in the same manner as in the head T1 except that a rib t660 to be described later was provided on the sole as the rib (X). Natural value analysis was conducted using commercially available natural value analyzing software to calculate a natural frequency and a mode shape.

Figure 58:
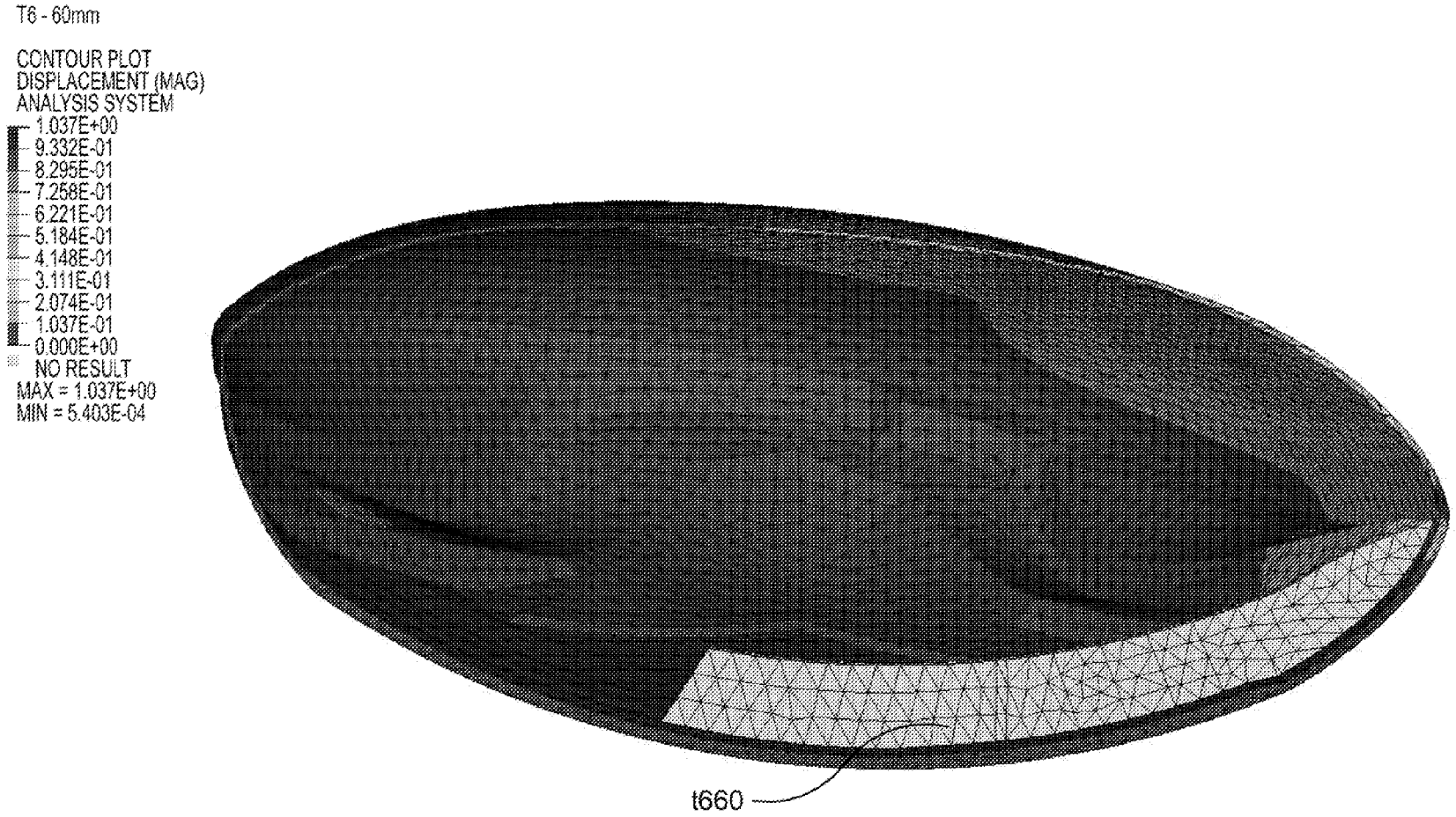
FIG. 58 is a simulation image of a head T6—60 mm.
Figure 59A:
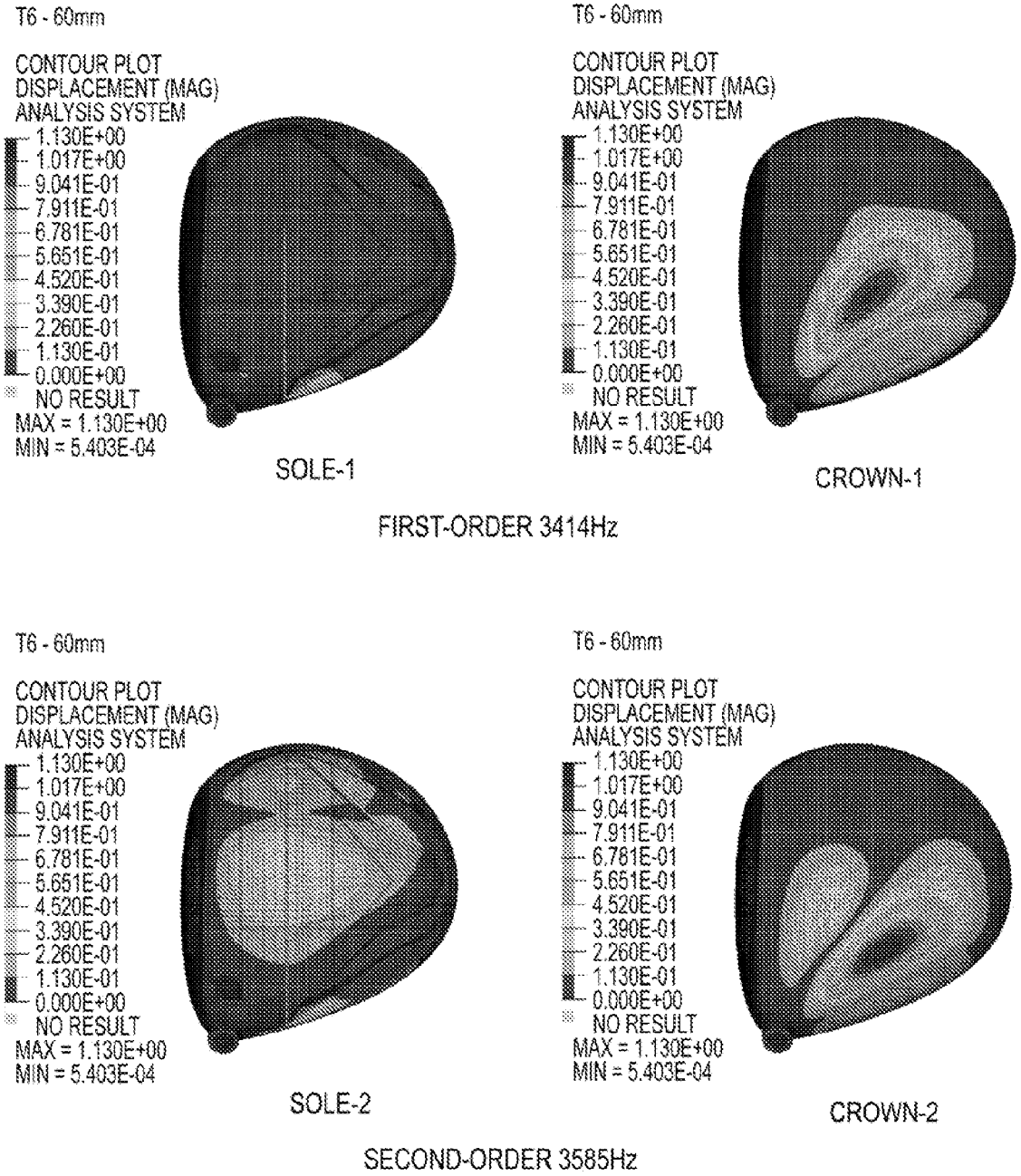
FIG. 59 is a simulation image of a head T6—60 mm.
Figure 59B:
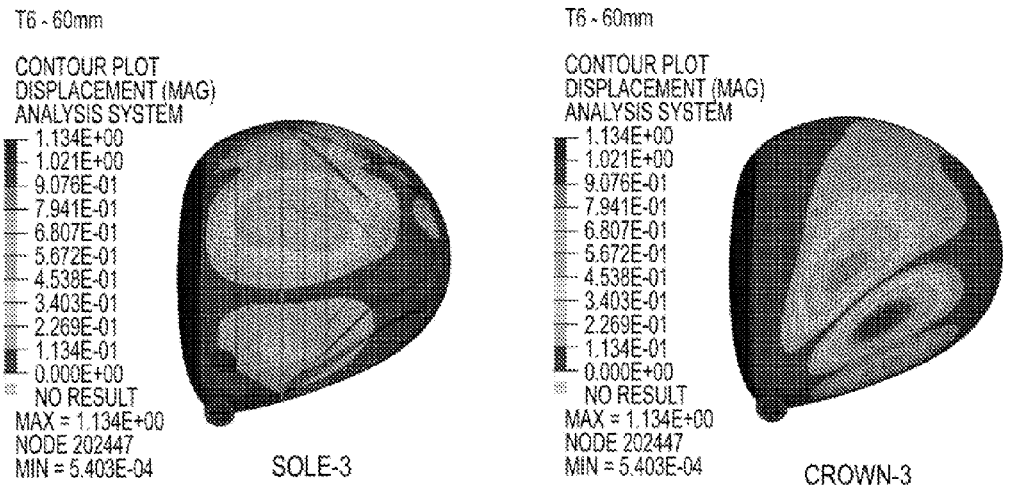
Figure 59B:
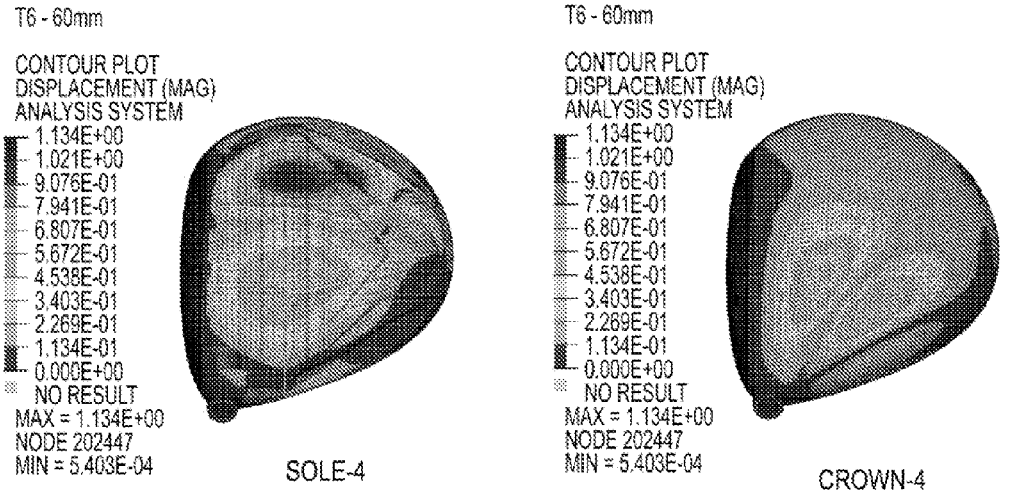

FIGS. 58 and 59 are simulation images showing the mesh-divided head T6—60 mm. FIG. 58 shows a back side portion of the head cut at the same position as that of line F2-F2 in FIG. 1. A shade of FIG. 58 shows a form of natural vibration in a first-order mode. A deeper portion has a greater amplitude.

As the position of the rib t660, the distance Wb (see FIG. 5) was set to 36 mm; the distance Vt (see FIG. 2) was set to 60 mm; and the distance Vh (see FIG. 2) was set to 0 mm.

Four kinds of simulation images are shown in FIG. 59. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 59 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 59, in the head T6—60 mm, a maximum amplitude point in the first-order mode is located on the crown.

Natural frequency in each of the orders of the head T6—60 mm was as follows as the result of the calculation.

First-order natural frequency H1: 3414 Hz
Second-order natural frequency H2: 3585 Hz
Third-order natural frequency H3: 3723 Hz
Fourth-order natural frequency H4: 3827 Hz

[Head T6—65 mm]

A calculation model of a head T6—65 mm was obtained in the same manner as in the head T1 except that a rib t665 to be described later was provided on the sole as the rib (X). Natural value analysis was conducted using commercially available natural value analyzing software to calculate a natural frequency and a mode shape.

Figure 60:
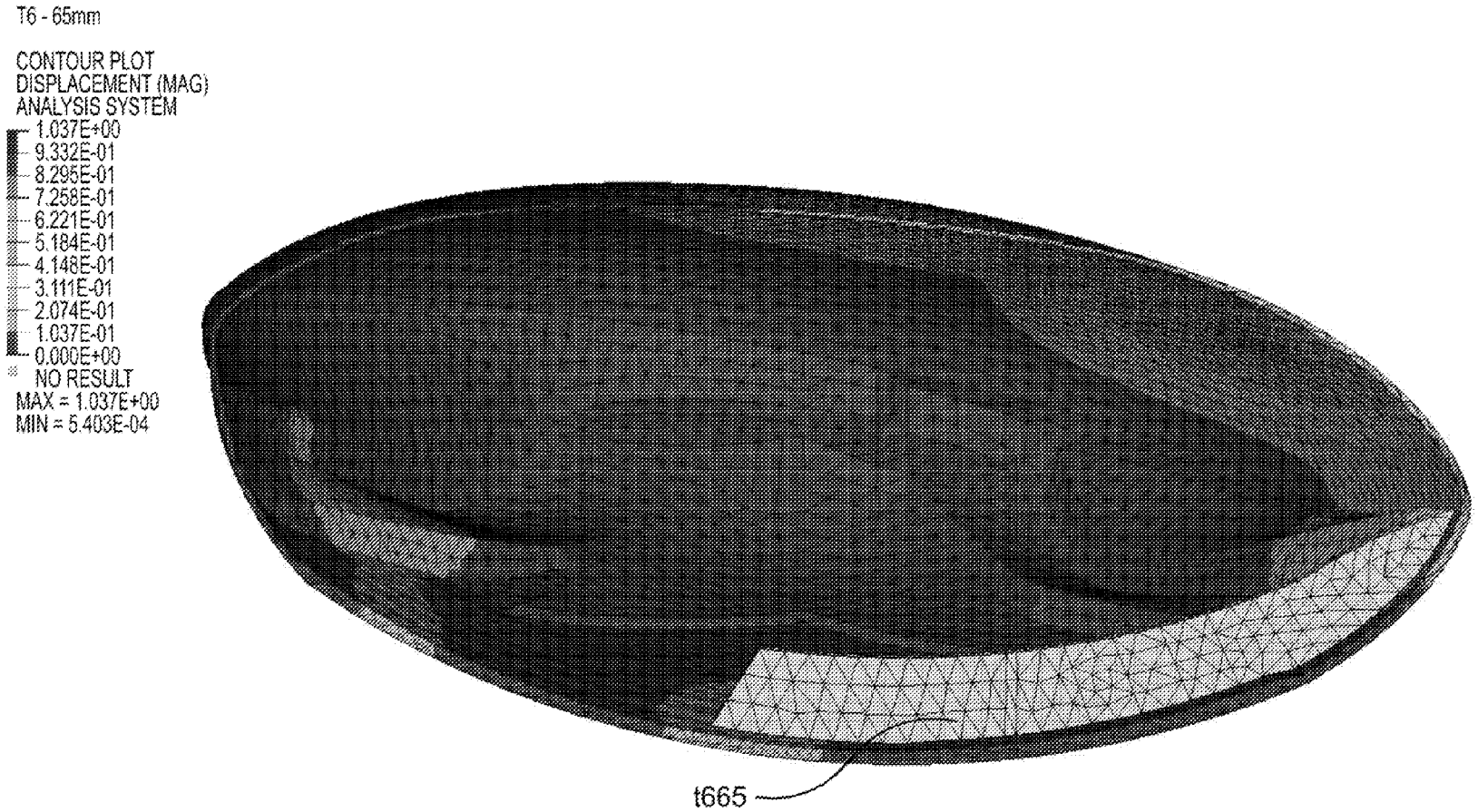
FIG. 60 is a simulation image of a head T6—65 mm.
Figure 61A:
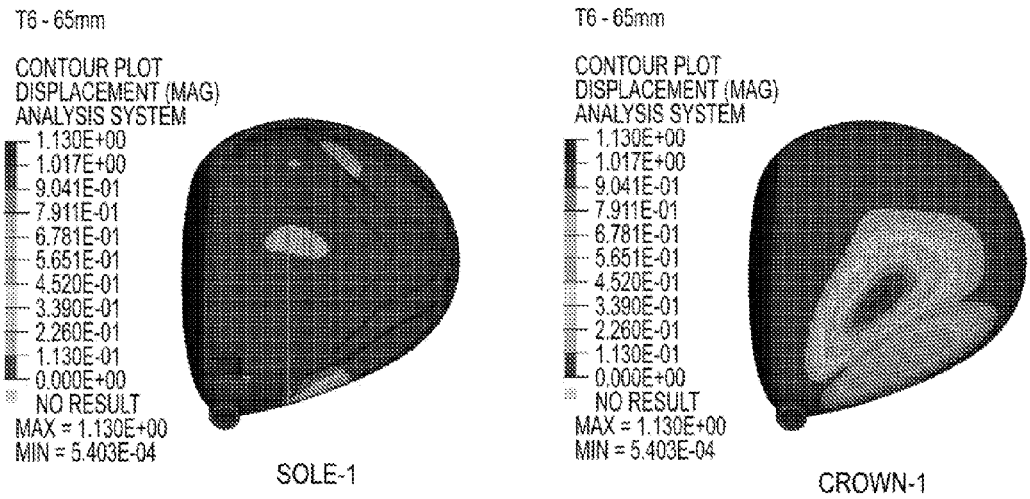
FIG. 61 is a simulation image of a head T6—65 mm.
Figure 61A:
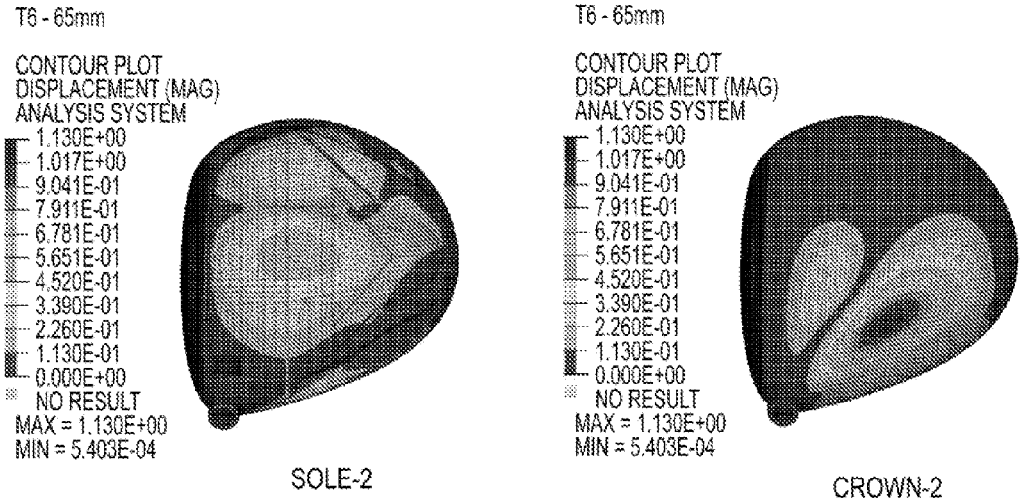
Figure 61B:
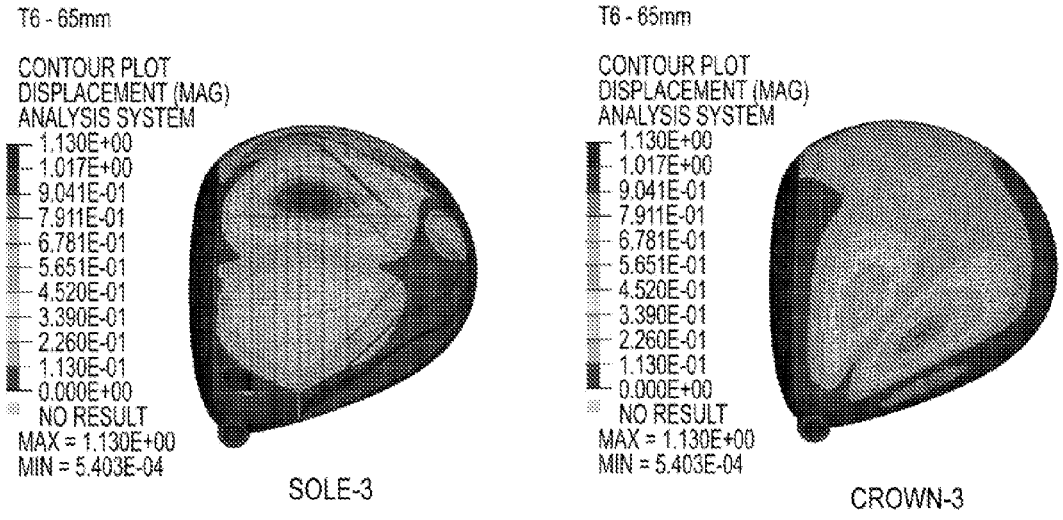
Figure 61B:
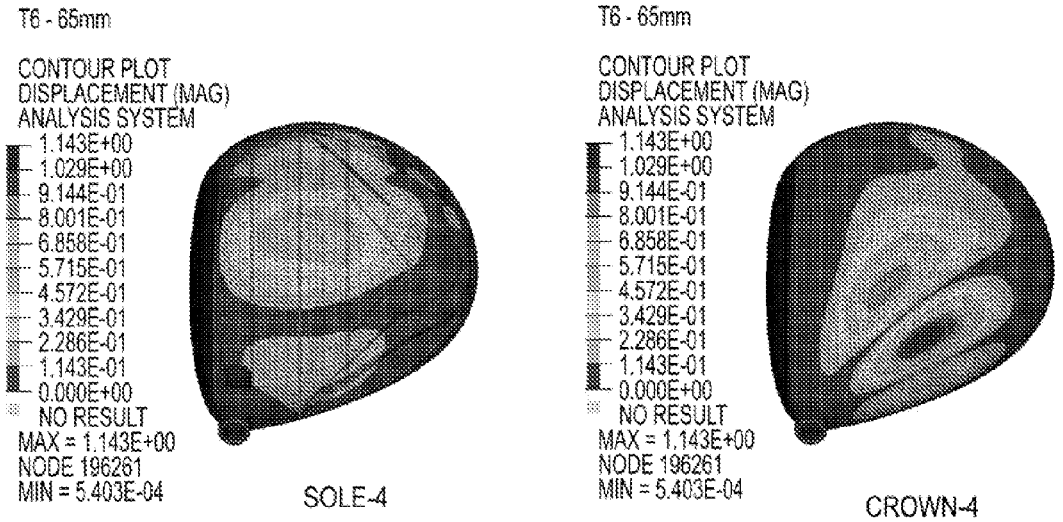

FIGS. 60 and 61 are simulation images showing the mesh-divided head T6—65 mm. FIG. 60 shows a back side portion of the head cut at the same position as that of line F2-F2 in FIG. 1. A shade of FIG. 60 shows a form of natural vibration in a first-order mode. A deeper portion has a greater amplitude.

As the position of the rib t665, the distance Wb (see FIG. 5) was set to 36 mm; the distance Vt (see FIG. 2) was set to 65 mm; and the distance Vh (see FIG. 2) was set to 0 mm.

Four kinds of simulation images are shown in FIG. 61. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 61 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 61, in the head T6—65 mm, a maximum amplitude point in the first-order mode is located on the crown.

Natural frequency in each of the orders of the head T6—65 mm was as follows as the result of the calculation.

First-order natural frequency H1: 3411 Hz
Second-order natural frequency H2: 3557 Hz
Third-order natural frequency H3: 3716 Hz
Fourth-order natural frequency H4: 3739 Hz

[Head T6—70 mm]

A calculation model of a head T6—70 mm was obtained in the same manner as in the head T1 except that a rib t670 to be described later was provided on the sole as the rib (X). Natural value analysis was conducted using commercially available natural value analyzing software to calculate a natural frequency and a mode shape.

Figure 62:
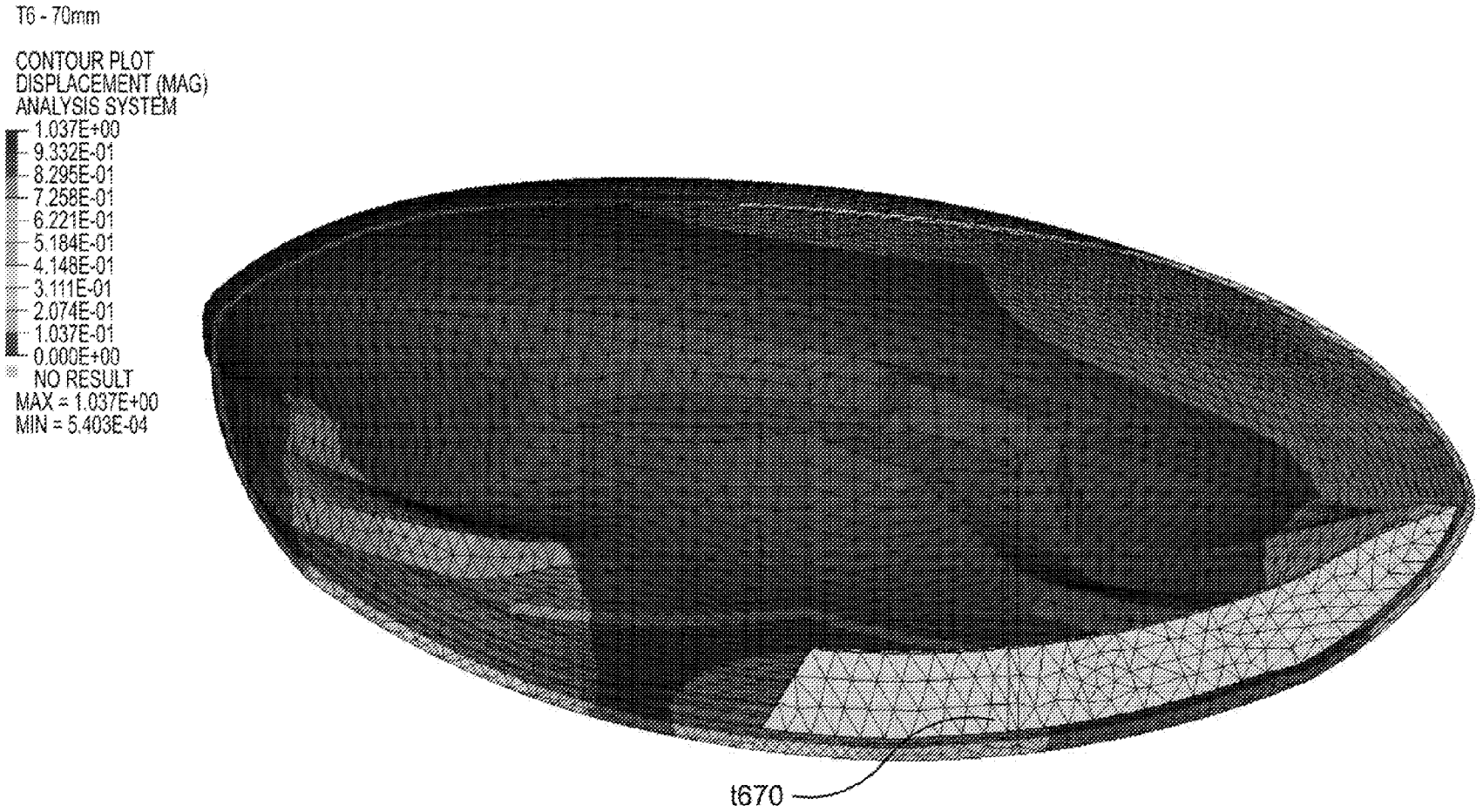
FIG. 62 is a simulation image of a head T6—70 mm.
Figure 63A:
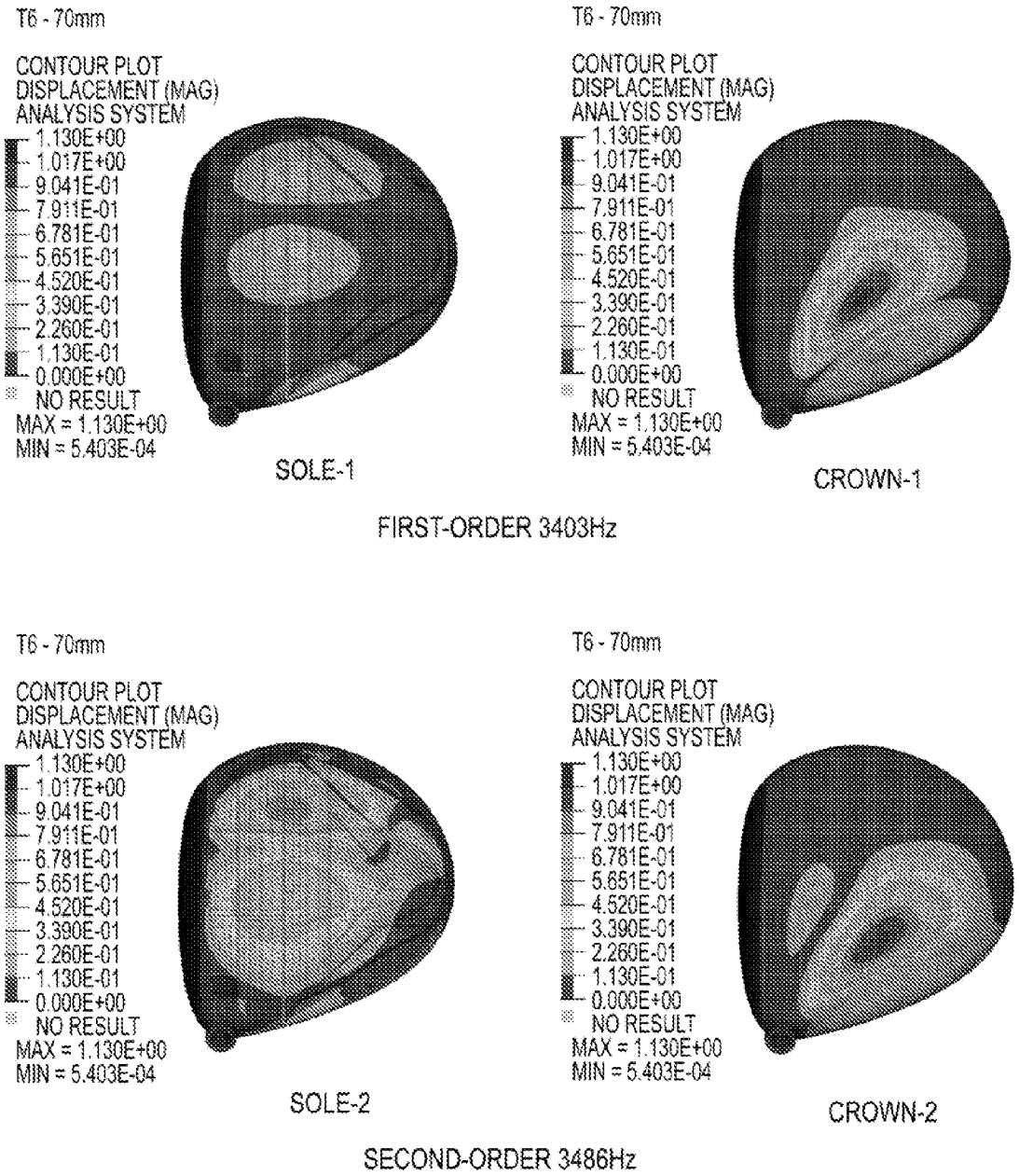
FIG. 63 is a simulation image of a head T6—70 mm.
Figure 63B:
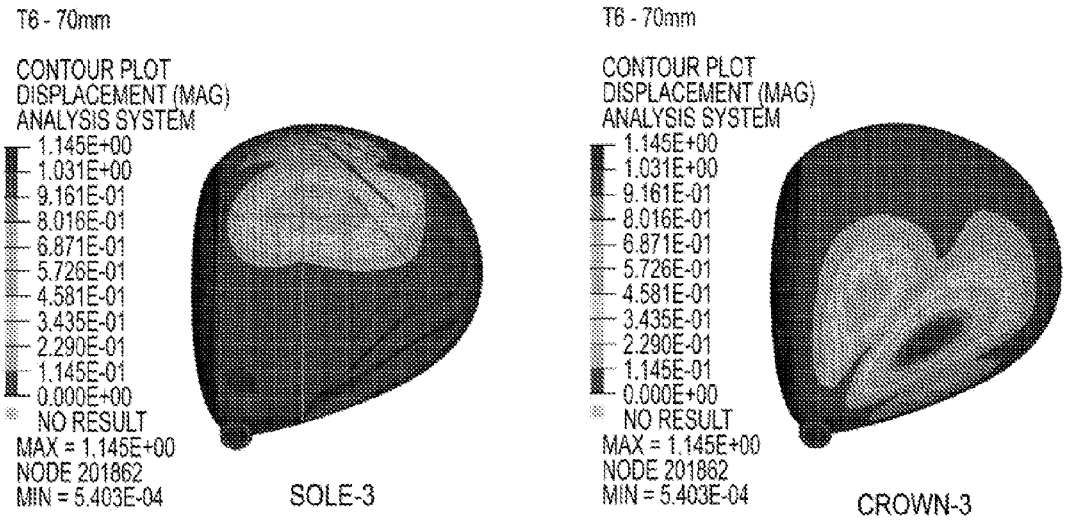
Figure 63B:
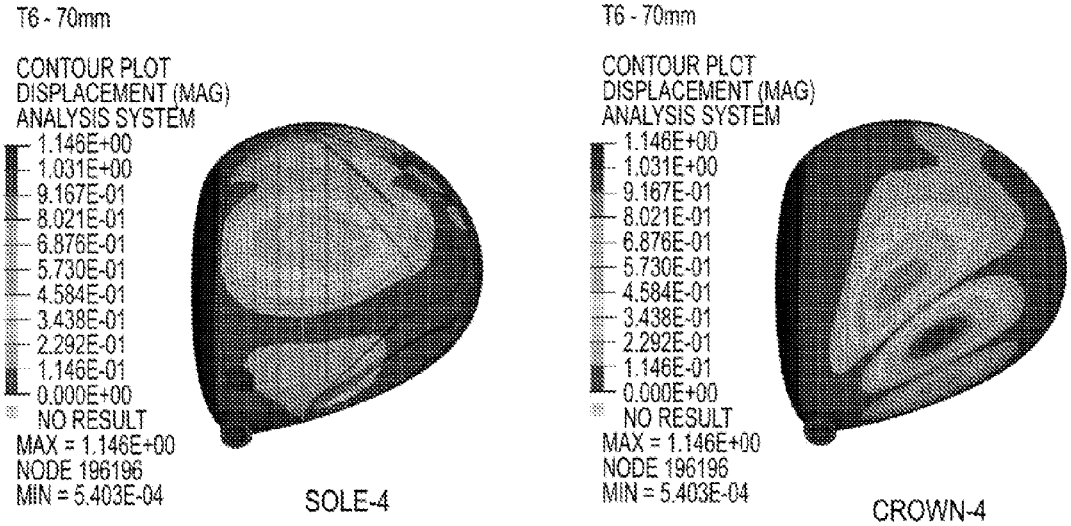

FIGS. 62 and 63 are simulation images showing the mesh-divided head T6—70 mm. FIG. 62 shows a back side portion of the head cut at the same position as that of line F2-F2 in FIG. 1. A shade of FIG. 62 shows a form of natural vibration in a first-order mode. A deeper portion has a greater amplitude.

As the position of the rib t670, the distance Wb (see FIG. 5) was set to 36 mm; the distance Vt (see FIG. 2) was set to 70 mm; and the distance Vh (see FIG. 2) was set to 0 mm.

Four kinds of simulation images are shown in FIG. 63. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 63 are images viewed from a crown side. Therefore, the SOLE-1, the SOLE-2, the SOLE-3, and the SOLE-4 are perspective views in which a sole is viewed from the crown side.

As shown in the image CROWN-1 in FIG. 63, in the head T6—70 mm, a maximum amplitude point in the first-order mode is located on the crown.

Natural frequency in each of the orders of the head T6—70 mm was as follows as the result of the calculation.

First-order natural frequency H1: 3403 Hz
Second-order natural frequency H2: 3486 Hz
Third-order natural frequency H3: 3648 Hz
Fourth-order natural frequency H4: 3751 Hz

[Head T6—75 mm]

A calculation model of a head T6—75 mm was obtained in the same manner as in the head T1 except that a rib t675 to be described later was provided on the sole as the rib (X). Natural value analysis was conducted using commercially available natural value analyzing software to calculate a natural frequency and a mode shape.

Figure 64:
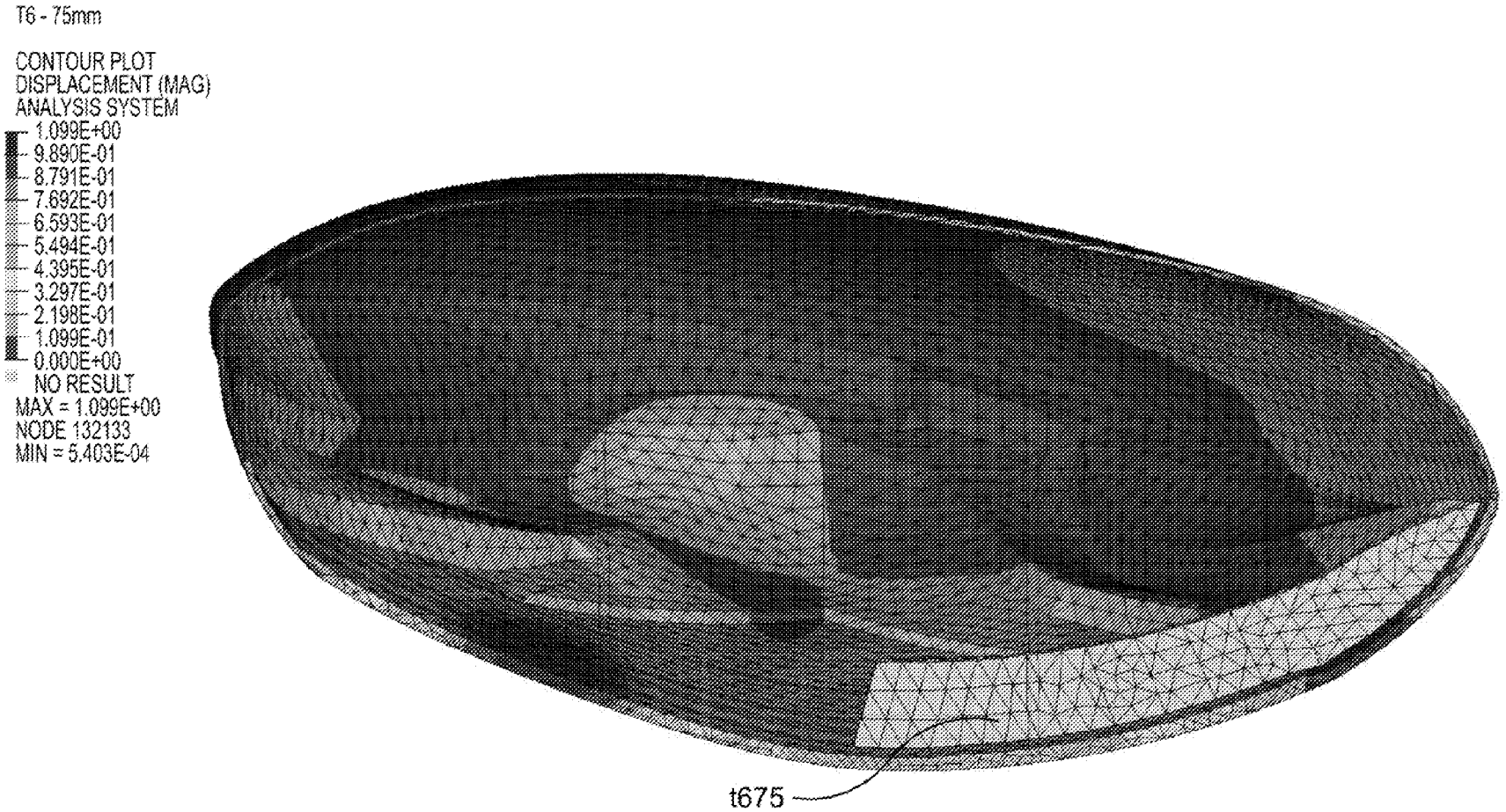
FIG. 64 is a simulation image of a head T6—75 mm.
Figure 65A:
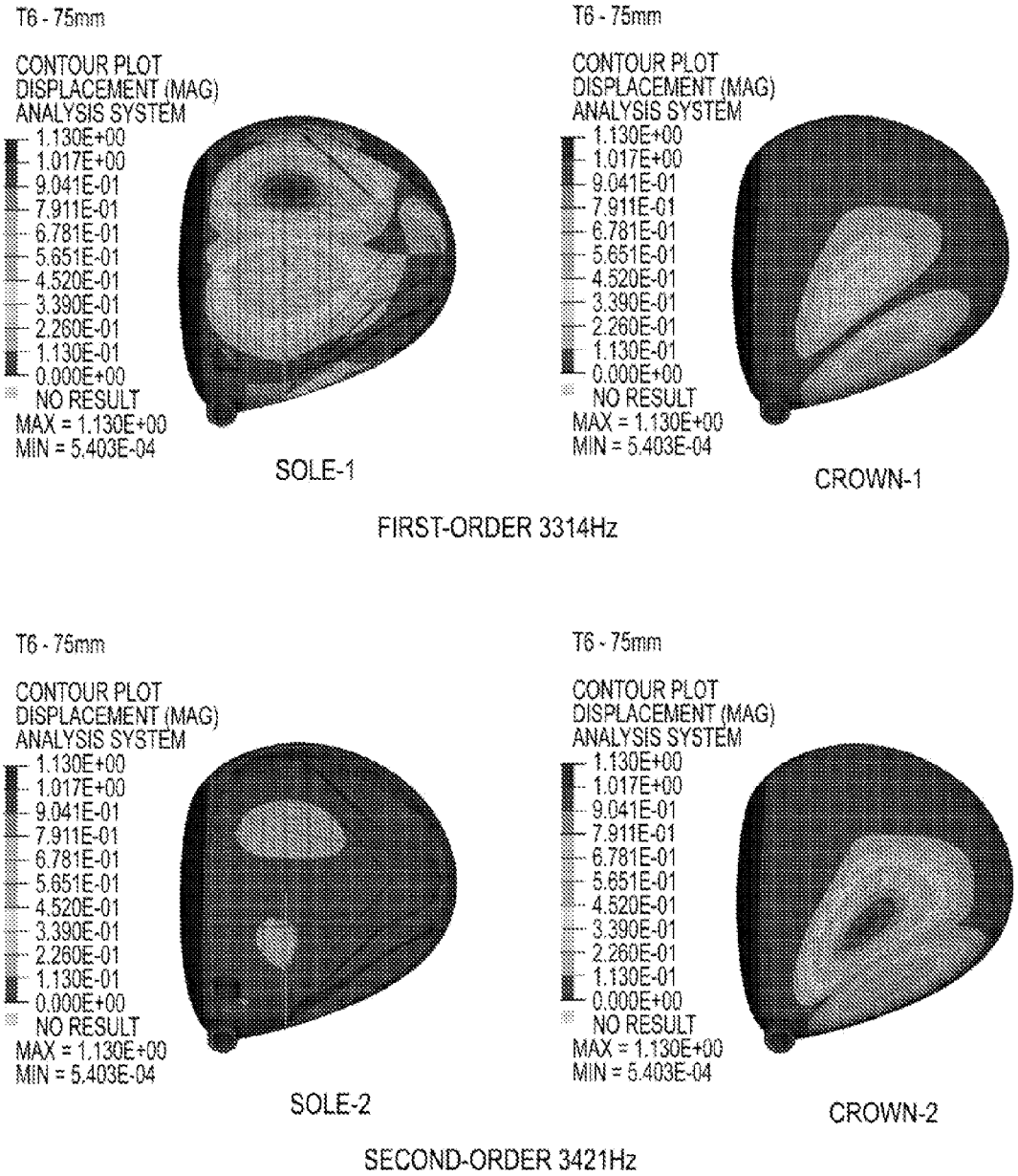
FIG. 65 is a simulation image of a head T6—75 mm.
Figure 65B:
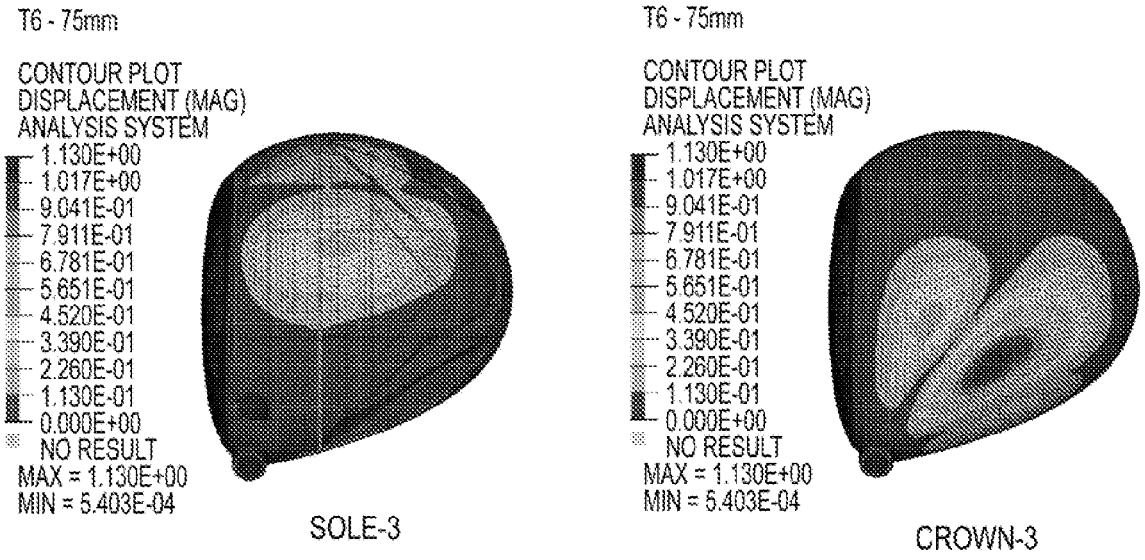
Figure 65B:
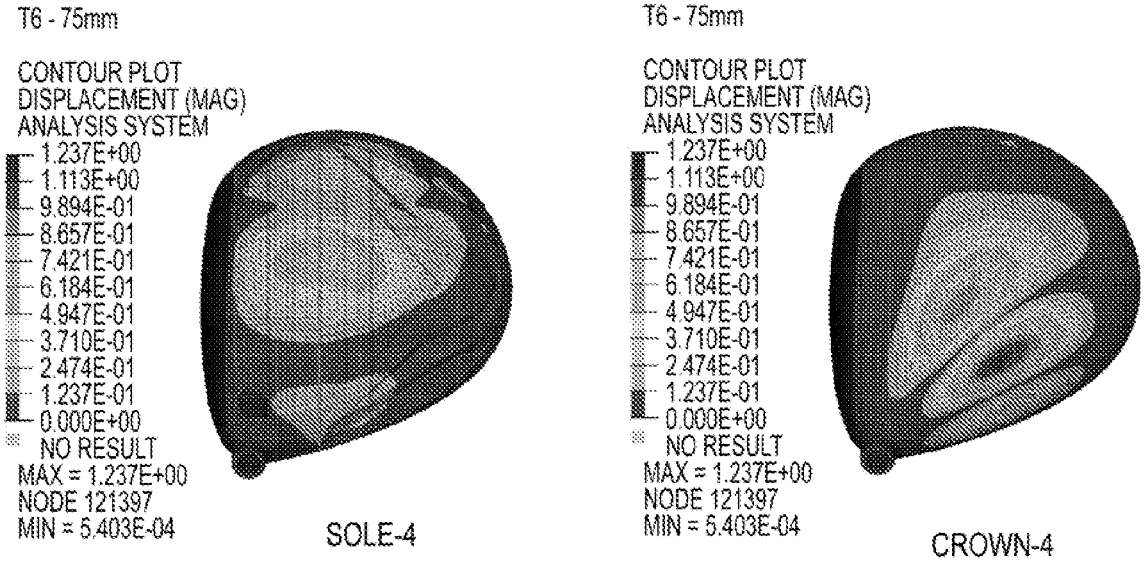

FIGS. 64 and 65 are simulation images showing the mesh-divided head T6—75 mm. FIG. 64 shows a back side portion of the head cut at the same position as that of line F2-F2 in FIG. 1. A shade of FIG. 64 shows a form of natural vibration in a first-order mode. A deeper portion has a greater amplitude.

As the position of the rib t675, the distance Wb (see FIG. 5) was set to 36 mm; the distance Vt (see FIG. 2) was set to 75 mm; and the distance Vh (see FIG. 2) was set to 0 mm.

Four kinds of simulation images are shown in FIG. 65. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 65 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 65, in the head T6—75 mm, a maximum amplitude point in the first-order mode is located on the sole.

Natural frequency in each of the orders of the head T6—75 mm was as follows as the result of the calculation.

First-order natural frequency H1: 3314 Hz
Second-order natural frequency H2: 3421 Hz
Third-order natural frequency H3: 3618 Hz
Fourth-order natural frequency H4: 3756 Hz

[Head T6—80 mm]

A calculation model of a head T6—80 mm was obtained in the same manner as in the head T1 except that a rib t680 to be described later was provided on the sole as the rib (X). Natural value analysis was conducted using commercially available natural value analyzing software to calculate a natural frequency and a mode shape.

Figure 66:
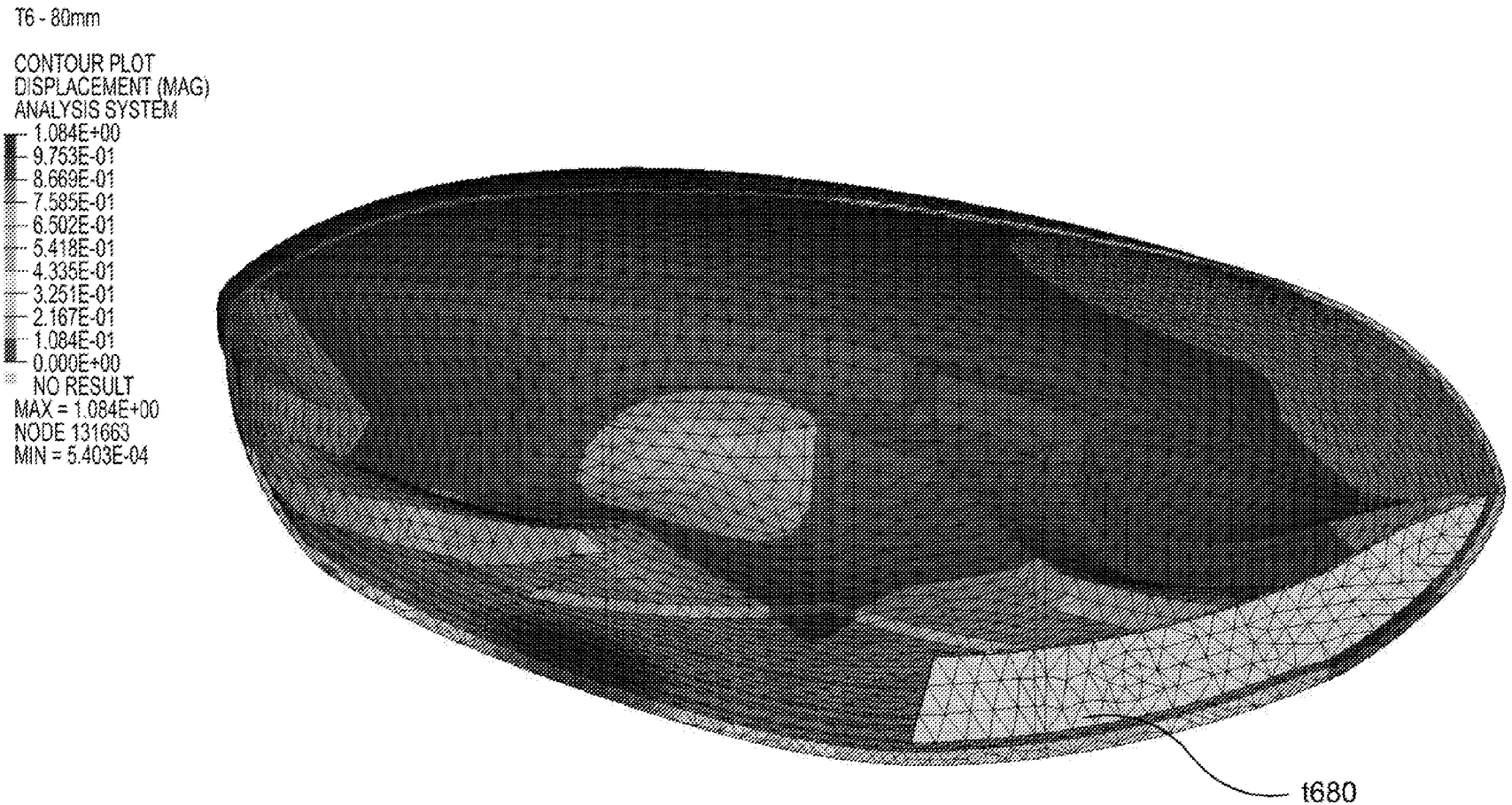
FIG. 66 is a simulation image of a head T6—80 mm.
Figure 67A:
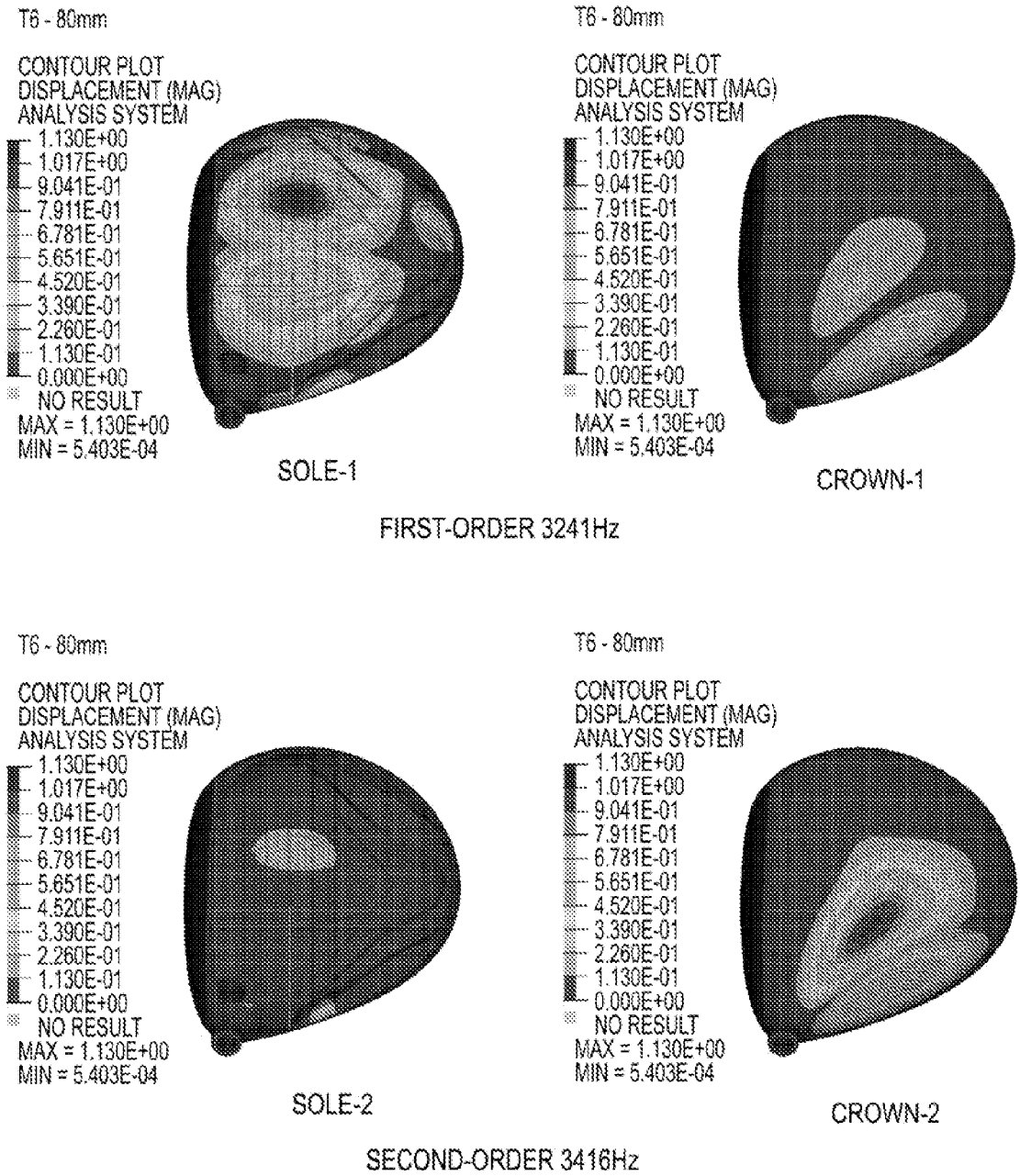
FIG. 67 is a simulation image of a head T6—80 mm.
Figure 67B:
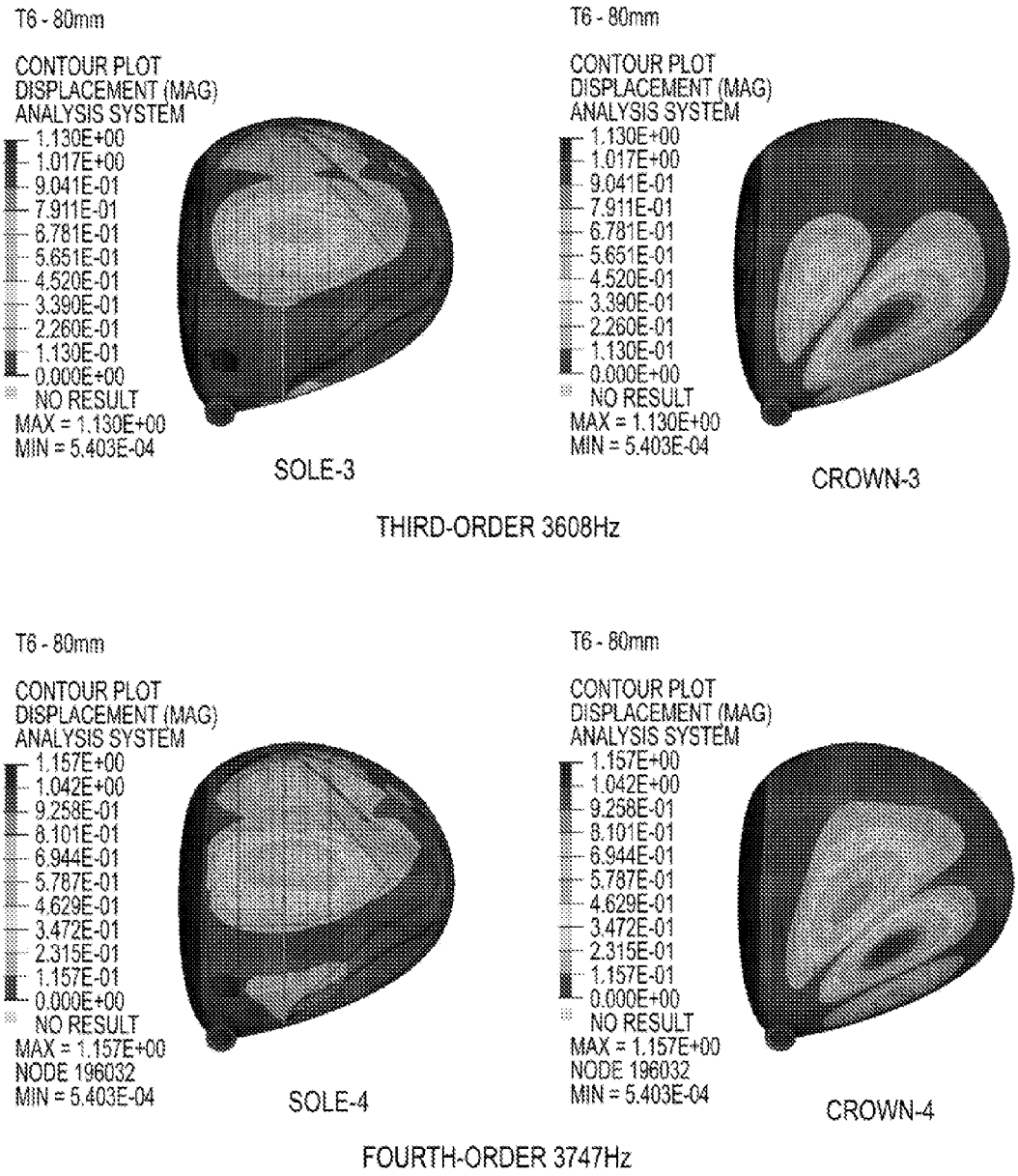

FIGS. 66 and 67 are simulation images showing the mesh-divided head T6—80 mm. FIG. 66 shows a back side portion of the head cut at the same position as that of line F2-F2 in FIG. 1. A shade of FIG. 66 shows a form of natural vibration in a first-order mode. A deeper portion has a greater amplitude.

As the position of the rib t680, the distance Wb (see FIG. 5) was set to 36 mm; the distance Vt (see FIG. 2) was set to 80 mm; and the distance Vh (see FIG. 2) was set to 0 mm.

Four kinds of simulation images are shown in FIG. 67. Two upper left head images (SOLE-1 and CROWN-1) show the form of the natural vibration in the first-order mode. Two upper right head images (SOLE-2 and CROWN-2) show a form of natural vibration in a second-order mode. Two lower left head images (SOLE-3 and CROWN-3) show a form of natural vibration in a third-order mode. Two lower right head images (SOLE-4 and CROWN-4) show a form of natural vibration in a fourth-order mode. A deeper portion has a greater amplitude.

All of the images in FIG. 67 are images viewed from a crown side. Therefore, the SOLE-1, the SOLE-2, the SOLE-3, and the SOLE-4 are perspective views in which a sole is viewed from the crown side.

As shown in the image SOLE-1 in FIG. 67, in the head T6—80 mm, a maximum amplitude point in the first-order mode is located on the sole.

Natural frequency in each of the orders of the head T6—80 mm was as follows as the result of the calculation.

First-order natural frequency H1: 3241 Hz
Second-order natural frequency H2: 3416 Hz
Third-order natural frequency H3: 3608 Hz
Fourth-order natural frequency H4: 3747 Hz In the simulation 1, the face-back direction positions of the ribs (X) (the ribs T2 to T6) were set to the position shown by the virtual line in FIG. 8.

A position of an end of each of the ribs (X) is as follows.

A toe side end of T3—10 mm: a region between contour lines CL10 and CL20 (specifically, a point having an amplitude ratio Rh of about 10%)

A heel side end of T3—10 mm: a region having an amplitude ratio Rh of equal to or less than 10% (specifically, a point having the amplitude ratio Rh is about 5%)

A toe side end of T3—15 mm: a region between contour lines CL10 and CL20 (specifically, a point having an amplitude ratio Rh of about 10%)

A heel side end of T3—15 mm: a region having an amplitude ratio Rh of equal to or less than 10% (specifically, a point having the amplitude ratio Rh is about 10%)

A toe side end of T3—30 mm: a region between contour lines CL20 and CL30 (specifically, a point having an amplitude ratio Rh of about 30%)

A heel side end of T3—30 mm: a region between contour lines CL20 and CL30 (specifically, a point having an amplitude ratio Rh of about 20%)

A toe side end of T3—35 mm: a region between contour lines CL20 and CL30 (specifically, a point having an amplitude ratio Rh of about 30%)

A heel side end of T3—35 mm: a region between contour lines CL30 and CL40 (specifically, a point having an amplitude ratio Rh of about 40%)

A toe side end of T3—40 mm: a region between contour lines CL40 and CL50 (specifically, a point having an amplitude ratio Rh of about 50%)

A heel side end of T3—40 mm: a region between contour lines CL40 and CL50 (specifically, a point having an amplitude ratio Rh of about 50%)

A toe side end of T3—45 mm: a region between contour lines CL70 and CL80 (specifically, a point having an amplitude ratio Rh of about 75%)

A heel side end of T3—45 mm: a region between contour lines CL60 and CL70 (specifically, a point having an amplitude ratio Rh of about 60%)

A toe side end of T3—50 mm: a region between contour lines CL80 and CL90 (specifically, a point having an amplitude ratio Rh of about 90%)

A heel side end of T3—50 mm: a region between contour lines CL80 and CL90 (specifically, a point having an amplitude ratio Rh of about 90%)

A toe side end of T3—55 mm: a region surrounded by a contour line CL90 (specifically, a point having an amplitude ratio Rh of about 95%)

A heel side end of T3—55 mm: a region surrounded by a contour line CL80 (specifically, a point having an amplitude ratio Rh of about 85%)

A toe side end of a dividing part of T4—5 mm (a heel end of the rib located on the toe side than the dividing part): a region between contour lines CL20 and CL30 (specifically, a point having an amplitude ratio Rh of about 30%)

A heel side end of a dividing part of T4—5 mm (a toe end of the rib located on the heel side than the dividing part): a region between contour lines CL20 and CL30 (specifically, a point having an amplitude ratio Rh of about 30%)

A toe side end of a dividing part of T4—10 mm (a heel end of the rib located on the toe side than the dividing part): a region between contour lines CL40 and CL50 (specifically, a point having an amplitude ratio Rh of about 50%)

A heel side end of a dividing part of T4—10 mm (a toe end of the rib located on the heel side than the dividing part): a region between contour lines CL40 and CL50 (specifically, a point having an amplitude ratio Rh of about 50%)

A toe side end of a dividing part of T4—15 mm (a heel end of the rib located on the toe side than the dividing part): a region between contour lines CL50 and CL60 (specifically, a point having an amplitude ratio Rh of about 60%)

A heel side end of a dividing part of T4—15 mm (a toe end of the rib located on the heel side than the dividing part): a region between contour lines CL50 and CL60 (specifically, a point having an amplitude ratio Rh of about 60%)

A heel side end of T5—20 mm: a region having an amplitude ratio Rh of equal to or less than 10% (specifically, a point having the amplitude ratio Rh is about 10%)

A heel side end of T5—30 mm: a region between contour lines CL20 and CL30 (specifically, a point having an amplitude ratio Rh of about 20%)

A heel side end of T5—35 mm: a region between contour lines CL30 and CL40 (specifically, a point having an amplitude ratio Rh of about 40%)

A heel side end of T5—45 mm: a region between contour lines CL60 and CL70 (specifically, a point having an amplitude ratio Rh of about 60%)

A heel side end of T5—60 mm: a region surrounded by a contour line CL80 (specifically, a point having an amplitude ratio Rh of about 85%)

A heel side end of T5—80 mm: a region between contour lines CL20 and CL30 (specifically, a point having an amplitude ratio Rh of about 20%)

A toe side end of T6—45 mm: a region between contour lines CL70 and CL80 (specifically, a point having an amplitude ratio Rh of about 75%)

A toe side end of T6—50 mm: a region surrounded by a contour line CL90 (specifically, a point having an amplitude ratio Rh of about 90%)

A toe side end of T6—55 mm: a region surrounded by a contour line CL90 (specifically, a point having an amplitude ratio Rh of about 95%)

A toe side end of T6—60 mm: a region between contour lines CL80 and CL90 (specifically, a point having an amplitude ratio Rh of about 85%)

A toe side end of T6—65 mm: a region between contour lines CL50 and CL60 (specifically, a point having an amplitude ratio Rh of about 60%)

A toe side end of T6—70 mm: a region between contour lines CL30 and CL40 (specifically, a point having an amplitude ratio Rh of about 35%)

A toe side end of T6—75 mm: a region between contour lines CL30 and CL40 (specifically, a point having an amplitude ratio Rh of about 30%)

A toe side end of T6—80 mm: a region between contour lines CL60 and CL70 (specifically, a point having an amplitude ratio Rh of about 60%)

The crossing of a high Rh region is as follows. The rib (X) of the head T2 crosses the two high Rh regions. The rib (X) of the head T3—10 mm crosses the two high Rh regions. The rib (X) of the head T3—15 mm crosses the two high Rh regions. The rib (X) of the head T3—30 mm crosses the two high Rh regions. The rib (X) of the head T3—35 mm crosses the two high Rh regions. The rib (X) of the head T3—40 mm crosses the two high Rh regions. The rib (X) of the head T3—45 mm crosses the two high Rh regions. The rib (X) of the head T3—50 mm crosses the heel side high Rh region, but does not cross the toe side high Rh region. The rib (X) of the head T3—55 mm does not cross the heel side high Rh region, and does not cross the toe side high Rh region. The rib (X) of the head T4—5 mm crosses the two high Rh regions. That is, the toe side rib crosses the toe side high Rh region, and the heel side rib crosses the heel side high Rh region. The rib (X) of the head T4—10 mm crosses the two high Rh regions. That is, the toe side rib crosses the toe side high Rh region, and the heel side rib crosses the heel side high Rh region. The rib (X) of the head T4—15 mm crosses the two high Rh regions. That is, the toe side rib crosses the toe side high Rh region, and the heel side rib crosses the heel side high Rh region.

The rib (X) of the head T5—20 mm crosses the two high Rh regions. The rib (X) of the head T5—30 mm crosses the two high Rh regions. The rib (X) of the head T5—35 mm crosses the two high Rh regions. The rib (X) of the head T5—45 mm crosses the two high Rh regions. The rib (X) of the head T5—60 mm crosses the toe side high Rh region, but does not cross the heel side high Rh region.

The rib (X) of the head T5—80 mm crosses the toe side high Rh region, but does not cross the heel side high Rh region. The rib (X) of the head T6—45 mm crosses the two high Rh regions. The rib (X) of the head T6—50 mm crosses the heel side high Rh region, but does not cross the toe side high Rh region. The rib (X) of the head T6—55 mm crosses the heel side high Rh region, but does not cross the toe side high Rh region. The rib (X) of the head T6—60 mm crosses the heel side high Rh region, but does not cross the toe side high Rh region. The rib (X) of the head T6—65 mm crosses the heel side high Rh region, but does not cross the toe side high Rh region. The rib (X) of the head T6—70 mm crosses the heel side high Rh region, but does not cross the toe side high Rh region. The rib (X) of the head T6—75 mm crosses the heel side high Rh region, but does not cross the toe side high Rh region. The rib (X) of the head T6—80 mm crosses the heel side high Rh region, but does not cross the toe side high Rh region.

In view of enhancing the hitting sound, a head satisfying the following items (b) and (c) is preferable in the present invention.

(b) A region having the amplitude ratio Rh of equal to or greater than 60% does not exist on the toe side than the rib (x).

(c) A region having the amplitude ratio Rh of equal to or greater than 60% does not exist on the heel side than the rib (X).

In the simulation 1, the head T2, the head T3—10 mm, the head T3—15 mm, the head T3—30 mm, the head T3—35 mm, the head T3—40 mm, the head T4—5 mm, the head T4—10 mm, the head T4—15 mm, the head T5—20 mm, the head T5—30 mm and the head T5—35 mm satisfy the items (b) and (c).

As described above, the movement of the first-order maximum amplitude point to the crown from the sole may be caused by the setting of the rib (X). The movement contributes to the increase of the natural frequency. Furthermore, the movement of the second-order maximum amplitude point to the crown from the sole may be caused by the setting of the rib (X).

When the results are considered, in view of the hitting sound, the following item (x1) is preferable, and the following item (x2) is more preferable.

(x1) The first-order maximum amplitude point Pmt is located on the crown.

(x2) The first-order maximum amplitude point Pm1 is located on the crown, and the second-order antinode is located on the sole.

When the results are considered, in view of the hitting sound, the following item (y1) is preferable, and the following item (y2) is more preferable.

(y1) The movement of the first-order maximum amplitude point to the crown from the sole may be caused by the setting of the rib (X). That is, the first-order maximum amplitude point located on the sole in the state where the rib (X) is removed is located on the crown after the setting of the rib (X).

(y2) The movement of the first-order maximum amplitude point to the crown from the sole may be caused by the setting of the rib (X), and the second antinode is located on the sole. That is, the first-order maximum amplitude point located on the sole in the state where the rib (X) is removed is located on the crown after the setting of the rib (X), and the second antinode is located on the sole.

[Simulation 2: Consideration of Orientation of Rib and Intermittence of Rib]

Hereinafter, another examples will be described.

[Head Rf1]

Figure 68:
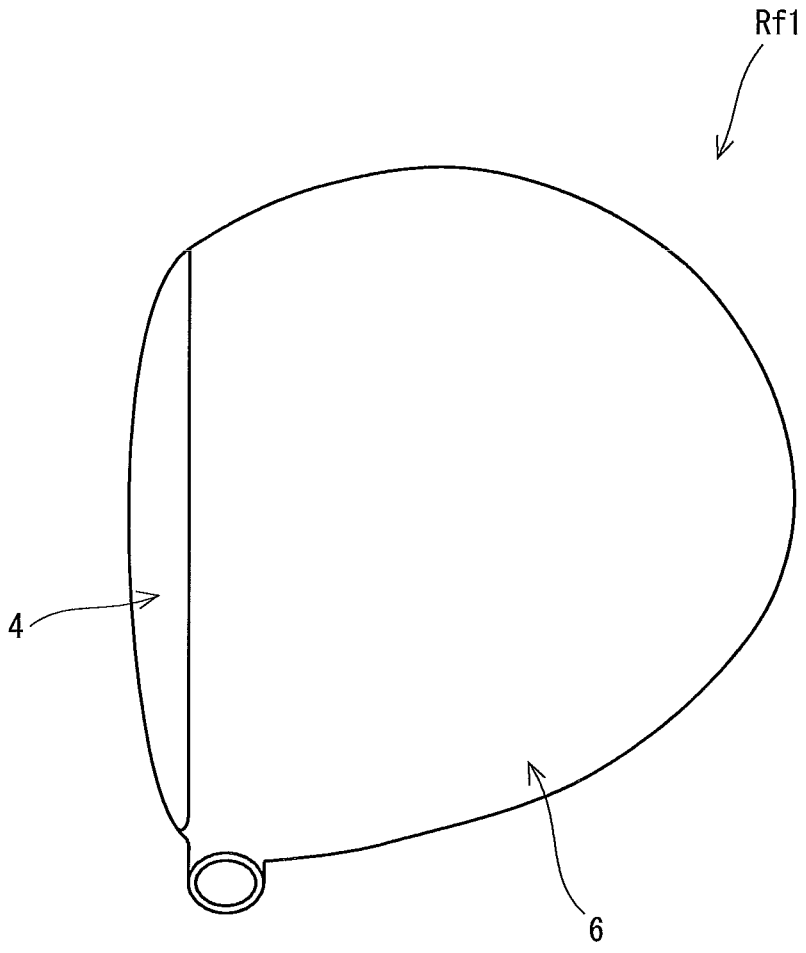
FIG. 68 is a view of the head Rf1, as viewed from a crown side.
Figure 69:
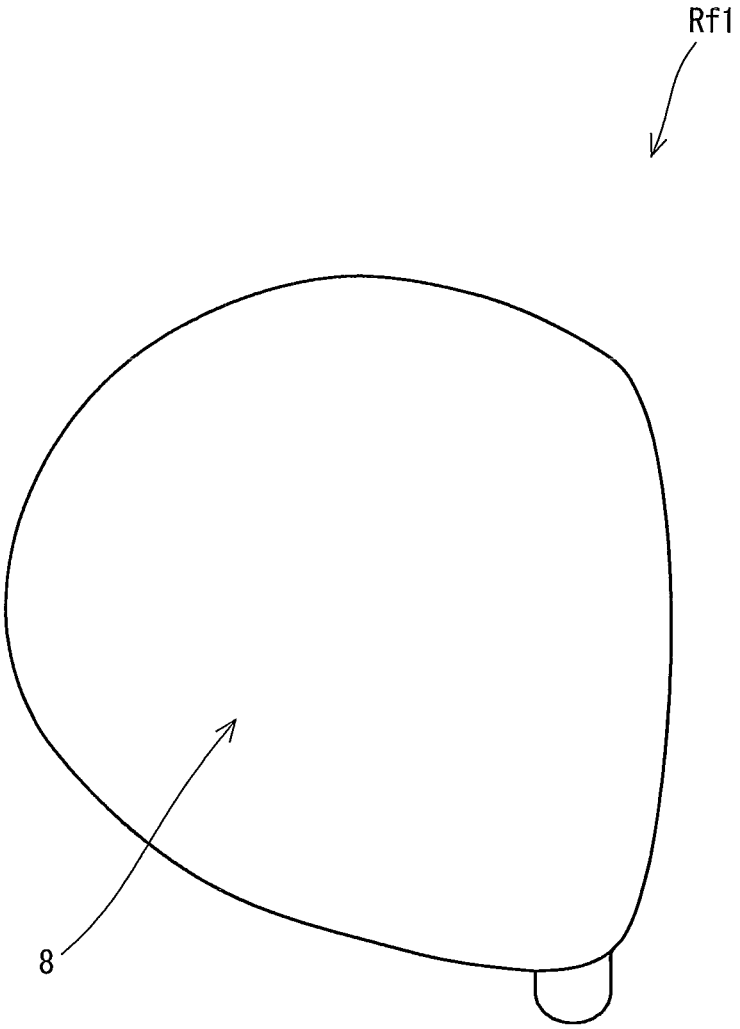
FIG. 69 is a view of the head Rf1, as viewed from a sole side.

FIGS. 68 and 69 show a head Rf1 according to another example. FIG. 68 is a view of the head Rf1, as viewed from a crown side, and FIG. 69 is a view of the head Rf1, as viewed from a sole side.

Three-dimensional data of the head Rf1 having a shape shown in FIGS. 68 and 69 was prepared. The shape of the head Rf1 is the same as that of the head 28. As shown in FIGS. 68 and 69, the head Rf1 does not have a rib. A thickness Tc of a crown of the head was set to 0.55 (mm). A thickness Ts of a sole was set to 1.3 mm. A volume of the head was set to 460 cc. A titanium alloy was selected as a material of the head, and calculation was conducted using a coefficient based on the material. A weight of the head was set to 193 g.

The head was mesh-divided into a finite element using a commercially available preprocessor (HyperMesh or the like) to obtain a calculation model. Next, natural value analysis was conducted using commercially available natural value analyzing software to calculate a natural frequency and a mode shape. The results are shown in the following Tables.

Next, a rib was provided on the head Rf1, and data of heads to be shown later were prepared. Specification of each of the heads will be described later. In all of the following heads, the material of the rib was set to be the same as that of the head Rf1.

[Head Ex1]

Figure 70:
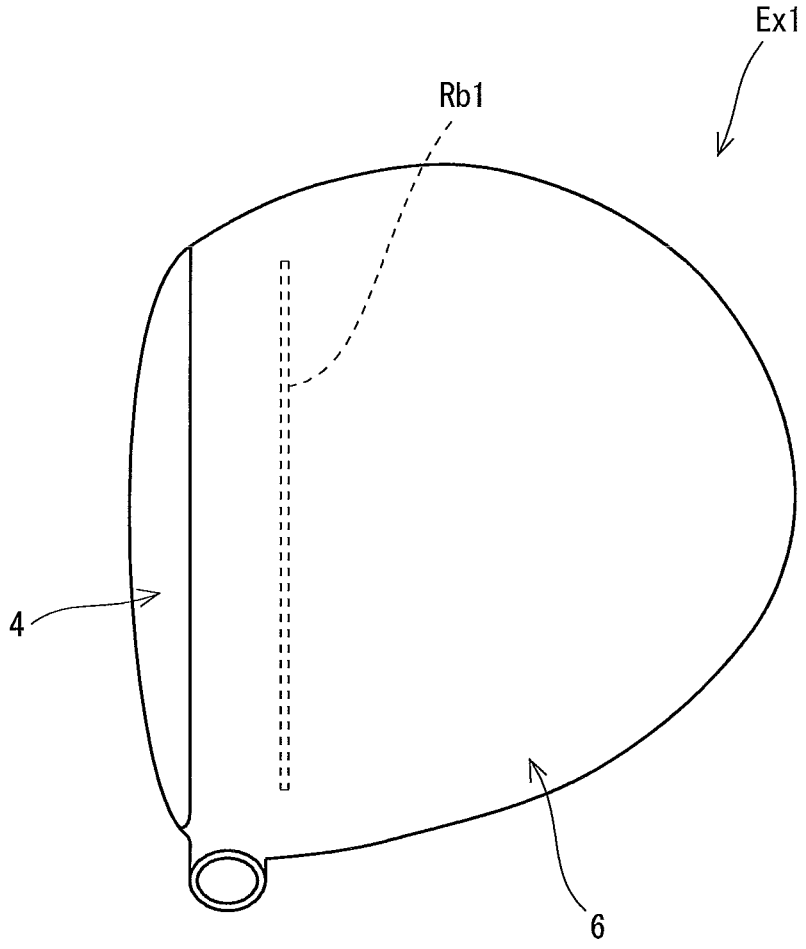
FIG. 70 is a view of the head Ex1, as viewed from a crown side.

Three-dimensional data of a head Ex1 was obtained in the same manner as in the head Rf1 except that a rib Rb1 as the rib (X) was provided on an inner surface of a sole of the head Rf1 (see FIG. 70). A distance Wb (see FIG. 5) was set to 16 (mm). Natural value analysis of the head Ex1 was conducted. The results are shown in the following Table.

[Head Ex2]

Figure 71:
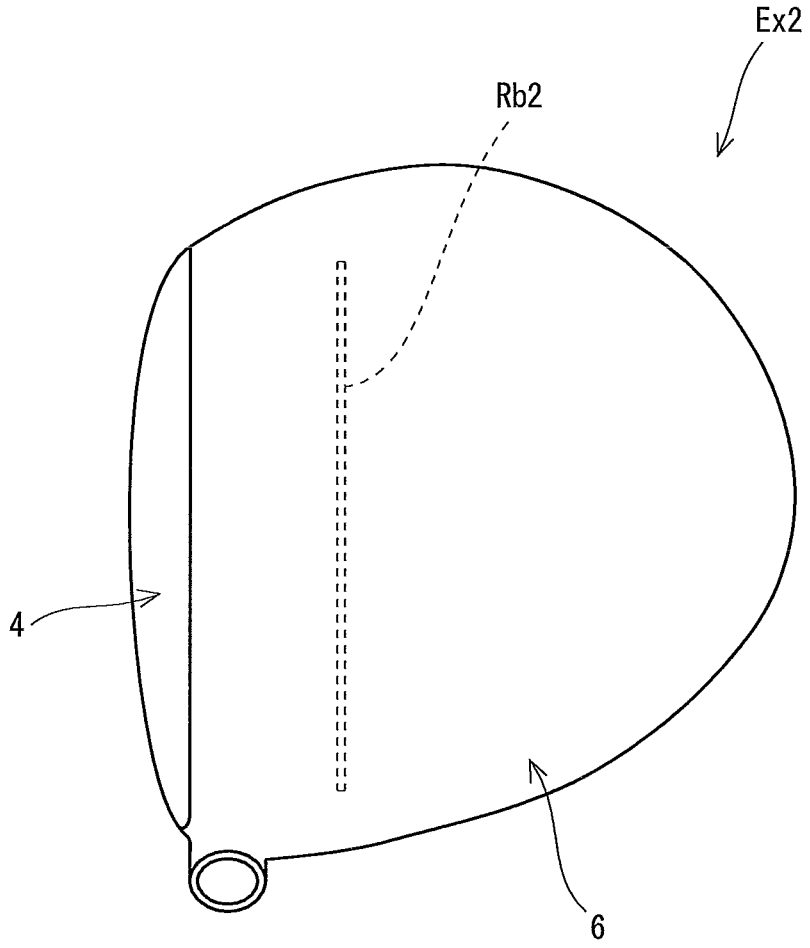
FIG. 71 is a view of the head Ex2, as viewed from a crown side.

Three-dimensional data of a head Ex2 was obtained in the same manner as in the head Rf1 except that a rib Rb2 as the rib (X) was provided on an inner surface of a sole of the head Rf1 (see FIG. 71). A distance Wb (see FIG. 5) was set to 26 (mm). Natural value analysis of the head Ex2 was conducted. The results are shown in the following Table.

[Head Ex3]

Figure 72:
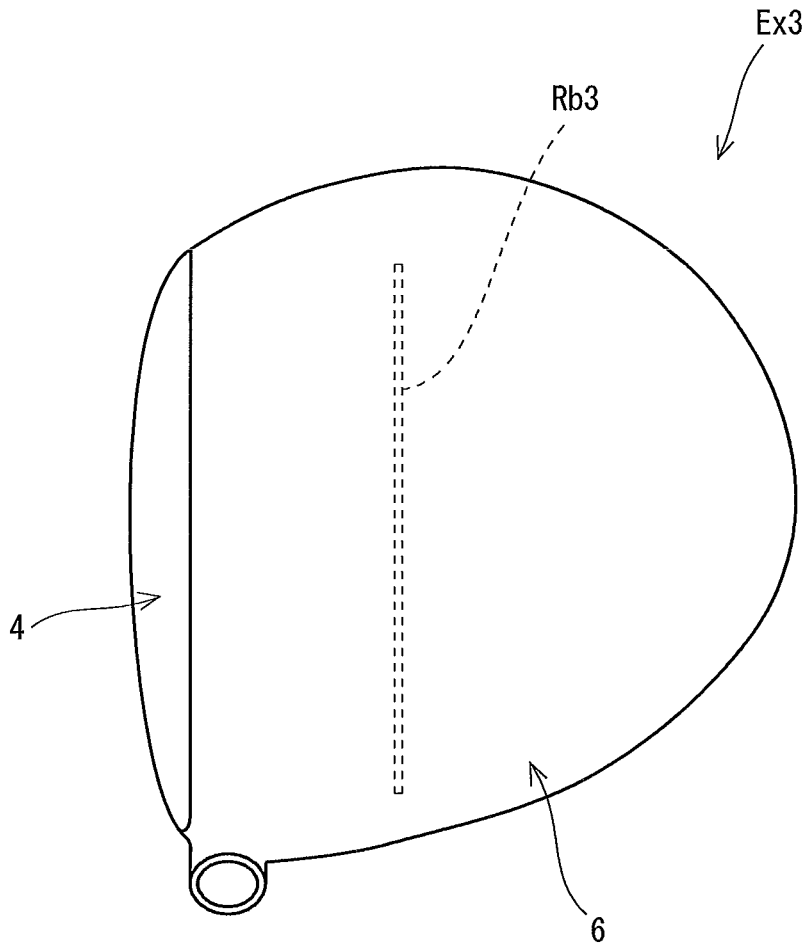
FIG. 72 is a view of the head Ex3, as viewed from a crown side.

Three-dimensional data of a head Ex3 was obtained in the same manner as in the head Rf1 except that a rib Rb3 as the rib (X) was provided on an inner surface of a sole of the head Rf1 (see FIG. 72). A distance Wb (see FIG. 5) was set to 36 (mm). Natural value analysis of the head Ex3 was conducted. The results are shown in the following Table.

[Head Ex4]

Figure 73:
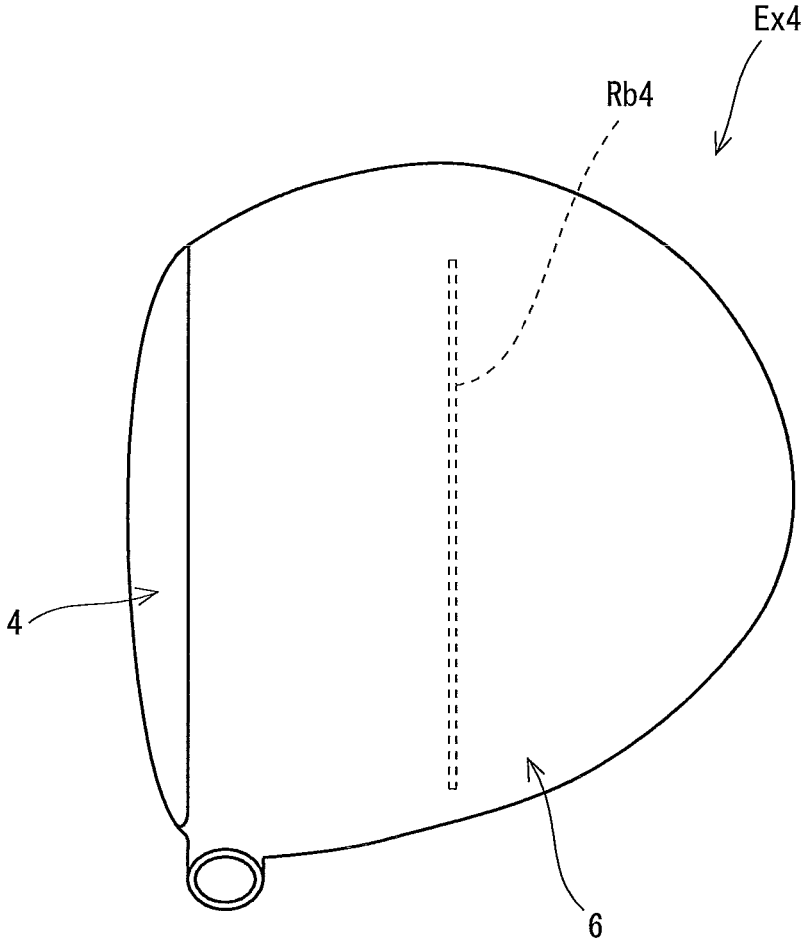
FIG. 73 is a view of the head Ex4, as viewed from a crown side.

Three-dimensional data of a head Ex4 was obtained in the same manner as in the head Rf1 except that a rib Rb4 as the rib (X) was provided on an inner surface of a sole of the head Rf1 (see FIG. 73). A distance Wb (see FIG. 5) was set to 46 (mm). Natural value analysis of the head Ex4 was conducted. The results are shown in the following Table.

[Head Ex5]

Figure 74:
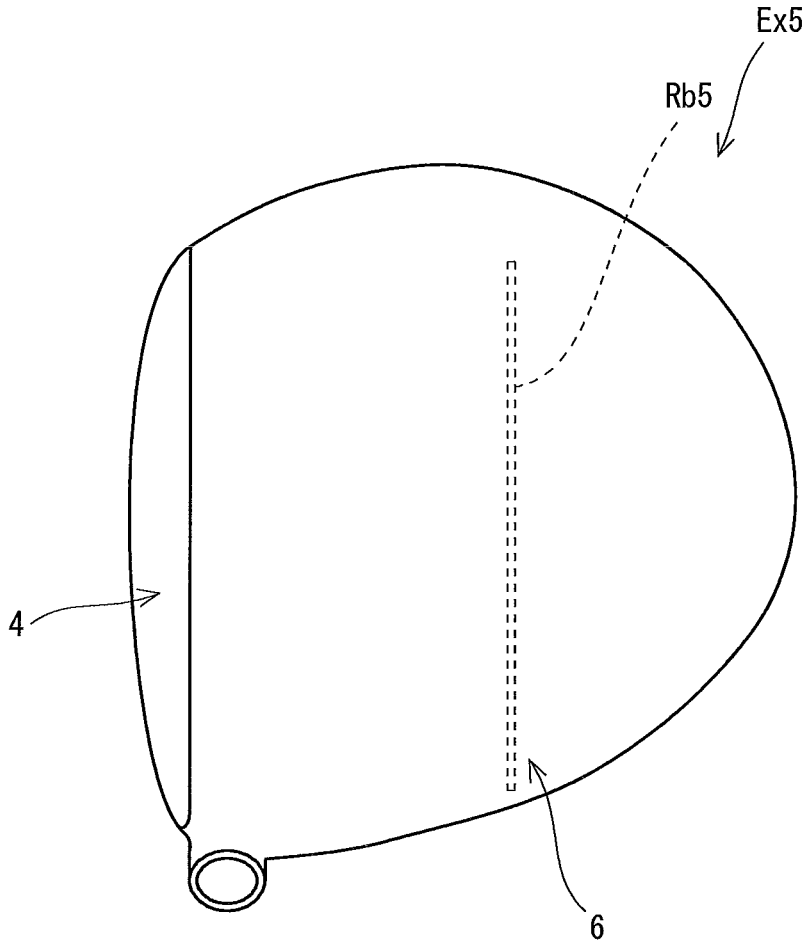
FIG. 74 is a view of the head Ex5, as viewed from a crown side.

Three-dimensional data of a head Ex5 was obtained in the same manner as in the head Rf1 except that a rib Rb5 as the rib (X) was provided on an inner surface of a sole of the head Rf1 (see FIG. 74). A distance Wb (see FIG. 5) was set to 56 (mm). Natural value analysis of the head Ex5 was conducted. The results are shown in the following Table.

Figure 75:
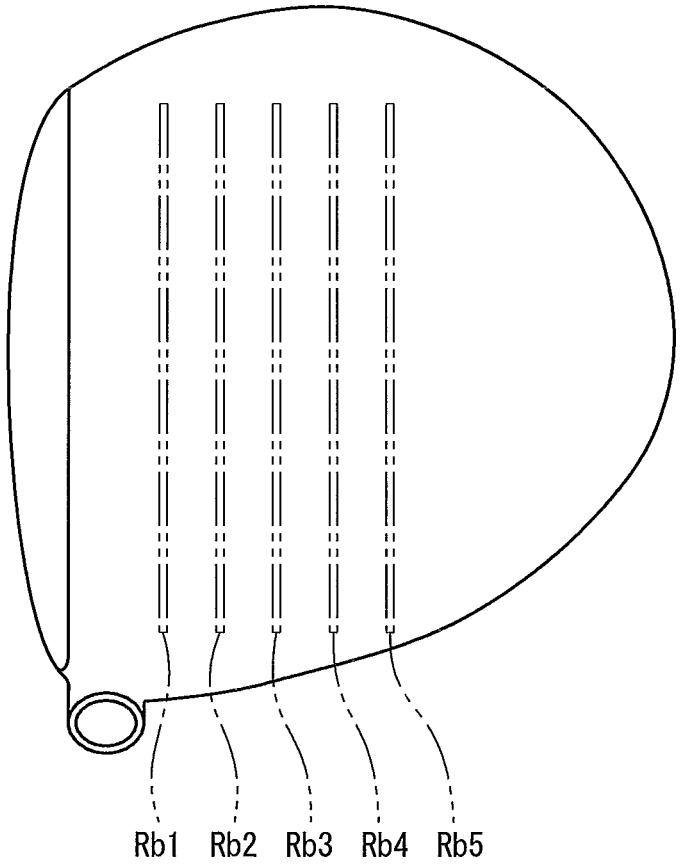
FIG. 75 is a view showing the positional relationship of a rib Rb1, a rib Rb2, a rib Rb3, a rib Rb4, and a rib Rb5, as viewed from a crown side.
Figure 76:
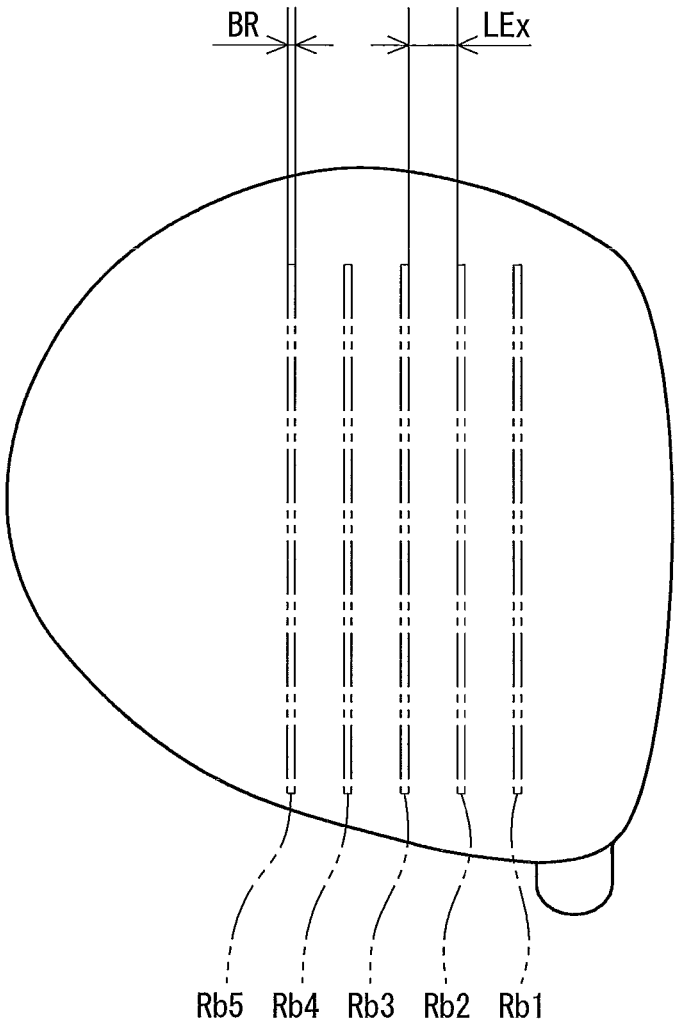
FIG. 76 is a view showing the positional relationship of a rib Rb1, a rib Rb2, a rib Rb3, a rib Rb4, and a rib Rb5, as viewed from a sole side.

FIGS. 75 and 76 are views showing the positional relationship of the rib Rb1, the rib Rb2, the rib Rb3, the rib Rb4, and the rib Rb5. FIG. 75 is a view showing the positional relationship, as viewed from the crown side. FIG. 76 is a view showing the positional relationship, as viewed from the sole side. In these ribs, a width BR of the rib was set to 1 (mm), and a distance LEx between the ribs was set to 10 (mm). A constant length of each of the ribs was set to 100 (mm).

[Head Ex6]

Figure 77:
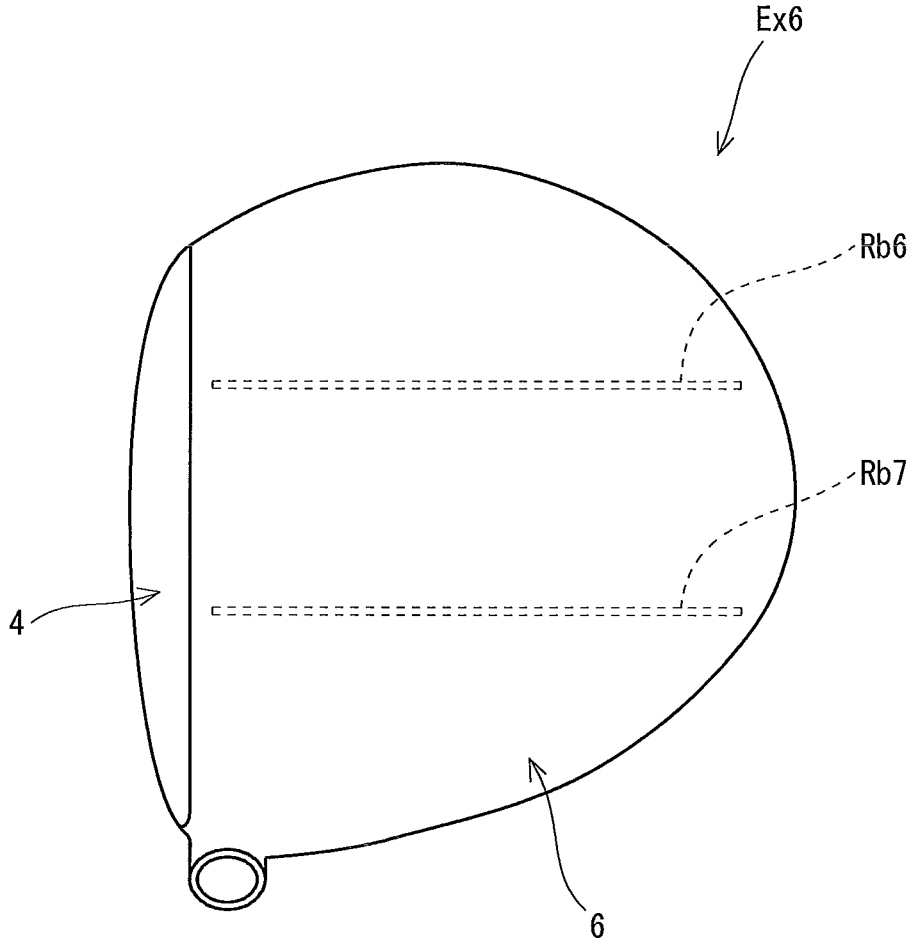
FIG. 77 is a view of the head Ex6, as viewed from a crown side.

Three-dimensional data of a head Ex6 was obtained in the same manner as in the head Rf1 except that a rib Rb6 and a rib Rb7 were provided on the inner surface of the sole of the head Rf1 (see FIG. 77). These ribs Rb6 and Rb7 extend in the face-back direction. Natural value analysis of the head Ex6 was conducted. The results are shown in the following Table.

[Head Ex7]

Figure 78:
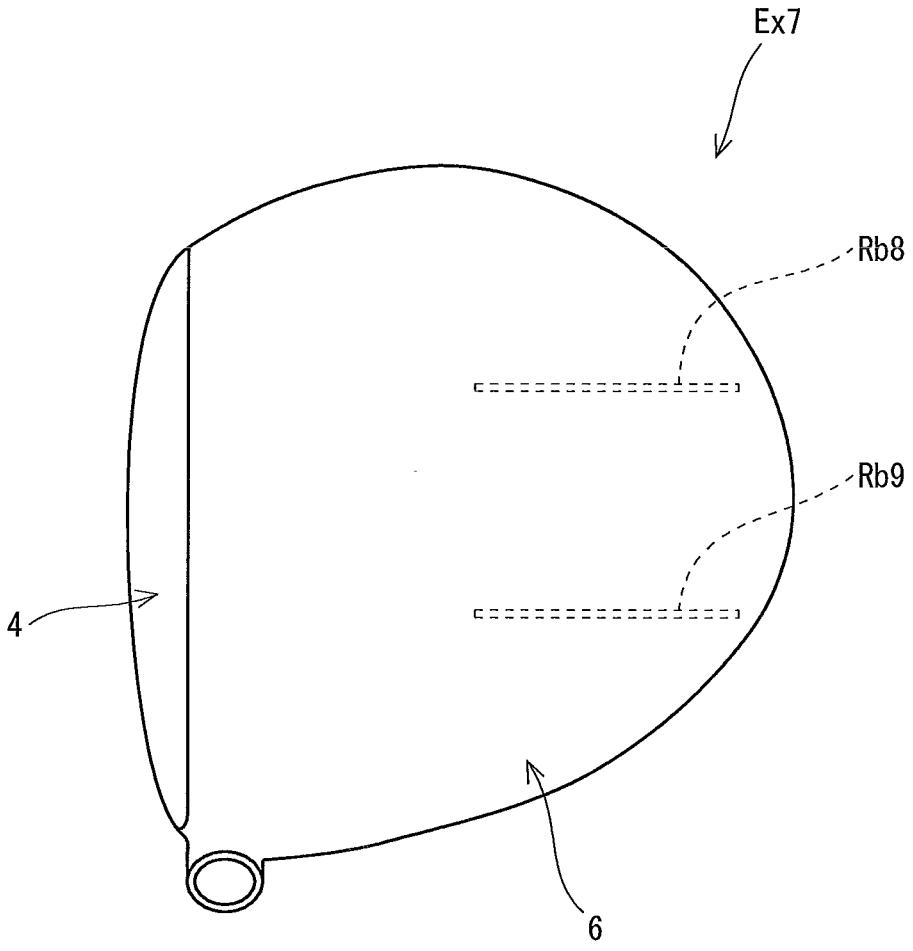
FIG. 78 is a view of the head Ex7, as viewed from a crown side.

Three-dimensional data of a head Ex7 was obtained in the same manner as in the head Rf1 except that a rib Rb8 and a rib Rb9 were provided on the inner surface of the sole of the head Rf1 (see FIG. 78). These ribs Rb8 and Rb9 extend in the face-back direction. Natural value analysis of the head Ex7 was conducted. The results are shown in the following Table.

[Head Ex8]

Figure 81:
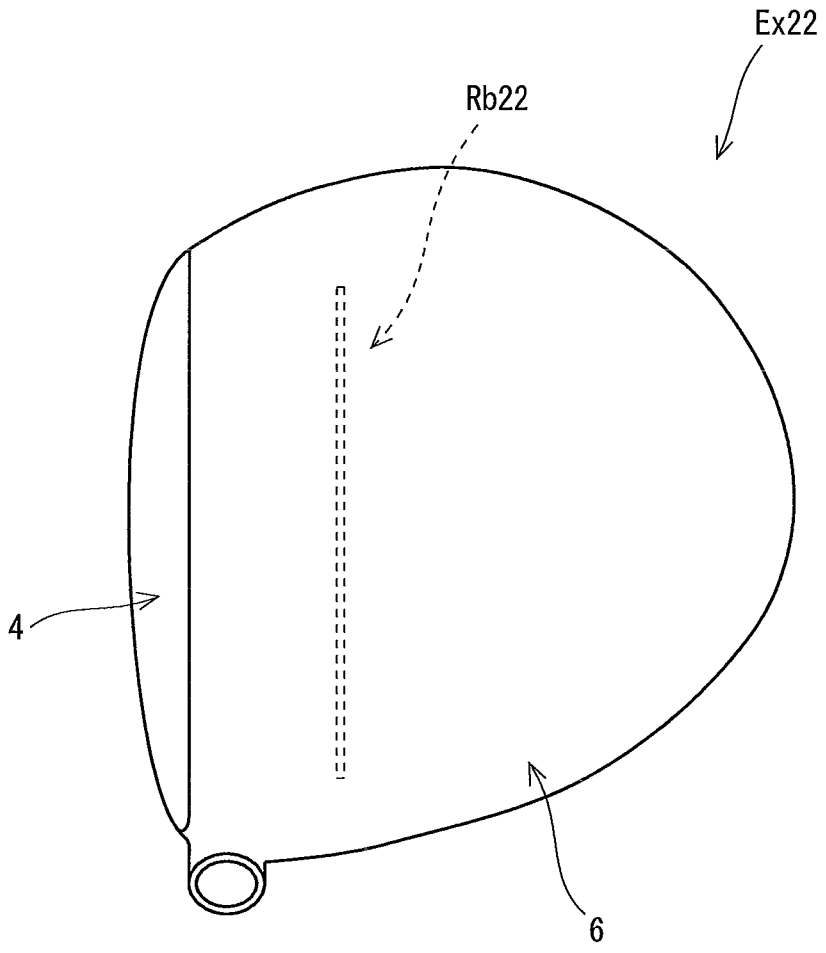
FIG. 81 is a view of the head Ex22, as viewed from a crown side.

Three-dimensional data of a head Ex22 was obtained in the same manner as in the head Rf1 except that an continuation rib Rb22 was provided on the inner surface of the sole of the head Rf1 (see FIG. 81). The continuation rib Rb22 extends in the toe-heel direction. Natural value analysis of the head Ex22 was conducted. The results are shown in the following Table.

[Head Ex21]

Figure 80:
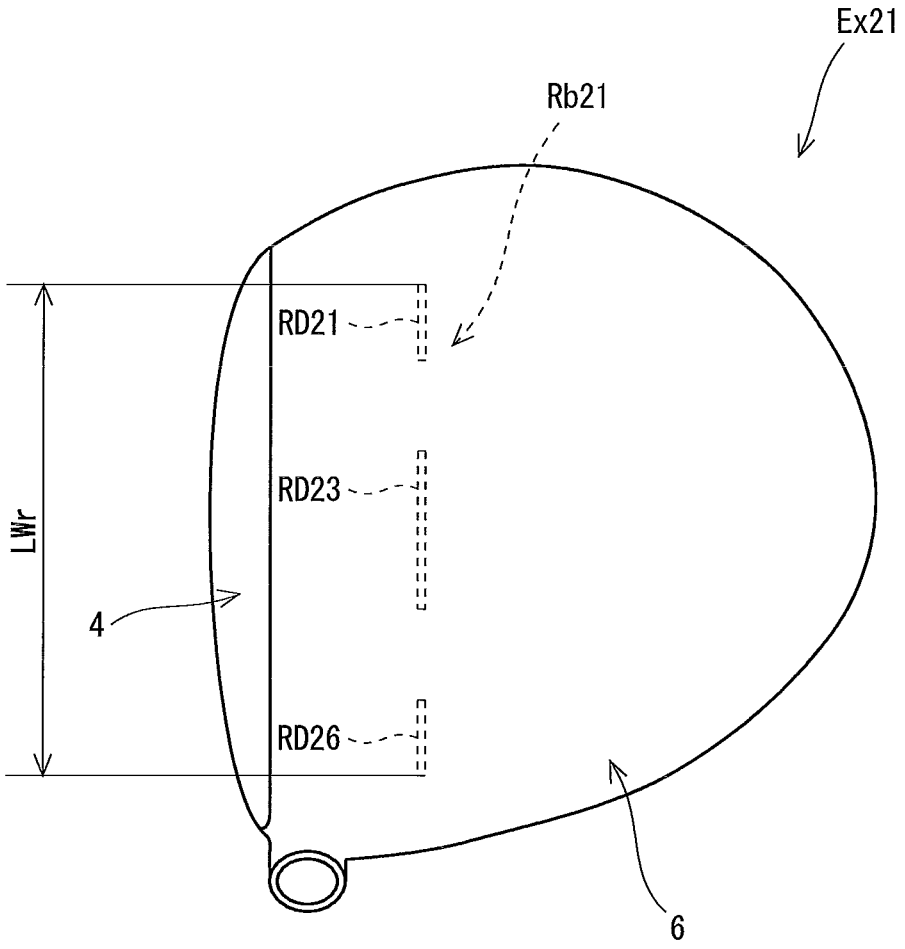
FIG. 80 is a view of the head Ex21, as viewed from a crown side.

Three-dimensional data of a head Ex21 was obtained in the same manner as in the head Rf1 except that an intermittence rib Rb21 was provided on the inner surface of the sole of the head Rf1 (see FIG. 80). As shown in FIG. 80, the intermittence rib Rb21 has a first portion RD21, a second portion RD23, and a third portion RD26. The intermittence rib Rb21 extends in the toe-heel direction. Natural value analysis of the head Ex21 was conducted. The results are shown in the following Table.

[Head Ex22]

Three-dimensional data of a head Ex22 was obtained in the same manner as in the head Rf1 except that an intermittence rib Rb22 was provided on the inner surface of the sole of the head Rf1 (see FIG. 81). The intermittence rib Rb22 extends in the toe-heel direction. Natural value analysis of the head Ex22 was conducted. The results are shown in the following Table.

[Head Ex23]

Figure 82:
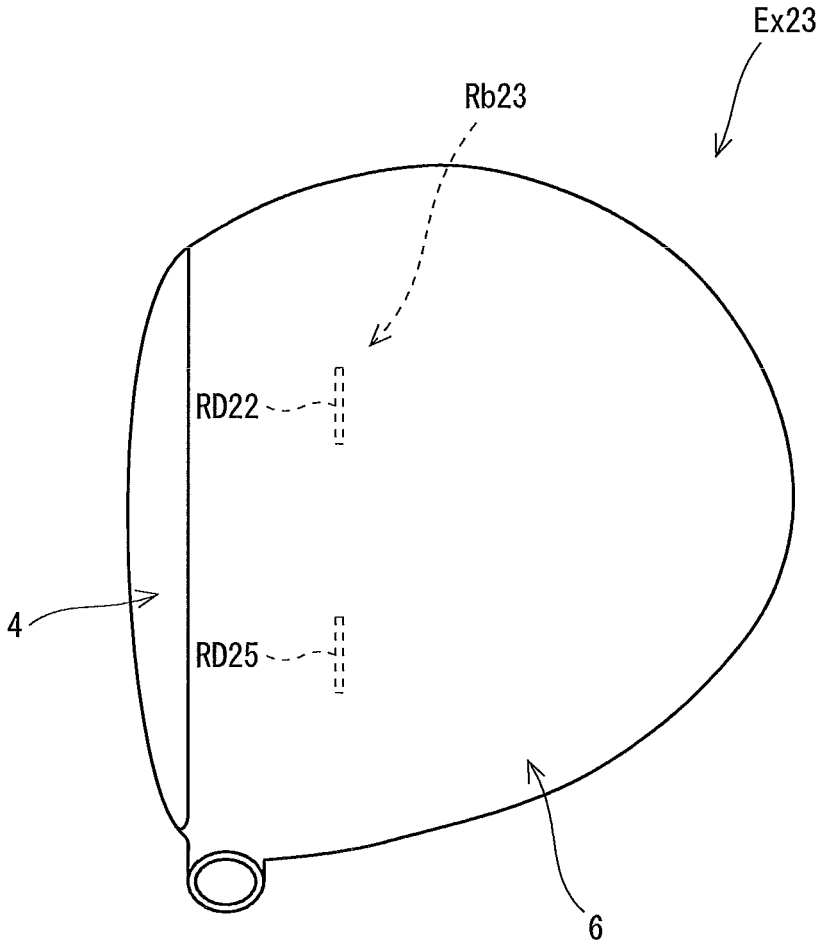
FIG. 82 is a view of the head Ex23, as viewed from a crown side.

Three-dimensional data of a head Ex23 was obtained in the same manner as in the head Rf1 except that an intermittence rib Rb23 was provided on the inner surface of the sole of the head Rf1 (see FIG. 82). As shown in FIG. 82, the intermittence rib Rb23 has a first portion Rb22 and a second portion RD25. The intermittence rib Rb23 extends in the toe-heel direction. Natural value analysis of the head Ex23 was conducted. The results are shown in the following Table.

[Head Ex24]

Figure 83:
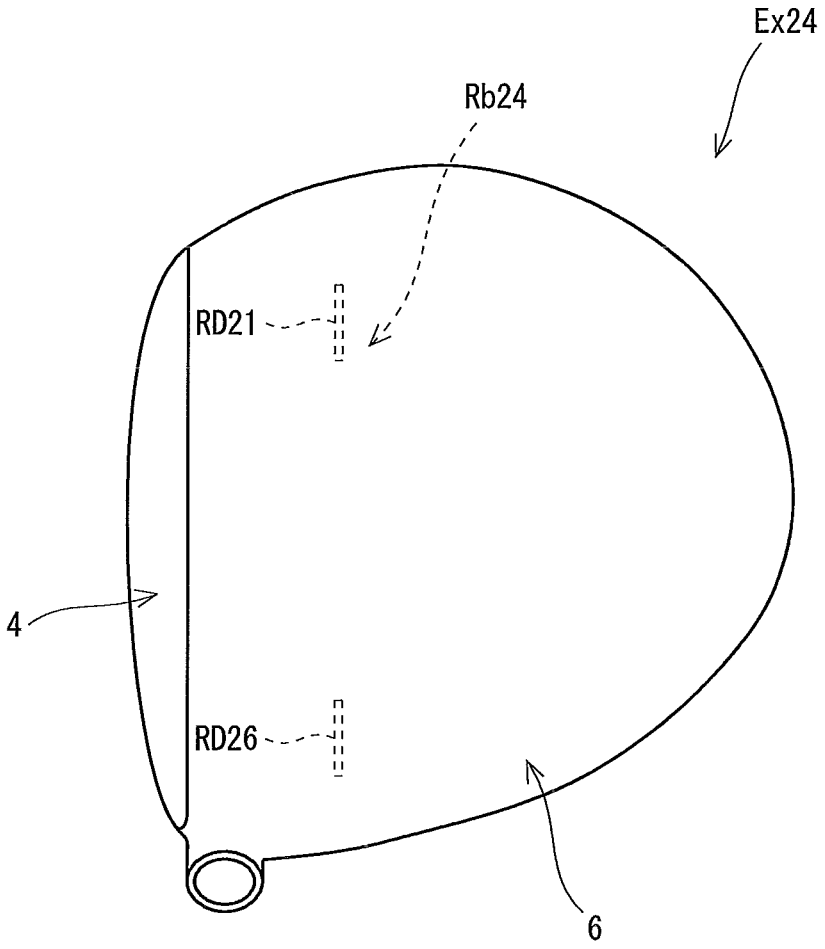
FIG. 83 is a view of the head Ex24, as viewed from a crown side.

Three-dimensional data of a head Ex24 was obtained in the same manner as in the head Rf1 except that an intermittence rib Rb24 was provided on the inner surface of the sole of the head Rf1 (see FIG. 83). As shown in FIG. 83, the intermittence rib Rb24 has a first portion RD21 and a second portion RD26. The intermittence rib Rb24 extends in the toe-heel direction. Natural value analysis of the head Ex24 was conducted. The results are shown in the following Table.

The rib Rb2 was used as the base in the data preparation of the intermittence rib Rb21, the continuation rib Rb22, the intermittence rib Rb23, and the intermittence rib Rb24. First, the both ends of the rib Rb2 were slightly shortened so that the distance LWr (see FIG. 80 or the like) was set to 90 mm. The rib Rb2 was then uniformly divided at five places. Two or more parts of parts divided equally into six were suitably selected to obtain the intermittence rib Rb21, the continuation rib Rb22, the intermittence rib Rb23, and the intermittence rib Rb24.

[Head Ex31]

Figure 84:
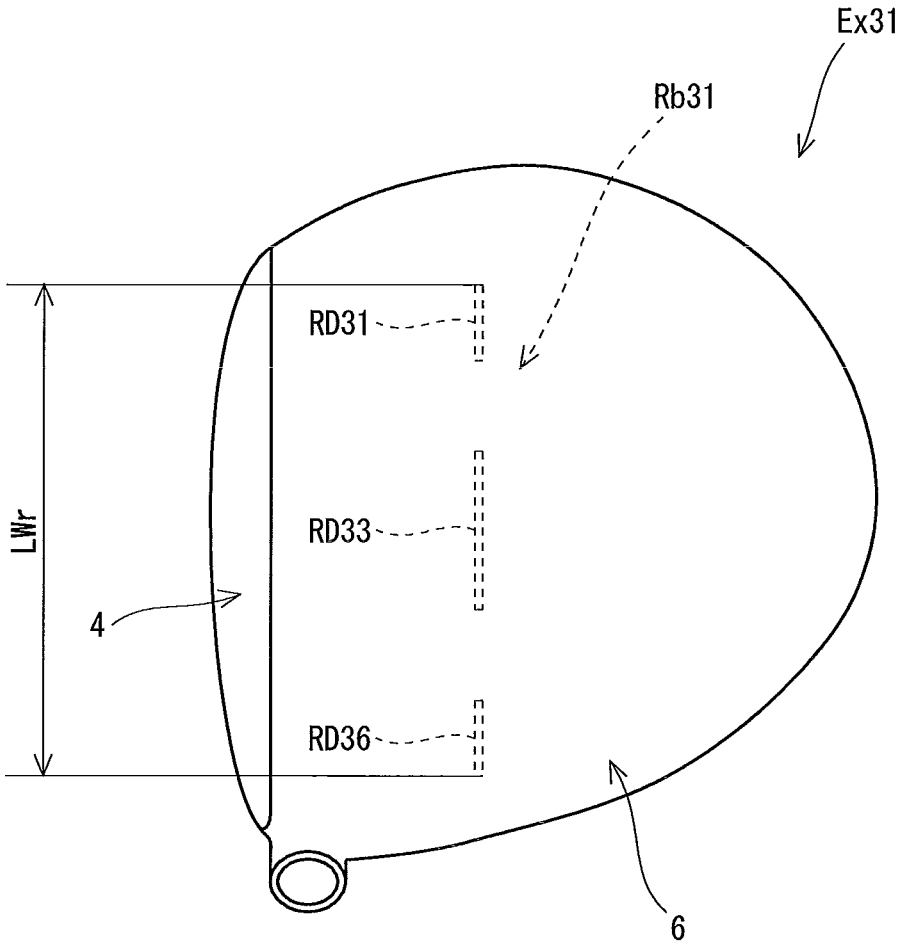
FIG. 84 is a view of the head Ex31, as viewed from a crown side.

Three-dimensional data of a head Ex31 was obtained in the same manner as in the head Rf1 except that an intermittence rib Rb31 was provided on the inner surface of the sole of the head Rf1 (see FIG. 84). As shown in FIG. 84, the intermittence rib Rb31 has a first portion RD31, a second portion RD33, and a third portion RD36. The intermittence rib Rb31 extends in the toe-heel direction. Natural value analysis of the head Ex31 was conducted. The results are shown in the following Table.

[Head Ex32]

Figure 85:
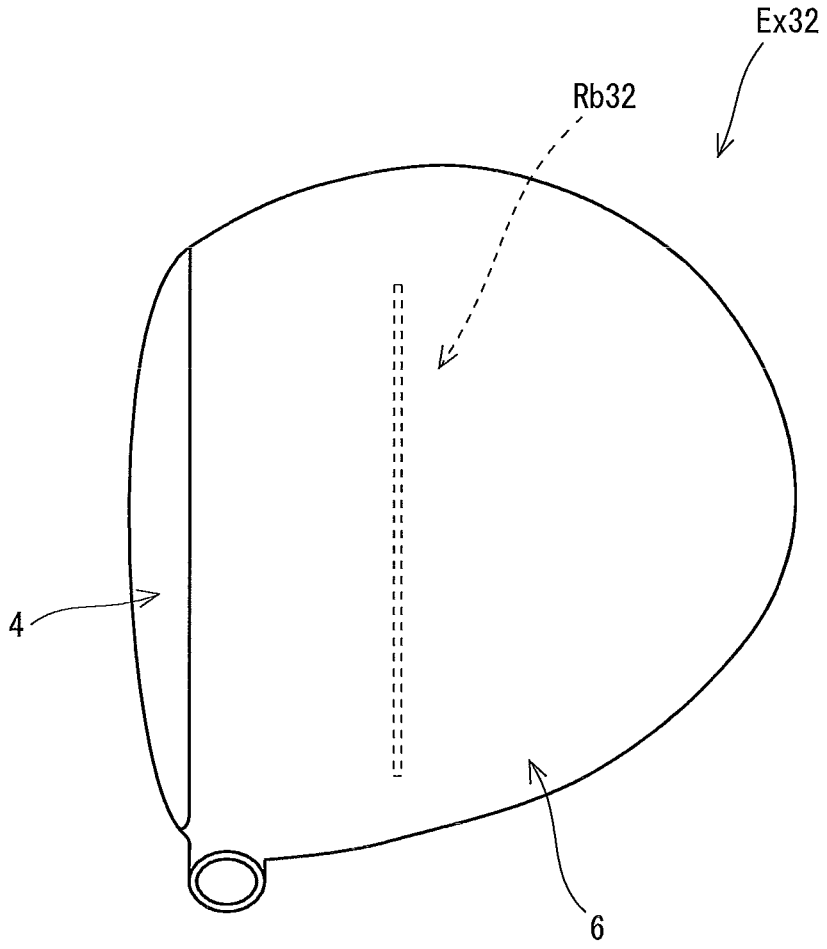
FIG. 85 is a view of the head Ex32, as viewed from a crown side.

Three-dimensional data of a head Ex32 was obtained in the same manner as in the head Rf1 except that an continuation rib Rb32 was provided on the inner surface of the sole of the head Rf1 (see FIG. 85). As shown in FIG. 85, the continuation rib Rb32 extends in the toe-heel direction. Natural value analysis of the head Ex32 was conducted. The results are shown in the following Table.

[Head Ex33]

Figure 86:
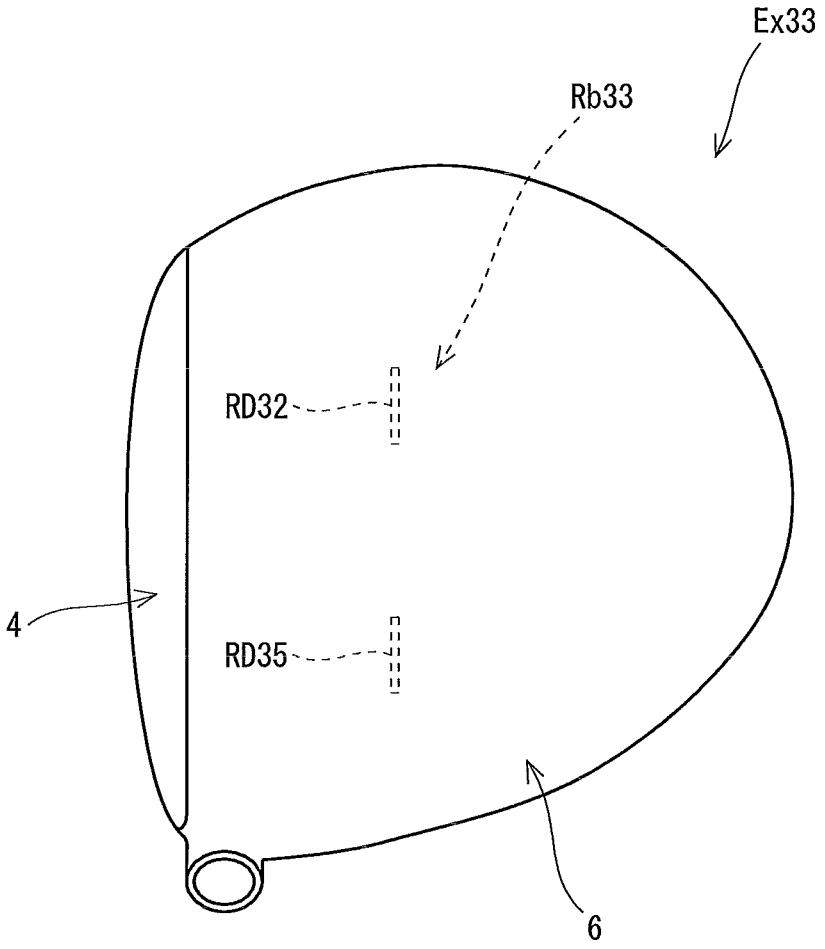
FIG. 86 is a view of the head Ex33, as viewed from a crown side.

Three-dimensional data of a head Ex33 was obtained in the same manner as in the head Rf1 except that an intermittence rib Rb33 was provided on the inner surface of the sole of the head Rf1 (see FIG. 86). As shown in FIG. 86, the intermittence rib Rb33 has a first portion RD32 and a second portion RD35. The intermittence rib Rb33 extends in the toe-heel direction. Natural value analysis of the head Ex33 was conducted. The results are shown in the following Table.

[Head Ex34]

Figure 87:
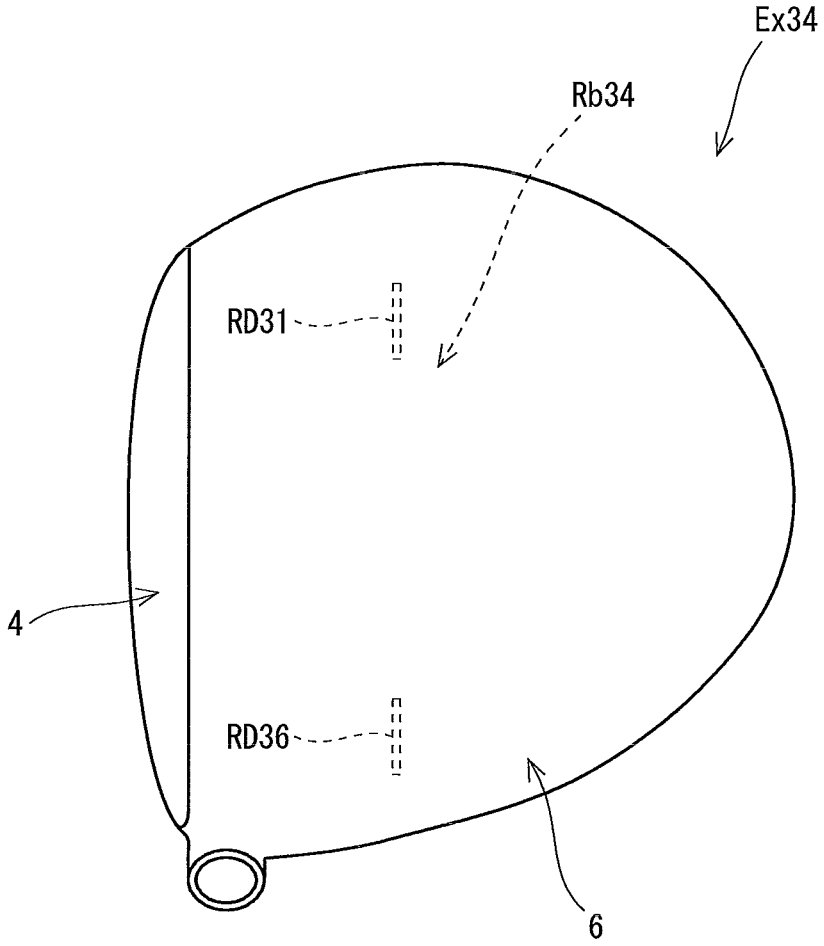
FIG. 87 is a view of the head Ex34, as viewed from a crown side.

Three-dimensional data of a head Ex34 was obtained in the same manner as in the head Rf1 except that an intermittence rib Rb34 was provided on the inner surface of the sole of the head Rf1 (see FIG. 87). As shown in FIG. 87, the intermittence rib Rb34 has a first portion RD31 and a second portion RD36. The intermittence rib Rb34 extends in the toe-heel direction. Natural value analysis of the head Ex34 was conducted. The results are shown in the following Table.

The rib Rb3 was used as the base in the data preparation of the intermittence rib Rb31, the continuation rib Rb32, the intermittence rib Rb33, and the intermittence rib Rb34. First, the both ends of the rib Rb3 were slightly shortened so that the distance LWr (see FIG. 84) was set to 90 mm. The rib Rb3 was then uniformly divided at five places. Two or more parts of parts divided equally into six were suitably selected to obtain the intermittence rib Rb31, the continuation rib Rb32, the intermittence rib Rb33, and the intermittence rib Rb34.

[Head Ex41]

Figure 88:
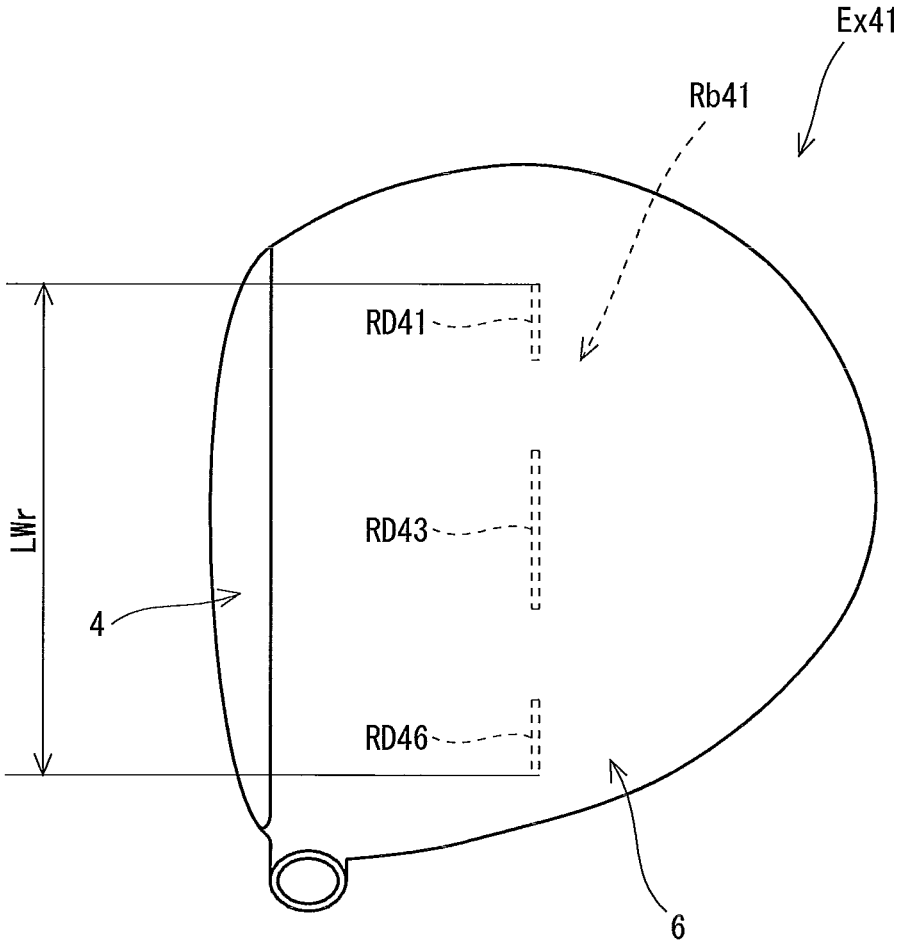
FIG. 88 is a view of the head Ex41, as viewed from a crown side.

Three-dimensional data of a head Ex41 was obtained in the same manner as in the head Rf1 except that an intermittence rib Rb41 was provided on the inner surface of the sole of the head Rf1 (see FIG. 88). The intermittence rib Rb41 has a first portion RD41, a second portion RD43 and a third portion RD 46. The intermittence rib Rb41 extends in the toe-heel direction. Natural value analysis of the head Ex41 was conducted. The results are shown in the following Table.

[Head Ex42]

Figure 89:
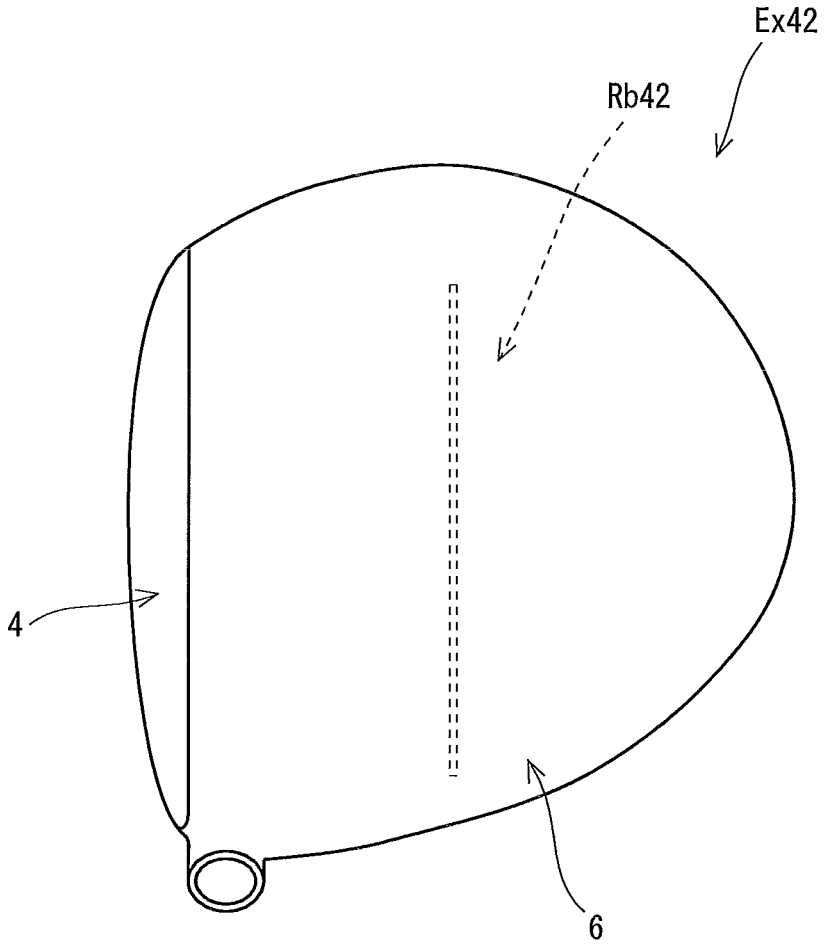
FIG. 89 is a view of the head Ex42, as viewed from a crown side.

Three-dimensional data of a head Ex42 was obtained in the same manner as in the head Rf1 except that an continuation rib Rb42 was provided on the inner surface of the sole of the head Rf1 (see FIG. 89). As shown in FIG. 89, the continuation rib Rb42 extends in the toe-heel direction. Natural value analysis of the head Ex42 was conducted. The results are shown in the following Table.

[Head Ex43]

Figure 90:
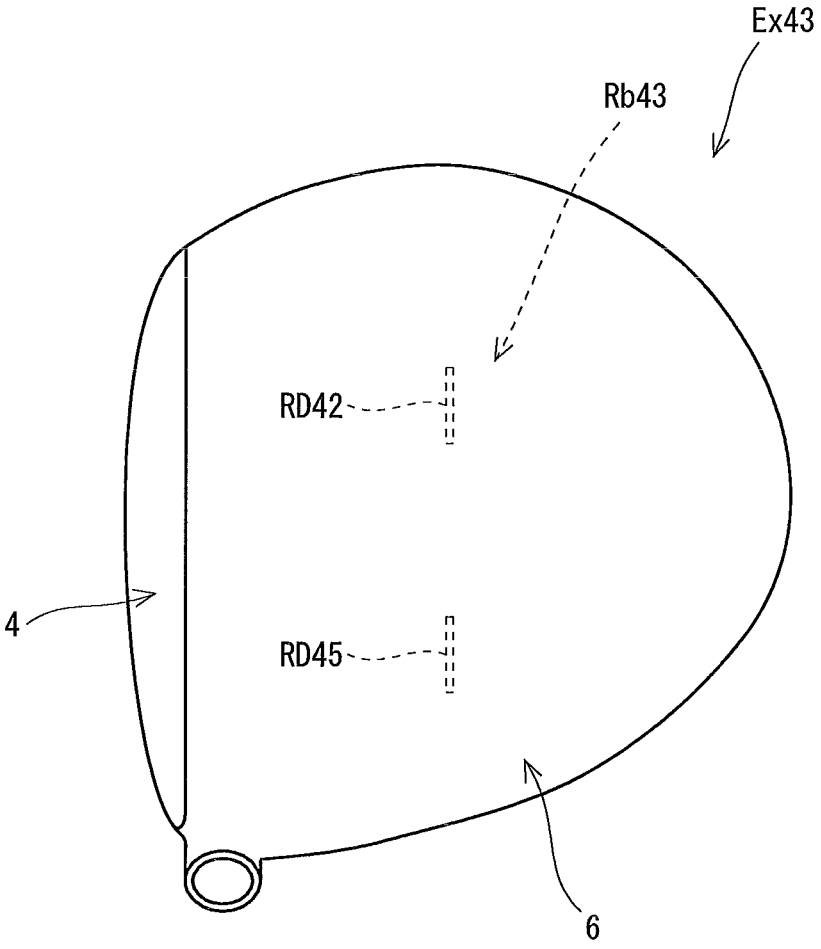
FIG. 90 is a view of the head Ex43, as viewed from a crown side.

Three-dimensional data of a head Ex43 was obtained in the same manner as in the head Rf1 except that an intermittence rib Rb43 was provided on the inner surface of the sole of the head Rf1 (see FIG. 90). As shown in FIG. 90, the intermittence rib Rb43 has a first portion RD42 and a second portion RD45. The intermittence rib Rb43 extends in the toe-heel direction. Natural value analysis of the head Ex43 was conducted. The results are shown in the following Table.

[Head Ex44]

Figure 91:
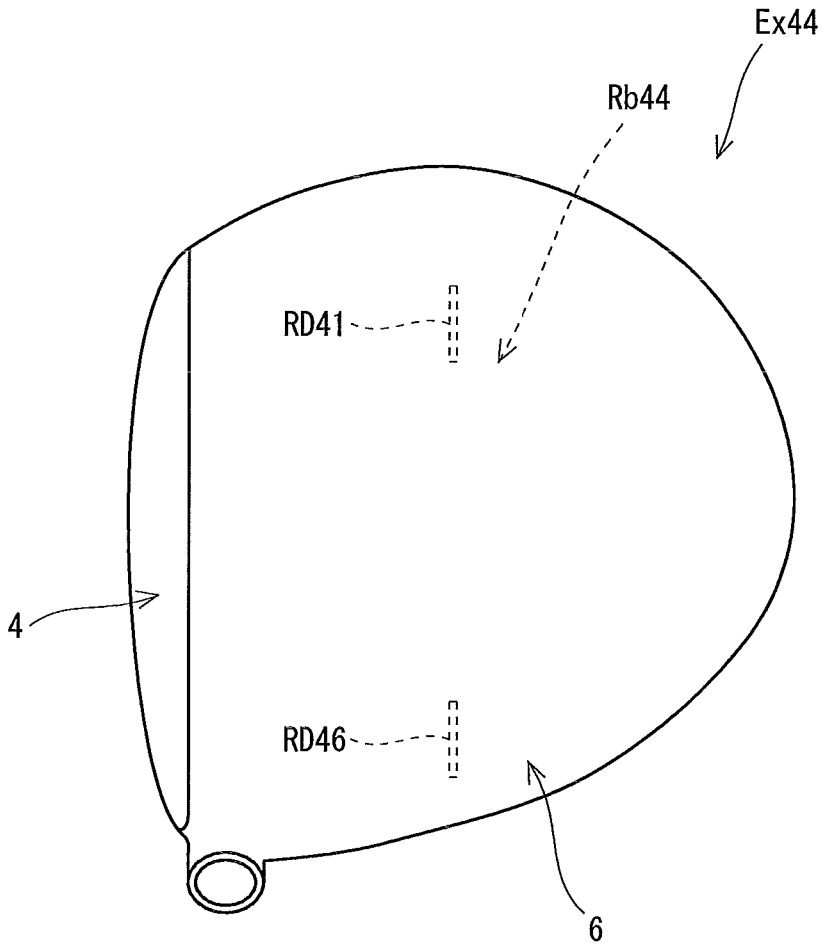
FIG. 91 is a view of the head Ex44, as viewed from a crown side.

Three-dimensional data of a head Ex44 was obtained in the same manner as in the head Rf1 except that an intermittence rib Rb44 was provided on the inner surface of the sole of the head Rf1 (see FIG. 91). As shown in FIG. 91, the intermittence rib Rb44 has a first portion RD41 and a second portion RD46. The intermittence rib Rb44 extends in the toe-heel direction. Natural value analysis of the head Ex44 was conducted. The results are shown in the following Table.

The rib Rb4 was used as the base in the data preparation of the intermittence rib Rb41, the continuation rib Rb42, the intermittence rib Rb43, and the intermittence rib Rb44. The both ends of the rib Rb4 were slightly shortened so that the distance LWr (see FIG. 88) was set to 90 mm. The rib Rb4 was then uniformly divided at five places. Two or more parts of parts divided equally into six were suitably selected to obtain the intermittence rib Rb41, the continuation rib Rb42, the intermittence rib Rb43, and the intermittence rib Rb44.

The evaluation results of each of the heads are shown in the following Tables 1, 2, 3, 4, 5, and 6.

TABLE 1

Results (1) of simulation 2

| | Head Rf1 | Head Ex1 | Head Ex2 | Head Ex3 |
|---|---|---|---|---|
| Form of rib | (State where rib is removed) | Continuation rib | Continuation rib | Continuation rib |
| Extending direction of rib | — | Toe-heel direction | Toe-heel direction | Toe-heel direction |
| Frequency H1 (Hz) | — | 3409 | 3407 | 3409 |
| Frequency H2 (Hz) | — | 3631 | 3611 | 3610 |
| Frequency H3 (Hz) | — | 3806 | 3832 | 3856 |
| Frequency H4 (Hz) | — | 3839 | 3948 | 3949 |
| Frequency H5 (Hz) | — | 3952 | 4097 | 4221 |
| Frequency V1 (Hz) | 3072 | — | — | — |
| Frequency V2 (Hz) | 3317 | — | — | — |
| Frequency V3 (Hz) | 3432 | — | — | — |
| Frequency V4 (Hz) | 3641 | — | — | — |
| Frequency V5 (Hz) | 3918 | — | — | — |
| Position of maximum amplitude point Pm1 | — | Crown | Crown | Crown |
| Position of maximum amplitude point Pm2 | — | Crown | Crown | Crown |
| Position of maximum amplitude point Pm3 | — | Sole | Crown | Crown |
| Position of maximum amplitude point Pm4 | — | Sole | Crown | Crown |
| Position of maximum amplitude point Pm5 | — | Sole | Sole | Sole |
| Position of maximum amplitude point Pe1 | Sole | — | — | — |
| Position of maximum amplitude point Pe2 | Sole | — | — | — |
| Position of maximum amplitude point Pe3 | Crown | — | — | — |
| Position of maximum amplitude point Pe4 | Crown | — | — | — |
| Position of maximum amplitude point Pe5 | Crown | — | — | — |
| Position of first antinode in first-order mode | Sole | Crown | Crown | Crown |
| Position of second antinode in first-order mode | Sole | Crown | Crown | Crown |
| Position of first antinode in second-order mode | Sole | Crown | Crown | Crown |
| Position of second antinode in second-order mode | Sole | Crown | Crown | Crown |
| Position of first antinode in third-order mode | Crown | Sole | Crown | Crown |
| Position of second antinode in third-order mode | Grown | Sole | Crown | Crown |
| Number of drawing | FIG. 68 | FIG. 70 | FIG. 71 | FIG. 72 |

TABLE 2

Results (2) of simulation 2

| | Head Ex4 | Head Ex5 | Head Ex6 | Head Ex7 |
|---|---|---|---|---|
| Form of rib | Continuation rib | Continuation rib | Continuation rib | Continuation rib |
| Extending direction of rib | Toe-heel direction | Toe-heel direction | Face-back direction | Face-back direction |
| Frequency H1 (Hz) | 3410 | 3412 | 3200 | 3031 |
| Frequency H2 (Hz) | 3606 | 3598 | 3232 | 3266 |
| Frequency H3 (Hz) | 3876 | 3673 | 3414 | 3415 |
| Frequency H4 (Hz) | 3923 | 3857 | 3622 | 3620 |
| Frequency H5 (Hz) | 4093 | 3915 | 3910 | 3905 |
| Frequency V1 (Hz) | — | — | — | — |
| Frequency V2 (Hz) | — | — | — | — |
| Frequency V3 (Hz) | — | — | — | — |
| Frequency V4 (Hz) | — | — | — | — |
| Frequency V5 (Hz) | — | — | — | — |
| Position of maximum amplitude point Pm1 | Crown | Crown | Sole | Sole |
| Position of maximum amplitude point Pm2 | Crown | Crown | Sole | Sole |
| Position of maximum amplitude point Pm3 | Crown | Crown | Crown | Crown |
| Position of maximum amplitude point Pm4 | Crown | Sole | Crown | Crown |
| Position of maximum amplitude point Pm5 | Sole | Grown | Crown | Crown |
| Position of maximum amplitude point Pe1 | — | — | — | — |
| Position of maximum amplitude point Pe2 | — | — | — | — |
| Position of maximum amplitude point Pe3 | — | — | — | — |
| Position of maximum amplitude point Pe4 | — | — | — | — |
| Position of maximum amplitude point Pe5 | — | — | — | — |
| Position of first antinode in first-order mode | Crown | Crown | Sole | Sole |
| Position of second antinode in first-order mode | Crown | Crown | Sole | Sole |
| Position of first antinode in second-order mode | Crown | Crown | Sole | Sole |
| Position of second antinode in second-order mode | Crown | Crown | Sole | Sole |
| Position of first antinode in third-order mode | Grown | Sole | Crown | Crown |
| Position of second antinode in third-order mode | Crown | Sole | Crown | Crown |
| Number of drawing | FIG. 73 | FIG. 74 | FIG. 77 | FIG. 78 |

TABLE 3

Results (3) of simulation 2

| | Head Ex8 |
|---|---|
| Form of rib | Continuation rib |
| Extending direction of rib | Diagonal direction |
| Frequency H1 (Hz) | 2916 |
| Frequency H2 (Hz) | 3265 |
| Frequency H3 (Hz) | 3414 |
| Frequency H4 (Hz) | 3619 |
| Frequency H5 (Hz) | 3906 |
| Frequency V1 (Hz) | — |
| Frequency V2 (Hz) | — |
| Frequency V3 (Hz) | — |
| Frequency V4 (Hz) | — |
| Frequency V5 (Hz) | — |
| Position of maximum amplitude point Pm1 | Sole |
| Position of maximum amplitude point Pm2 | Sole |

TABLE 3-continued

Results (3) of simulation 2

Figure 79:
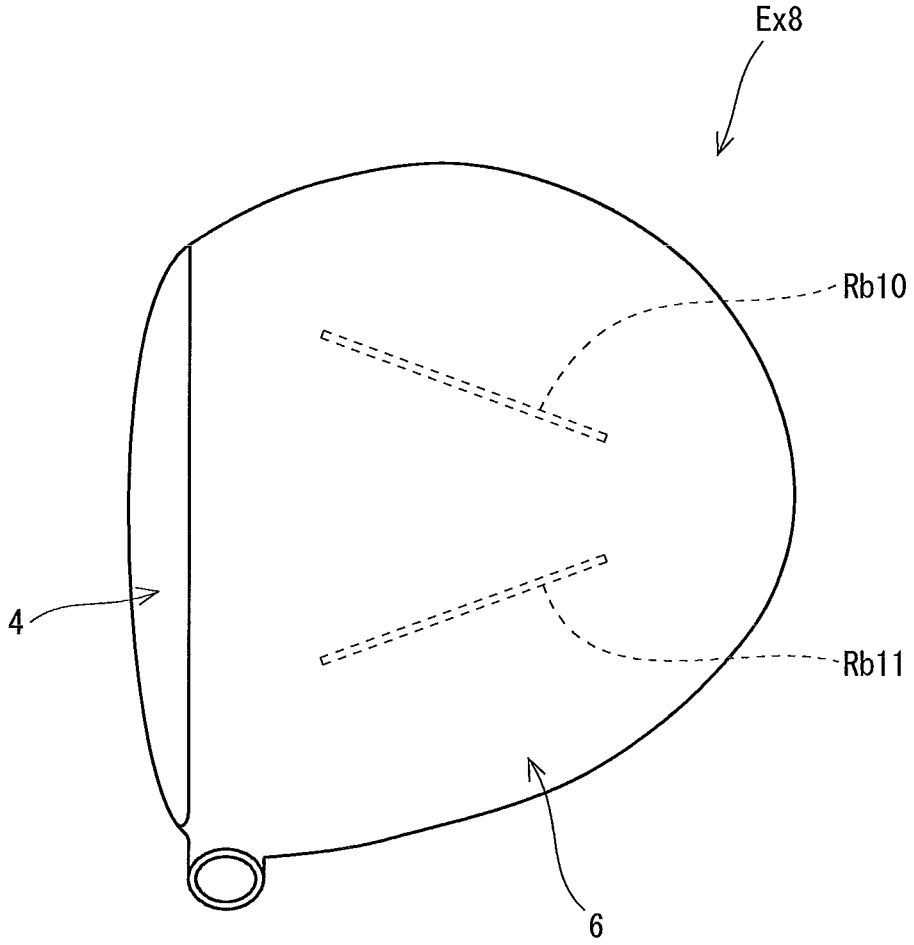
FIG. 79 is a view of the head Ex8, as viewed from a crown side.

| | Head Ex8 |
|---|---|
| Position of maximum amplitude point Pm3 | Crown |
| Position of maximum amplitude point Pm4 | Crown |
| Position of maximum amplitude point Pm5 | Crown |
| Position of maximum amplitude point Pe1 | — |
| Position of maximum amplitude point Pe2 | — |
| Position of maximum amplitude point Pe3 | — |
| Position of maximum amplitude point Pe4 | — |
| Position of maximum amplitude point Pe5 | — |
| Position of first antinode in first-order mode | Sole |
| Position of second antinode in first-order mode | Sole |
| Position of first antinode in second-order mode | Sole |
| Position of second antinode in second-order mode | Sole |
| Position of first antinode in third-order mode | Crown |
| Position of second antinode in third-order mode | Crown |
| Number of drawing | FIG. 79 |

TABLE 4

Results (4) of simulation 2

| | Head Ex21 | Head Ex22 | Head Ex23 | Head Ex24 |
|---|---|---|---|---|
| Form of rib | Intermittence rib patterns 1, 3, 4, and 6 | Continuation rib patterns 1, 2, 3, 4, 5, and 6 | Intermittence rib patterns 2 and 5 | Intermittence rib patterns 1 and 6 |
| Extending direction of rib | Toe-heel direction | Toe-heel direction | Toe-heel direction | Toe-heel direction |
| Frequency H1 (Hz) | 2974 | 3407 | 3046 | 3013 |
| Frequency H2 (Hz) | 3383 | 3603 | 3256 | 3348 |
| Frequency H3 (Hz) | 3434 | 3765 | 3415 | 3426 |
| Frequency H4 (Hz) | 3630 | 3834 | 3624 | 3625 |
| Frequency H5 (Hz) | 3916 | 3932 | 3909 | 3911 |
| Frequency V1 (Hz) | — | — | — | — |

TABLE 4-continued

| Results (4) of simulation 2 | | | | |
|---|---|---|---|---|
| | Head Ex21 | Head Ex22 | Head Ex23 | Head Ex24 |
| Frequency V2 (Hz) | — | — | — | — |
| Frequency V3 (Hz) | — | — | — | — |
| Frequency V4 (Hz) | — | — | — | — |
| Frequency V5 (Hz) | — | — | — | — |
| Position of maximum amplitude point Pm1 | Sole | Crown | Sole | Sole |
| Position of maximum amplitude point Pm2 | Crown | Crown | Sole | Sole |
| Position of maximum amplitude point Pm3 | Crown | Crown | Crown | Crown |
| Position of maximum amplitude point Pm4 | Crown | Sole | Crown | Crown |
| Position of maximum amplitude point Pm5 | Crown | Crown | Crown | Crown |
| Position of maximum amplitude point Pe1 | — | — | — | — |
| Position of maximum amplitude point Pe2 | — | — | — | — |
| Position of maximum amplitude point Pe3 | — | — | — | — |
| Position of maximum amplitude point Pe4 | — | — | — | — |
| Position of maximum amplitude point Pe5 | — | — | — | — |
| Position of first antinode in first-order mode | Sole | Crown | Sole | Sole |
| Position of second antinode in first-order mode | Sole | Crown | Sole | Sole |
| Position of first antinode in second-order mode | Crown | Crown | Sole | Sole |
| Position of second antinode in second-order mode | Sole | Crown | Sole | Crown |
| Position of first antinode in third-order mode | Crown | Crown | Crown | Crown |
| Position of second antinode in third-order mode | Sole | Sole | Crown | Crown |
| Number of drawing | FIG. 80 | FIG. 81 | FIG. 82 | FIG. 83 |

TABLE 5

| Results (5) of simulation 2 | | | | |
|---|---|---|---|---|
| | Head Ex31 | Head Ex32 | Head Ex33 | Head Ex34 |
| Form of rib | Intermittence rib patterns 1, 3, 4, and 6 | Continuation rib patterns 1, 2, 3, 4, 5, and 6 | Intermittence rib patterns 2 and 5 | Intermittence rib patterns 1 and 6 |
| Extending direction of rib | Toe-heel direction | Toe-heel direction | Toe-heel direction | Toe-heel direction |
| Frequency H1 (Hz) | 2976 | 3408 | 3008 | 3004 |
| Frequency H2 (Hz) | 3399 | 3600 | 3254 | 3340 |
| Frequency H3 (Hz) | 3465 | 3758 | 3415 | 3425 |
| Frequency H4 (Hz) | 3634 | 3836 | 3624 | 3624 |
| Frequency H5 (Hz) | 3918 | 3930 | 3909 | 3912 |
| Frequency V1 (Hz) | — | — | — | — |
| Frequency V2 (Hz) | — | — | — | — |
| Frequency V3 (Hz) | — | — | — | — |
| Frequency V4 (Hz) | — | — | — | — |
| Frequency V5 (Hz) | — | — | — | — |
| Position of maximum amplitude point Pm1 | Sole | Crown | Sole | Sole |
| Position of maximum amplitude point Pm2 | Crown | Crown | Sole | Sole |
| Position of maximum amplitude point Pm3 | Sole | Sole | Crown | Crown |
| Position of maximum amplitude point Pm4 | Crown | Crown | Crown | Crown |
| Position of maximum amplitude point Pm5 | Crown | Crown | Crown | Crown |
| Position of maximum amplitude point Pe1 | — | — | — | — |
| Position of maximum amplitude point Pe2 | — | — | — | — |
| Position of maximum amplitude point Pe3 | — | — | — | — |
| Position of maximum amplitude point Pe4 | — | — | — | — |
| Position of maximum amplitude point Pe5 | — | — | — | — |
| Position of first antinode in first-order mode | Sole | Crown | Sole | Sole |
| Position of second antinode in first-order mode | Sole | Crown | Sole | Sole |
| Position of first antinode in second-order mode | Crown | Crown | Sole | Sole |
| Position of second antinode in second-order mode | Crown | Crown | Sole | Crown |
| Position of first antinode in third-order mode | Sole | Sole | Crown | Crown |
| Position of second antinode in third-order mode | Crown | Crown | Crown | Crown |
| Number of drawing | FIG. 84 | FIG. 85 | FIG. 86 | FIG. 87 |

TABLE 6

| Results (6) of simulation 2 | | | | |
|---|---|---|---|---|
| | Head Ex41 | Head Ex42 | Head Ex43 | Head Ex44 |
| Form of rib | Intermittence rib patterns 1, 3, 4, and 6 | Continuation rib patterns 1, 2, 3, 4, 5, and 6 | Intermittence rib patterns 2 and 5 | Intermittence rib patterns 1 and 6 |
| Extending direction of rib | Toe-heel | Toe-heel | Toe-heel | Toe-heel |

TABLE 6-continued

| Results (6) of simulation 2 | | | | |
|---|---|---|---|---|
| | Head Ex41 | Head Ex42 | Head Ex43 | Head Ex44 |
| | direction | direction | direction | direction |
| Frequency H1 (Hz) | 2961 | 3409 | 2992 | 3009 |
| Frequency H2 (Hz) | 3359 | 3600 | 3250 | 3319 |
| Frequency H3 (Hz) | 3424 | 3713 | 3415 | 3423 |
| Frequency H4 (Hz) | 3629 | 3843 | 3624 | 3624 |
| Frequency H5 (Hz) | 3913 | 3920 | 3910 | 3912 |
| Frequency V1 (Hz) | — | — | — | — |
| Frequency V2 (Hz) | — | — | — | — |
| Frequency V3 (Hz) | — | — | — | — |
| Frequency V4 (Hz) | — | — | — | — |
| Frequency V5 (Hz) | — | — | — | — |
| Position of maximum amplitude point Pm1 | Sole | Crown | Sole | Sole |
| Position of maximum amplitude point Pm2 | Sole | Crown | Sole | Sole |
| Position of maximum amplitude point Pm3 | Crown | Sole | Crown | Crown |
| Position of maximum amplitude point Pm4 | Crown | Grown | Crown | Crown |
| Position of maximum amplitude point Pm5 | Crown | Crown | Crown | Crown |
| Position of maximum amplitude point Pe1 | — | — | — | — |
| Position of maximum amplitude point Pe2 | — | — | — | — |
| Position of maximum amplitude point Pe3 | — | — | — | — |
| Position of maximum amplitude point Pe4 | — | — | — | — |
| Position of maximum amplitude point Pe5 | — | — | — | — |
| Position of first antinode in first-order mode | Sole | Crown | Sole | Sole |
| Position of second antinode in first-order mode | Sole | Crown | Sole | Sole |
| Position of first antinode in second-order mode | Sole | Crown | Crown | Sole |
| Position of second antinode in second-order mode | Crown | Crown | Crown | Crown |
| Position of first antinode in third-order mode | Crown | Sole | Crown | Crown |
| Position of second antinode in third-order mode | Sole | Sole | Crown | Crown |
| Number of drawing | FIG. 88 | FIG. 89 | FIG. 90 | FIG. 91 |

[Graphs]

Figure 92:
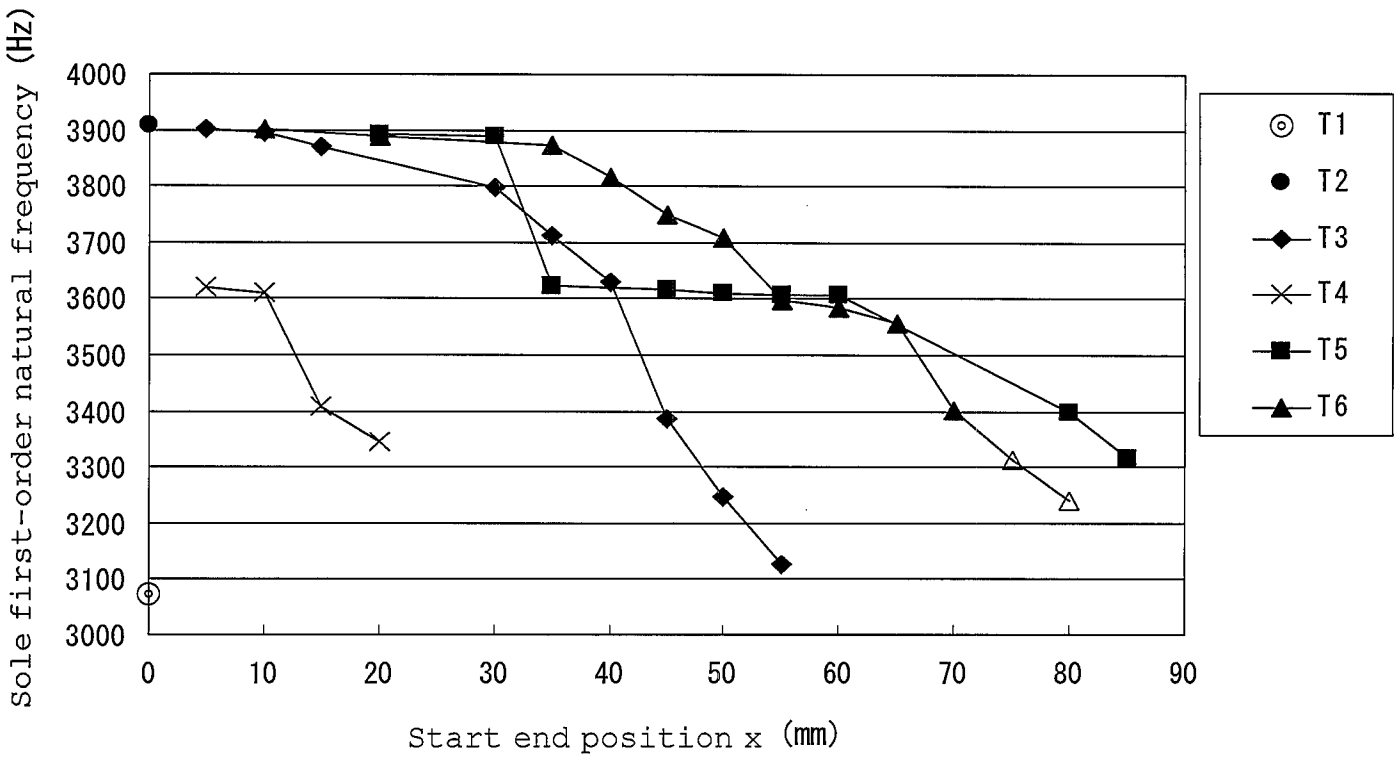
FIG. 92 is graph showing the relationship between disposal of a rib (X) and a first-order natural frequency of a sole.
Figure 93:
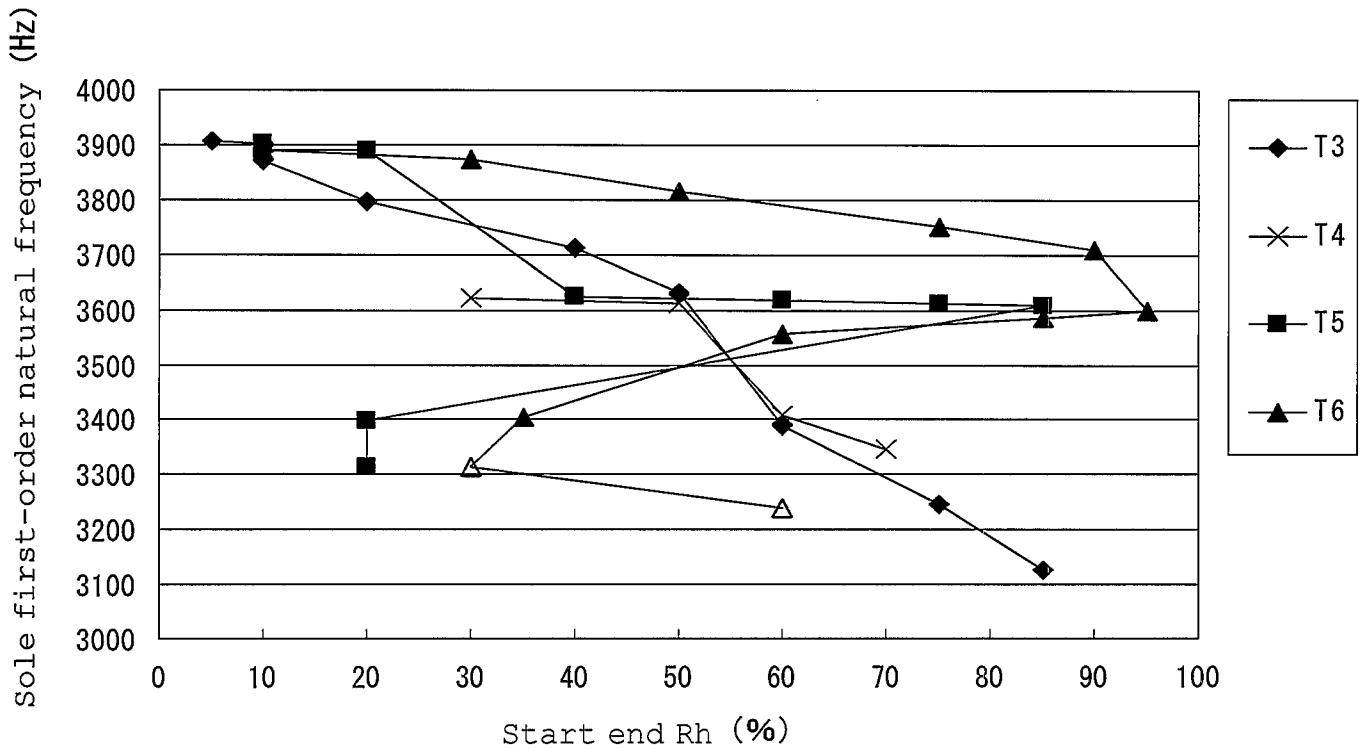
FIG. 93 is graph showing the relationship between disposal of a rib (X) and a first-order natural frequency of a sole.
Figure 94:
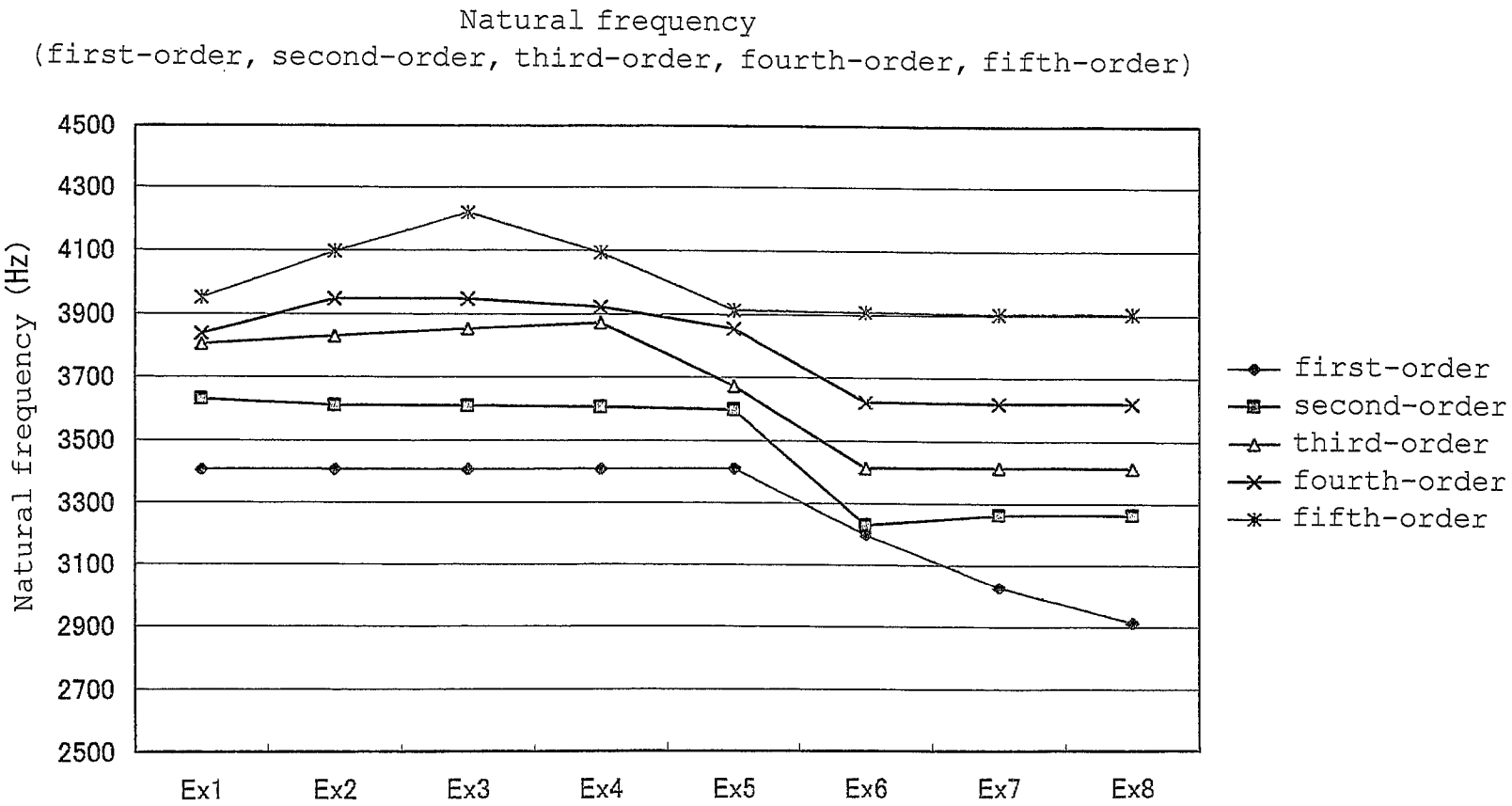
FIG. 94 is graph showing the natural frequencies of a head Ex1, a head Ex2, a head Ex3, a head Ex4, a head Ex5, a head Ex6, a head Ex7, and a head Ex8.

FIGS. 92 and 93 are graphs in which a part of the results of the simulation 1 are plotted. FIG. 94 is a graph in which a part of the results of the simulation 2 are plotted.

Vertical axes of FIGS. 92 and 93 show a sole first-order natural frequency. A sole natural frequency means a natural frequency of the head when the sole substantially vibrates among the natural frequencies of the head. The sole first-order natural frequency means the smallest natural frequency among the sole natural frequencies. A case where the sole substantially vibrates means a case where the maximum amplitude of the sole is equal to or greater than 20% of the maximum amplitude Ma1. In this case, the vibration of the sole can have an influence on the hitting sound. The vibration of the sole tends to generate a low hitting sound. When the sole first-order natural frequency is great, the hitting sound tends to be enhanced.

A horizontal axis (start end position x) of FIG. 92 shows a value of greater one of the distance Vt and the distance Vh. The horizontal axis for the head T4 in the graph of FIG. 92 means the dividing width.

A horizontal axis (start end Rh) of FIG. 93 shows the amplitude ratio Rh at the position of the rib end. When the number of the end parts of the rib is two, that is, when neither the distance Vt nor the distance Vh is 0 mm, the horizontal axis (start end Rh) of FIG. 93 shows a greater amplitude ratio Rh of the amplitude ratios Rh at the positions of the both ends of the rib.

"T4" of FIGS. 92 and 93 is the result of the head T4, that is, a case where the rib is divided halfway. The head T4 is considered to correspond to the head described in the prior document (Japanese Patent Application Laid-Open No. 2003-102877) described above. Since an exact head size was not described in Japanese Patent Application Laid-Open No. 2003-102877, a head similar to the head described in Japanese Patent Application Laid-Open No. 2003-102877 was modeled in an expectable range. In the head T4, the sole first-order natural frequency is small, and the hitting sound is comparatively low.

"T6" of FIGS. 92 and 93 is the result of the head T6. The head T6—75 mm and the head T6—80 mm are shown by white triangles in the result of the head T6. These heads are considered to correspond to the head described in the prior document (U.S. Pat. No. 7,056,228) described above. Since an exact head size was not described in U.S. Pat. No. 7,056,228, a head similar to the head described in U.S. Pat. No. 7,056,228 was modeled in an expectable range. In the head T6—75 and the head T6—80, the sole first-order natural frequency is small, and the hitting sound is comparatively low.

FIG. 94 is a graph showing the natural frequencies of the head Ex1, the head Ex2, the head Ex3, the head Ex4, the head Ex5, the head Ex6, the head Ex7, and the head Ex8. The first-order, second-order, third-order, fourth-order, and fifth-order natural frequencies are shown in FIG. 94. In all of the orders, the natural frequencies of the head Ex1, the head Ex2, the head Ex3, the head Ex4, and the head Ex5 are greater than those of the head Ex6, the head Ex7, and the head Ex8.

When these results are also referred, examples of the preferable embodiment include the following.

In view of obtaining the high hitting sound, the maximum amplitude point Pm1 in the first-order mode is preferably located on the crown. More preferably, the maximum amplitude point Pm1 is located on the crown, and the maximum amplitude point of the second antinode is located on the sole. This is because the mode in which the crown and the sole vibrate is said to have a balance between crown rigidity and sole rigidity better than that in the mode in which only the crown vibrates, to provide the most efficient disposal of the rib (X).

In the head having the state where the rib is removed, both the maximum amplitude point Pe1 in the first-order mode and the maximum amplitude point Pe2 in the second-order natural mode are preferably located on the sole. In this case, the hitting sound tends to be improved by disposing the rib (X) on the inner surface of the sole.

In view of actualizing the effect of the rib (X), in the head having the state where the rib is removed, the following item (a2) is preferable; the following item (b2) is more preferable; the following item (c2) is still more preferable; and the following item (d2) is yet still more preferable.

(a2) The position of the first antinode in the first-order mode is the sole.

(b2) The position of the first antinode in the first-order mode and the position of the second antinode in the first-order mode are the sole.

(c2) The position of the first antinode in the first-order mode, the position of the second antinode in the first-order mode, and the position of the first antinode in the second-order mode are the sole.

(d2) The position of the first antinode in the first-order mode, the position of the second antinode in the first-order mode, the position of the first antinode in the second-order mode and the position of the second antinode in the second-order mode are the sole.

As shown in the Tables and the graphs, the advantages of the present invention are apparent.

The head described above can be applied to all hollow golf club heads.

The description hereinabove is merely for an illustrative example, and various modifications can be made in the scope not to depart from the principles of the present invention.

What is claimed is:

1. A hollow golf club head having a volume equal to or greater than 400 cubic centimeters and comprising: a crown; a sole; and a continuously extending rib (X) having a mean value of a width, BR, equal to or less than 2 millimeters and a weight equal to or less than 5.0 grams, wherein the rib (X) is provided on an inner surface of the head; the rib (X) is substantially parallel to a toe-heel direction; and when a maximum amplitude of vibration in a first-order mode in a state where the rib (X) is removed is defined as Ma1 and an amplitude ratio with respect to the maximum amplitude Ma1 is defined as Rh (%), disposal of the rib (X) satisfies the following items (a), (b), and (c):

(a) the rib (X) crosses at least one of high Rh regions having the amplitude ratio Rh of equal to or greater than 80%;

(b) no region having the amplitude ratio Rh of equal to or greater than 60% exists on a toe side than the rib (X); and (c) no region having the amplitude ratio Rh of equal to or greater than 60% exists on a heel side than the rib (X); and wherein the plurality of high Rh regions exist and the rib (X) crosses all of the high Rh regions.

2. The golf club head according to claim 1, wherein a maximum amplitude point Pe1 in the first-order mode in the state where the rib (X) is removed is located at a position other than the crown.

3. The golf club head according to claim 1, wherein a maximum amplitude point Pm1 in a first-order mode in a state where the rib (X) is disposed is located on the crown.

4. The golf club head according to claim 1, wherein the rib (X) is provided on an inner surface of the sole.

5. The golf club head according to claim 1, further comprising a side, wherein the rib (X) is provided on an inner surface of the sole and an inner surface of the side.

6. The golf club head according to claim 1, wherein a height HR of the rib (X) is 2 mm or greater and 15 mm or less; and a mean value of a width BR of the rib (X) is 0.5 mm or greater.

7. The golf club head according to claim 1, wherein a weight of the head is equal to or less than 200 g; a lateral moment of inertia of the head is equal to or greater than 5000 $g \cdot cm^2$; a thickness of the sole is equal to or less than 1 mm; and a curvature radius of the sole is equal to or greater than 100 mm.

8. The golf club head according to claim 1, wherein a maximum amplitude point Pm1 in the first-order mode is located on the crown; and a maximum amplitude point of a second antinode is located on the sole.

9. The golf club head according to claim 1, wherein when the rib (X) is removed, both a maximum amplitude point Pe1 in the first-order mode and a maximum amplitude point Pe2 in a second-order natural mode are located on the sole.

10. The golf club head according to claim 1, wherein when the rib (X) is removed, a position of a first antinode in the first-order mode is the sole.

11. The golf club head according to claim 1, wherein when the rib (X) is removed, a position of a first antinode in the first-order mode and a position of a second antinode in the first-order mode are the sole.

12. The golf club head according to claim 1, wherein when the rib (X) is removed, a position of a first antinode in the first-order mode, a position of a second antinode in the first-order mode and a position of the first antinode in a second-order mode are the sole.

13. The golf club head according to claim 1, wherein when the rib (X) is removed, a position of a first antinode in the first-order mode, a position of a second antinode in the first-order mode, a position of the first antinode in a second-order mode, and a position of the second antinode in the second-order mode are the sole.

14. The golf club head according to claim 1, wherein a head width Wa is equal to or greater than 100 millimeters.

15. The golf club head according to claim 1, wherein a head length Wc is equal to or greater than 100 millimeters.

16. The golf club head according to claim 1, wherein a ratio Wr/Wc of a length Wr of the rib to the length Wc of the head is equal to or greater than 0.8.

17. The golf club head according to claim 1, wherein a maximum amplitude point Pm2 in the second order mode is located on the crown.

18. A hollow golf club head having a volume equal to or greater than 400 cubic centimeters and comprising: a crown; a sole; and a continuously extending rib (X) having a mean value of a width, BR, equal to or less than 2 millimeters and a weight equal to or less than 5.0 grams, wherein the rib (X) is provided on an inner surface of the head; and, when a maximum amplitude of vibration in a first-order mode in a state where the rib (X) is removed is defined as Ma1 and an amplitude ratio with respect to the maximum amplitude Ma1 is defined as Rh (%), disposal of the rib (X) satisfies the following items (a), (b) and (c):

(a) the rib (X) crosses at least one of high Rh regions having the amplitude ratio Rh of equal to or greater than 80%;

(b) no region having the amplitude ratio Rh of equal to or greater than 60% exists on a toe side than the rib (X); and (c) no region having the amplitude ratio Rh of equal to or greater than 60% exists on a heel side than the rib (X); and wherein the plurality of high Rh regions exist and the rib (X) crosses all of the high Rh regions.

* * * * *